US006948710B2

(12) United States Patent
Togashi et al.

(10) Patent No.: US 6,948,710 B2
(45) Date of Patent: Sep. 27, 2005

(54) METHOD AND APPARATUS FOR SHEET FEEDING AND IMAGE FORMING APPARATUS INCORPORATING THE SAME

(75) Inventors: Toshifumi Togashi, Zama (JP); Osamu Takehira, Yokohama (JP); Manabu Nonaka, Chigasaki (JP)

(73) Assignee: Ricoh Company, Ltd., Tokyo (JP)

( * ) Notice: Subject to any disclaimer, the term of this patent is extended or adjusted under 35 U.S.C. 154(b) by 202 days.

(21) Appl. No.: 10/359,620

(22) Filed: Feb. 7, 2003

(65) Prior Publication Data

US 2003/0155702 A1 Aug. 21, 2003

(30) Foreign Application Priority Data

| | | |
|---|---|---|
| Feb. 8, 2002 | (JP) | 2002-032985 |
| Mar. 1, 2002 | (JP) | 2002-056456 |
| Mar. 28, 2002 | (JP) | 2002-092405 |
| May 2, 2002 | (JP) | 2002-130314 |
| Aug. 6, 2002 | (JP) | 2002-229200 |
| Nov. 8, 2002 | (JP) | 2002-326074 |
| Nov. 20, 2002 | (JP) | 2002-336234 |

(51) Int. Cl.[7] ..... B65H 3/52

(52) U.S. Cl. ..... 271/124; 271/121

(58) Field of Search ..... 271/121, 124

(56) References Cited

U.S. PATENT DOCUMENTS

| | | | | |
|---|---|---|---|---|
| 5,443,251 | A | 8/1995 | Kan et al. | |
| 5,975,518 | A * | 11/1999 | Wakana et al. | 271/121 |
| 6,331,002 | B1 * | 12/2001 | Yoshino et al. | 271/117 |
| 6,540,221 | B2 * | 4/2003 | Nakashima et al. | 271/121 |
| 6,554,272 | B2 * | 4/2003 | Otake et al. | 271/121 |
| 6,565,078 | B1 * | 5/2003 | Foglino et al. | 271/124 |
| 6,575,452 | B2 * | 6/2003 | Hsiao et al. | 271/121 |
| 6,824,131 | B2 * | 11/2004 | Togashi | 271/121 |

FOREIGN PATENT DOCUMENTS

| | | |
|---|---|---|
| EP | 1 179 498 | 2/2002 |
| JP | 8-91612 | 4/1996 |
| JP | 9-278216 | 10/1997 |
| JP | 10-139197 | 5/1998 |
| JP | 2001-217675 | 8/2001 |

OTHER PUBLICATIONS

Patent Abstracts of Japan, JP 2000–128379, May 9, 2000.
Patent Abstracts of Japan, JP 63–315435, Dec. 23, 1988.

* cited by examiner

*Primary Examiner*—Donald P. Walsh
*Assistant Examiner*—Kaitlin Joerger
(74) *Attorney, Agent, or Firm*—Oblon, Spivak, McClelland, Maier & Neustadt, P.C.

(57) ABSTRACT

A method for feeding sheet materials is disclosed, which is implemented by forwarding a plurality of sheet materials loaded on a loading plate with a rotating feeding roller toward a separation unit, for the leading edge of the sheet materials to be collided with a tapered face of taper member, and subsequently separating the uppermost of the loaded sheet materials through frictional force from the feeding roller after climbing over the taper member to be forwarded further to an image forming unit by way of a nip forming portion, while other underlying sheet materials are halted by the taper member owning to smaller frictional forces there between, thereby obviating the multiple feeding. In addition, the conditions suitable for sheet feeding can be satisfied for various sheet materials different in size and thickness by adjusting the distance between the point of contact of the uppermost sheet material with the feeding roller and that of nip formation, such that modulus values are equated to various sheet materials. As a result, considerably high sheet separation qualities are obtained obviating undue non-feeding or multiple feeding, and various kinds of sheet materials different in size, thickness and coefficient of friction, can be forwarded sheet by sheet securely to image forming unit, thereby achieving satisfactory image formation by means of image forming apparatuses incorporating the sheet feeding apparatuses disclosed herein.

38 Claims, 98 Drawing Sheets

METHOD AND APPARATUS FOR SHEET FEEDING AND IMAGE FORMING APPARATUS INCORPORATING THE SAME

BACKGROUND

1. Field

This patent specification relates to a method and apparatus for feeding sheet materials in general and, in particular, to such method adapted to separating and feeding sheet by sheet the uppermost out of sheet materials loaded on a sheet loading member, and an image forming apparatus incorporating such sheet feeding apparatus.

2. Discussion of the Background

As the methods previously disclosed for separating sheet by sheet the uppermost out of sheet materials loaded on a sheet loading member to be forwarded to an image forming unit, several methods are cited such as a corner presser separation method, separation pad method and bank separation method, for example.

Namely, the corner presser separation method is adapted to sheet separation with presser members by pressing both ends of leading edge of sheet material in the feeding direction, the separation pad method by pressing frictional members, and the bank separation method disclosed having a tapered face of fixed gate member to be collided with sheet materials to thereby be separated.

There cited among the methods are the separation pad method and the bank separation method, which offers advantages of relatively small in the number of parts and lower costs, being adapted to feeding various sheet materials different in size and thickness, e.g., post card, sealed letter and OHP sheet (Japanese Laid-Open Patent Applications No. 8-91612 and 10-139197).

In these known sheet separation methods, however, the former separation pad method has to include an additional measure for alleviating undue noises during image formation when applied to conventional less expensive and low speed reproduction machines in the range of 10 PPM or less (i.e., 10 or less copies of image formed per minute).

Since the undue noises are caused by sticking and slip movements of the sheet material passing through a nip portion between the feeding roller and frictional member, the feeding roller has to assume conventionally the half-moon shape to eliminate the noises.

This change in the roller shape places a limitation on the height for hosting the sheet loading plate. As a result, a pair of cylindrical collar members has to be additionally provided on both sides of the feeding roller having a diameter slightly smaller than that of feeding roller, whereby the number of parts is increased together with concomitant increase in manufacturing costs.

With increasing concern for resources and operation costs in recent years, recycled paper sheets have been used more often, in which the leading edges of sheet materials such as post cards and sealed envelopes are worn out and irregular, or having weld flash formed during sheet cutting steps, whereby conveyance load is unduly increased and non feeding situation may arise with relative ease in the separation pad method.

In addition, with the increase in reuse of the rear side of previously copied sheet, there caused are several difficulties such as increased scatter of frictional coefficient values between loaded sheets, to thereby causing multiple feeding and increased curling of the sheet caused by either fixing steps or environmental conditions, which results in undue load applied to leading edge of the sheet and failure in forwarding the sheet to separation unit, i.e., non feeding situation.

Furthermore, since the surface of the pad is brought into pressed contact to the feeding roller in the separation pad method, the angle between the pad and the forwarding direction of the sheet material (which corresponds to the angel of displacement for the loading base plate) has to be limited within a predetermined range.

The diameter of the feeding roller is therefore limited and the freedom of design layout for feeding apparatus is also limited, thereby causing another difficulty in reducing machine size, for example.

In the bank separation method as disclosed in Japanese Laid-Open Patent Application No. 8-91612, by contrast, the upper edge portion of the taper member is made flat and the nip portion with the feeding roller is relatively wide. As a result, the tapered face of the taper member is rather difficult to be provided within a certain range of placement angle.

Also, in the bank separation method for various sheet materials even largely different in size and thickness, it has been found from experiment, as detailed herein below, that satisfactory sheet feeding is feasible by equating modulus values to these sheet materials, which can be achieved by adjusting the distance in sheet forwarding direction between the point of pressed contact for the sheet material to feeding roller and the point of nip formation to be within a certain range (e.g., from 2 to 6 mm), and also adjusting the angle between the longitudinal direction of tapered face in taper member and sheet forwarding direction to be in a predetermined range (e.g., from 50° to 70°).

In order to achieve these conditions, however, the circumference of the feeding roller has to be large enough to be in contact with both of the noted contact points simultaneously, which results in a large diameter for the feeding roller and a concomitant increase in size of the sheet feeding apparatus as a whole, giving rise to another difficulty in reducing the size of feeding apparatus.

In addition, although the rotation of feeding roller is halted when the forwarding of a first sheet in the image forming unit is in progress, the following case has to be considered, in that the first sheet is still nipped between the feeding roller and an opposing gating member, and that the nipped sheet induces the concomitant rotation of the feeding roller through frictional force generated by the contact with a second sheet loaded on the base plate.

As a result, this concomitant rotation of the feeding roller then operates to forward the second sheet to be in contact with the tapered face of the taper member, when the tailing edge of the first sheet leaves the nip portion. If a friction coefficient between the second sheet and a further underlying sheet is smaller than that between the first and second sheets, the second sheet may climb over the tapered face to be forwarded further, thereby resulting the multiple feeding situation.

To obviate such difficulties, the present inventors have disclosed a sheet feeding apparatus capable of considerably reducing the effects of bending modulus coefficient for various kinds of sheet materials, and separating and subsequently forwarding sheet martial securely sheet by sheet without the non-feeding or multiple feeding (Japanese Patent Application No. 2001-217675)

The content of the above noted disclosure, however, is based primarily on previous experiences through various process of trial and error implemented to find optimum results on several factors such as the shape of the taper member, the direction of, and relative magnitude between, the forces in operation onto the system such as feeding pressure, separation pressure and others. Therefore, the theoretical analysis on the sheet feeding process has been earnestly awaited for.

It is therefore an object of the present disclosure to provide a method and apparatus capable of separating sheet materials securely without the non-feeding or multiple feeding through the clarification of conditions for obviating these undue feeding situations.

SUMMARY

Accordingly, there provided in the present disclosure are a method and apparatus for separating and forwarding sheet materials securely sheet by sheet along with presenting the conditions for obviating non-feeding and multiple feeding of the sheet materials, having most, if not all, of the advantages and features of similar employed methods and apparatuses, while eliminating many of their disadvantages.

The following brief description is a synopsis of only selected features and attributes of the present disclosure. A more complete description thereof is found below in the section entitled "Description of the Preferred Embodiments" A method is disclosed for feeding a sheet material for a sheet feeding apparatus, including the step of providing at least several means such as a feeding means for forwarding a sheet material to a separation unit, which is in contact with a sheet material loaded on a sheet loading member; a taper member provided thereon with a tapered face, which is brought into pressed contact with the feeding means at a nip forming portion, the tapered face colliding with a leading edge of the sheet material; and a contact face of a protruded portion on the taper member, which is aligned parallel to a tangent of sheet feeding direction to be brought into contact with the feeding means.

This method is characterized by further steps of forwarding the sheet material to the separation unit and separating the sheet material by means of the tapered face of taper member under following conditions adapted to the sheet material feeding;

$$P>R_f A/(\mu_1-\mu_{P12})$$

$$P<R_f A/\Delta\mu_P$$

$$A=\sin\theta_{P2}+\mu_2\cdot\cos\theta_{P2},$$

where

P: feeding pressure, $R_f$: a vertical drag caused by sheet material bending exerted onto leading edge of the sheet material through the taper face of taper member, $\mu_1$: coefficient of friction between the feeding means and the sheet material, $\mu_2$: coefficient of friction between the tapered face of taper member and the leading edge of the sheet material, $\mu_{P12}$: coefficient of friction between first and second sheet materials, $\Delta\mu_P$: a difference in coefficients of friction between the sheet materials, and $\theta_{P2}$: an angle between a tangent to the nip forming portion and the sheet forwarding direction.

A further method for feeding a sheet material is disclosed including similar steps described as above. This method is characterized by further steps of forwarding the sheet material to the separation unit and separating the sheet material by means of the nip forming portion under following conditions adapted to the sheet material feeding;

$$P>\{(A/B)-\mu_1\}Q/(\mu_1-\mu_{P12})+\mu_1\cdot R_f\cdot B/(\mu_1-\mu_{P12})P<\{(A/B)-\mu_{P12}\}Q/\Delta\mu_P+\mu_{P12}\cdot R_f\cdot B/\Delta\mu_P$$

$$A=\sin\theta_{P2}+\mu_2\cdot\cos\theta_{P2}$$

$$B=\cos\theta_{P2}-\mu_2\cdot\sin\theta_{P2},$$

where

P: feeding pressure,

Q: separation pressure, $R_f$: a vertical drag caused by sheet material bending exerted onto leading edge of the sheet material through the taper face of taper member, $\mu_1$: coefficient of friction between the feeding means and the sheet material, $\mu_2$: coefficient of friction between the tapered face of taper member and the leading edge of the sheet material, $\mu_{P12}$: coefficient of friction between first and second sheet materials, $\Delta\mu_P$: a difference in coefficients of friction between the sheet materials, and $\theta_{P2}$: an angle between a tangent to the nip forming portion and the sheet forwarding direction.

A still further method is disclosed including similar steps described as above. The present method is characterized by further steps of forwarding the sheet material to the separation unit and separating the sheet material by means of the tapered face of taper member and the nip forming portion under following conditions adapted to the sheet material feeding;

$$P>R_f A/(\mu_1-\mu_{P12})$$

$$P<R_f A/\Delta\mu_P$$

$$P>\{(A/B)-\mu_1\}Q/(\mu_1-\mu_{P12})+\mu_1\cdot R_f\cdot B/(\mu_1-\mu_{P12})P<\{(A/B)-\mu_{P12}\}Q/\Delta\mu_P+\mu_{P12}\cdot R_f\cdot B/\Delta\mu_P$$

$$A=\sin\theta_{P2}+\mu_2\cdot\cos\theta_{P2}$$

$$B=\cos\theta_{P2}-\mu_2\cdot\sin\theta_{P2},$$

where

P: feeding pressure,

Q: separation pressure, $R_f$: a vertical drag caused by sheet material bending exerted onto leading edge of the sheet material through the taper face of taper member, $\mu_1$: coefficient of friction between the feeding means and the sheet material, $\mu_2$: coefficient of friction between the tapered face of taper member and the leading edge of the sheet material, $\mu_{P12}$: coefficient of friction between first and second sheet materials, $\Delta\mu_P$: a difference in coefficients of friction between the sheet materials, and $\theta_{P2}$: an angle between a tangent to the nip forming portion and the sheet forwarding direction.

It is preferable in these methods for the angle, between the longitudinal direction of the tapered face of taper member and a leading edge of the sheet material colliding with the tapered face, to be adjusted in the range from 50° to 70°.

According to another aspect, a sheet feeding apparatus is disclosed including at least a feeding means provided for forwarding a sheet material to a separation unit, which is in contact with a sheet material loaded on a sheet loading member; and a taper member provided thereon with a tapered face, which is brought into pressed contact with the feeding means at a nip forming portion, and the tapered face colliding with a leading edge of the sheet material. In addition, the taper member is provided thereon with a contact face of a protruded portion, and the contact face is aligned parallel to the tangent of sheet feeding direction to be brought into contact with the feeding means.

This sheet feeding apparatus is characterized by forwarding the sheet material to the separation unit, and subsequently separating by means of the tapered face of taper member under following conditions adapted to the sheet material feeding;

$$P>R_f A/(\mu_1-\mu_{P12})$$

$$P<R_f A/\Delta\mu_P$$

$$A=\sin\theta_{P2}+\mu_2\cdot\cos\theta_{P2},$$

where

P: feeding pressure, $R_f$: a vertical drag caused by sheet material bending exerted onto leading edge of the sheet material through the taper face of taper member, $\mu_1$: coefficient of friction between the feeding means and the sheet material, $\mu_2$: coefficient of friction between the tapered face of taper member and the leading edge of the sheet material, $\mu_{P12}$: coefficient of friction between first and second sheet materials, $\Delta\mu_P$: a difference in coefficients of friction between the sheet materials, and $\theta_{P2}$: an angle between a tangent to the nip forming portion and the sheet forwarding direction.

A further sheet feeding apparatus is provided in a similar manner as described above. This sheet feeding apparatus is further characterized by forwarding the sheet material to the separation unit, and subsequently separating by means of the nip forming portion under following conditions adapted to the sheet material feeding;

$$P>\{(A/B)-\mu_1\}Q/(\mu_1-\mu_{P12})+\mu_1\cdot R_f\cdot B/(\mu_1-\mu_{P12})P<\{(A/B)-\mu_{P12}\}Q/\Delta\mu_P+\mu_{P12}\cdot R_f\cdot B/\Delta\mu_P$$

$$A=\sin\theta_{P2}+\mu_2\cdot\cos\theta_{P2}$$

$$B=\cos\theta_{P2}-\mu_2\cdot\sin\theta_{P2},$$

where

P: feeding pressure,

Q: separation pressure, $R_f$: a vertical drag caused by sheet material bending exerted onto leading edge of the sheet material through the taper face of taper member, $\mu_1$: coefficient of friction between the feeding means and the sheet material, $\mu_2$: coefficient of friction between the tapered face of taper member and the leading edge of the sheet material, $\mu_{P12}$: coefficient of friction between first and second sheet materials, $\Delta\mu_P$: a difference in coefficients of friction between the sheet materials, and $\theta_{P2}$: an angle between a tangent to the nip forming portion and the sheet forwarding direction.

A still further sheet feeding apparatus is provided in a similar manner described above. The present sheet feeding apparatus is characterized by forwarding the sheet material is forwarded to the separation unit, and subsequently separating by means of the tapered face of taper member and the nip forming portion under following conditions adapted to the sheet material feeding;

$$P>R_f A/(\mu_1-\mu_{P12})$$

$$P<R_f A/\Delta\mu_P$$

$$P>\{(A/B)-\mu_1\}Q/(\mu_1-\mu_{P12})+\mu_1\cdot R_f\cdot B/(\mu_1-\mu_{P12})P<\{(A/B)-\mu_{P12}\}Q/\Delta\mu_P+\mu_{P12}\cdot R_f\cdot B/\Delta\mu_P$$

$$A=\sin\theta_{P2}+\mu_2\cdot\cos\theta_{P2}$$

$$B=\cos\theta_{P2}-\mu_2\cdot\sin\theta_{P2},$$

where

P: feeding pressure,

Q: separation pressure, $R_f$: a vertical drag caused by sheet material bending exerted onto leading edge of the sheet material through the taper face of taper member, $\mu_1$: coefficient of friction between the feeding means and the sheet material, $\mu_2$: coefficient of friction between the tapered face of taper member and the leading edge of the sheet material, $\mu_{P12}$: coefficient of friction between first and second sheet materials, $\Delta\mu_P$: a difference in coefficients of friction between the sheet materials, and $\theta_{P2}$: an angle between a tangent to the nip forming portion and the sheet forwarding direction.

It is preferable in these sheet feeding apparatuses for the angle to be adjusted in the range from 50° to 70° between the longitudinal direction of the tapered face of taper member and a leading edge of the sheet material colliding with the tapered face.

An image forming apparatus is also disclosed in the present disclosure, which is formed suitably incorporating anyone of the sheet feeding apparatuses described above.

It may be added that a feeding roller, feeding belt and other similar devices can suitably be utilized as the feeding means.

According to another aspect, a method is disclosed for feeding a sheet material for a sheet feeding apparatus, including the step of providing at least several means such as a feeding means for forwarding a sheet material to a separation unit, which is in contact with a sheet material loaded on a sheet loading member; a separation member in the separation unit; a taper member to be brought into pressed contact with the feeding means at a nip forming portion, the taper member being provided thereon with a tapered face colliding with a leading edge of the sheet material; and a protrusion between the taper member and the feeding means, the protrusion being brought into contact with the sheet material forwarded by the feeding means.

This method is characterized by further steps of forwarding the sheet material to the separation unit and separating the sheet material by means of the tapered face of taper member under following conditions adapted to the sheet material feeding;

$$P>R_f A/(\mu_1-\mu_{P12})+\mu_3 P'/(\mu_1-\mu_{P12})$$

$$P<R_f A/\Delta\mu_P+\mu_3 P'/(\mu_1-\mu_{P12})$$

$$A=\sin\theta_{P2}+\mu_2\cdot\cos\theta_{P2},$$

where

P: feeding pressure,

P': feeding pressure at the protrusion $R_f$: a vertical drag caused by sheet material bending exerted onto leading edge of the sheet material through the taper face of taper member, $\mu_1$: coefficient of friction between the feeding means and the sheet material, $\mu_2$: coefficient of friction between the tapered face of taper member and the leading edge of the sheet material, $\mu_3$: coefficient of friction between the protrusion and the sheet material $\mu_{P12}$: coefficient of friction between first and second sheet materials, $\Delta\mu_P$: a difference in coefficients of friction between the sheet materials, and $\theta_{P2}$: an angle between a tangent to the nip forming portion and the tapered face of taper member.

A further method for feeding a sheet material is disclosed including similar steps described as above. This method is characterized by further steps of forwarding the sheet material to the separation unit and subsequently separating the sheet material by means of the nip forming portion under following conditions adapted to the sheet material feeding, $$P<\{(A/B)-\mu_1\}Q/(\mu_1-\mu_{P12})+\mu_1\cdot R_f\cdot B/(\mu_1-\mu_{P12})+\mu_3 P'/(\mu_1-\mu_{P12})P<\{(A/B)-\mu_{P12}\}Q/\Delta\mu_P+\mu_{P12}\cdot R_f\cdot B/\Delta\mu_P+\mu_3 P'/(\mu_1-\mu_{P12})$$

$$A=\sin\theta_{P2}+\mu_2\cdot\cos\theta_{P2}$$

$$B=\cos\theta_{P2}-\mu_2\cdot\sin\theta_{P2},$$

where

P: feeding pressure,

P': feeding pressure at the protrusion

Q: separation pressure $R_f$: a vertical drag caused by sheet material bending exerted onto leading edge of the sheet material through the taper face of taper member, $\mu_1$: coefficient of friction between the feeding means and the sheet material, $\mu_2$: coefficient of friction between the tapered face of taper member and the leading edge of the sheet material, $\mu_3$: coefficient of friction between the protrusion and the sheet material $\mu_{P12}$: coefficient of friction between first and second sheet materials, $\Delta\mu_P$: a difference in coefficients of friction between the sheet materials, and $\theta_{P2}$: an angle between a tangent to the nip forming portion and the tapered face of taper member.

A still further method is disclosed including similar steps described as above. The present method is characterized by further steps of forwarding the sheet material to the separation unit and subsequently separating the sheet material by means of by means of the tapered face of taper member and the nip forming portion under following conditions adapted to the sheet material feeding, $$P>R_f A/(\mu_1-\mu_{P12})+\mu_3 P'/(\mu_1-\mu_{P12})$$

$$P<R_f A/\Delta\mu_P+\mu_3 P'/(\mu_1-\mu_{P12})$$

$$P>\{(A/B)-\mu_1\}Q/(\mu_1-\mu_{P12})+\mu_1\cdot R_f\cdot B/(\mu_1-\mu_{P12})+\mu_3 P'/(\mu_1-\mu_{P12})P<\{(A/B)-\mu_{P12}\}Q/\Delta\mu_P+\mu_{P12}\cdot R_f\cdot B/\Delta\mu_P+\mu_3 P'/(\mu_1-\mu_{P12})$$

$$A=\sin\theta_{P2}+\mu_2\cdot\cos\theta_{P2}$$

$$B=\cos\theta_{P2}-\mu_2\cdot\sin\theta_{P2},$$

where

P: feeding pressure,

P': feeding pressure at the protrusion

Q: separation pressure $R_f$: a vertical drag caused by sheet material bending exerted onto leading edge of the sheet material through the taper face of taper member, $\mu_1$: coefficient of friction between the feeding means and the sheet material, $\mu_2$: coefficient of friction between the tapered face of taper member and the leading edge of the sheet material, $\mu_3$: coefficient of friction between the protrusion and the sheet material $\mu_{P12}$: coefficient of friction between first and second sheet materials, $\Delta\mu_P$: a difference in coefficients of friction between the sheet materials, and $\theta_{P2}$: an angle between a tangent to the nip forming portion and the tapered face of taper member.

It is preferable in these methods for the angle to be adjusted in the range from 50° to 70° between the longitudinal direction of the tapered face of taper member and a leading edge of the sheet material colliding with the tapered face.

According to another aspect, a sheet feeding apparatus is disclosed including at least a feeding means provided for forwarding a sheet material to a separation unit, which-is in contact with a sheet material loaded on a sheet loading member; a separation member provided in the separation unit; a taper member provided to be brought into pressed contact with the feeding means at a nip forming portion, which is provided thereon with a tapered face colliding with a leading edge of the sheet material; and a protrusion provided between the taper member and the feeding means, which is brought into contact with the sheet material forwarded by the feeding means.

This sheet feeding apparatus is further characterized by forwarding the sheet material to the separation unit, and subsequently separating by means of the tapered face of taper member under following conditions adapted to the sheet material feeding;

$$P>R_f A/(\mu_1-\mu_{P12})+\mu_3 P'/(\mu_1-\mu_{P12})$$

$$P<R_f A/\Delta\mu_P+\mu_3 P'/(\mu_1-\mu_{P12})$$

$$A=\sin\theta_{P2}+\mu_2\cdot\cos\theta_{P2},$$

where

P: feeding pressure,

P': feeding pressure at the protrusion $R_f$: a vertical drag caused by sheet material bending exerted onto leading edge of the sheet material through the taper face of taper member, $\mu_1$: coefficient of friction between the feeding means and the sheet material, $\mu_2$: coefficient of friction between the tapered face of taper member and the leading edge of the sheet material, $\mu_3$: coefficient of friction between the protrusion and the sheet material $\mu_{P12}$: coefficient of friction between first and second sheet materials, $\Delta\mu_P$: a difference in coefficients of friction between the sheet materials, and $\theta_{P2}$: an angle between a tangent to the nip forming portion and the tapered face of taper member.

A further sheet feeding apparatus is provided in a similar manner as described above. This sheet feeding apparatus is characterized by forwarding the sheet material to the separation unit, and subsequently separating by means of the nip forming portion under following conditions adapted to the sheet material feeding;

$$P>\{(A/B)-\mu_1\}Q/(\mu_1-\mu_{P12})+\mu_1\cdot R_f\cdot B/(\mu_1-\mu_{P12})+\mu_3 P'/(\mu_1-\mu_{P12})P<\{(A/B)-\mu_{P12}\}Q/\Delta\mu_P+\mu_{P12}\cdot R_f\cdot B/\Delta\mu_P+\mu_3 P'/(\mu_1-\mu_{P12})$$

$$A=\sin\theta_{P2}+\mu_2\cdot\cos\theta_{P2}$$

$$B=\cos\theta_{P2}-\mu_2\cdot\sin\theta_{P2},$$

where

P: feeding pressure,

P': feeding pressure at the protrusion

Q: separation pressure $R_f$: a vertical drag caused by sheet material bending exerted onto leading edge of the sheet material through the taper face of taper member, $\mu_1$: coefficient of friction between the feeding means and the sheet material, $\mu_2$: coefficient of friction between the tapered face of taper member and the leading edge of the sheet material, $\mu_3$: coefficient of friction between the protrusion and the sheet material $\mu_{P12}$: coefficient of friction between first and second sheet materials, $\Delta\mu_P$: a difference in coefficients of friction between the sheet materials, and $\theta_{P2}$: an angle between a tangent to the nip forming portion and the tapered face of taper member.

A still further sheet feeding apparatus is provided in a similar manner described above. The present sheet feeding apparatus is characterized by forwarding the sheet material is forwarded to the separation unit, and subsequently separating by means of the tapered face of taper member and the nip forming portion under following conditions adapted to the sheet material feeding;

$$P>R_f A/(\mu_1-\mu_{P12})+\mu_3 P'/(\mu_1-\mu_{P12})$$

$$P<R_f A/\Delta\mu_P+\mu_3 P'/(\mu_1-\mu_{P12})$$

$$P>\{(A/B)-\mu_1\}Q/(\mu_1-\mu_{P12})+\mu_1\cdot R_f\cdot B/(\mu_1-\mu_{P12})+\mu_3 P'/(\mu_1-\mu_{P12})P<\{(A/B)-\mu_{P12}\}Q/\Delta\mu_P+\mu_{P12}\cdot R_f\cdot B/\Delta\mu_P+\mu_3 P'/(\mu_1-\mu_{P12})$$

$$A=\sin\theta_{P2}+\mu_2\cdot\cos\theta_{P2}$$

$$B=\cos\theta_{P2}-\mu_2\cdot\sin\theta_{P2},$$

where

P: feeding pressure,

P': feeding pressure at the protrusion

Q: separation pressure $R_f$: a vertical drag caused by sheet material bending exerted onto leading edge of the sheet material through the taper face of taper member, $\mu_1$: coefficient of friction between the feeding means and the sheet material, $\mu_2$: coefficient of friction between the tapered face of taper member and the leading edge of the sheet material, $\mu_3$: coefficient of friction between the protrusion and the sheet material $\mu_{P12}$: coefficient of friction between first and second sheet materials, $\Delta\mu_P$: a difference in coefficients of friction between the sheet materials, and $\theta_{P2}$: an angle between a tangent to the nip forming portion and the tapered face of taper member.

It is preferable in these sheet feeding apparatuses for the angle to be adjusted in the range from 50° to 70° between the longitudinal direction of the tapered face of taper member and a leading edge of the sheet material colliding with the tapered face.

Another image forming apparatus is also disclosed in the present disclosure, suitably incorporating anyone of the sheet feeding apparatuses described above.

It may be noted the sheet materials described herein are not only limited to thin sheets of paper such as, for example, conventional copy sheets, but also include various sheet materials different in size and thickness, such as post cards, sealed letters and OHP (overhead projector) sheets, as will be detailed later on.

The present disclosure and features and advantages thereof will be more readily apparent from the following detailed description and appended claims when taken with drawings.

BRIEF DESCRIPTION OF THE DRAWINGS

FIG. 24 is a cross sectional view illustrating the feeder main according to the sixth embodiment disclosed herein, in which the multiple feeding can be prevented, caused by the second sheet still retained at the waiting location to thereby forward later on;

DESCRIPTION OF THE PREFERRED EMBODIMENTS

In the detailed description which follows, specific embodiments on paper sheet feeding method and apparatus primarily related to an image forming apparatus are described. It is understood, however, that the present disclosure is not limited to these embodiments, and it is appreciated that the method and apparatus for feeding paper sheets disclosed herein may also be adaptable to any form of sheet feeding. Other embodiments will be apparent to those skilled in the art upon reading the following description.

There described herein below are an apparatus and a method for sheet feeding according to one embodiment disclosed herein referring to several drawings.

Figure 1:
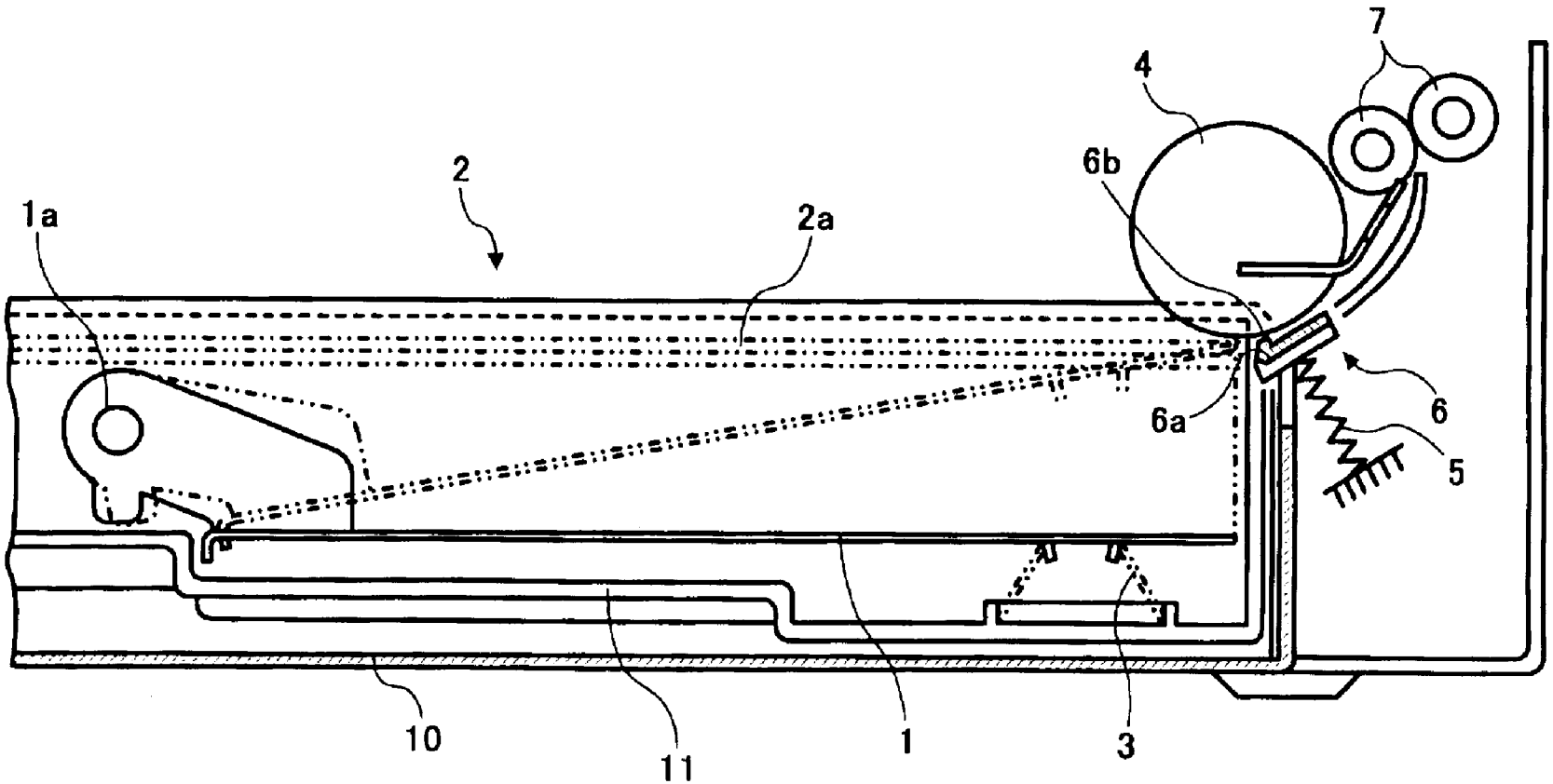
FIG. 1 is a longitudinal section drawing illustrating the sheet feeding apparatus according to one embodiment disclosed herein.
Figure 2:
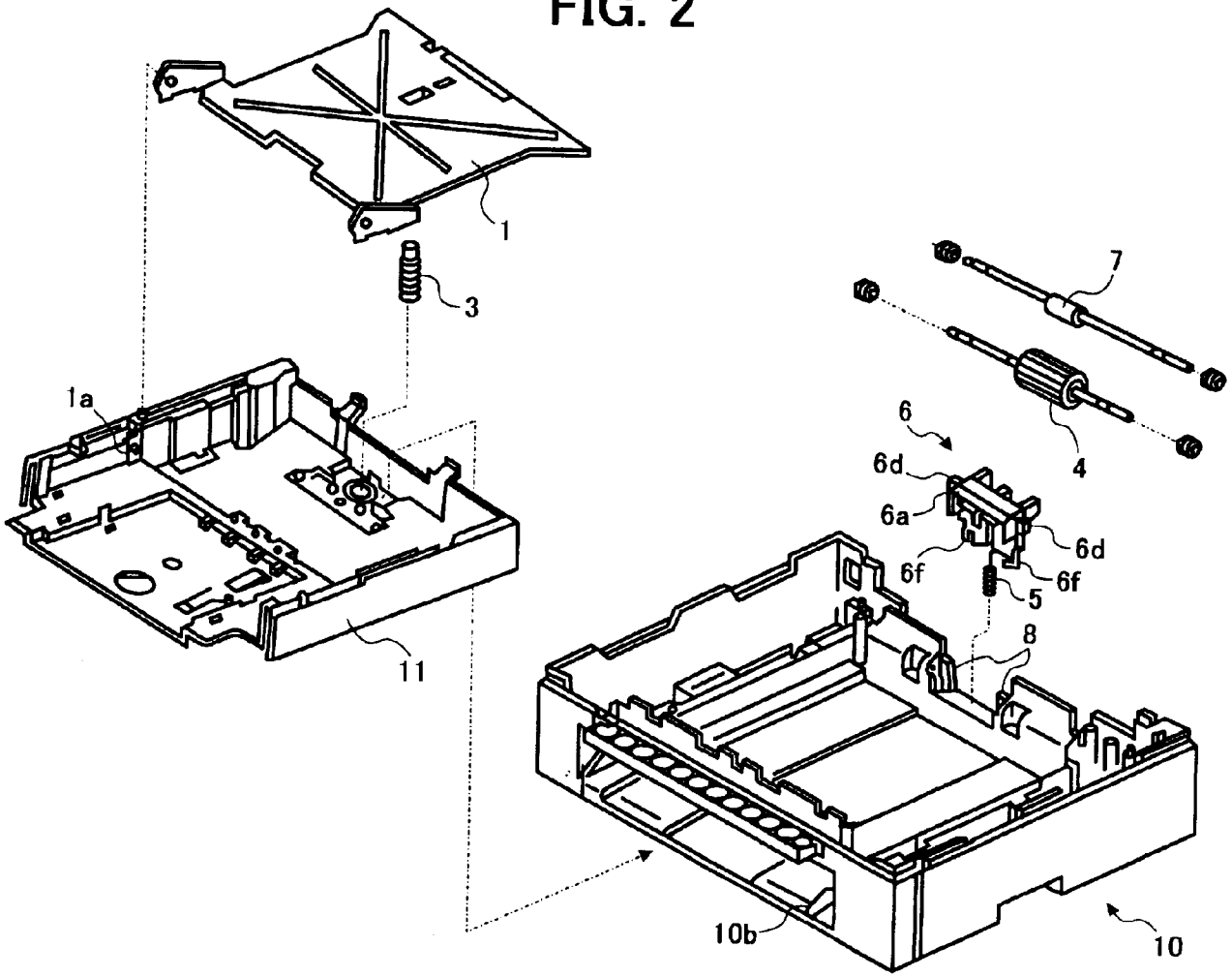
FIG. 2 is partial compositional views illustrating the structure of the sheet feeding apparatus of FIG. 1.
Figure 3:
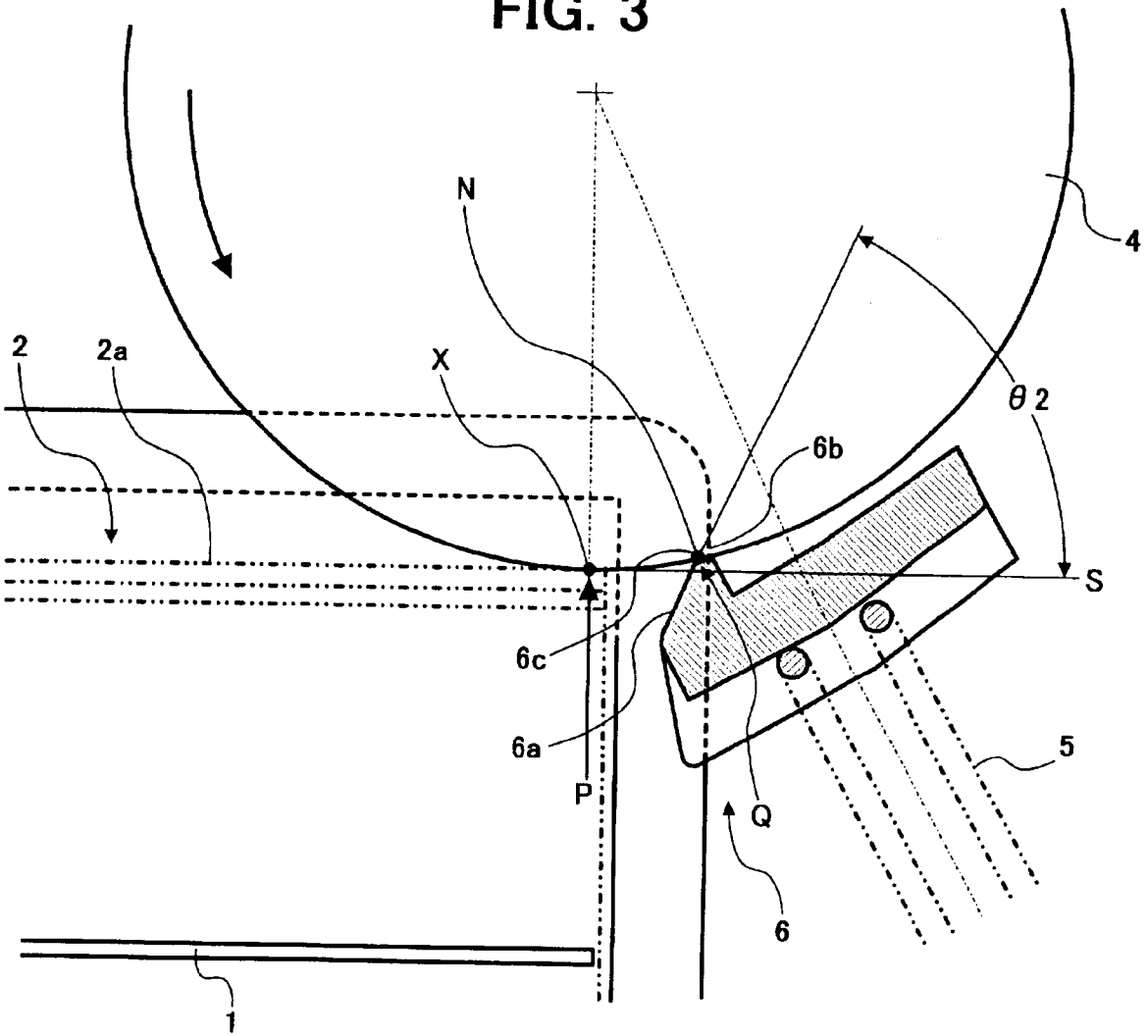
FIG. 3 is an expanded view illustrating the feeding portion incorporated into the apparatus according to the embodiment.

FIG. 1 is a longitudinal section drawing illustrating the sheet feeding apparatus, FIG. 2 is a compositional perspective drawing illustrating the overall structure thereof, and FIG. 3 is an expanded view illustrating the feeding part incorporated into the apparatus according to the present embodiment.

Referring now to FIGS. 1 and 2, the overall structure of the sheet feeding apparatus will be described herein below.

Being surrounded by relatively low walls on four sides, a feeder main 10 as the main part of the sheet feeding apparatus is herein provided having the shape of a shallow container box. This feeder main 10 is further provided with a cassette 11 which is detachably equipped through an opening 10*b* formed on one of the side walls of the part 10.

As shown in FIG. 1, there provided inside the cassette 11 is a base plate 1 as a sheet loading member capable of loading a plurality of sheets of paper, or sheet materials 2, one edge portion of which is pivotably supported by a supporting axis 1*a*, and the other edge of which is free to be continually pressed upward with a pressing force exerted by a coiled spring 3 attached to the cassette 11.

A feeding roller 4 is further provided as feeding means in the feeder main 10 so as to be in contact with the leading edge of an uppermost sheet material 2*a* among the plurality of sheet materials 2 loaded on the base plate 1. The base plate 1, in turn, exerts the aforementioned pressing force by the coiled spring 3 in the clockwise direction as viewed in FIG. 1, thereby enabling this contact of the contact of the feeding roller 4 with the uppermost sheet material 2*a*.

In addition, a taper member 6 is further provided having a tapered face 6*a* and a contact face 6*b*, in which the latter face 6*b* is brought into contact with the feeding roller 4 by the pressing force by coiled spring 3, whereby a separation component is formed.

Figure 18:
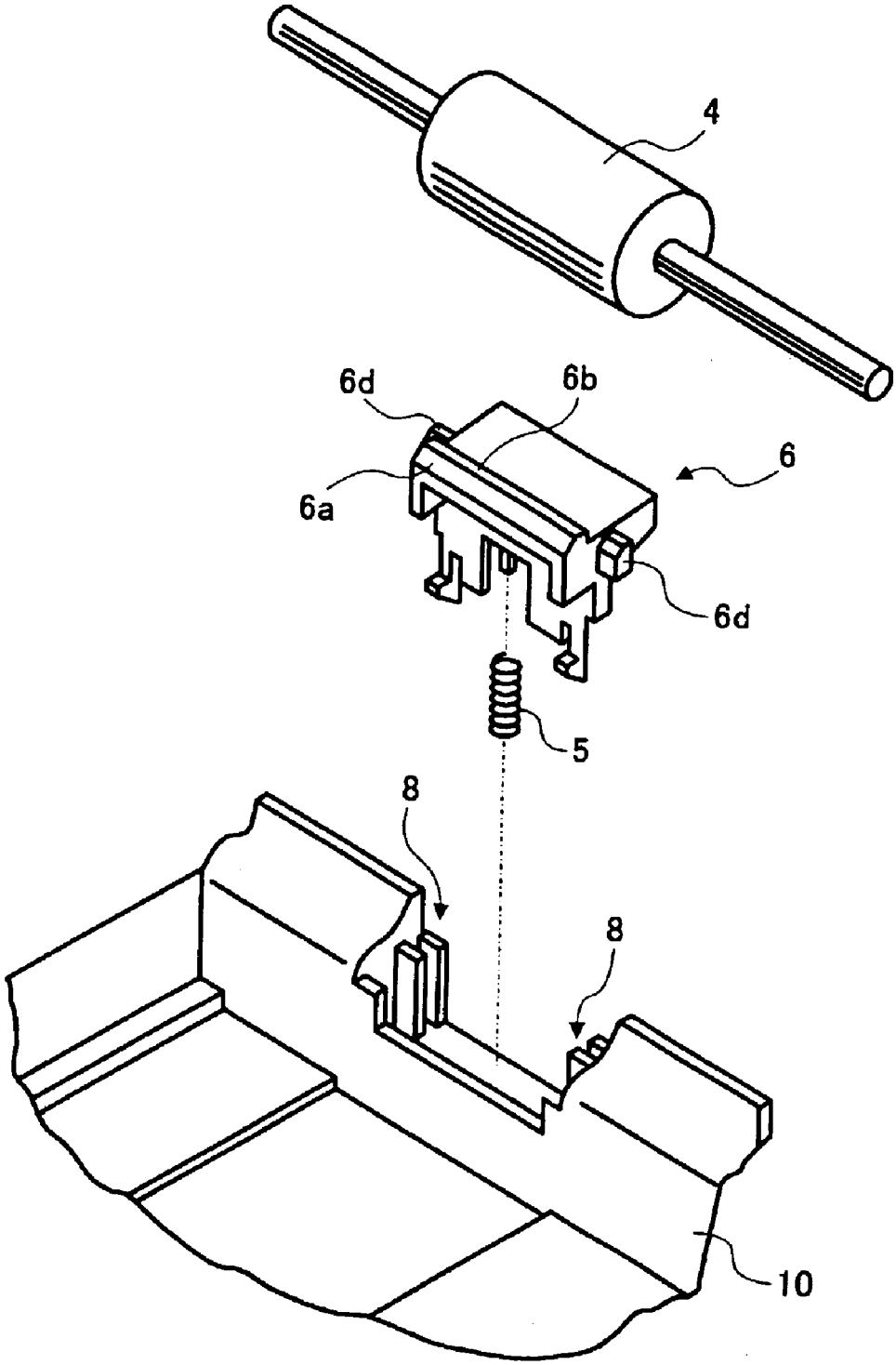
FIG. 18 is a compositional perspective view illustrating the structure of feeder main according to the second embodiment disclosed herein.

As shown in FIGS. 2 and 18 in a perspective and an enlarged manner, respectively, the taper member 6 is herein formed including several portions such as ribs 6*d*, 6*d* and a pair of hooks 6*f*, 6*f*. The ribs 6*d*, 6*d* are each formed at bilaterally left and right ends thereof in protruded manner, and mounted slidably in the direction for pressing to, and contacting with the feeding roller 4 in parallel one another under the guide by guide rails 8, 8 affixed to the feeder main 10.

The hooks 6*f*, 6*f* are situated the lower part of the taper member 6, and adapted to prevent undue lowering thereof. In addition, the extent of upward movements thereof is limited by the combination of these portions and a linkage unit (not shown) affixed to the feeder main 10.

A feeding roller pair 7 is further provided being rotatably axially supported downstream from the taper member 6, for conveying sheet materials 2 brought forward by the feeding roller 4 to an image forming unit of the image forming apparatus (not shown). It may be herein noted only one of the roller pair 7 is illustrated in FIG. 2.

Furthermore, the ribs and guide rails as the means for parallel movements may alternatively be formed on the side of the feeder main 10 and the taper member 6, respectively, in place of the aforementioned structure with the ribs and guide rails formed on the side of the feeder main 10 and the taper member 6, respectively.

Referring now to FIG. 3, the relationship of the sheet materials 2 loaded on the base plate 1 with feeding roller 4 and taper member 6 will be detailed herein below.

In the feeder main 10 disclosed herein, the tapered face 6*a* of taper member 6 is mounted to make a predetermined angle $\theta_2$ between the direction, S, for forwarding the uppermost sheet material 2*a* among the plural sheet materials 2 loaded on the base plate 1.

Being connected to the tapered face 6*a* and situated in proximity to the feeding roller 4, the contact face 6*b* is formed as a protruded portion with its longitudinal side aligned in the axial direction of the feeding roller 4, having a relatively narrow width. This protruded portion may be formed as either a single linear body or a series of similar continual bodies.

The thus constructed feeding roller 4 is prepared for rotation so as the distance for forwarding the sheet material to be small as much as possible between the point X of pressed contact for the uppermost sheet material 2*a* on the base plate 1 with feeding roller 4 and the location N of nip formation, i.e., the point of contact for the feeding roller 4 with the tailing edge 6*c* of tapered face 6*a* which is defined as an intersection between contact face 6*b* and the tapered face 6*a* in taper member 6.

The rotation of the thus prepared feeding roller 4 is initiated by an instruction signal from a control unit (not shown) and continues until the forwarding the uppermost sheet material 2*a* be completed.

The reduction in the distance between both points of pressed contact, X and N, facilitates to narrowing the difference in flexural modulus for various kinds of sheet materials since the extent of sheet bending is decreased by the reduction of the above noted distance.

As a result, since the scatter of the components of force generated on the tapered face 6*a* of taper member 6 is also decreased, the separation of sheet materials becomes feasible for those having relatively large modulus values such as a thick paper sheet, post card and sealed letter, as well as thin paper sheets with small modulus values, to thereby be able to handle a variety of sheet materials.

Referring particularly to FIGS. 4 through 7 in the drawings, several embodiments will be detailed herein below.

Figure 4:
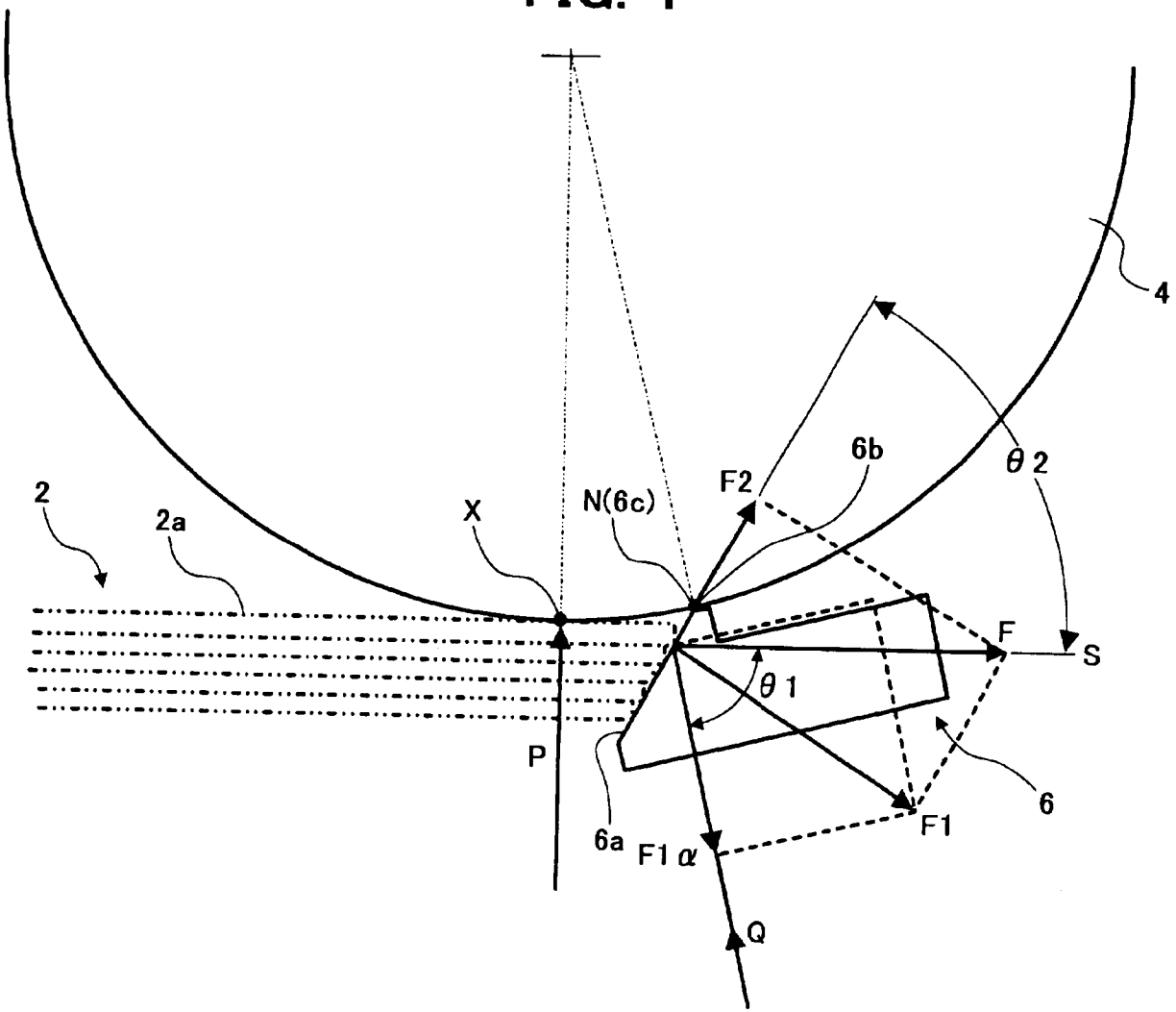
FIG. 4 is prepared to illustrate the force and the components thereof exerted onto the uppermost sheet material.

FIG. 4 is prepared to illustrate the force exerted onto the uppermost sheet material 2*a*, in which a force F is applied to the tapered face 6*a* of taper member 6 through the leading edge of the sheet material 2*a* as a resultant force for forwarding a plurality of sheet materials 2 by means of the feeding roller 4.

Since the tapered face 6*a* is mounted to make a predetermined angle $\theta_2$ between the direction S for forwarding the uppermost sheet material 2*a*, as mentioned earlier, first and second force components, $F_1$ and $F_2$, are generated in the direction perpendicular and parallel to the tapered face 6*a*, respectively.

In addition, a separation pressure, Q, exerted to press the taper member 6 against feeding roller 4 is setup to make another predetermined angle $\theta_1$ between the direction S for forwarding the sheet materials 2.

By adjusting the separation pressure Q smaller than $F1_{\alpha}$, the component of the above noted component $F_1$ parallel to the pressure Q, the uppermost sheet material 2*a* can climb over the tapered face 6*a* of taper member 6 to be forwarded to the feeding roller pair 7 of FIG. 1.

Figure 5:
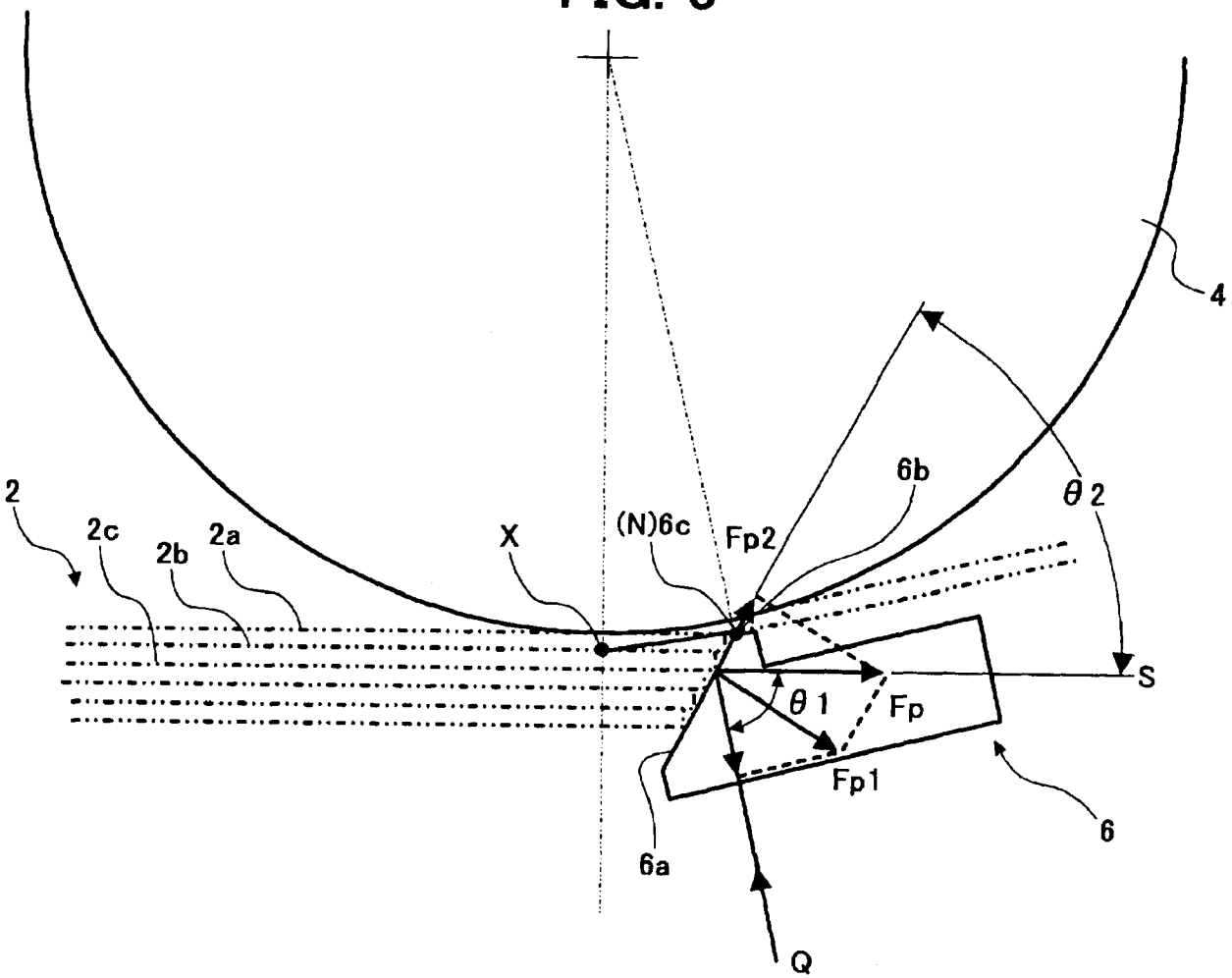
FIG. 5 is prepared to illustrate the force exerted onto the next sheet material situated immediately under the uppermost sheet material with the uppermost sheet material being at the nipped situation.

FIG. 5 is prepared to illustrate the force exerted onto the next sheet material 2*b* situated immediately under the uppermost sheet material 2*a*, in which a force $F_P$ is generated through friction between the second next sheet material 2*c* situated immediately under the sheet material 2*b*, to thereby generating further force components, $F_{P1}$ and $F_{P2}$, in the direction perpendicular and parallel to the tapered face 6*a*, respectively.

Since the friction coefficient between sheet materials is generally as large as about 50% of that between the sheet material and feeding roller 4, and the magnitude of the force $F_P$ is therefore about 50% of the force F of FIG. 4. As a result, a force associated with the frictional force $F_P$ having a magnitude large enough to climb over the tapered face 6*a* is not generated in the present case, and the sheet material 2*b* is halted by the taper member 6, to thereby be separated from the uppermost sheet material 2*a*.

Figure 6:
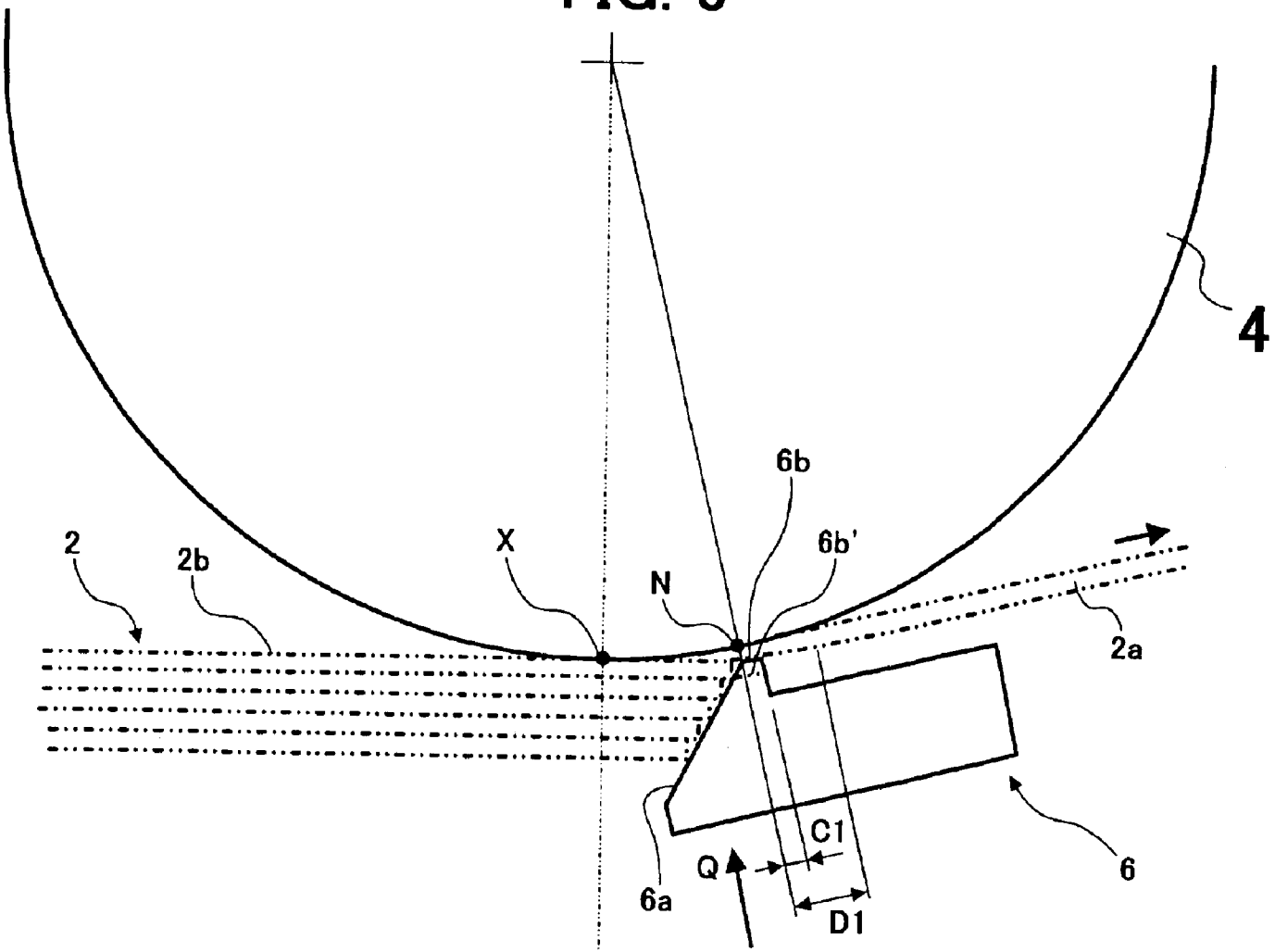
FIG. 6 is prepared to illustrate the configuration of the sheet materials upon leaving of the uppermost sheet material from the nip portion.

Even in the case of worn-out contact face 6*b*, in which the face 6*b* is worn-out to be a face 6*b'* having a narrower contact region with the feeding roller 4 of taper member 6 as shown in FIG. 6, the above mentioned conditions for the separation are retained since the taper member 6 is displaced in the direction of separation pressure Q from the compressed spring 5 and the predetermined angle $\theta_1$ (FIG. 3) previously set with the tapered face 6*a* remains unchanged.

Furthermore, by reducing the region of contact face 6*b* in contact with the feeding roller 4 of taper member 6 from those previously known, the nip width for the uppermost sheet material 2*a* is reduced to a present nip width C1 from previous width D1, and the distance of carrying the next sheet material around the feeding roller 4 immediately after the discharge of the uppermost sheet material 2*a* is also decreased.

As a result, a forwarding force generated in proportion to the above distance is decreased, and the multiple feeding of sheet materials 2 can suitably be obviated.

In the following description, the method and apparatus will be examined theoretically according to the present disclosure.

Figure 8:
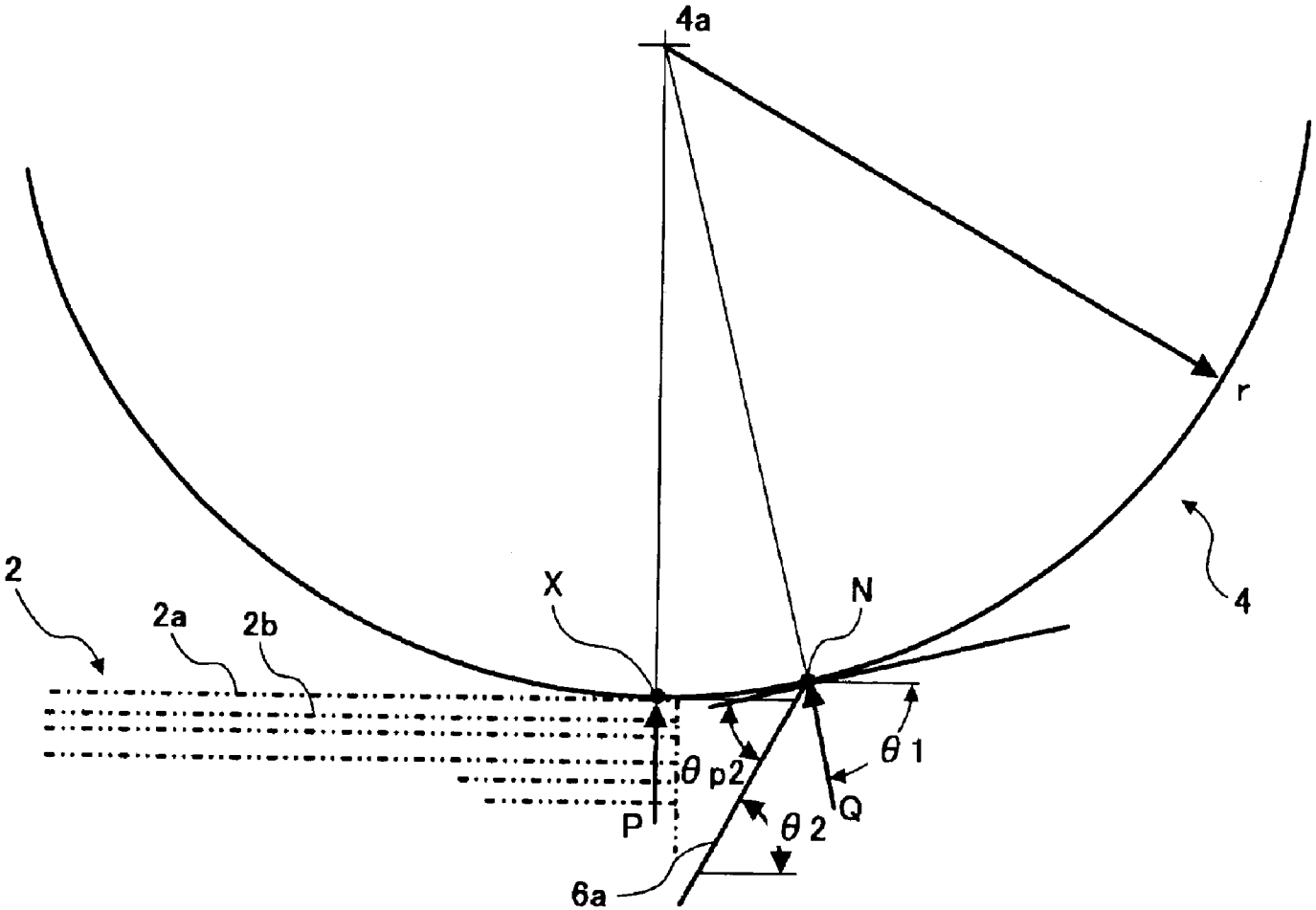
FIG. 8 is an expanded view of the contact points prepared to illustrate the details of the configuration of the sheet materials and the forces operated thereto.

FIG. 8 is an enlarged drawing illustrating the separation component disclosed herein, in which sheet materials 2 are loaded horizontally. In this horizontal configuration, the point of application for the feeding pressure P is located at the lowermost point of the feeding roller 4. The point of application, X, is now taken as the origin, and the point of contact between the feeding roller 4 and tapered face 6*a* of taper member 6 is denoted by N.

There included herein are following notations:

r: Radius of feeding roller 4

P: Feeding pressure P

Q: Separation pressure Q $\theta_1$: The angle between applied separation pressure Q and the direction for forwarding sheet materials (in degree)

$\theta_2$: The angle between tapered face of taper member and the direction for forwarding sheet materials (in degree)

$\theta_{P2}$: The angle between the tangent to nip portion and the direction for forwarding sheet materials (in degree)

N: Nip forming portion $\mu_1$: coefficient of friction between feeding roller and sheet material $\mu_2$: coefficient of friction between tapered face of taper member and the leading edge of sheet material $\mu_{P12}$: Coefficient of friction between first and second sheet materials $\Delta\mu_P$: The difference in coefficients of friction between sheet materials According to the notations, the following relations are derived.

$$\theta_{P2}=\theta_{P1}+\theta_2-90 \quad (1).$$

With the aforementioned point of application X as the origin, the coordinate $(N_x,N_y)$ for the nip portion N is obtained as $$N_x=r\cdot\cos(-\theta_1) \quad (2.1)$$

$$N_y=r+r\cdot\sin(-\theta_1) \quad (2.2),$$

in which N (3.871, 0.475) is obtained for the parameters r=16, $\theta_1$=76°, and $\theta_2$=60°, for example.

In addition, several inequalities will be derived next with regard to the forces exerted on sheet materials. There will be described on two cases, one for the leading edge of a sheet material 2 being right before entering to the nip portion, and the other right on entering to the nip forming portion N in reference to FIGS. 9, and 10A and 10B, respectively.

Figure 9:
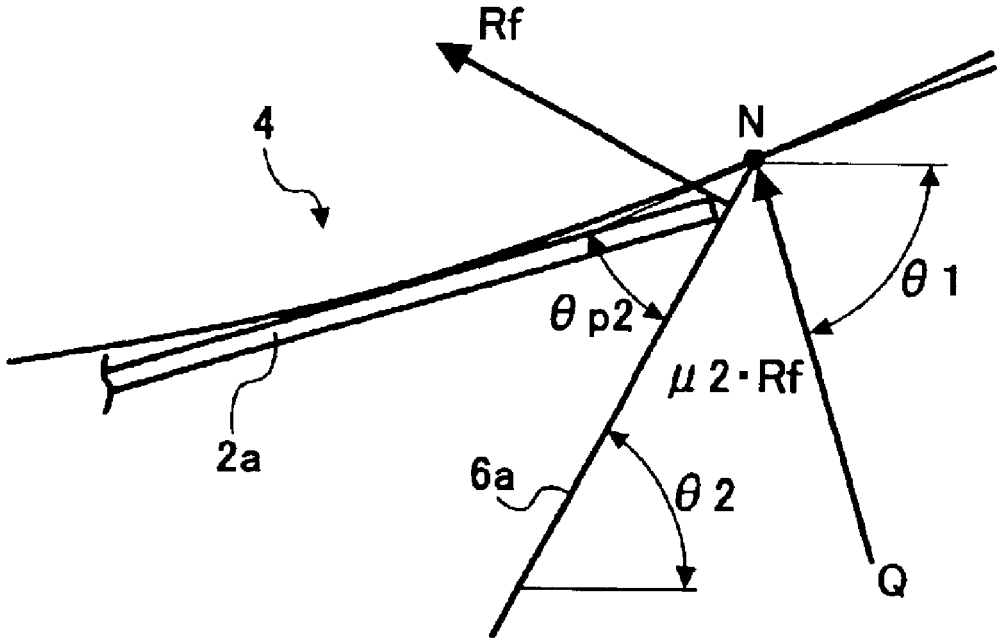
FIG. 9 is prepared to illustrate the case for the leading edge of a sheet material being right before entering to the nip portion.

Referring now to FIG. 9 illustrating the first case of right before entering to the nip portion, the leading edge of a sheet material 2 is exerted by a vertical drag $R_f$ through the tapered face 6*a* of taper member 6. For the leading edge of a sheet material 2 to arrive at the nip portion N, the material 2 has to be subjected to deflection in bending, and the magnitude of the force exerted onto the leading edge varies depending on the kind of sheet material, such as a larger force for a thick sheet, for example.

By making an assumption that the direction of sheet material 2 is parallel to the tangent to the outer circle of feeding roller 4 at the nip portion N, and that the only location on the roller 4 for the leading edge of a sheet material 2 being in contact with is the point at which the feeding pressure P is exerted.

Since the conveying force for the uppermost sheet material 2*a* is obtained as $(\mu_1-\mu_{P12})\cdot P$, and multiple feeding force onto the sheet material is $\Delta\mu_P\cdot P$, the condition for obviating non-feeding (NF) is expressed by the inequality $$(\mu_1-\mu_{P12})\cdot P>R_f\cdot A$$

$$\therefore P>R_f\cdot A/(\mu_1-\Delta\mu_{P12}) \quad (3),$$

while the condition for obviating multi-feeding (MF) is expressed by $$\Delta\mu_P\cdot P<R_f\cdot A$$

$$\therefore P<R_f\cdot A/\Delta\mu_P \quad (4)$$

$$A=\sin\theta_{P2}+\mu_2\cdot\cos\theta_{P2} \quad (5)$$

Figure 10A:
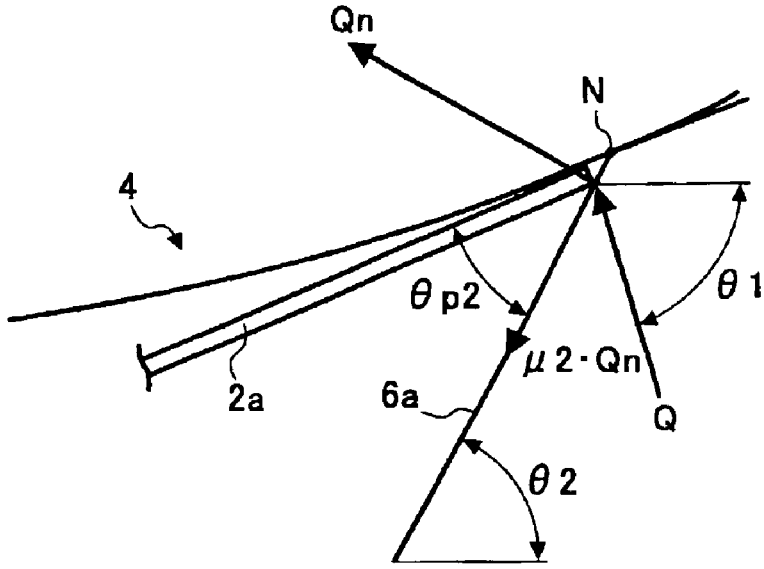
FIGS. 10A and 10B are prepared to illustrate the forces exerted onto the leading edge of a sheet material on entering to the nip portion.
Figure 10B:
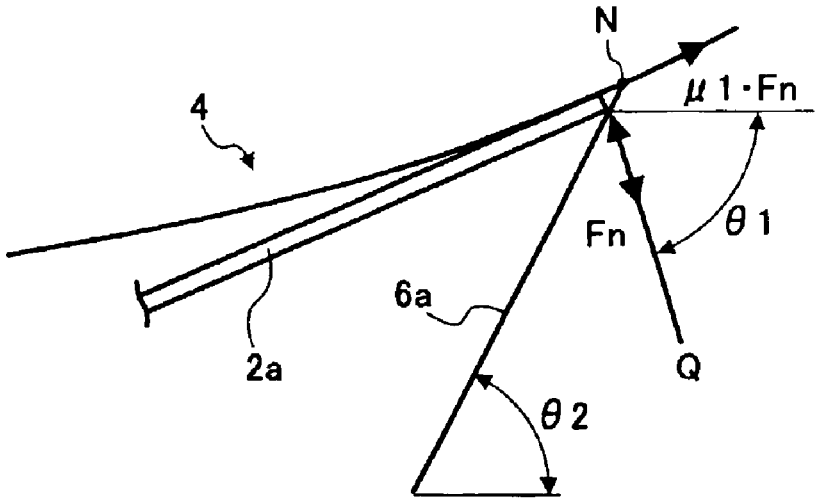

Referring to FIGS. 10A and 10B, the second case for the leading edge of a sheet material 2 being right on entering into the nip portion will be described, in which the leading edge of a sheet material 2 is exerted by a vertical drag $Q_n$ and its frictional force $\mu_2\cdot Q_n$ through the tapered face 6*a* of taper member 6.

On the other hand, the leading edge is also exerted by a force generated by nipping, such as another vertical drag $F_n$ and its frictional force $\mu_1\cdot Q_n$ in the forwarding direction.

The separation pressure Q is therefore obtained as $$F_n+R_f\cdot B=Q \quad (6)$$

$$R_f\cdot B=Q \quad (7)$$

$$B=\cos\theta_{P2}-\mu_2\cdot\sin\theta_{P2} \quad (8).$$

The conditions for obviating non-feeding in the longitudinal direction are obtained from (6) and (7), as $$(\mu_1-\mu_{P12})\cdot P+\mu_1\cdot F_n>Q_n\cdot A\ \therefore \quad (9)$$

$$P>\{(A/B)-\mu_1\}Q/(\mu_1-\mu_{P12})+\mu_1\cdot R_f\cdot B/(\mu_1-\mu_{P12}).$$

In addition, as the condition for obviating the multi-feeding is obtained as $$\Delta\mu_P\cdot P+\mu_{P12}\cdot F_n<Q_n\cdot A.$$

This is further deduced by inserting the relations (6) and (7).

$$P < \{(A/B) - \mu_{P12}\}Q/\Delta\mu_P + \mu_{P12} \cdot R_f \cdot B/\Delta\mu_P. \quad (10)$$

Summarizing the coefficients included in the relations (9) and (10), there obtained are the relation for obviating the non-feeding:

$$P>C\cdot Q+D \quad (11),$$

and the relation for obviating the multi-feeding:

$$P<C\cdot Q+H \quad (12)$$

$$C=\{(A/B)-\mu_1\}/(\mu_1-\mu_{P12}) \quad (13)$$

$$D=\mu_1\cdot R_f B/(\mu_1-\mu_{P12}) \quad (14)$$

$$G=\{(A/B)-\mu_{P12}\}/\Delta\mu_P \quad (15)$$

$$H=\mu_{P12}\cdot R_f B/\Delta\mu_P \quad (16).$$

The force exerted to the leading edge of sheet material is considered in the next place. The leading edge is exerted by a force caused the bending of the leading edge through the tapered face 6*a* of taper member 6, and a component perpendicular to the tapered face is found to be equal to the above-mentioned vertical drag Rf.

Figure 11:
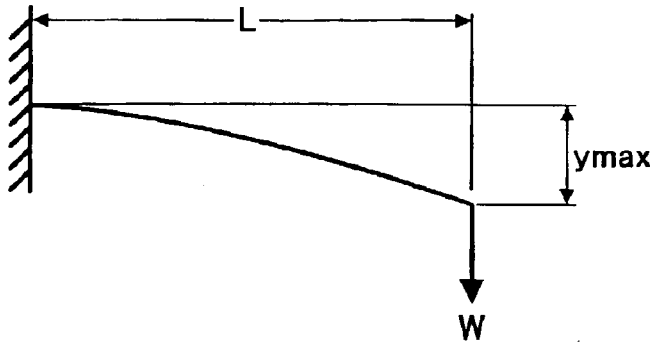
FIG. 11 is a view illustrating the component perpendicular to the tapered face which is equal to the vertical drag Rf.

This value may be calculated simply by assuming a concentrated weight placed on the tip of a beam of length L with the other end thereof is fixed as shown in FIG. 11. The amount of the bending $y_{max}$ at the tip of a beam is obtained as $$y_{max}=W\cdot L^3/3\cdot E\cdot I \quad (17)$$

$$I=b\cdot t^3/12 \quad (18),$$

where

I: Secondary section moment

E: Young's modulus b: Beam width t: Beam thickness.

The perpendicular drag Rf can be calculated by further assuming that the beam is fixed at the origin X, to which the feeding pressure P is exerted, and that the sheet material is bent up to the point N. The result from the calculation shows $$W=3\cdot E\cdot I\cdot N_y/L^3=R_f B$$

$$\therefore R_f=3\cdot E\cdot I\cdot N_y/B\cdot L^3 \quad (19)$$

$$L=\sqrt{(N_x^2+N_y^2)} \quad (20).$$

Also, the results on the perpendicular drag Rf obtained by the calculation using the relation (19) are shown in Table 1 for several sheet materials with different thickness, such as thick sheet A, thick sheet B, thin sheet A and thin sheet B. For the calculation, the width of sheet material is assumed to be 50 mm as equal as the width of feeding roller 4, and the values used for t and E are after experimental measurements.

TABLE 1

| Sheet | t [μm] | E [N/m²] | b [mm] | EI [N/m²] | W [N] | $R_f$ [N] |
|---|---|---|---|---|---|---|
| Thick A | 120.0 | 7.09E+09 | 50 | 5.10E−5 | 1.227 | 2.091 (*2.175) |
| Thick B | 89.0 | 6.26E+09 | 50 | 5.10E−5 | 0.442 | 0.731 |

TABLE 1-continued

| Sheet | t [μm] | E [N/m²] | b [mm] | EI [N/m²] | W [N] | $R_f$ [N] |
|---|---|---|---|---|---|---|
| Thin A | 72.5 | 3.60E+09 | 50 | 5.10E−5 | 0.155 | 0.257 |
| Thin B | 62.6 | 3.37E+09 | 50 | 5.10E−5 | 0.083 | 0.137 |

*Experimentally obtained for the sheet placed at (3.803 mm, 0.358 mm)

The comparison will now be made after substituting actual values into the values in the above relations, between the sheet separation method disclosed herein and the previous method using a separation pad. It may be noted three levels were used for the difference $\Delta\mu_P$ in friction coefficients between sheets considering the use of back paper. An example of the substituted values for each variable is shown in Table 2.

TABLE 2

| Notation | Values substituted presently |
|---|---|
| r | 16 [mm] |
| $\theta_1$ | 76 [deg] |
| $\Theta_2$ | 60 [deg] |
| $\mu_1$ | 1.3 (Relatively small value is set considering degradation) |
| $M_2$ | 0.15 |
| $\mu_{P12}$ | 0.6 (Sheet commonly used) |
| $\Delta\mu_P$ | 0.06, 0.1, 0.2 |
| $R_f$ | Thick A: 210 [gf], Thin B: 15 [gf] |
| $\mu_{FP2}$ | 0.8 (Friction coefficient of the sheet against friction pad) |

Figure 12:
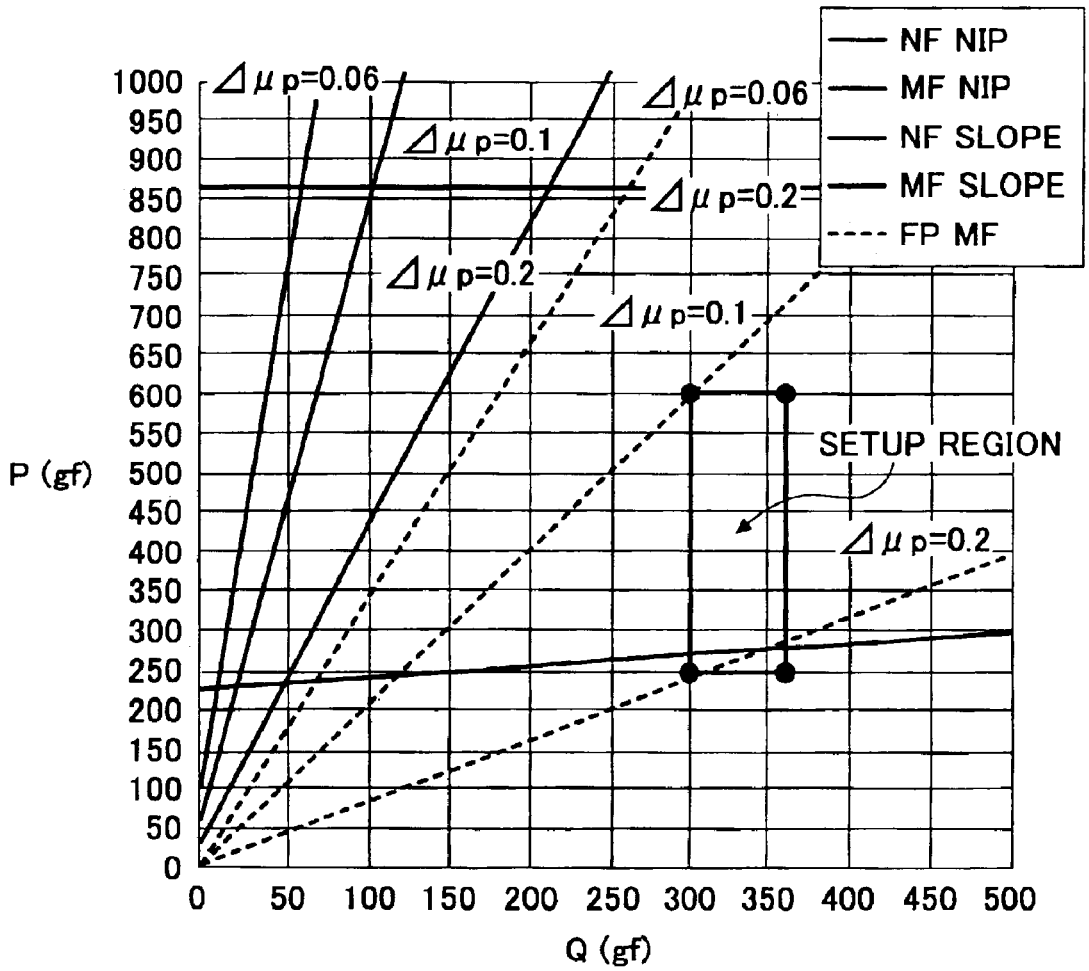
FIG. 12 is a diagrammatic drawing representing the feeding pressure P, vertically, versus the separation pressure Q, horizontally, for the sheet separation method according to the present embodiment disclosed herein.

FIG. 12 is a diagrammatic drawing representing the feeding pressure P, vertically, versus the separation pressure Q, horizontally, for the sheet separation method disclosed herein, in which several boundary lines obtained from the above relations are shown such as NF slope according to the relation (3), (which is abbreviated herein as 'NF slope: relation (3)'), MF slope: relation (4), NF nip: relation (11), and MF nip: relation (12). In addition, three lines are shown each corresponding to three levels of the $\Delta\mu_P$ values.

For also the FP separation method using the separation pad, three MF boundary lines are shown corresponding to three levels of the $\Delta\mu_P$ values. Additionally shown are the ranges in which the parameters, P and Q, are suitably set during the practical use of the sheet feeding apparatus disclosed herein.

It may be added further the separation and feeding pressures can be measured using several means such as, for example, a spring balance and pressure sensing device. In the case of measurement, it is preferable to take the weight of sheet material into consideration for the measurements.

As seen from the results shown in FIG. 12, since the range for multiple feeding in the FP separation method is considerably narrowed at $\Delta\mu_P$=0.2, the proper feeding cannot be achieved with the conventional P-Q setup.

In contrast, a relatively large margin against the MF region still exists even at $\Delta\mu_P$=0.2 in the sheet separation method disclosed herein.

An MF boundary line is expressed by the following formula (21)in the FP separation method.

$$P<(\mu_{FP}-\mu_{P12})Q/\Delta\mu_P \quad (21)$$

On the other hand, inclination of the MF boundary line in the sheet material separation method disclosed herein is obtained from (15) as $$\{(A/B)-\mu_{P12}\}/\Delta\mu_P,$$

which indicates the value (A/B) to correspond to FP friction coefficient $\mu_{FP}$ in the present method.

In addition, this is the coefficient for determining the component of the force exerted at the leading edge of the sheet material, and the following relation is found from (5) and (8) for the present setting of the variables, indicating the equivalence in that the $\mu_{FP}$ value is seemingly 1.4.

$$A/B=1.4 \quad (22).$$

This is considered to be one of the factors from which the degree of multistory margin with the sheet material separation method disclosed herein is far larger than the FP separation method.

In this case, the ratio of inclination of the MF boundary between the present method and the FP separation method is obtained as $$\{(A/B)-\mu_{P12}\}/(\mu_{FP}-\mu_{P12})\approx 4.1 \quad (23).$$

The degree of MF margin of the present disclosure is therefore approximately 4 times larger than the FP separation method.

Figure 13:
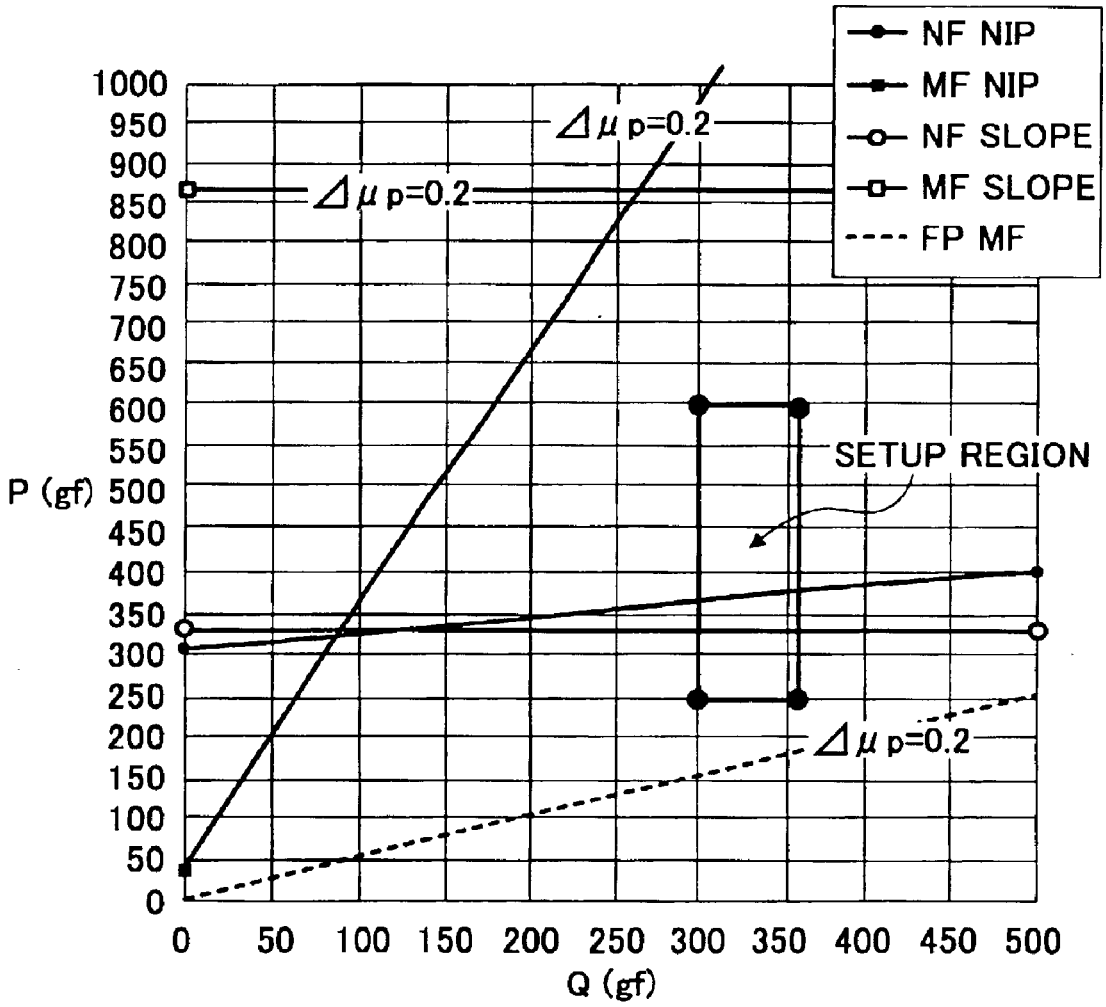
FIG. 13 is another diagrammatic drawing representing the feeding pressure P versus pressure Q relation in the case the friction coefficient $\mu_{P12}$ between the first and second sheet material being expected to be relatively large.

Furthermore, in order to confirm the degree of MF margin in the case of the lug paper (bond paper) and the recycled paper, in which the friction coefficient $\mu_{P12}$ between the first and second sheet material is expected to be relatively large, another P-Q diagram is shown in FIG. 13 in the case of $\mu_{P12}=0.77$ and $\Delta\mu_P=0.2$.

From the results shown in FIG. 13, it is indicated that even back papers with high friction coefficients can also be separated by the present sheet material separation method when a high enough feeding pressure P is applied.

Figure 14:
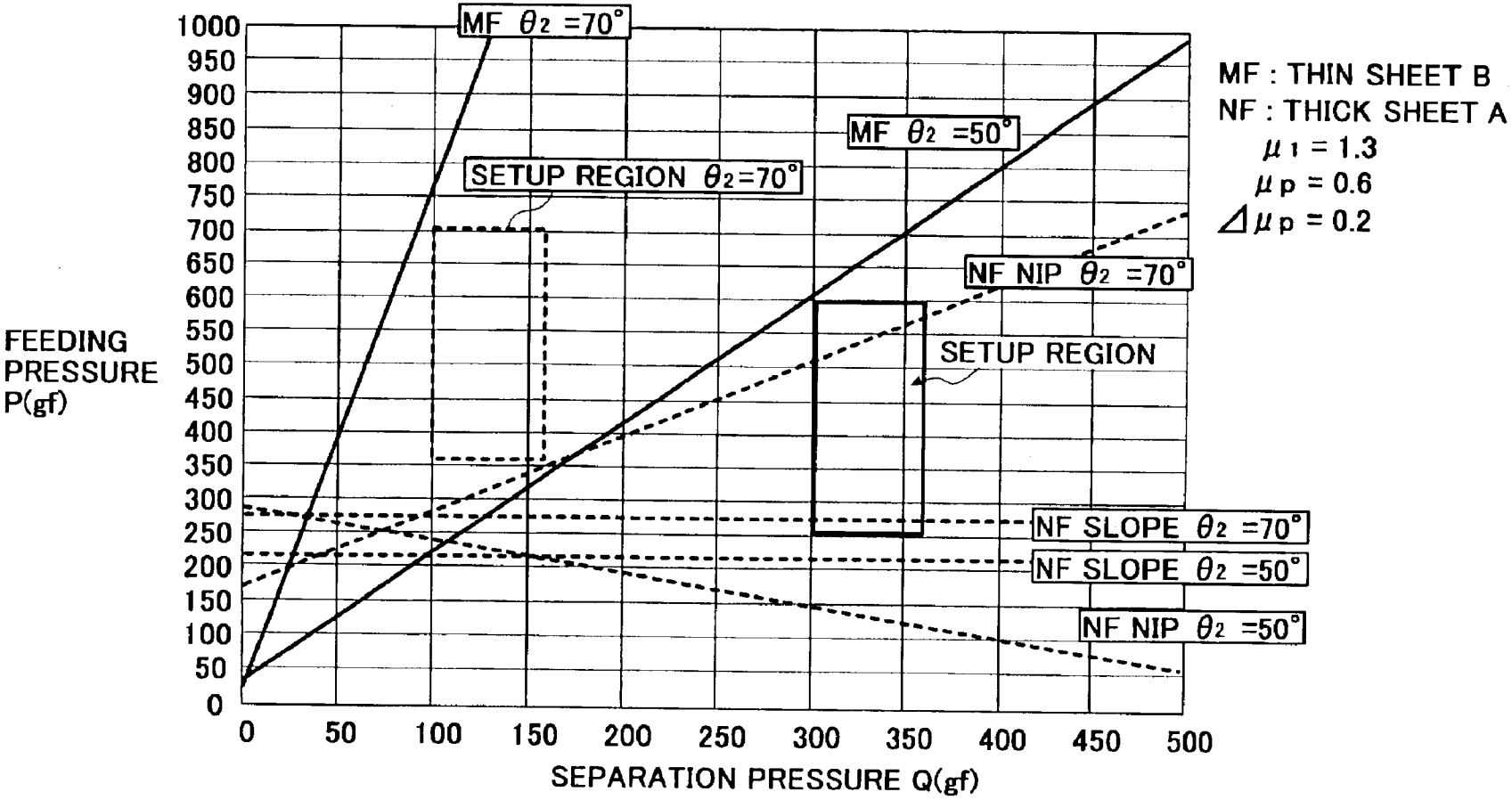
FIG. 14 is another diagrammatic drawing prepared in a similar manner to FIG. 12, representing P versus Q relation obtained from experiments, when the angel between the tapered face of taper member and the direction for forwarding the sheet material is varied ranging from 50° to 70°.

In the next place, FIG. 14 is another diagrammatic drawing prepared in a similar manner to FIG. 12, representing MF and NF regions with respect to the feeding pressure P, vertically, versus the separation pressure Q, horizontally, based on the experimental results obtained, when the angel ($\theta_2$) between the tapered face 6*a* of taper member 6 and the direction for forwarding the sheet material is varied ranging from 50° to 70°.

As seen clearly from FIG. 14, with the parameter setting indicated by the square drawn with solid lines in the drawing, sheet separation becomes feasible up to the difference in coefficient $\Delta\mu_P=0.2$.

Although the NF region becomes severe to be materialized when the above-mentioned angle $\theta_2$ is set as 70°, an appropriate setup becomes possible by bringing the ratio, separation pressure/feeding pressure, to be within the region indicated by the square drawn with solid lines in the drawing.

Figure 15:
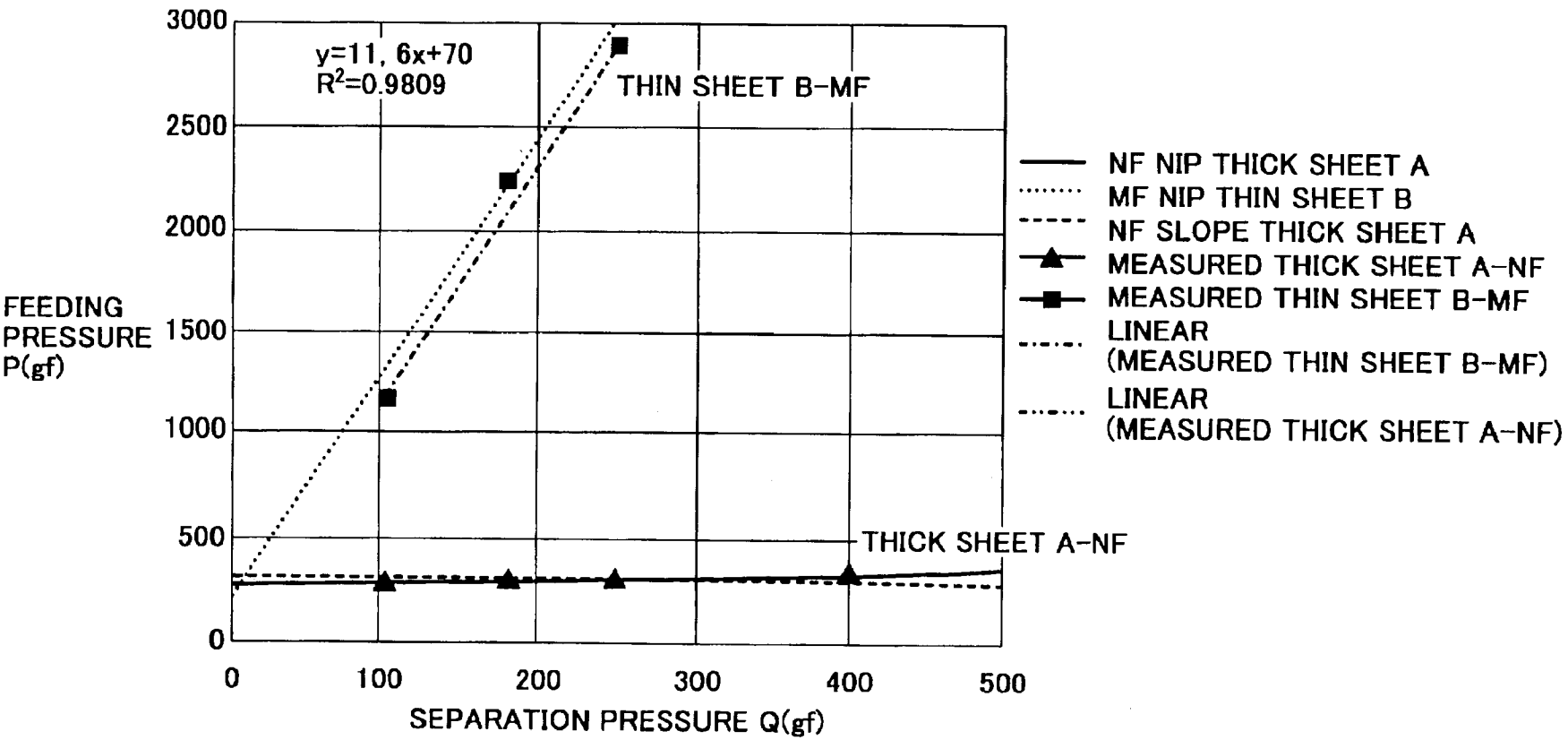
FIG. 15 is a diagram prepared to illustrate the comparison of the NF region for thick sheet, which is calculated using aforementioned relations, with that obtained through the actual measurement.

Also shown in FIG. 15 is a diagram which compares the NF region for thick sheet A, which is calculated using aforementioned relations, with that obtained through the actual measurement. It is confirmed that the NF region for the thick sheet A is approximated by the values, $\mu_1=1.3$ and $\mu_P=0.67$, while the MF region for thin sheet B is approximated by $\mu_2'=1.3$, $\mu_P=0.54$ and $\Delta\mu_P=0.048$.

It may be noted other substituted values and the vertical drag Rf from the tapered face for the thick A sheet and thin B sheet are the same as those aforementioned in Tables 1 and 2. Therefore, it has been confirmed that the values obtained through actual measurements can be approximated by the calculations which are carried out by substituting several friction coefficient data obtained from separate measurements, whereby the validity of respective aforementioned relations has been proved.

Since the taper member 6 has a rather complicated form in the sheet material feeding apparatus, it is fabricated preferably in an integrated manner with synthetic resinous materials.

Figure 17:
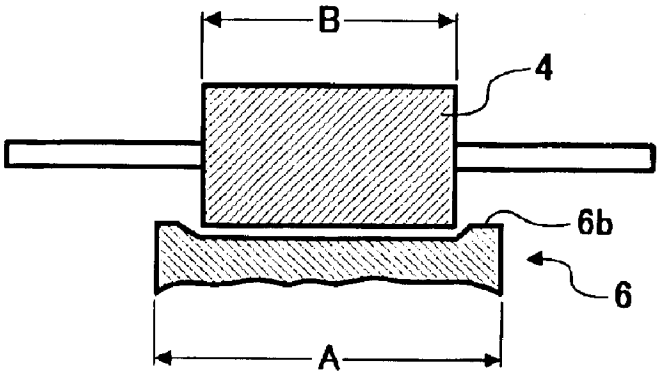
FIG. 17 is a cross sectional view of the taper member and feeding roller of FIG. 16.
Figure 16:
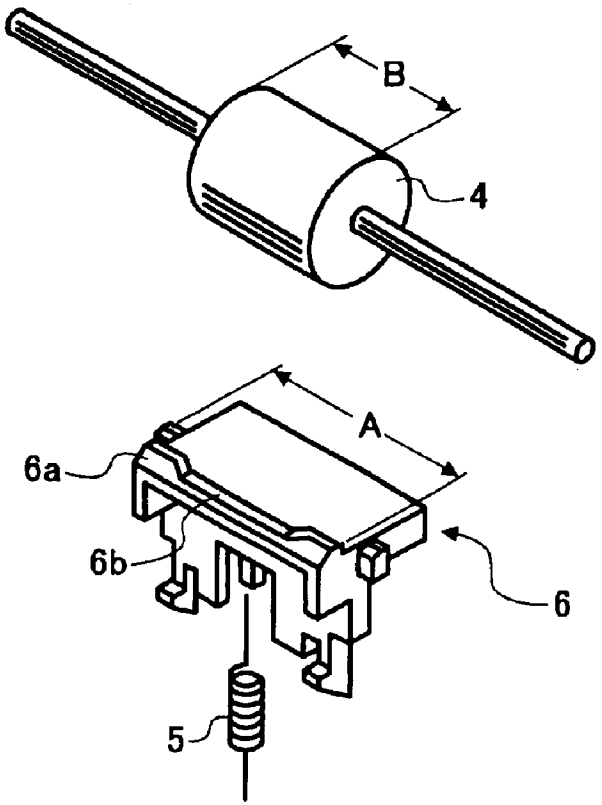
FIG. 16 is a perspective view illustrating the taper member according to the present embodiment, in which the length of the contact face in the taper member is larger than that of the feeding roller in its axial direction, that may cause the contact face be worn-out and subsequent caved-in in the middle portion of the contact face.

In such a case, if the length A of the contact face 6*b* in taper member 6 is larger than that of the feeding roller 4 in its axial direction, as shown in FIGS. 16 and 17 this may cause the contact face 6*b*, which is pressed to be brought in slidable contact with sheet material (not shown) during the transportation thereof, is subjected to worn-out and subsequent caved-in in the middle portion of the contact face 6*b* which is pressed to be brought in slidable contact with sheet material.

This deformation of the taper member 6 may cause undue sheet feeding, in which, on entering into the nip between the feeding roller 4 and taper member 6, the sheet material has to be advanced along the deformed surface of the contact face 6*b*. This may result in unduly increased conveyance load for the sheet material and concomitant non-feeding of sheet materials with relatively high rigidity.

FIG. 18 is a compositional perspective view illustrating the feeder main 10 which is formed to overcome the above noted difficulty according to the second embodiment disclosed herein.

In this embodiment, the length of the contact face 6*b* in taper member 6 is made smaller than that of the feeding roller 4 in its axial direction so as the entire length of the contact face 6*b* to be continually brought into contact with the feeding roller 4, and other portions thereof are formed in a similar manner to those aforementioned.

According to such composition, the contact face 6*b* in taper member 6 is pressed over its entire length against the feeding roller 4 to thereby exclude the possibility of the above noted partial cave-in, and result in worn-out of the contact face 6*b* averaged over the length thereof. In addition, since the taper member 6 is displaced in parallel to the direction to the feeding roller 4, the contact face 6*b* of taper member 6 can still retain the predetermined angle between sheet materials.

Figure 19:
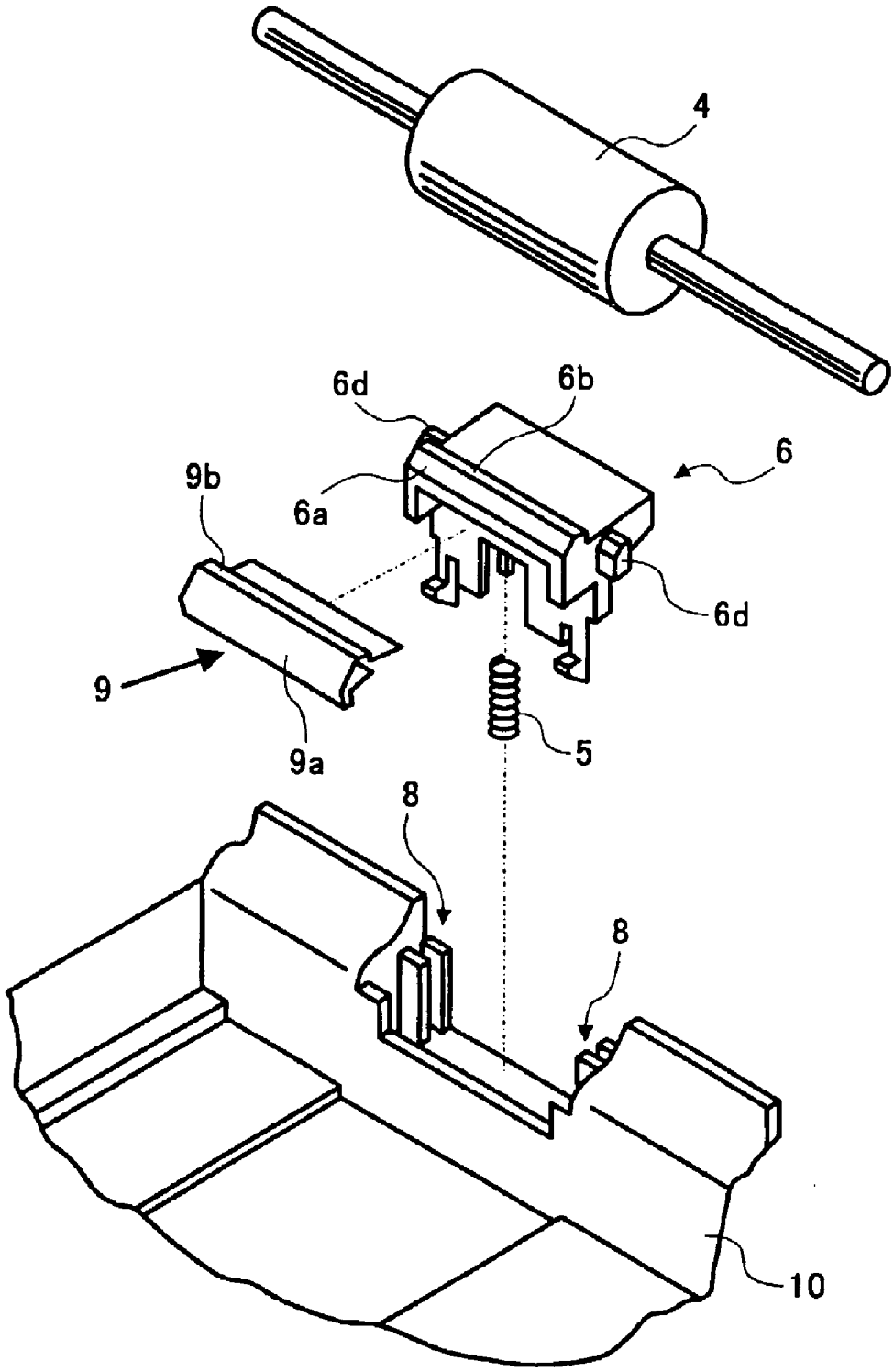
FIG. 19 is a compositional perspective view illustrating the feeder main according to the third embodiment disclosed herein, in which a plastic metal plate is inserted from the side of the tapered face of taper member.
Figure 20:
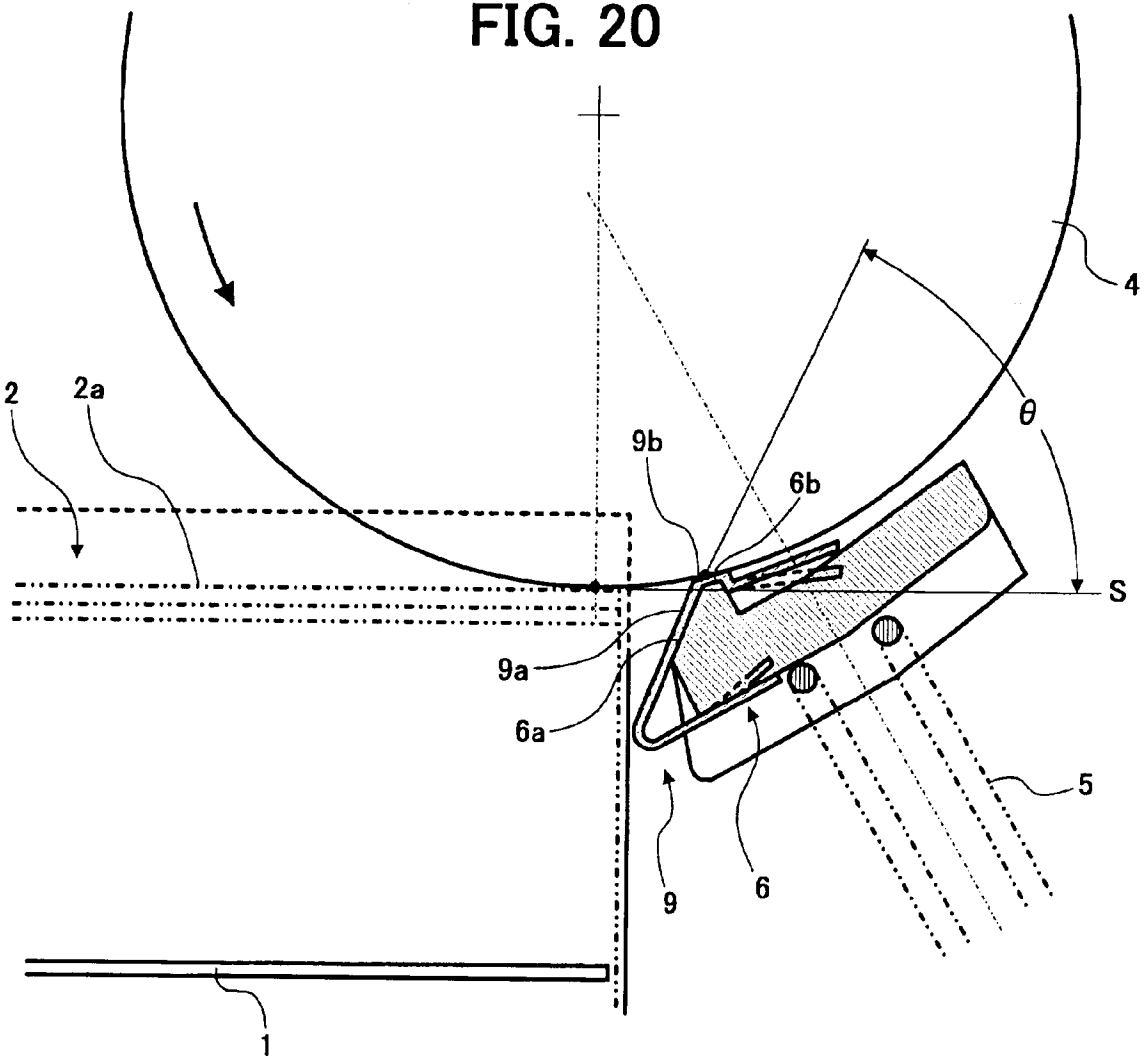
FIG. 20 is an expanded cross sectional view illustrating the feeder main of FIG. 19.

FIGS. 19 and 20 are compositional perspective and longitudinal cross sectional views, respectively, illustrating the feeder main 10 which is formed to overcome the aforementioned difficulty according to the third embodiment disclosed herein.

In the present embodiment, a thin plastic metal plate 9 is formed having a tapered face 9*a* and a contact face 9*b* by bending such that these faces 9*a* and 9*b* can be engaged with the tapered face 6*a* and contact face 6*b*, respectively. The thus prepared metal plate is then inserted from the side of the tapered face 6*a* of taper member 6.

Further, from its original form as shown with dotted lines in FIG. 20, the opening of the metal plate 9 is widened by plastic force upon the insertion to make a tight fit to the taper member 6 as shown with solid lines also in FIG. 20.

Since the surface of the tapered face 6*a* and contact face 6*b* of taper member 6 is covered in close contact with the metal plate 9 in the present embodiment, the contact face 6*b* of taper member 6 can retain the predetermined angle $\theta_2$ between the forwarding direction for sheet materials, and reduce considerably the worn-out of the contact face 6*b*.

Although the metal plate 9 is formed to cover both tapered face 6*a* and contact face 6*b* for plasticity consideration, the former may not be covered necessarily. In addition, since the worn-out of the contact face 6*b* can be reduced in the present embodiment, the length of the contact face 6*b* can be determined arbitrarily independent of the axial length of the feeding roller 4.

Furthermore, according to the results obtained from repeated experiment, the conditions for satisfactory separation of the sheet material 2 are now found: That is, adjusting the distance K in sheet forwarding direction to be in the range from 2 to 6 mm between the point X of pressed contact for the uppermost sheet material 2*a* loaded on the base plate 1 to feeding roller 4 and the point N of contact for the feeding roller 4 with the tailing edge 6*c*, and also adjusting the angle $\theta_2$ to be in the range from 50° to 70° between the longitudinal direction of tapered face 6*a* in taper member 6 and sheet forwarding direction S.

As far as these conditions are satisfied and the diameter $\phi$ of the feeding roller 4 is in the range between 16 and 36 mm, it has been confirmed satisfactory sheet separation quality is always obtained.

In addition, although the metal plate 9 is formed of plastic metal in the above example, this is not intended to be liming but other metal with no elasticity may alternatively used. In the latter case, the metal plate 9 shown in FIGS. 19 and 20 is formed as a metal plate 9' with no elasticity which is formed as shown in FIG. 21 so as not to include the portion downstream from the overlap with contact face 6*b*, and to be fixed to the taper member 6 from the bottom with a screw.

According to the present embodiment, since the abrasion from friction is practically negligible, the method of support is not necessarily of horizontal displacement, and the support in a swinging manner can alternatively be implemented by means of a supporting axis 6*e* of the taper member 6 with a axis hole 10*a* of the feeder main 10 with a torsion coil 15 affixed to the supporting axis 6*e* for exerting a pressing force to taper member 6 toward feeding roller 4.

Figure 21:
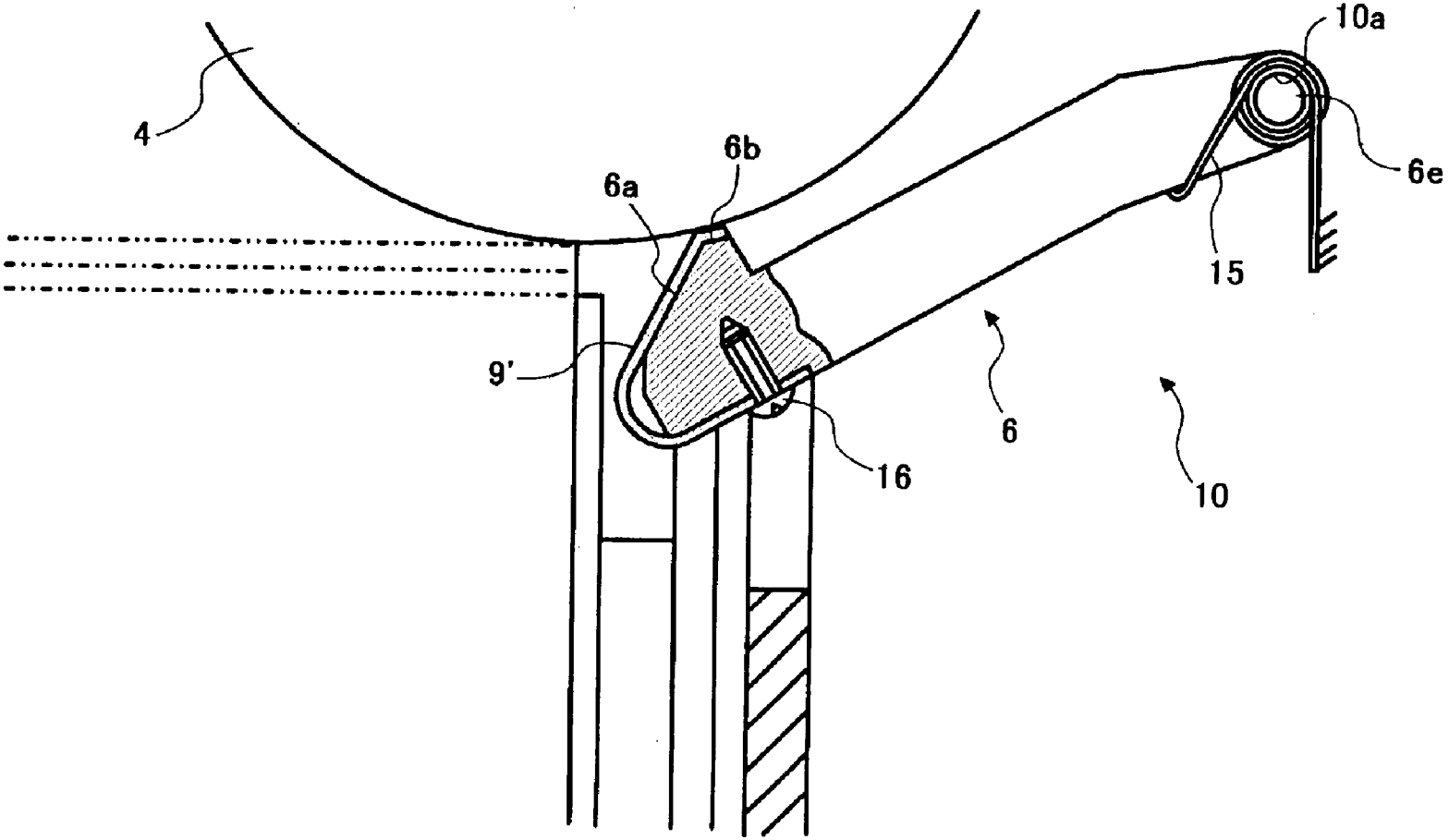
FIG. 21 is an expanded cross sectional view illustrating the feeder main according to the fourth embodiment disclosed herein.

In the above description of the embodiments 3 and 4 in reference to FIGS. 19 through 21, the metal plate 9 is formed to cover the taper member, which is formed with relatively abrasive synthetic resins, with the metal plate. However, the taper member may alternatively be formed with the hard synthetic resin such as, for example, the resin strengthened with carbon fiber or glass fiber, with a relatively thick layer of metal plating for the contact face 6*b*. By these means, it becomes possible to acquire the same effect.

In addition, the non-feeding and multiple feeding are obviated, in the above described embodiments 1 though 4, by specifying the shape and structure of constituent units and members. In case of unanticipated situation, in which two paper sheets simultaneously climb over the contact face of taper member, there may gives rise to the possibility of multiple feeding, since no means such as any load is provided further downstream to halt the sheet material. Thereafter, these two sheets are forwarded to the image forming unit, thereby resulting in the multiple feeding.

Figure 22:
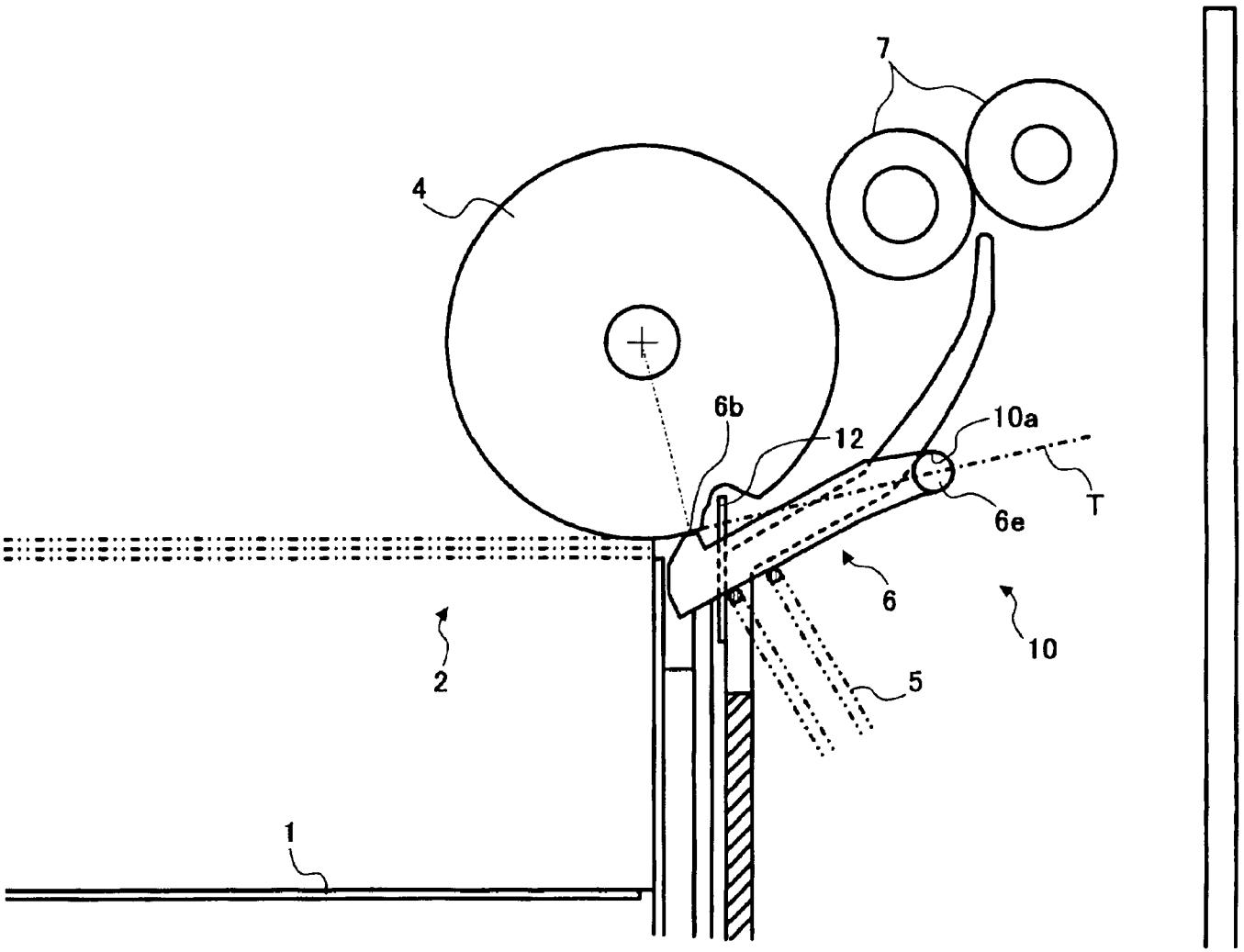
FIG. 22 is a cross sectional view illustrating the feeder main according to the fifth embodiment disclosed herein, in which the multiple feeding can be prevented.
Figure 23:
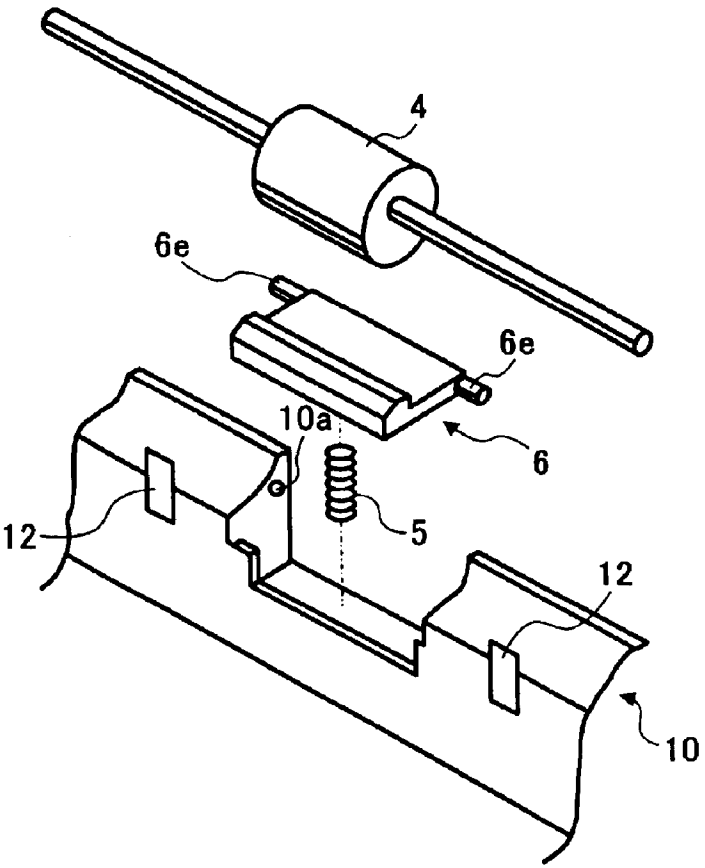
FIG. 23 is a compositional perspective view illustrating the feeder main of FIG. 22.

FIGS. 22 and 23 are longitudinal cross sectional and compositional perspective views, respectively, illustrating the feeder main 10 which is formed to over come the abovementioned difficulty according to the fifth embodiment disclosed herein.

It may be noted herein that, although some portion may not be shown for abbreviation purposes, the aforementioned metal plate 9 of plasticity and metal plate 9' with no elasticity, and also the support means in a swinging manner implemented by means of a supporting axis 6*e* of the taper member 6 with a axis hole 10*a* of the feeder main 10 may be included in the description. Furthermore, it is needless to add the aforementioned means for implementing horizontal displacement may also be included.

As shown in FIGS. 22 and 23, the taper member 6 is axially supported oscillatory by means of a supporting axis pair 6*e*, 6*e* fit to axis holes 10*a*, 10*a* of the feeder main 10 (only one of the pair is shown in the drawing), and the position of the supporting axis 6*e* is brought to be situated on the tangent T of the feeding roller 4 at the contact position with contact face 6*b*.

In addition, thin elastic members 12, 12 (designated hereinafter as mylar) are provided with the bottom portions thereof fixed to the inner wall of back wall of feeder main 10 and edge portions thereof across the tangent on both sides of the feeding roller 4.

Although the above elastic members are suitably formed of synthetic resinous materials, they may alternatively be formed of metal plates. Utilizing the structure, in case two paper sheets simultaneously climb over the contact face 6*b* of taper member 6, these sheets can be prevented from the multiple feeding, since a second sheet is blocked by a force exerted onto the edge portions of these sheets from the bending by the mylar units, to thereby forwarding the first sheet alone.

As described herein above, since these sheets can be prevented from the multiple feeding through the force exerted onto the edge portions of these sheets from the bending by the mylar units and the second sheet is halted, the prevention from the multiple feeding is secured by multiplying the force by the two pieces of mylar pairs.

However, the mylar pieces may be provided, having different capability in some case, such as either apart one another forward and backward, or different in elasticity. In such a case, the second sheet may be still retained at the waiting location to thereby forward later on. This difficulty is obviated by the following means.

Figure 24:
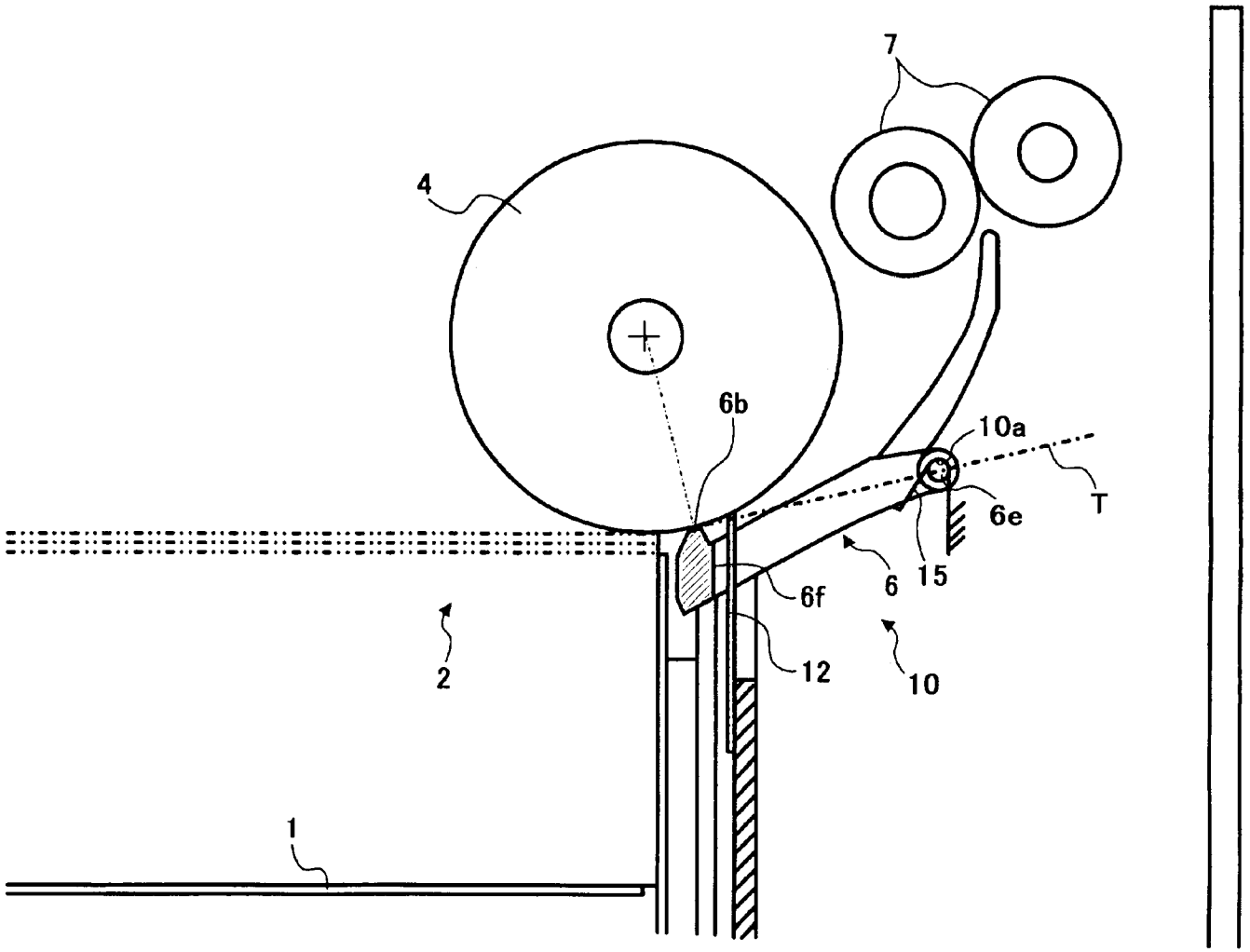
Figure 25:
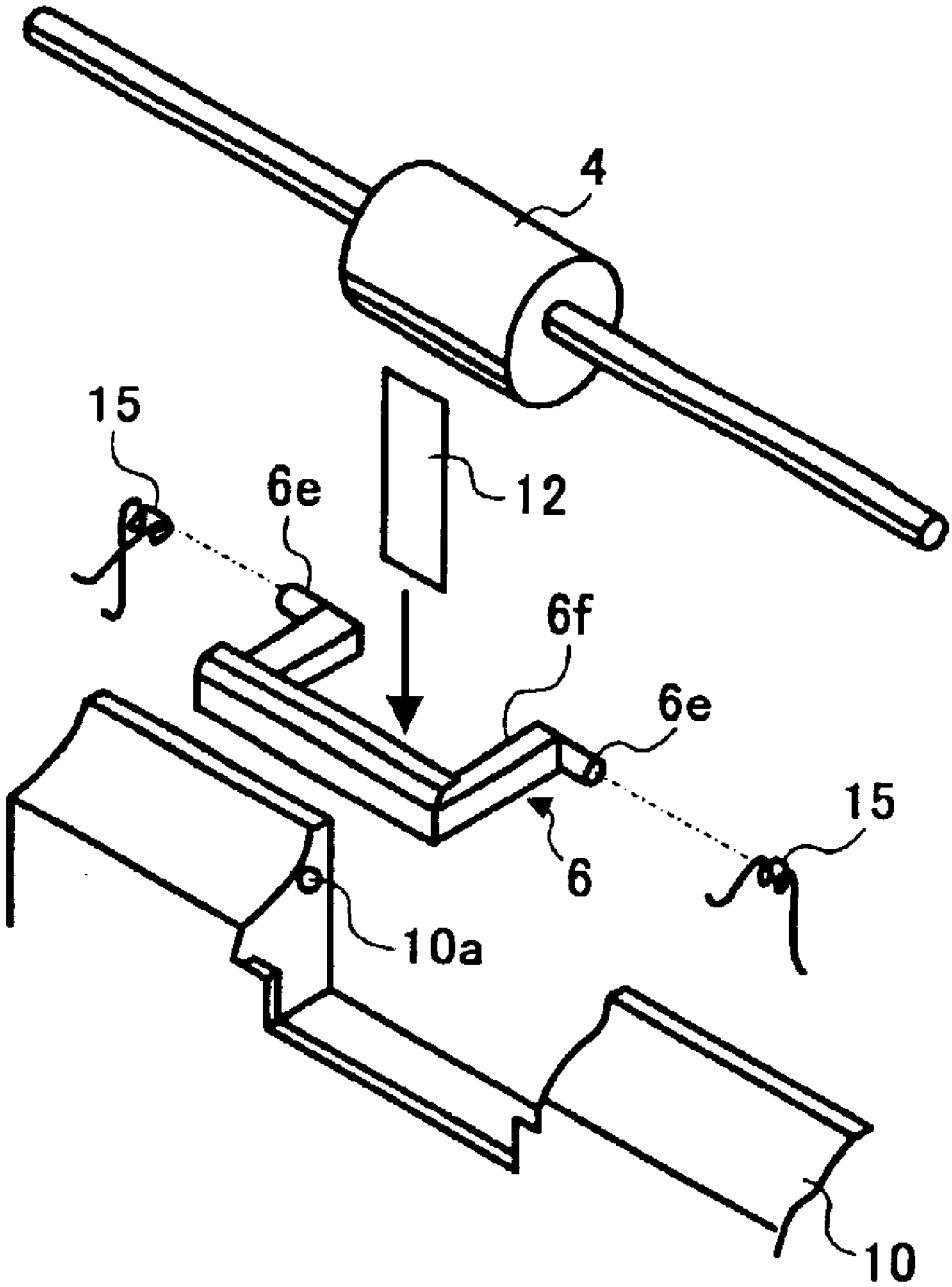
FIG. 25 is a compositional perspective view illustrating the feeder main of FIG. 24.

FIGS. 24 and 25 are longitudinal cross sectional and compositional perspective and views, respectively, illustrating the feeder main 10 which is formed to overcome the abovementioned difficulty according to the sixth embodiment disclosed herein.

Namely, a mylar piece is provided with the bottom portion thereof fixed to the inner wall of back wall of feeder main 10 approximately in the middle of the axial length of the feeding roller 4, and the edge portion thereof is protruded upward through an opening 6*f* for release formed approximately in the middle of taper member 6 to be placed across the tangent T. In addition, by providing the opening 6*f* for release, torsion coils 15, 15 may be used as the means for pressing the edge portion of the taper member 6 against feeding roller 4 in place of the spring coils.

Utilizing the above structure, even in case two paper sheets simultaneously pass by through the gap between the feeding roller 4 and the contact face 6*b* of taper member 6, the second sheet is blocked by a force exerted onto the edge portions of these sheets from the bending by the mylar units, to thereby the multiple feeding be prevented. Since the mylar piece 12 support approximately in the middle of the edge of the sheet material, the holding period for the sheet can be reduced.

Figure 26:
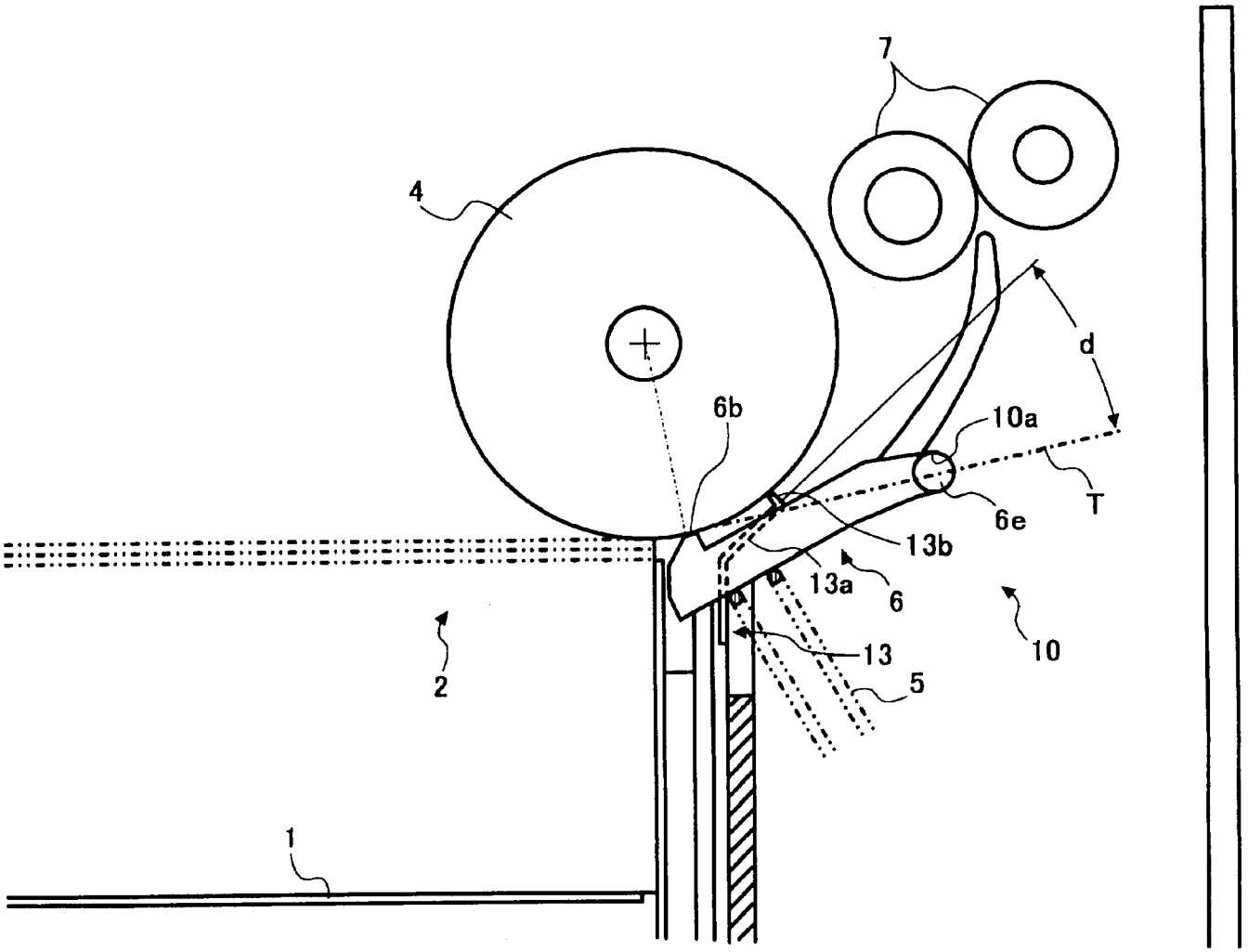
FIG. 26 is a cross sectional view illustrating the feeder main according to the seventh embodiment disclosed herein, in which the form of the mylar pair is modified.
Figure 27:
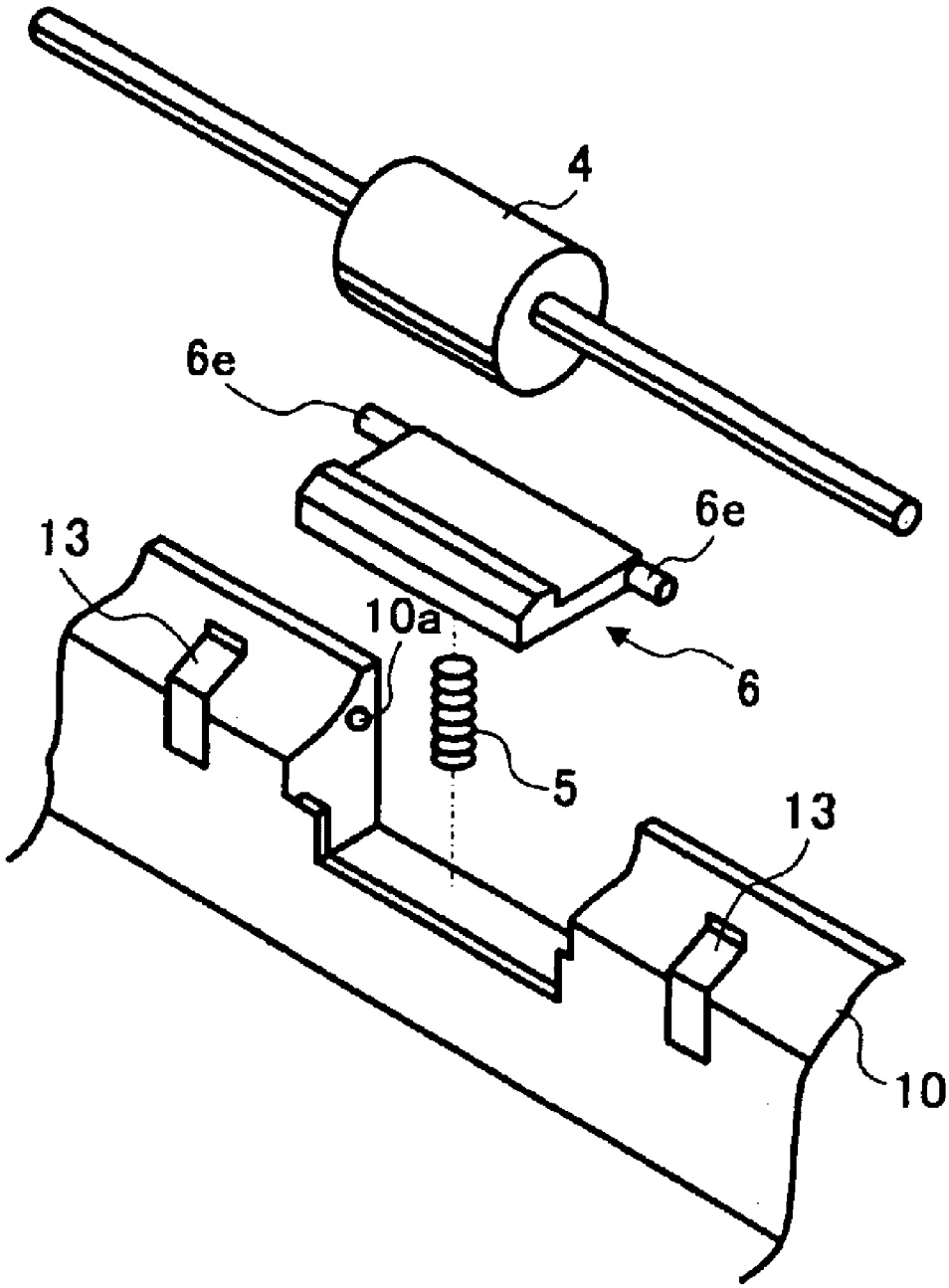
FIG. 27 is a compositional perspective view illustrating the feeder main of FIG. 26.

FIGS. 26 and 27 are prepared to illustrate the mylar pair situated downstream from the contact face 6*b* of taper member having modified forms according to the fifth embodiment disclosed herein.

In the present case, a mylar pair is provided with a first folded portion 13*a* and a second minute folded portion 13*b*.

The first folded portion 13*a* is herein formed approximately in the middle of the mylar piece with a blunt folded angle, while the second folded portion 13*b* is formed in the edge portion of the piece with an acute folded angle, where the first folded portion 13*a* is mounted across the tangent on both sides of the feeding roller 4 having an angle a between the tangent T to the contact face 6*b* of taper member 6.

From several experimental results, it is found the angle $\alpha$ suitably utilized herein is in the range between 20° and 60°, depending on flexural rigidity of mylar to a certain extent.

It may be added that other portions thereof are formed in a similar manner to those of FIGS. 22 and 23.

Utilizing the above structure, in case two paper sheets simultaneously climb over the contact face 6*b* of taper member 6, the leading edge of the sheets strike the second folded portion 13*b*, whereby the two sheets can be separated.

In case where thin sheets are handled by the present structure, an uppermost first sheet passes by the second folded portion 13*b* to be forwarded further, while a rigid thick sheet acts to bend the first folded portion 13*a* again to be forwarded further, and a second sheet is blocked by the the second folded portion 13*b*.

Figure 28:
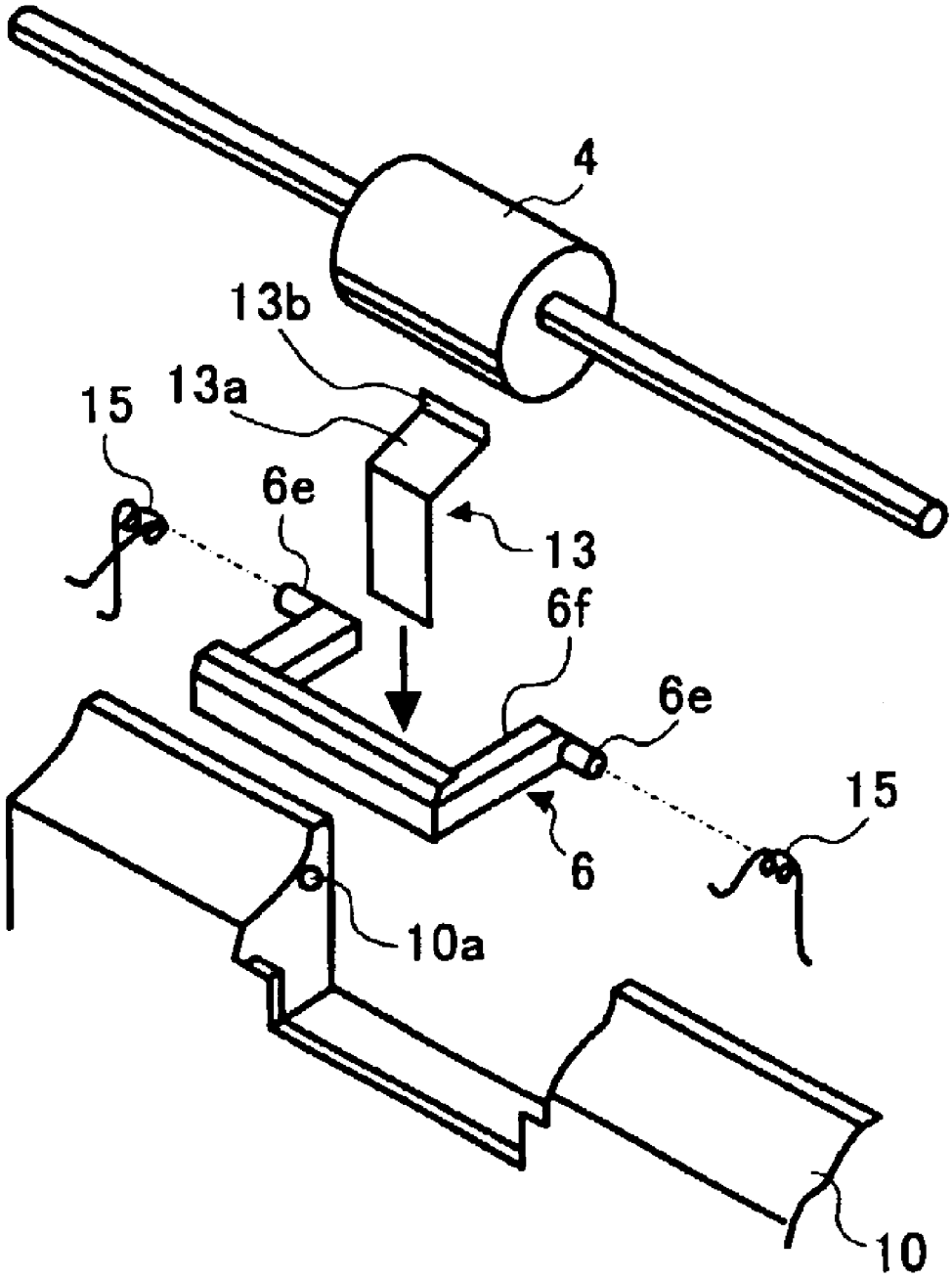
FIG. 28 is a compositional perspective view illustrating the feeder main according to the eighth embodiment disclosed herein, in which the mylar is provided approximately in the middle of the axial length of the feeding roller.

FIG. 28 is a compositional perspective view prepared to illustrate a further structure according to the eighth embodiment disclosed herein, in which the mylar 13 is provided approximately in the middle of the axial length of the feeding roller 4, further including the opening 6*f* for release.

Since the opening 6*f* is formed approximately in the middle of taper member 6, also in this case, torsion coils 15, 15 can be used as the pressing means in place of the spring coils. Other portions included in the structure are formed in a similar manner to those shown in FIGS. 26 and 27.

Utilizing the above structure, in a similar manner to those of FIGS. 24 and 25, undue halting of the second sheet material can be prevented. In addition, since the second minute folded portion 13*b* of the mylar 13 is capable of forcefully halting the second sheet, one mylar piece provided in the middle portion is found to be effective enough for the present sheet separation.

Figure 29:
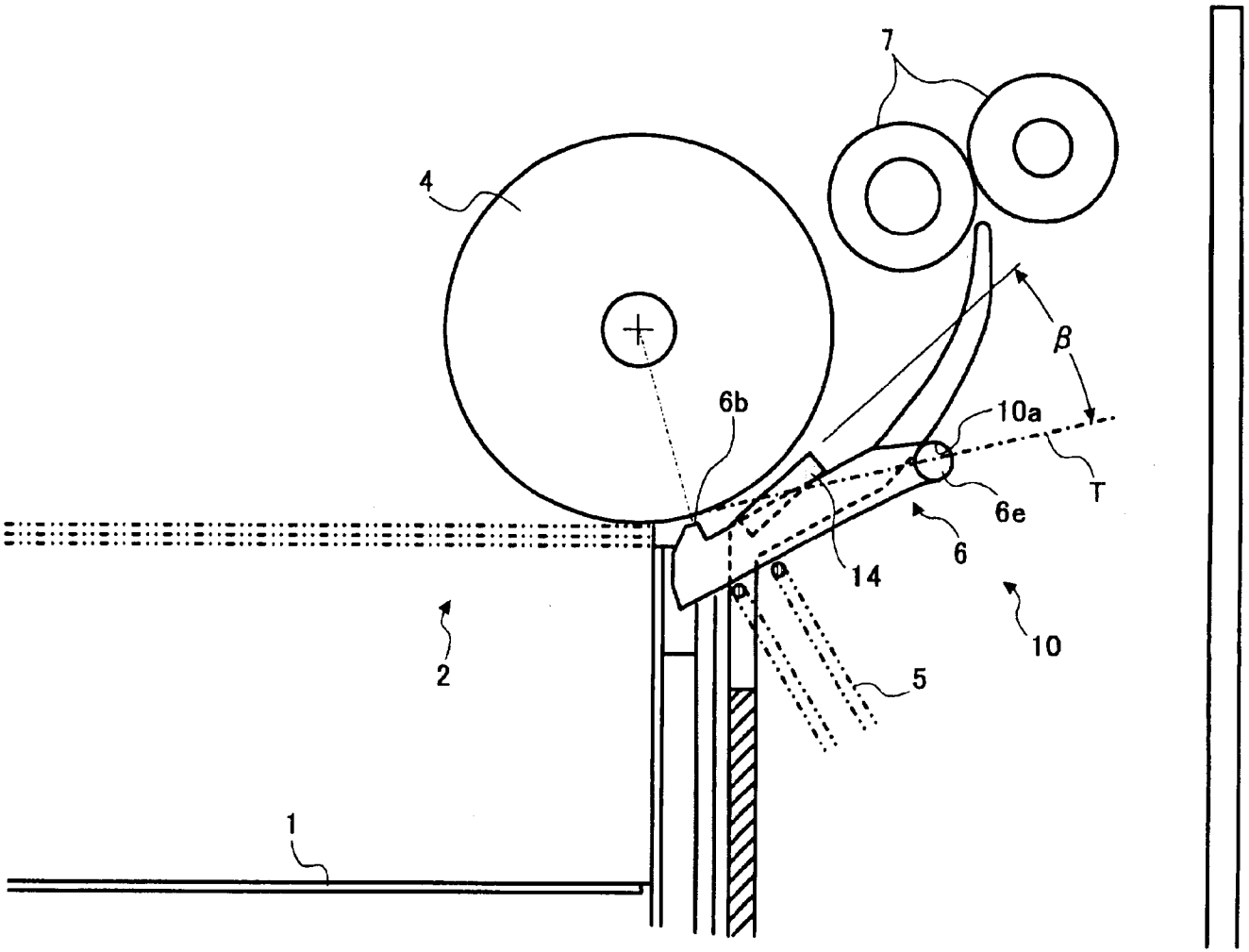
FIG. 29 is a compositional perspective view illustrating the feeder main according to the ninth embodiment disclosed herein, in which a frictional member is used in place of mylar.
Figure 30:
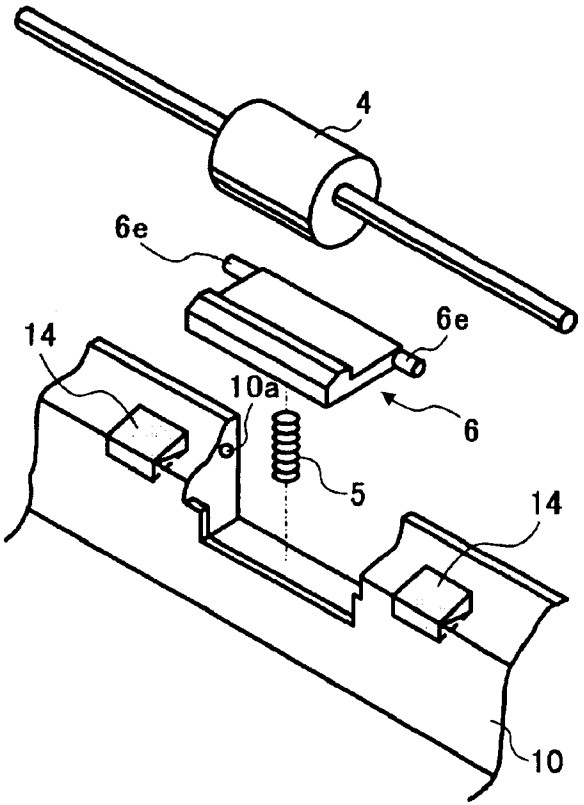
FIG. 30 is a cross sectional view illustrating the feeder main of FIG. 28.

FIGS. 29 and 30 are prepared to illustrate a further structure according to the ninth embodiment disclosed herein, in which a frictional member is used in place of mylar.

In the present embodiment, a pair of planar fictional members 14, 14 is provided being situated on the face of the sheet guide member of feeder main 10 downstream from the contact face 6*b* of taper member on both sides of the taper member 6 to make an angle β between the tangent T to the contact face 6*b*, where the angle β ranges from 20° to 30°. Other portions included in the structure are formed in a similar manner to those shown in FIGS. 22 and 26 with respect to the embodiments 5 and 7, respectively.

Utilizing the above structure, in case two paper sheets simultaneously are forwarded climbing over the contact face 6*b* of taper member 6, the leading edge of the sheets strike the second folded portion 13*b*, whereby the two sheets can be separated. In addition, sounds of touching mylar piece can be eliminated, since no mylar is used in this case.

Figure 31:
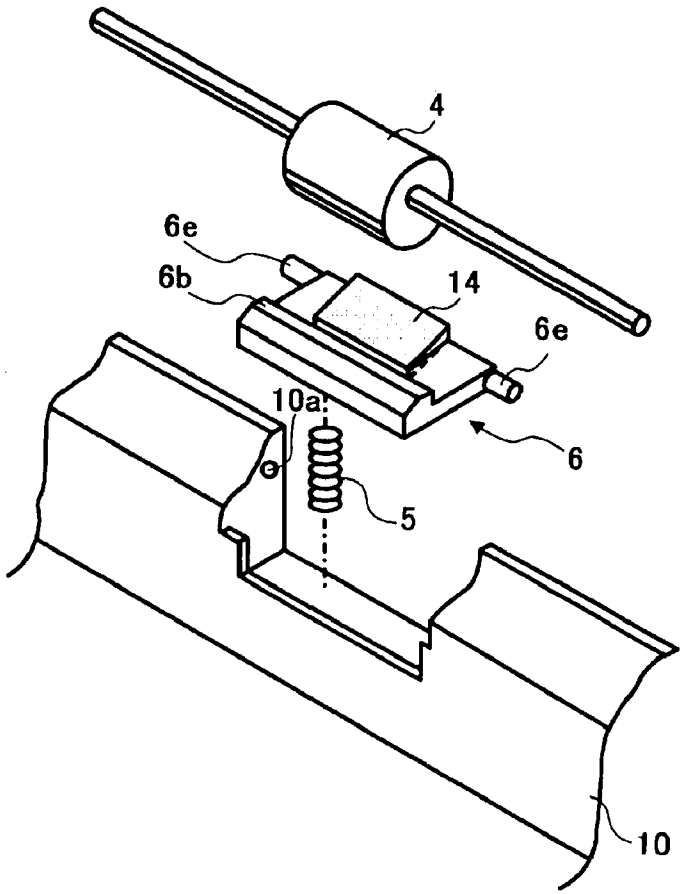
FIG. 31 is a compositional perspective view illustrating the feeder main according to the tenth embodiment disclosed herein, in which a fictional member is situated approximately in the middle of the taper member downstream from the contact face.

FIG. 31 is a compositional perspective view prepared to illustrate still a further structure according to the tenth embodiment disclosed herein, in which a fictional member 14 is provided being situated approximately in the middle of the taper member 6 downstream from the contact face 6*b* of taper member. Other portions included in the structure are formed in a similar manner to those shown in FIGS. 29 and 30 with respect to the embodiment 9.

With the present structure, a possible disadvantage in the ninth embodiment can be obviated. The disadvantage is caused by the alignment of the pair of frictional members which is situated each separated along the path of the sheet materials, or actual points which is in contact with sheet materials is each separated again along the path, to thereby for the second sheet possibly be forwarded.

In addition, the above noted mylar and frictional member may also utilized in combination, in which the multiple feeding of sheet materials is obviated further in a more reliable manner, since two of sheet materials left unseparated by one of the mylar and frictional member may be separated by the other according to the structure according to the present embodiment.

In the sheet material feeding apparatus according to the embodiments 1 through 10, there still persist several difficulties, which will be described herein below.

Namely, in case the sheet separation unit is positioned on the back side of the image forming apparatus viewed from the direction of sheet cassette loading, upon pulling out the cassette from the apparatus when the level of loaded sheet becomes low, a first disadvantage may be caused, in which the base plate subjected to an upward force through a pressing spring, is stuck to units or frame in the apparatus, to thereby the pulling out operation be made difficult.

This difficulty has been prevented so far by providing a guide rail for securely pulling out the cassette without the sticking, or the means for releasing the pressing force, for example, which may result the increase in the number of parts to be used, as well as in the size of the apparatus as a whole.

In addition, the base plate is generally formed of metal plate as well as pressing spring, which necessitates some grounding device. Although this has been implemented by achieving an electric connection between the metal plate and the main chases of the apparatus, this may cause a second disadvantage such as incomplete interconnection by the deformation of the metal plate or dirt on the plate.

Figure 39:
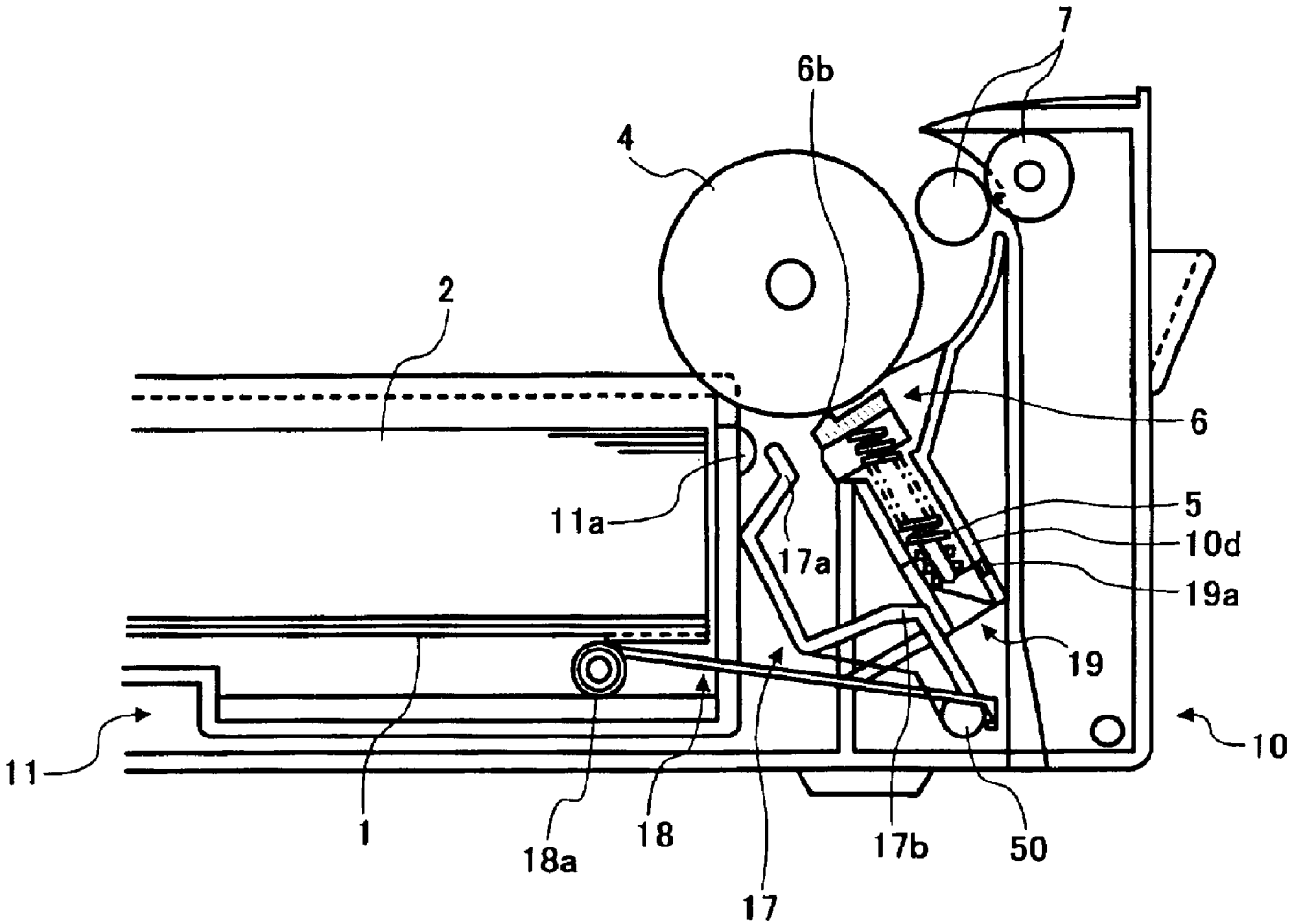
FIG. 39 is another cross sectional view illustrating the feeder main of FIG. 38, in which the cassette is inserted further into the main chases.
Figure 40:
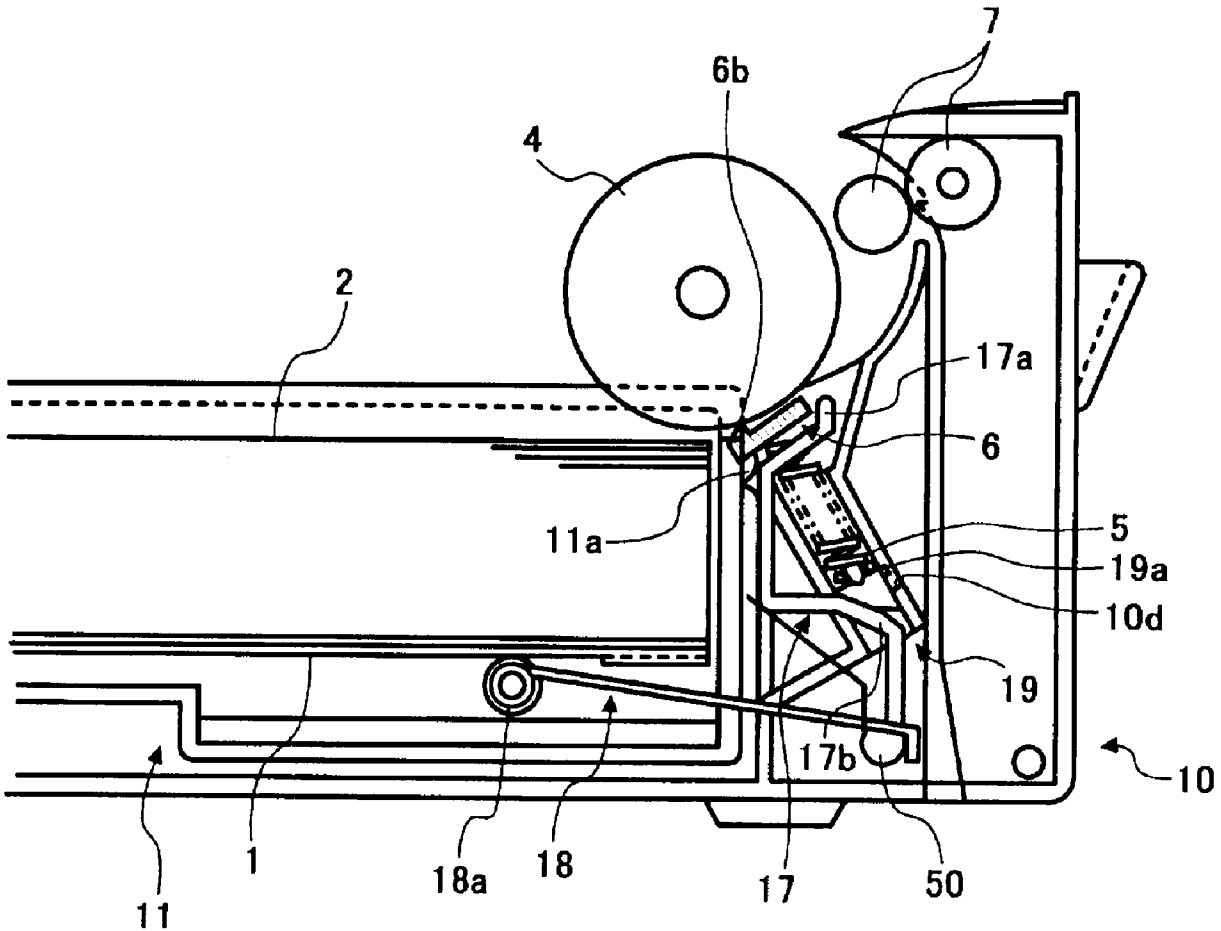
FIG. 40 is still another cross sectional view illustrating the feeder main of FIG. 38, in which the insertion of cassette is completed.
Figure 41:
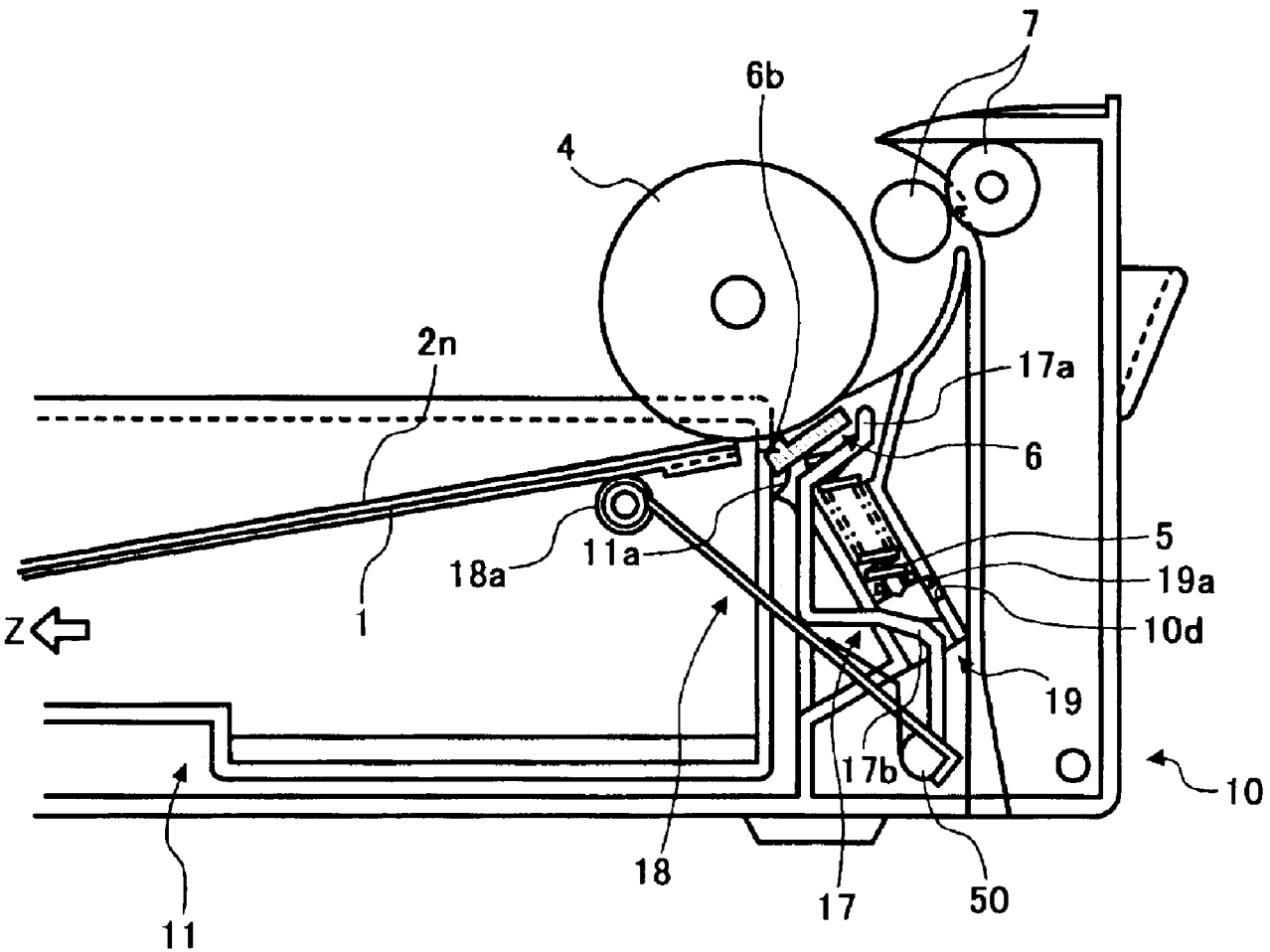
FIG. 41 is another cross sectional view illustrating the feeder main of FIG. 38, in which the number of sheet materials loaded on the base plate is decreased.

FIGS. 32 through 40 are several views illustrating the structure of the feeding unit which is formed to overcome the abovementioned difficulties according to the eleventh embodiment, and FIG. 41 is a compositional perspective view illustrating the relation between the detection lever for detecting the mounting/demounting of cassette and pressing lever for driving the base plate upward.

According to the eleventh embodiment, there provided are a top protruded portion 11*a* formed on a cassette 11, and the protruded portion 11*a* for detecting the mounting/demounting of the cassette 11 corresponding to the protruded portion 11*a*, and the bottom end of the detection lever 17 is engaged oscillatory around a supporting axis 50. In addition, a pair of bent arm portions 17*a*, 17*a* are formed as extensions situated at unfixed end portions of detection lever 17.

Figure 34:
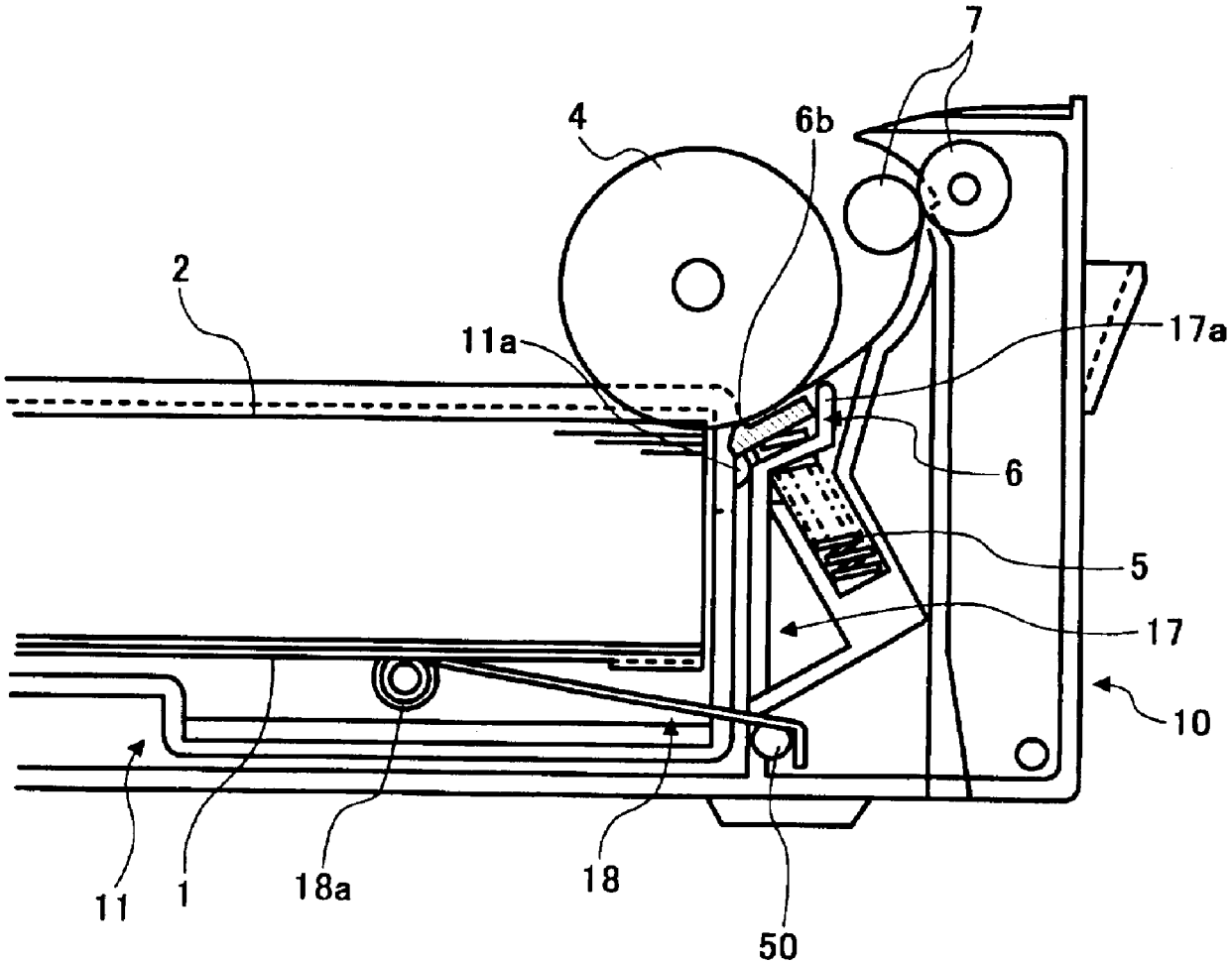
FIG. 34 is still another cross sectional view illustrating the feeder main of FIG. 32, in which the cassette is fully inserted into the main chases.

The thus constructed parts and the detailed form thereof are arranged so that the detection lever 17 is pressed by the top protruded portion 11*a* of cassette 11 when the cassette is fully inserted into the main chases 10 as shown in FIG. 34, and that the pair of bent arm portions 17*a*, 17*a* are situated to pass both sides of the contact face 6*b* of taper member 6 from the left to right as viewed in the drawing.

The bottom portion of the pressing lever 18 is fixed to the supporting axis 50 with a screw at the middle of axial length thereof. In addition, a roller 18*a* is provided being supported at the other unfixed end of pressing lever 18 such that the roller 18*a* may penetrate under the base plate 1.

Further, a pair of torsion springs 51, 51 as elastic member are also provided torsionally engaged with the supporting axis 50 between detection lever 17 and pressing lever 18 (FIG. 37) such that the pressing lever 18 is exerted with an upward pressure so as for the roller 18*a* to exert the feeding pressure to the base plate 1, when the angle between detection lever 17 and pressing lever 18 reaches at a predetermined value.

Other portions included in the structure are formed in a similar manner to those shown in FIGS. 1 and 2, and the coil spring 3 as pressing member in these drawing is herewith abbreviated since the torsion coils 51, 51*d* are provided to apply upward force onto detection lever 17 and pressing lever 18 in the present case.

Figure 32:
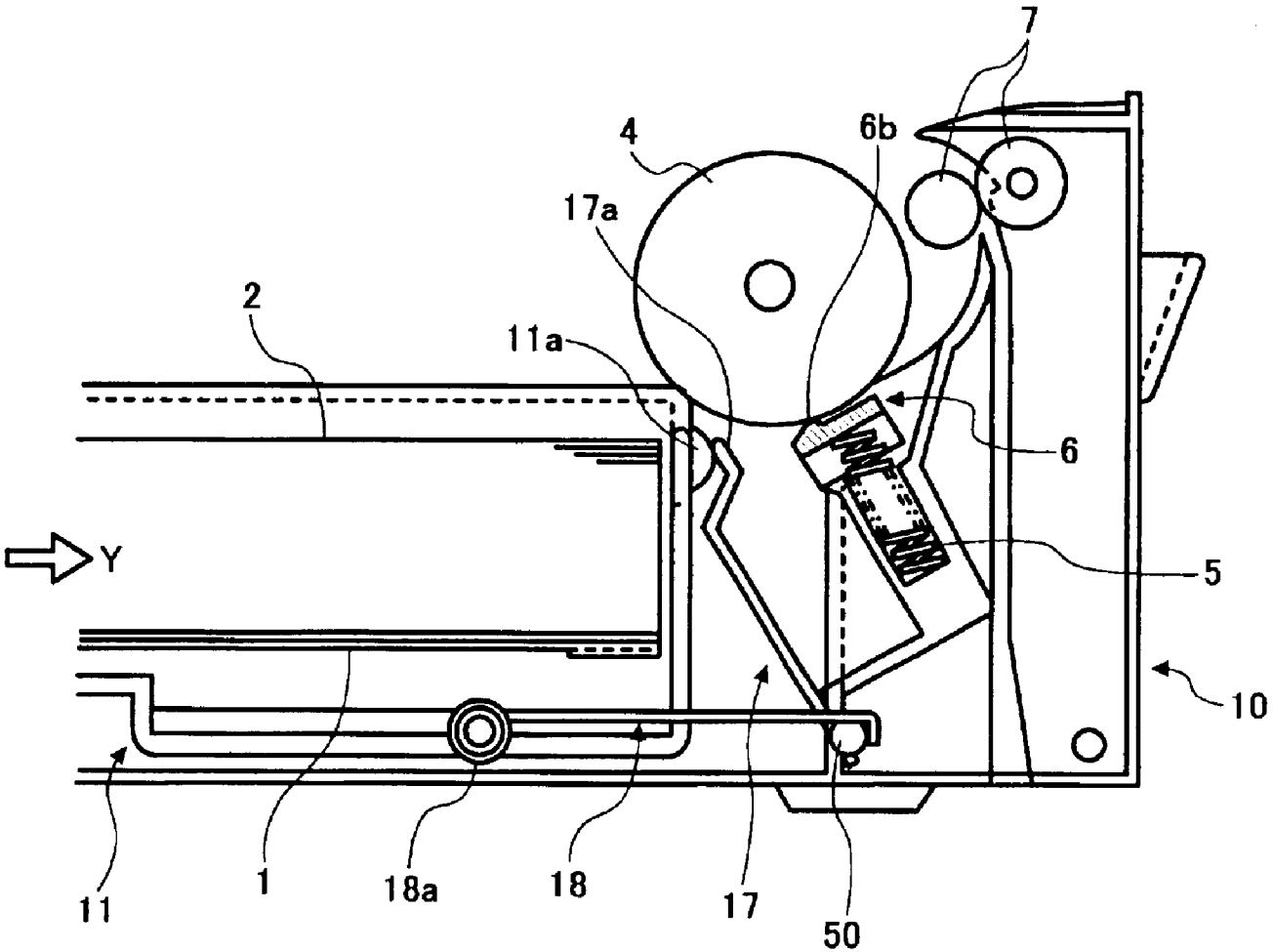
FIG. 32 is a cross sectional view illustrating the feeder main according to the eleventh embodiment disclosed herein, in which the means is provided for securely pulling the base plate out the main frame of the apparatus.

When a predetermined number of sheet materials are loaded on the base plate 1 with the thus prepared structure of the feeding unit, the base plate 1 is lowered as shown in FIG. 32 owning to its own weight to remain at its horizontal state.

Upon inserting the cassette 11 into the main chases 10 from the Y direction in the drawing retaining the horizontal state, the detection lever 17 is pressed by the top protruded portion 11*a* of cassette to thereby rotate the detection lever 17 clockwise around the supporting axis 50.

Figure 33:
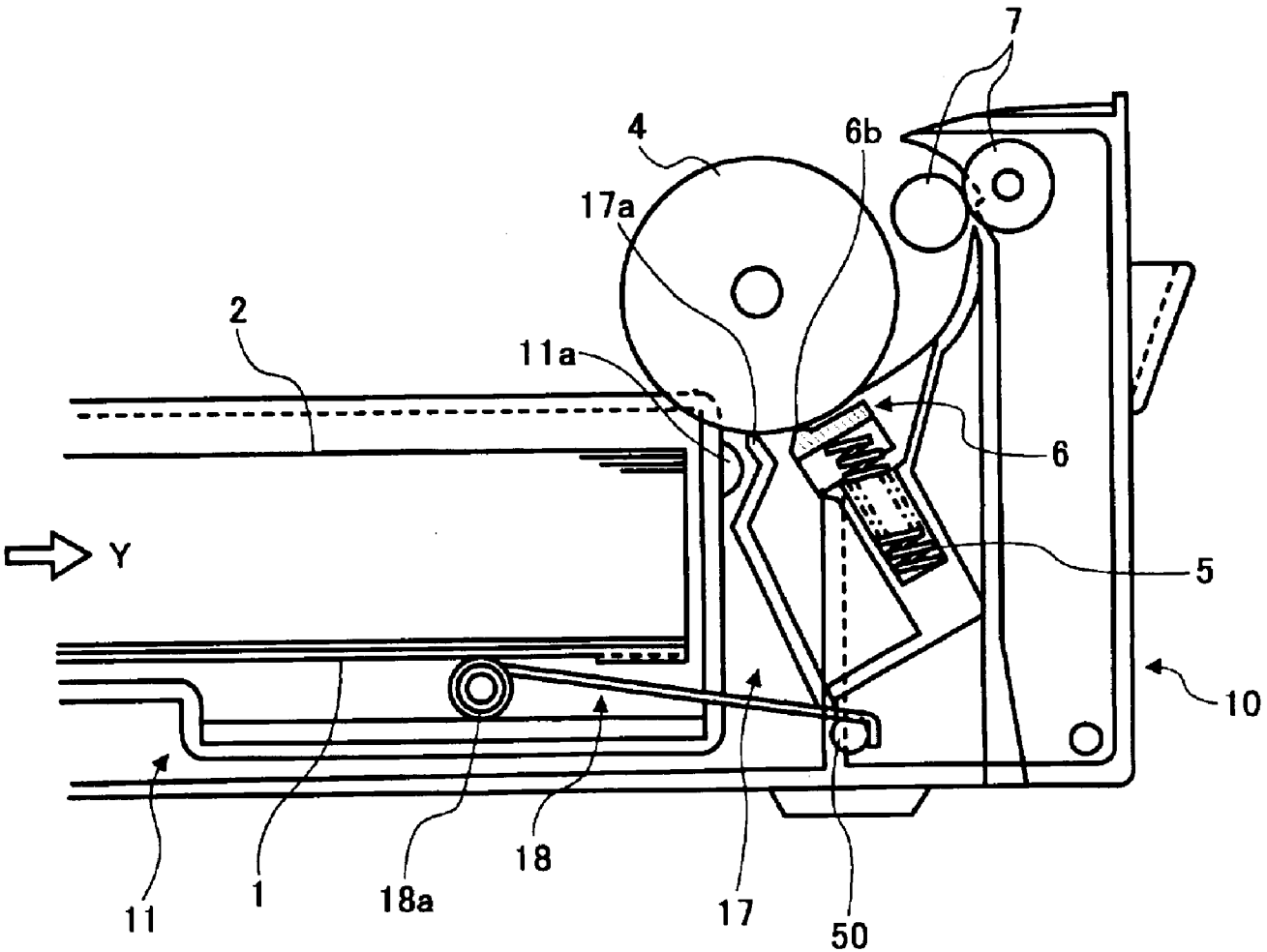
FIG. 33 is another cross sectional view illustrating the feeder main of FIG. 32, in which the detection lever is rotated to a predetermined position.

When the detection lever 17 is rotated to the position shown in FIG. 33 to make a predetermined angle between the pressing lever 18, the pressing force by the torsion springs 51, 51 starts to be generated, the pressing lever 18 rotates, and then the roller 18*a* is brought into contact to the lower face of the base plate 1.

When the cassette 11 is fully inserted into the main chases 10 as shown in FIG. 34, the pressing force from the torsion spring 51 increases to reach a predetermined feeding pressure. At the same time, a boss (not shown) is inserted groove formed on the side of the main chases 10 by a known cassette engaging means, to thereby the cassette 11 be held at the inserted position.

Figure 35:
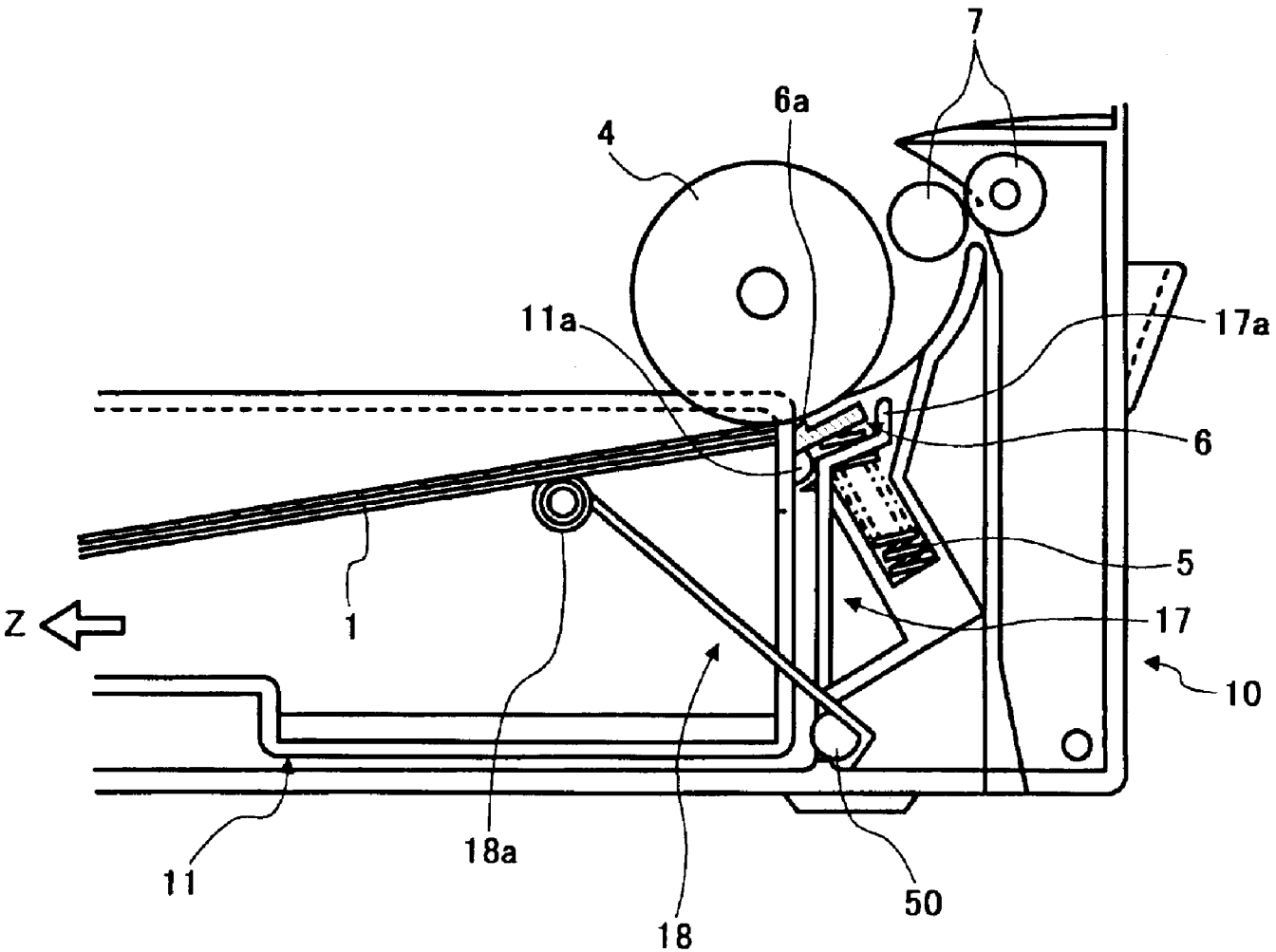
FIG. 35 is another cross sectional view illustrating the feeder main of FIG. 32, in which the number of sheet materials loaded on the base plate is decreased.

Subsequently, as image forming steps continues, the number of sheet materials 2 loaded on the base plate 1 decreases as shown in FIG. 35. In order to replenish sheet materials the cassette engaging means is released to be pulled out in the Z-direction in the drawing, and the contact of the protruded portion 11*a* to detection lever 17 is released.

Figure 36:
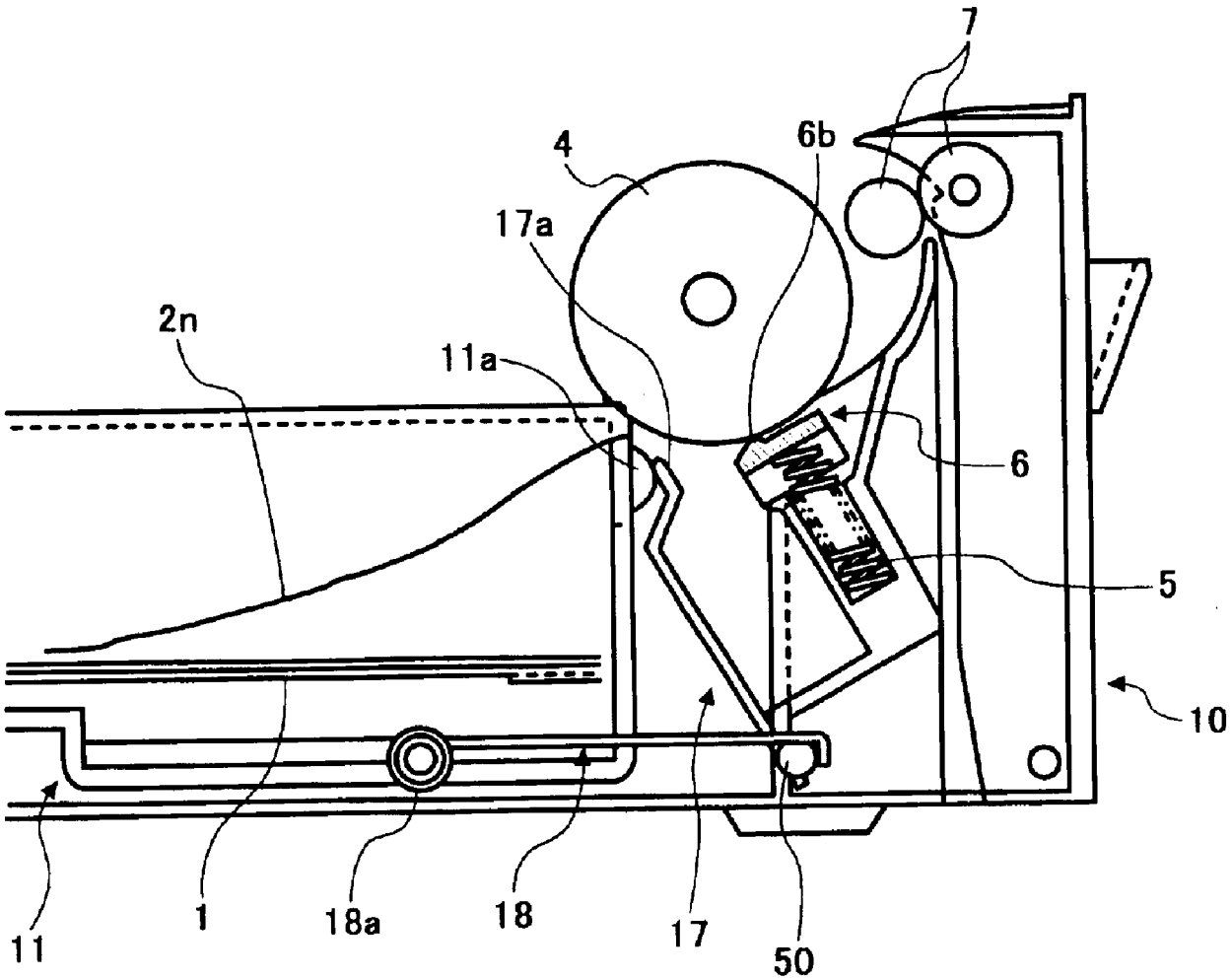
FIG. 36 is another cross sectional view illustrating the feeder main of FIG. 32, in which the base plate is lowered by the force from own weight.
Figure 37:
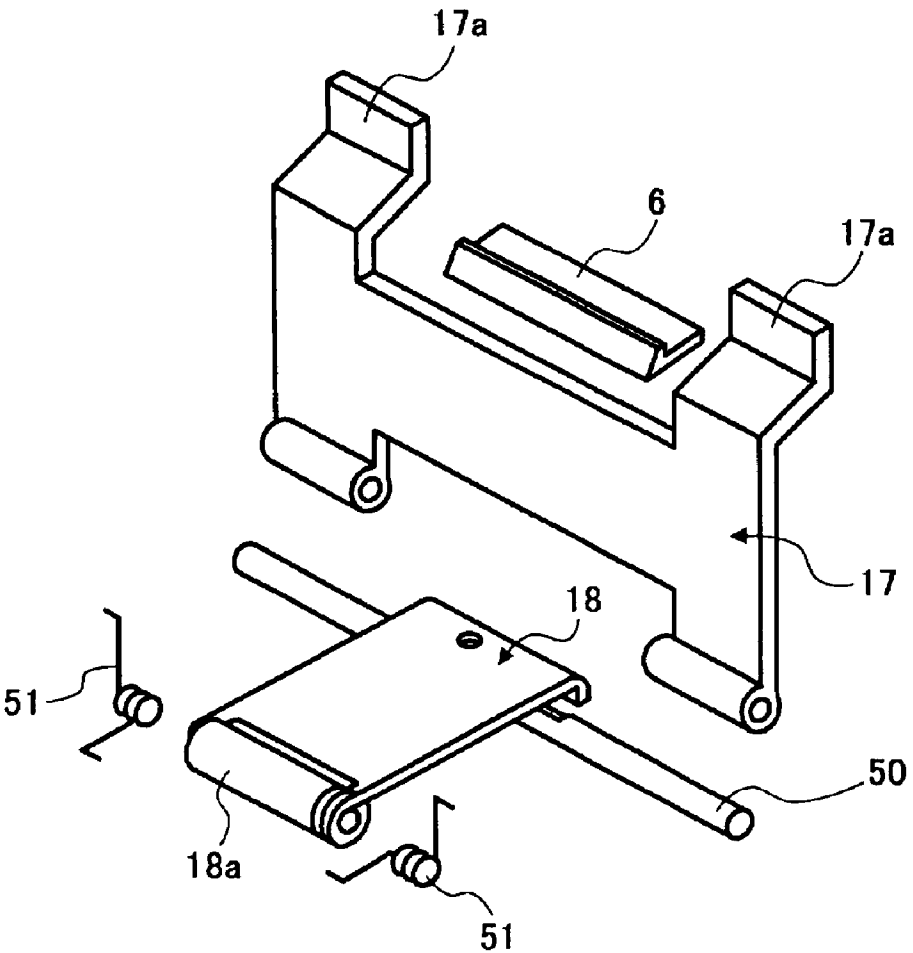
FIG. 37 is a compositional perspective view illustrating the feeder main of FIG. 32.

As the detection lever 17 subsequently rotates by the force from the torsion spring 51, the pressing force from the torsion spring 51 also decreases. As a result, the detection lever 17 rotates counterclockwise by the force from own weight, the base plate is lowered again by the force from own weight, as shown in FIG. 36.

During these steps, a sheet material 2*n* remaining in the cassette upstream of the nip portion and feeding roller 4 is clear of worry of staying inside, since the sheet is scraped out by the arm portion 17*a* to be forwarded onto cassette 11 and pulled out from the main chases 10.

In addition, since the detection lever 17 is made of metal plate itself, no additional grounding means is necessary there needs, and the grounding interconnection between the main chases 10 can be secured with relative ease.

During the pulling-out steps for the cassette 11 in the embodiment 11 as described just above, since the edge of the next sheet is nipped between feeding roller 4 and taper member 6, there may cause difficulty, in that the sheet materiel may be torn and both ends portions thereof be pulled out when scraped out by the arm portion 17*a*, leaving the nipped portion thereof in the nip portion.

Figure 42:
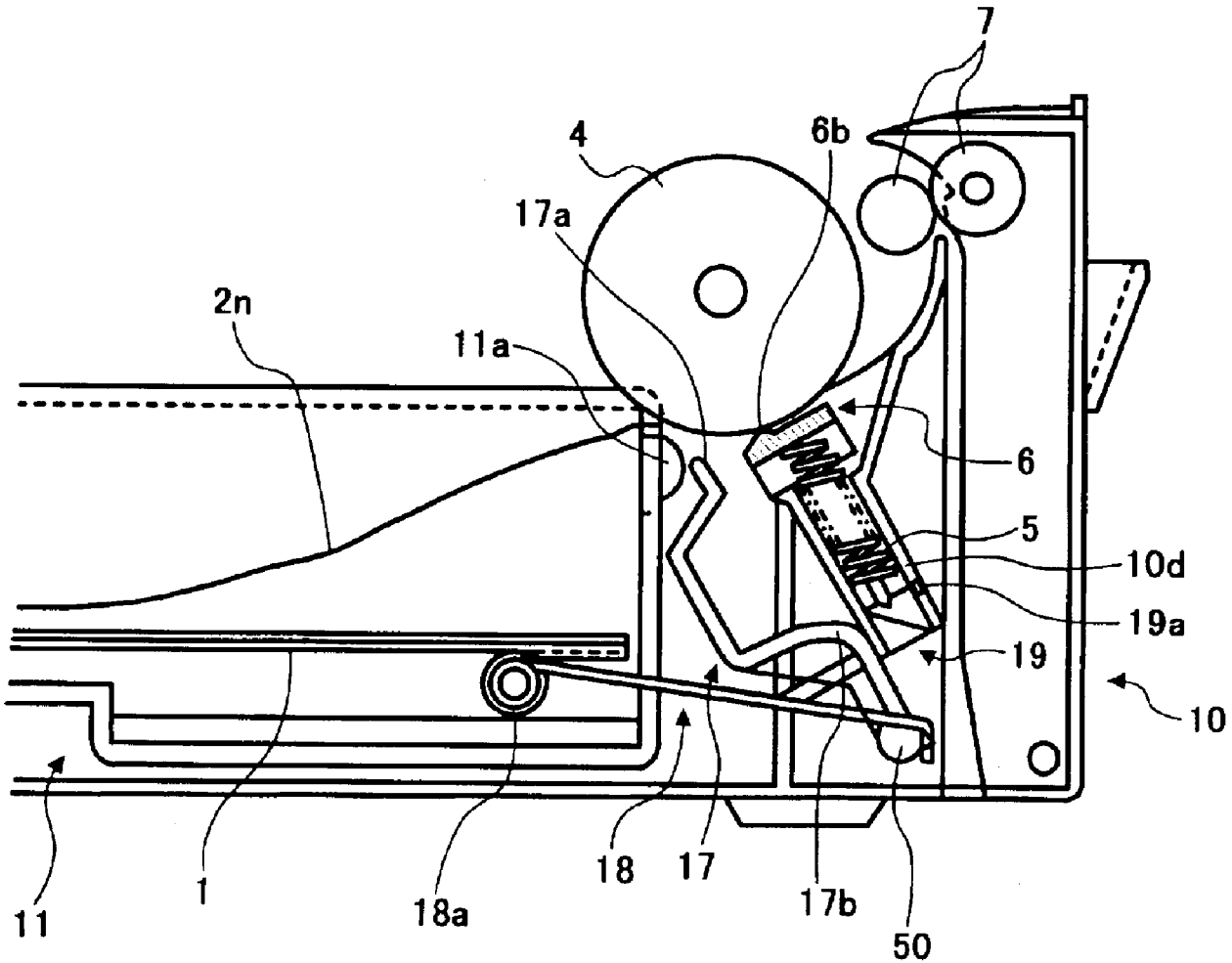
FIG. 42 is another cross sectional view illustrating the feeder main of FIG. 38, in which the sheet material remaining in the cassette is scraped out by the arm portion.
Figure 43:
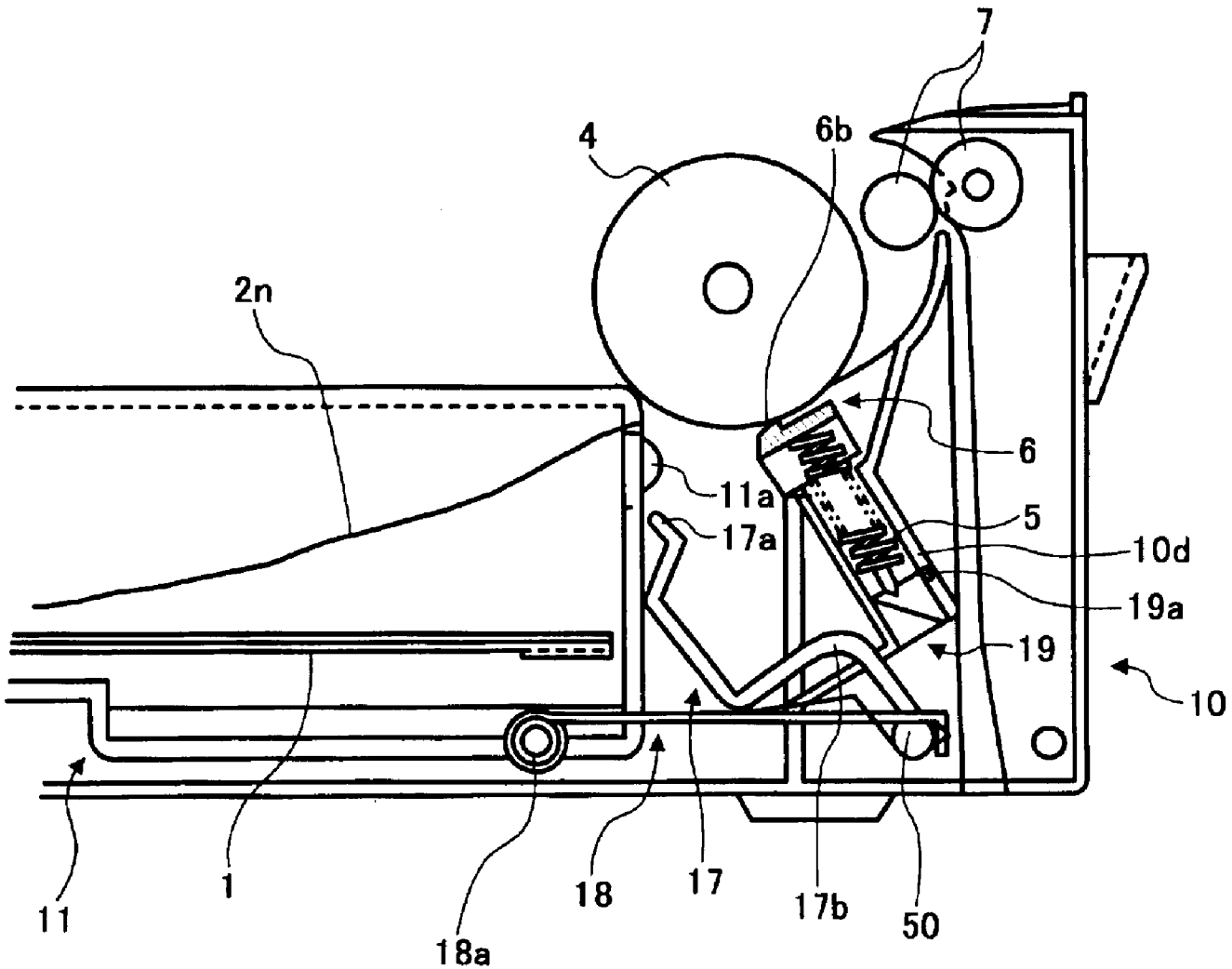
FIG. 43 is another cross sectional view illustrating the feeder main of FIG. 38, in which the base plate is lowered by the force from own weight.
Figure 44:
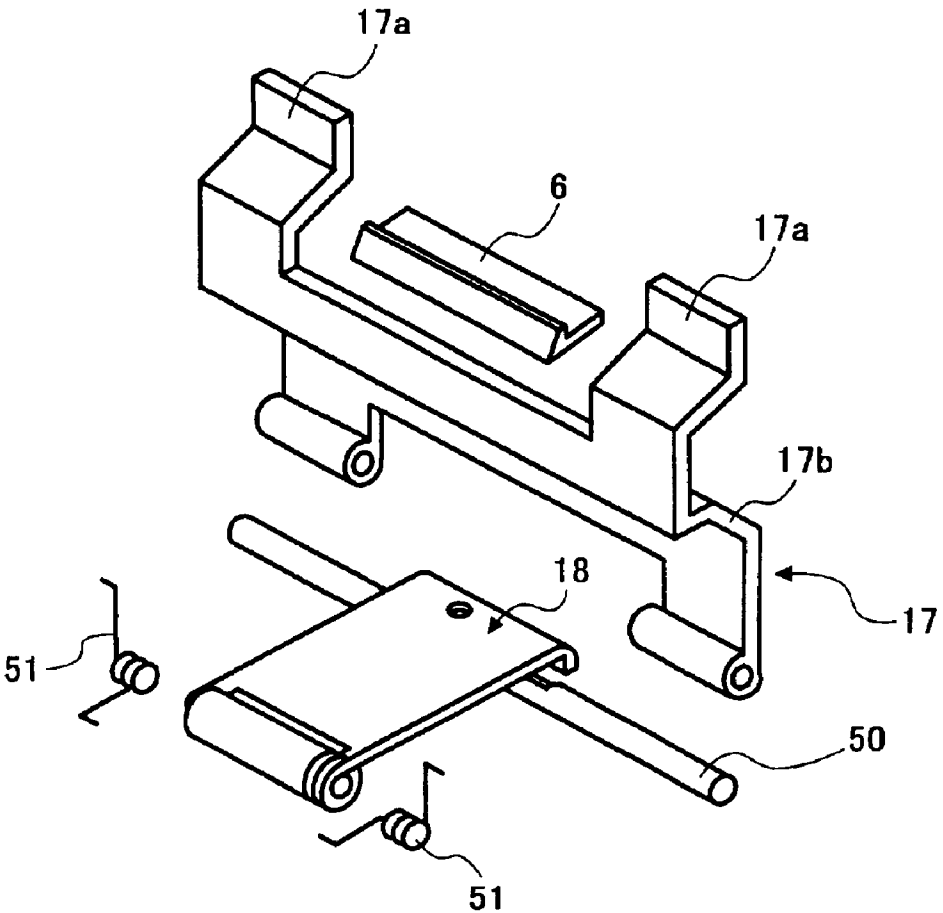
FIG. 44 is a compositional perspective view illustrating the feeder main of FIG. 38.

FIGS. 38 through 43 are cross section views of the main parts of the feeding unit which is formed to overcome the abovementioned difficulty according to the twelfth embodiment, and FIG. 44 is a compositional perspective view illustrating the relation between the detection lever for detecting the mounting/demounting of cassette and pressing lever for driving the base plate upward.

According to the twelfth embodiment, a spring receptor 19 with its cross section being the shape of right triangle, is provided slidably along the axial direction of the compressed spring 5 by means of a guide pin 19*a* and guide groove 10*d* under the compressed spring 5 formed for applying the separation pressure onto taper member 6.

In addition, the supporting axis 50 for supporting both detection lever 17 and pressing lever 18 in common is positioned being displaced toward the right as viewed in the drawing. Further, a folded portion 17*b* is formed on the detection lever 17 close to the supporting axis 50 to be detachable to the slope of the spring receptor 19, whereby a variable spring pressure unit is constituted with the folded portion 17*b*.

Other portions included in the structure are formed in a similar manner to those of the embodiment 11 with reference to FIGS. 32 through 37.

Figure 38:
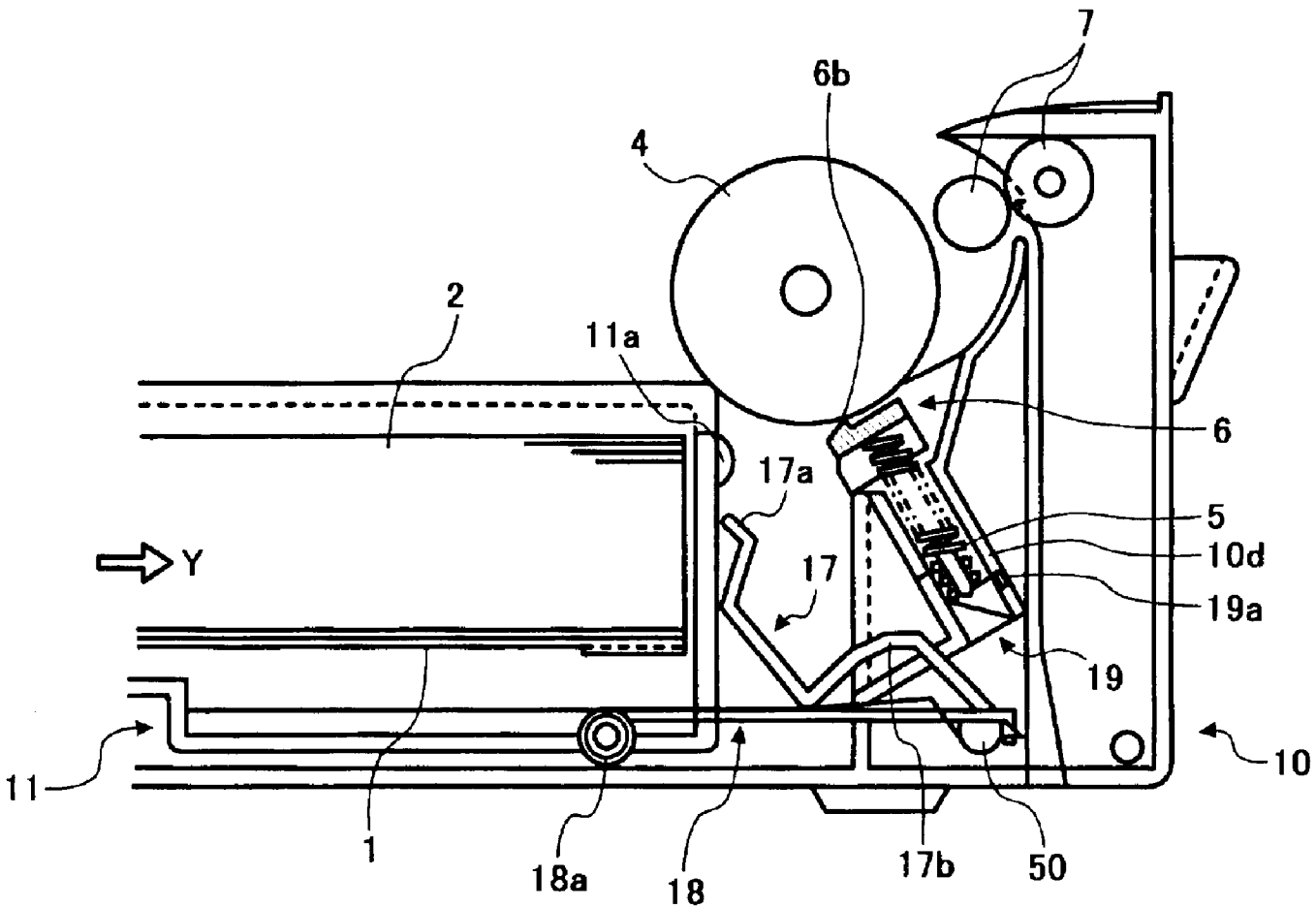
FIG. 38 is a cross sectional view illustrating the feeder main according to the twelfth embodiment disclosed herein, in which the means is provided for preventing for the torn portion of sheet materiel being left in the nip portion.

In the present embodiment, in the midst of inserting operation for the cassette 11 into the main chases 10 in the Y-direction with sheet materials loaded as shown in FIG. 38, the folded portion 17*b* formed on the detection lever 17 is situated being removed from the slope of spring receptor 19.

As a result, the spring receptor 19 is lowered and the compressed spring 5 is retained at non-compressed state, and the contact face 6*b* of taper member 6 is situated slightly removed from the feeding roller 4.

When the cassette 11 is inserted further into the main chases 10 as shown in FIG. 39, the detection lever 17 is pressed by the frontal face of the cassette 11 to be rotated clockwise in the drawing, and the roller 18*a* is brought into contact with the lower face of the base plate 1. The folded portion 17*b* of detection lever 17 still remains as removed at this moment from the slope of spring receptor 19.

When the insertion of cassette 11 is completed into the main chases 10 as shown in FIG. 40, the detection lever 17 is rotated further clockwise and the folded portion 17*b* of detection lever 17 is brought into contact with, and slides on, the slope of spring receptor 19.

As a result, the pressing force from the compressed spring 5 increases and the contact face 6*b* of taper member 6 is pressed toward feeding roller 4, to thereby for separation pressure to be generated. In this instance, the pair of bent arm portions 17*a*, 17*a* of detection lever 17 is situated to pass both sides of the contact face 6*b* of taper member 6 as earlier described in the eleventh embodiment.

As image forming steps continues, the number of sheet materials 2 loaded on the base plate 1 is decreased as shown in FIG. 41. In order to replenish sheet materials the cassette is then pulled out along the Z-direction, and the contact of the protruded portion 11*a* to detection lever 17 is released. As the detection lever 17 subsequently rotates by the force from the torsion spring 51, the folded portion 17*b* of detection lever 17 is removed from the slope of spring receptor 19, and the pressing force from the torsion spring 51 also decreases.

As a result, the taper member 6 is lowered by the force from own weight and separated from the feeding roller 4, and the edge of the sheet material 2*n* nipped between feeding roller 4 and taper member 6 is released from the nipping. At the same time, the sheet material 2*n* remaining in the cassette is scraped out by the arm portion 17*a*, as shown in FIG. 42.

When the cassette 11 is pulled out further, the pressing force from the torsion spring 51 is decreased. As a result, the detection lever 17 rotates counterclockwise by the force from own weight, the base plate is lowered again by the force from own weight, as shown in FIG. 43.

With the present structure according to the twelfth embodiment, the pressing force from the taper member 6 can be released and the left-out sheet materials can be removed without increasing the number of parts to be added, whereby non-feeding of sheet materials can be prevented more securely.

In the abovementioned sheet material feeding apparatus according to the embodiments 1 through 12, the feeding apparatus has been described as being capable of loading a relatively small number of sheet materials such as, for example, about 500 sheets at most, on the base plate 1 in the cassette 11, one of the end portions thereof is pivotably supported by a supporting axis 1*a*, and the other edge of which is free to be continually pressed upward with a pressing force exerted by a coiled spring 3 attached to the cassette 11.

In contrast, other examples are found of feeding apparatuses having the capability of loading sheet materials as large as, for example, 1000 sheets or more. Because of the increased weight of sheet materials in such apparatuses, there encountered is a difficulty in elevating the sheet loading member by the above noted pressing means such as coil spring.

This difficulty has been obviated by elevating the sheet loading member at its horizontal state by means of motor driving to a predetermined feeding position, detecting the position by a sheet level detecting means, and then halting driving of the motor, thereby retaining the position of the sheet loading member.

In such a case, the pressurization from the side of the feeding roller becomes necessary for generating the feeding force exerted onto sheet material by means of feeding roller 4, and own weight of the feeding roller is generally utilized for the pressurization.

As described earlier on the construction of the feeding apparatus disclosed herein in reference to the first embodiment, it is preferable that both sheet material 2 and taper member 6 are pressed against one feeding roller 4, and that both the distance K in the sheet forwarding direction between the points, X and N, of pressed contact with feeding roller 4, and the angle $\theta_2$ between the tapered face 6*a* of taper member 6 and the sheet forwarding direction, are suitably adjusted in certain ranges.

When the above requirement is applied further to the present case of a large number of sheets so as to retain proper separation pressure Q through compressed spring 5 of taper member 6, the generation of the feeding force by the feeding roller 4 becomes difficult.

As a result, the separation method by means of the taper member has been abandoned in general, and another separation method is adopted, utilizing a forwarding roller in combination with a separation reverse roller.

Figure 45:
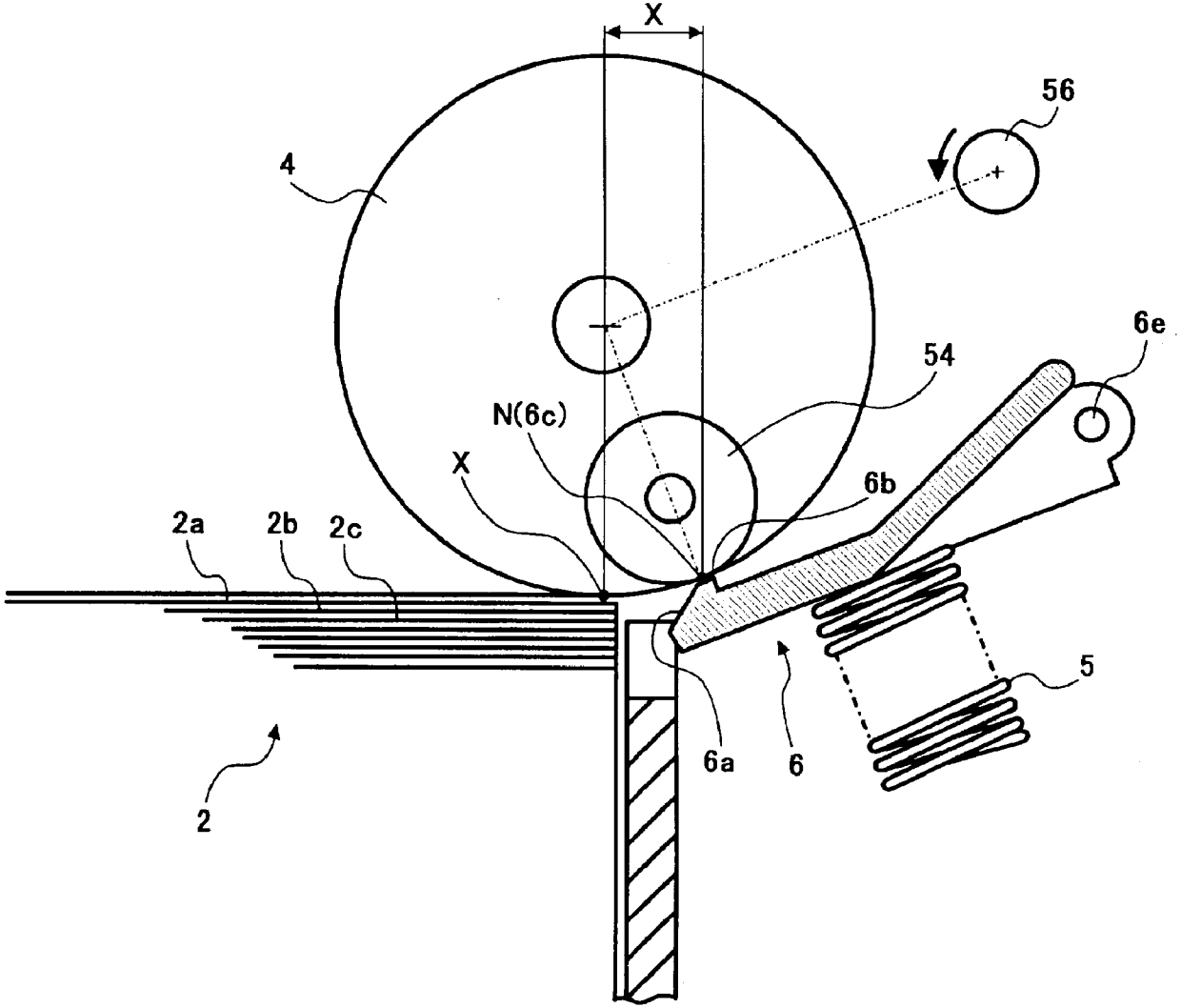
FIG. 45 is a cross sectional view illustrating the structure of the feeding unit adapted to handling a relatively large number of sheet materials according to the thirteenth and fourteenth embodiments.
Figure 46:
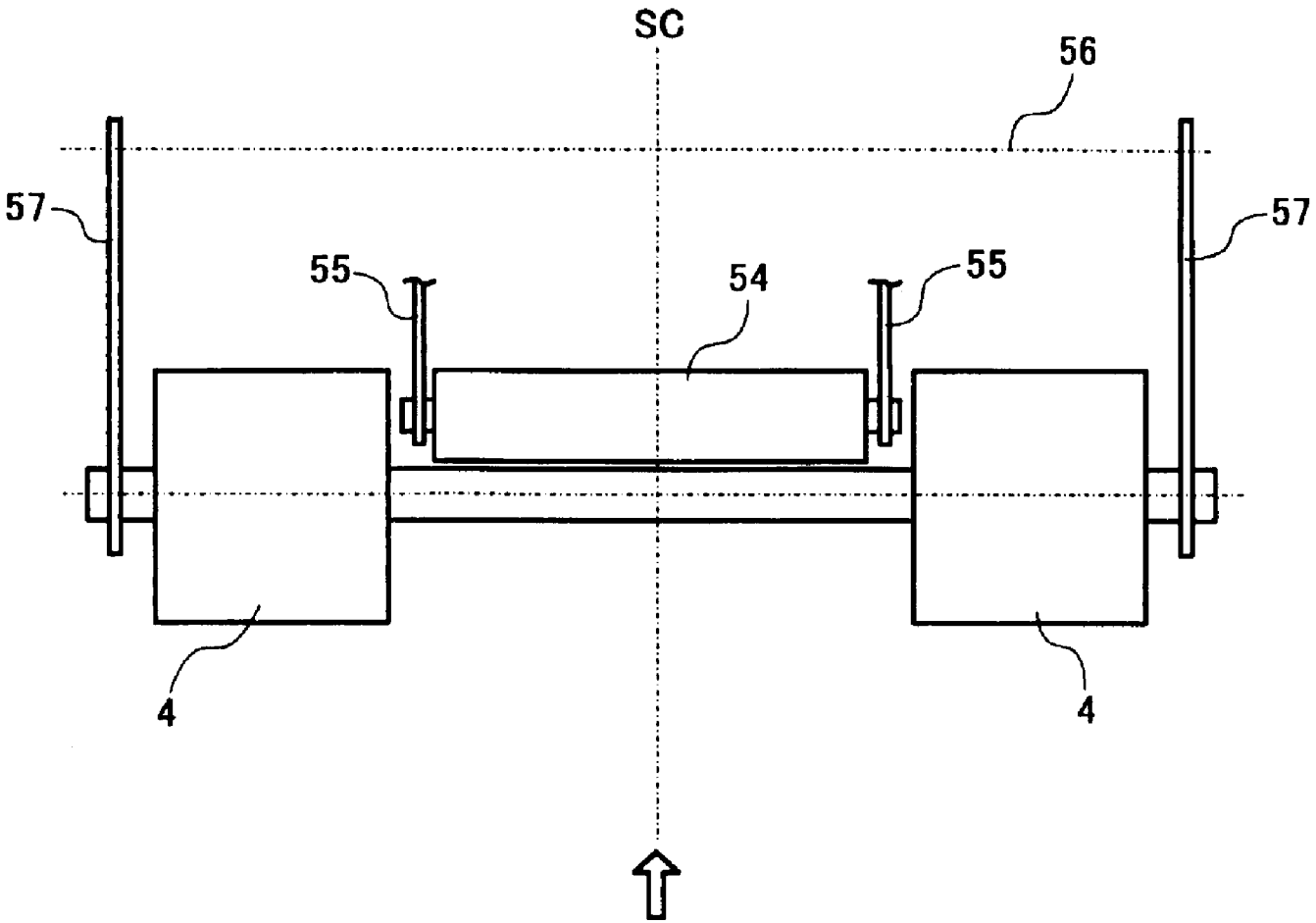
FIG. 46 is a plan view illustrating the structure of the feeding unit according to the thirteenth embodiment, in which a further separation roller different from the feeding roller is provided downstream from the contact point X between feeding roller and sheet material at the nip forming location N.
Figure 47:
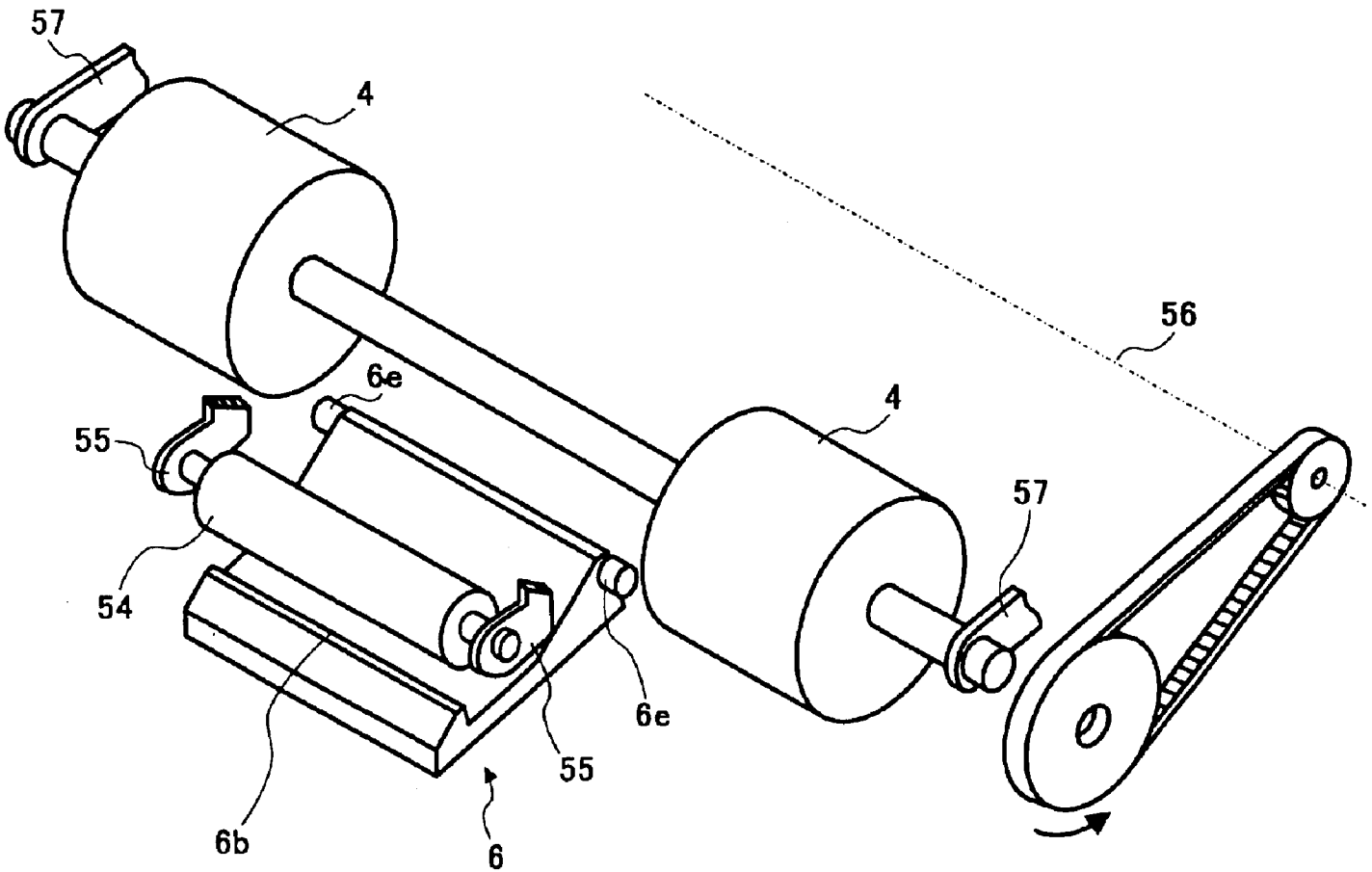
FIG. 47 is a compositional perspective view of FIG. 46.
Figure 48:
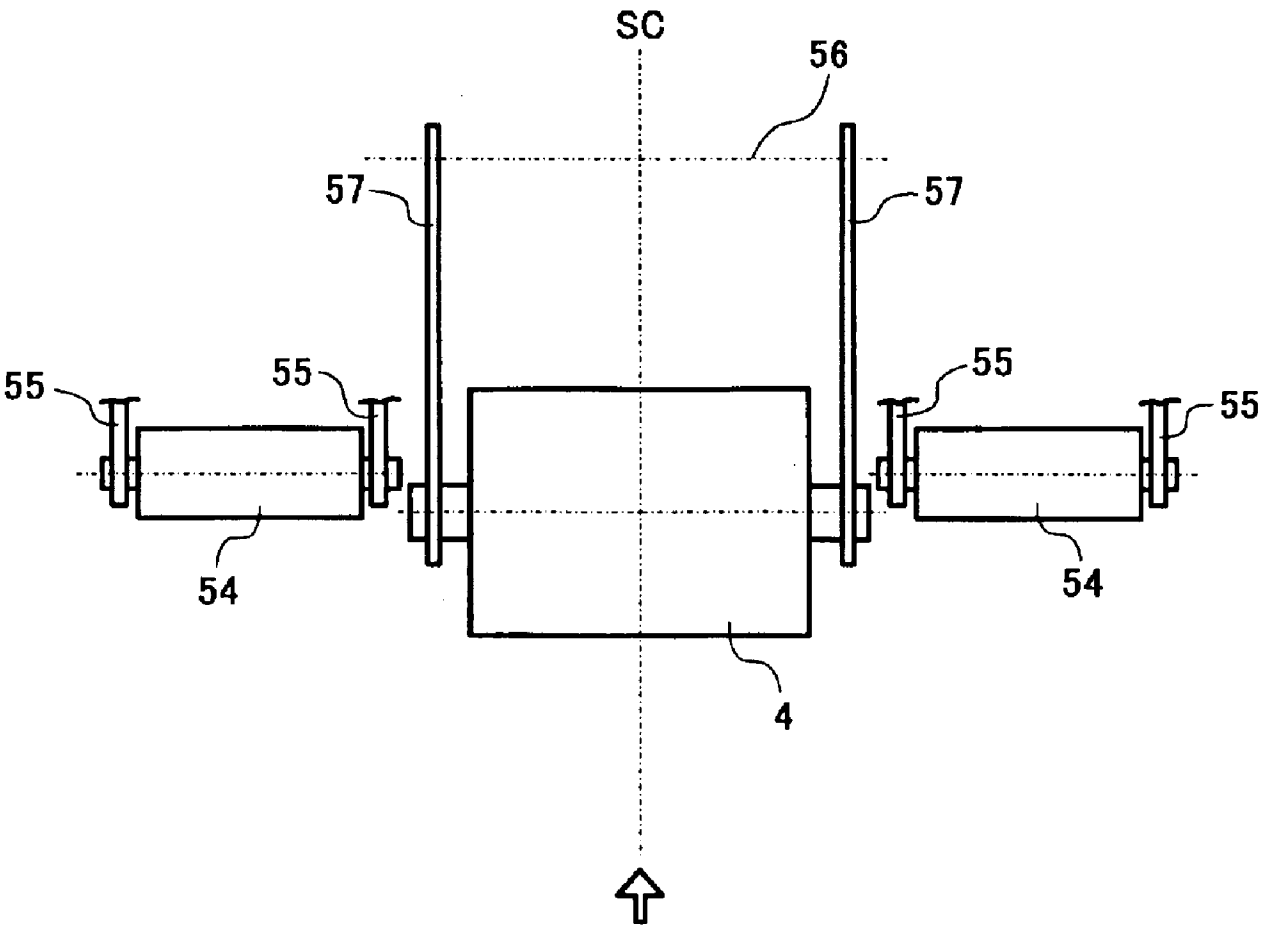
FIG. 48 is a plan view illustrating the structure of the feeding unit according to the fourteenth embodiment, in which the feeding roller is supported by a pair of fixed bearings so as to be placed in the middle of the width of sheet feeding, a pair of taper members are provided on the both sides of the feeding roller, and a pair of separation rollers each corresponding to the taper members are supported oscillatory by fixed bearings.
Figure 49:
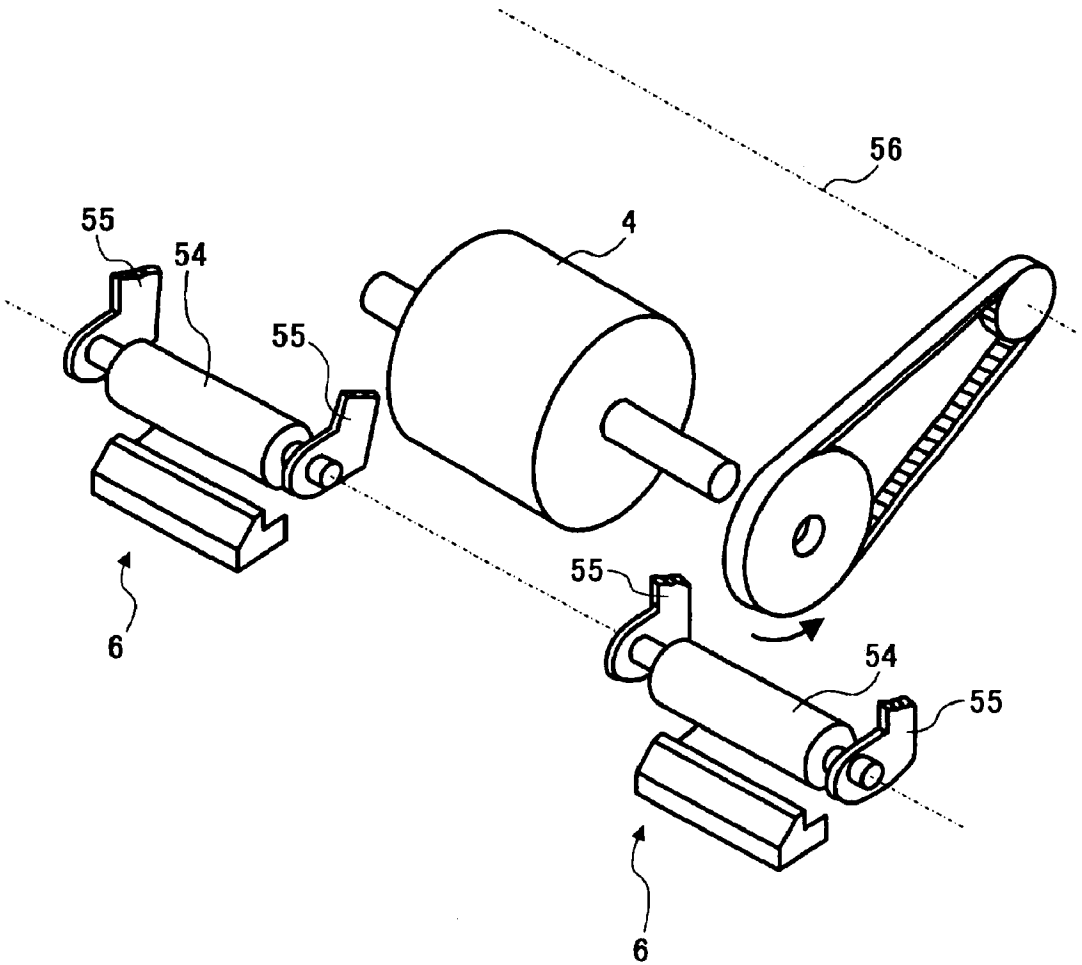
FIG. 49 is a compositional perspective view of FIG. 48.

FIGS. 45 through 49 are several views illustrating the structure of the feeding unit which is formed to overcome the abovementioned difficulties in handling a relatively large number of sheet materials according to the thirteenth and fourteenth embodiments, FIG. 45 is a longitudinal cross sectional view of several components used in common in these embodiments, FIGS. 46 and 47 are plan and compositional perspective views, respectively, according to the thirteenth embodiment; and FIGS. 48 and 49 are plan and compositional perspective views, respectively, according to the fourteenth embodiment.

As shown in FIGS. 45 through 47 in reference to the present embodiment, a further separation roller 54 different from the feeding roller 4 is provided downstream from the contact point X between feeding roller 4 and sheet material 2 at the nip forming location N with the tailing edge 6*c* of taper member 6*a*.

As shown in FIG. 46, the separation roller 54 is then supported by a pair of fixed bearings 55, 55 each attached to main chases 10 (FIG. 2) so as to be placed in the middle of the width of sheet feeding, which is perpendicular to sheet feeding direction (i.e., the same direction as the aforementioned sheet forwarding direction S) to be symmetric with respect to the center line SC of the feeding width.

In addition, the taper member 6 is supported oscillatory around an axis 6*e* as shown in FIG. 47, and the contact face 6*b* thereof is brought into contact with the separation roller 54, whereby a separation component is formed in the present embodiment.

Furthermore, a pair of feeding rollers 4, 4 are provided on both, sides of the separation roller 54 to be supported by an axis 56 which is further supported oscillatory by a pair of movable bearing 57, 57 (FIG. 46). The separation roller 54 is then operated to transfer counterclockwise rotation of the separation roller 54 generated from a drive motor (not shown) thorough a belt to the feeding rollers 4, 4, and to exert feeding pressure from their own weight to the sheet material which is then forwarded to the separation component.

Incidentally, the pair of feeding rollers 4, 4 are also arranged to be symmetric with respect to the center line SC of the feeding width, as shown in FIG. 46, and other portions of the feeding unit and separation parameters therewith are formed in a similar manner to those mentioned earlier in the first embodiment.

When a large number of sheet materials 2 are elevated to a predetermined feeding position by sheet loading member (not shown), the sheet materials 2 are pressed by the pair of the feeding rollers 4, 4 from their own weight, and a plurality of sheet materials are forwarded to the separation component by counterclockwise rotation of also feeding rollers 4, 4, separated sheet by sheet by the separation roller 54 positioned in the separation component and the taper member 6 compressed thereto, and then forwarded to the image forming unit (not shown).

According to the present thirteenth embodiment, even in the sheet feeding unit which is provided with the sheet loading member capable of loading a large number of sheet material, and of being elevated still retaining its horizontal state, the taper member can be used as one having relative simple construction and excellent separation characteristics by only providing additionally the separation roller 54 disclosed herein in place of rather complicated previous structure consisting of forwarding roller in combination with separation reverse roller. In addition to the excellent separation characteristics, the number of parts to be used in the present structure can be reduced.

It maybe added further, in place of rubber used for forming separation roller 54, synthetic resinous materials conventionally used may alternatively be utilized such as, for example, polyacetal POM, having excellent properties such as high crash proof, heat resistance, chemical proof, and weathering resistance.

Even such materials as mentioned above are used, the relation between the aforementioned two forces remain unchanged, in which these forces is the feeding force, which is exerted by the feeding roller 4, 4 for the uppermost sheet material 2*a* to climb over the taper member 6, and the other is generated by the friction between the uppermost sheet material 2*a* and the next sheet material 2*b*.

Figure 7:
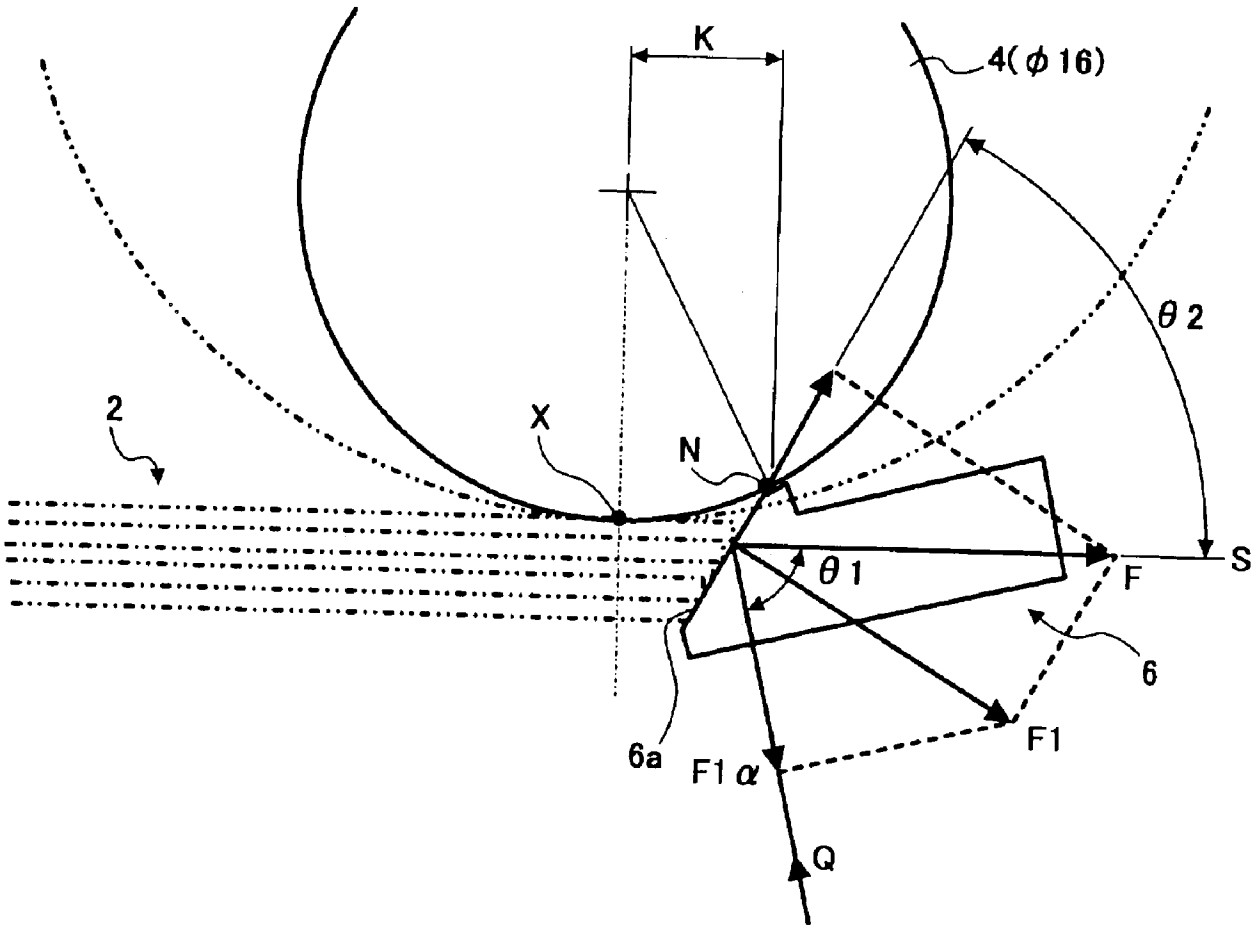
FIG. 7 is prepared to illustrate the distance K in sheet forwarding direction between the point X of pressed contact for the uppermost sheet material loaded on the base plate to feeding roller and the point N of contact for the feeding roller 4 with the tailing edge.

In addition, the distance K in the sheet forwarding direction between the points, X and N, of pressed contact with feeding roller 4, is set to be the same as that shown in FIG. 7. As result, sheet separation characteristics are retained and parts cost can be reduced for the separation roller as well.

In the next place, the fourteenth embodiment will be described referring to FIGS. 48 and 49, in which the feeding roller 4 is supported by a pair of fixed bearings 57, 57 so as to be placed in the middle of the width of sheet feeding, a pair of taper members 6, 6 are provided on the both sides of the feeding roller 4, and a pair of separation rollers 54, 54 each corresponding to the taper members 6, 6 are supported oscillatory by fixed bearings 55, 55. The feeding roller 4 and separation rollers 54, 54 formed on both sides thereof are aligned to be symmetric with respect to the center line SC of the feeding width.

Incidentally, other portions of the feeding unit and separation parameters therewith are formed in a similar manner to those mentioned earlier in the thirteenth embodiment, and synthetic resinous materials conventionally used may be utilized for forming separation roller 54 in place of rubber in the present fourteenth embodiment as well.

In addition, although two of each of the taper member and separation roller are provided in the present embodiment, overall machine cost can be reduced still, since the part formed of rubber is feeding roller 4 only, when the separation roller 54 is formed of synthetic resinous materials.

Furthermore, it may be noted, by substituting the feeding roller pressed to taper member 6 for the separation roller in the thirteenth and fourteenth embodiments, operation steps afore described embodiments 2 through 12 can be suitably carried out.

In the abovementioned sheet material feeding apparatus according to the embodiments 1 through 14, the feeding apparatus has been described having the capability of loading plural sheet materials 2 approximately at horizontal state. In contrast, other examples are found of feeding apparatuses capable of loading the sheet materials inclined with respect to the back face of the image formation apparatus.

Figure 50:
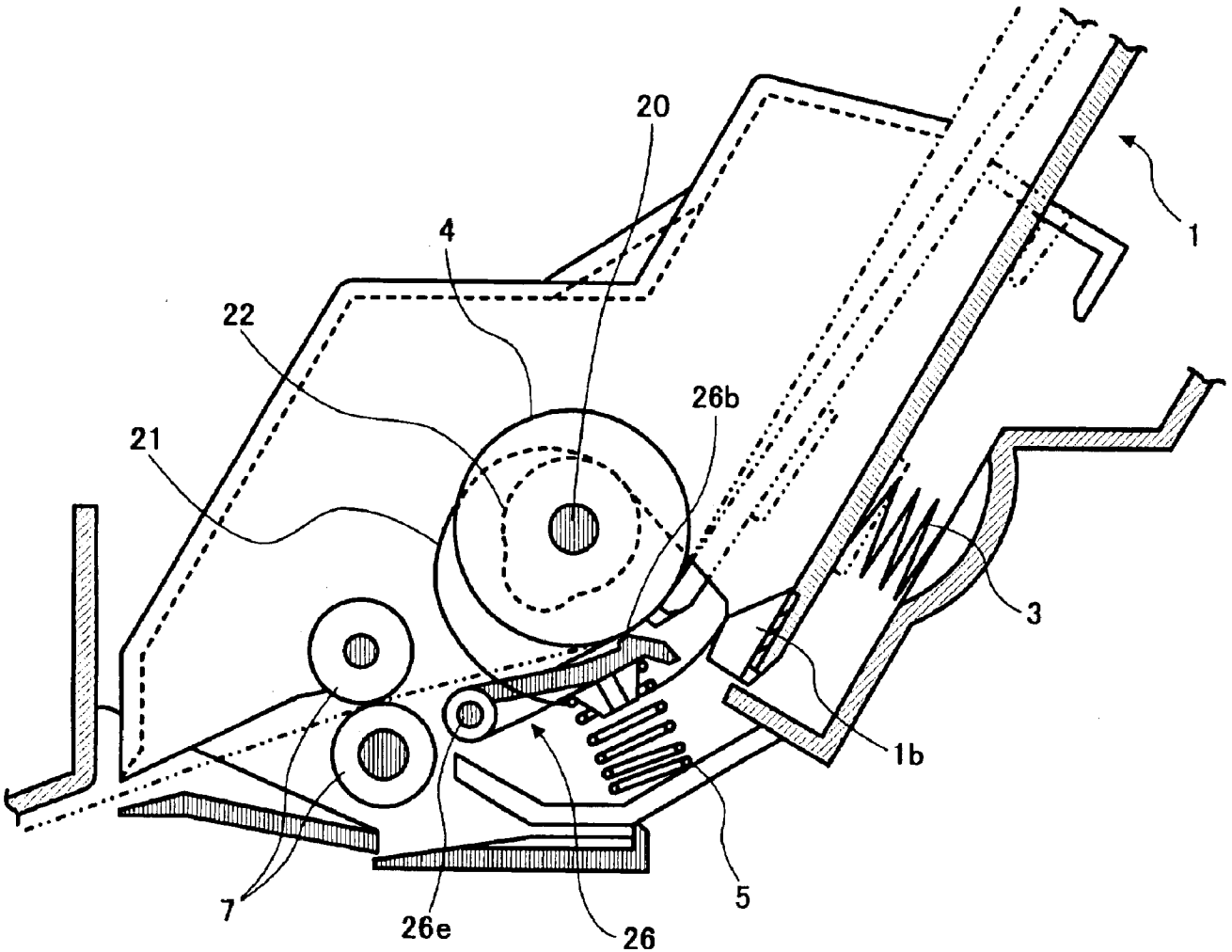
FIG. 50 is a cross sectional view illustrating major portions of the feeding apparatus according to the fifteenth embodiment disclosed herein, in which the feeding apparatus is capable of loading the sheet materials inclined with respect to the back face of the image formation apparatus.
Figure 51:
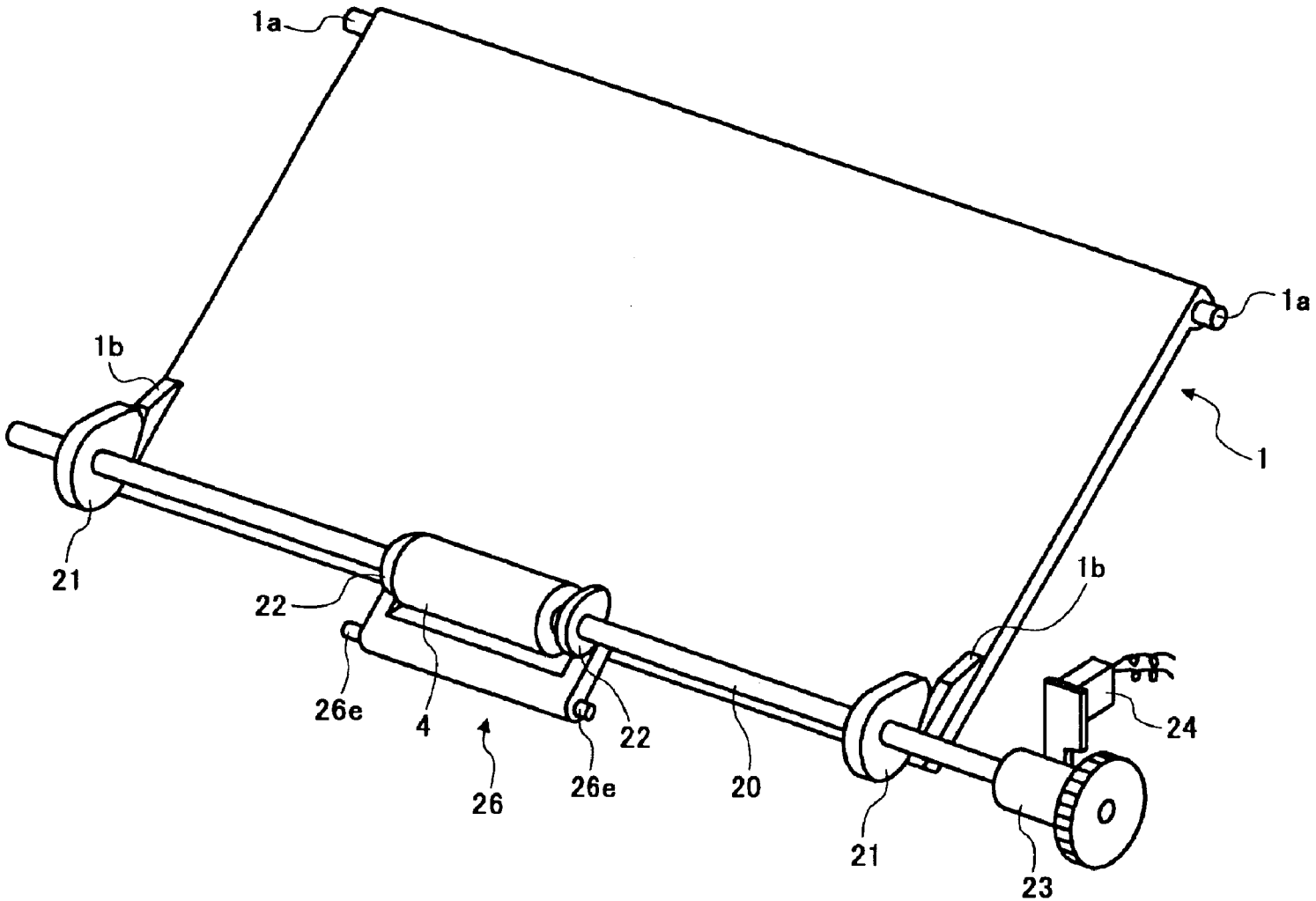
FIG. 51 is a perspective view illustrating the feeding apparatus of FIG. 50.
Figure 52:
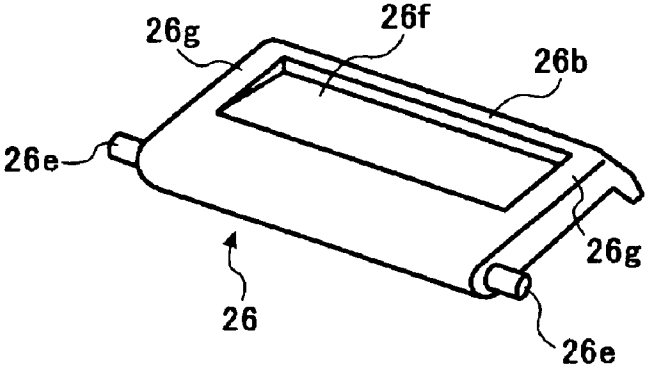
FIG. 52 is a cross sectional view illustrating the taper member included in the feeding apparatus of FIG. 50.

FIGS. 50 through 52 are several views illustrating the structure of the feeding unit which is formed to be adaptable for the abovementioned feeding apparatuses capable of loading the sheet materials inclined with respect to the back face, inn which FIGS. 50 and 51 are cross sectional view of major portion, and perspective view, of the feeding apparatus, respectively, according to the fifteenth embodiment disclosed herein. In addition, FIG. 52 is a perspective view of the tapered member included in the apparatus.

As shown in FIGS. 50 through 52 in reference to the present embodiment, there provided are a pair of pressing ribs 1*b*, 1*b* on both sides of frontal edge portion being integrally fixed thereto, first cams 21, 21 fixed to a rotation axis 20 of the feeding roller 4 at the positions corresponding to the pressing ribs 1*b*, 1*b*, and second cams 22, 22 also fixed to the rotation axis 20 on the both sides of the feeding roller 4.

Being oscillatory supported to a supporting axis 26*e*, the taper member 26 is formed including the end portion thereof, as a contact member 26*b*, which is brought into contact with the feeding roller 4 by a pressing force from a spring coil 5; a concaved portion 26*f* formed downstream from the contact member 26*b* opposing to the feeding roller 4, and other ribs 26*g*, 26*g* formed on the both sides detachably to the second cams 22, 22.

In addition, a spring clutch unit 23 is further provided at one end (the right-hand side in FIG. 51) of the rotation axis 20 for enabling switch driving of a drive motor (not shown) by means of a solenoid 24 so as the clockwise rotation around the rotation axis 20 (as shown in FIG. 51) be controlled within one rotation.

Figure 53:
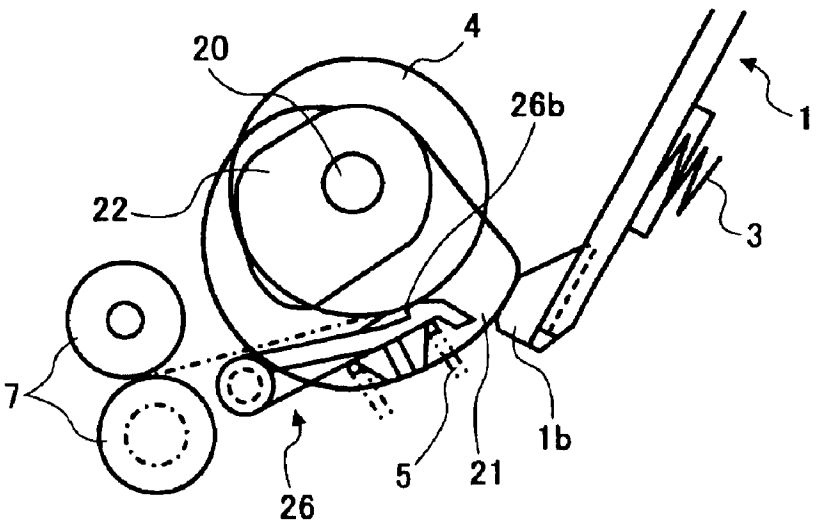
FIG. 53 is a cross sectional view illustrating the operation of the feeding apparatus of FIG. 50, in which the upper dead point of the second cam is removed from the taper member and the taper member is brought into contact with the feeding roller.
Figure 58:
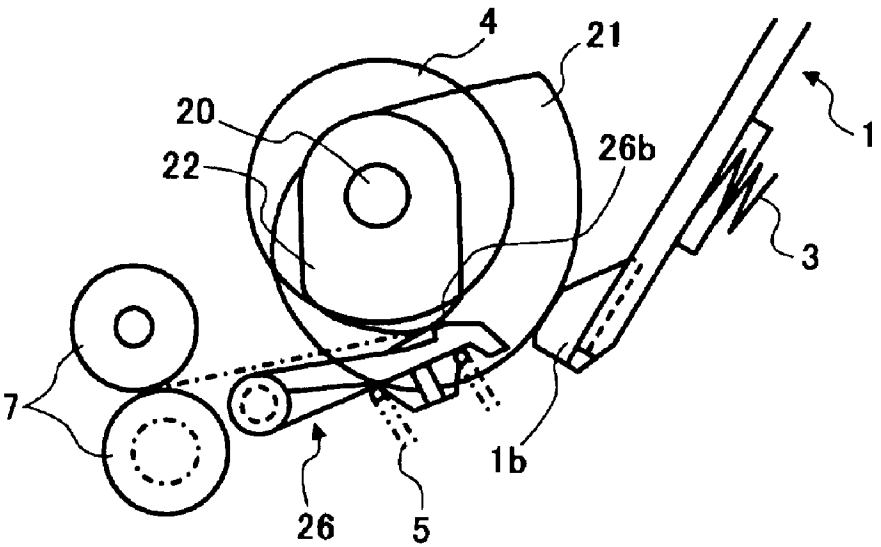
FIG. 58 is another cross sectional view illustrating the operation, in which the structure is brought back to the sheet feed standby mode.
Figure 61:
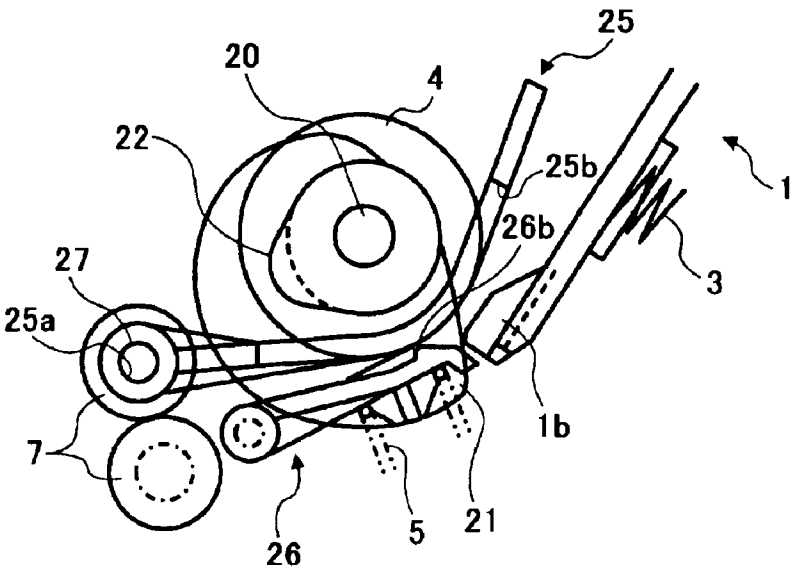
FIG. 61 is another cross sectional view illustrating the operation of the feeding apparatus of FIG. 60, in which the upper dead point of the second cam is removed from taper member pressing plate.
Figure 60:
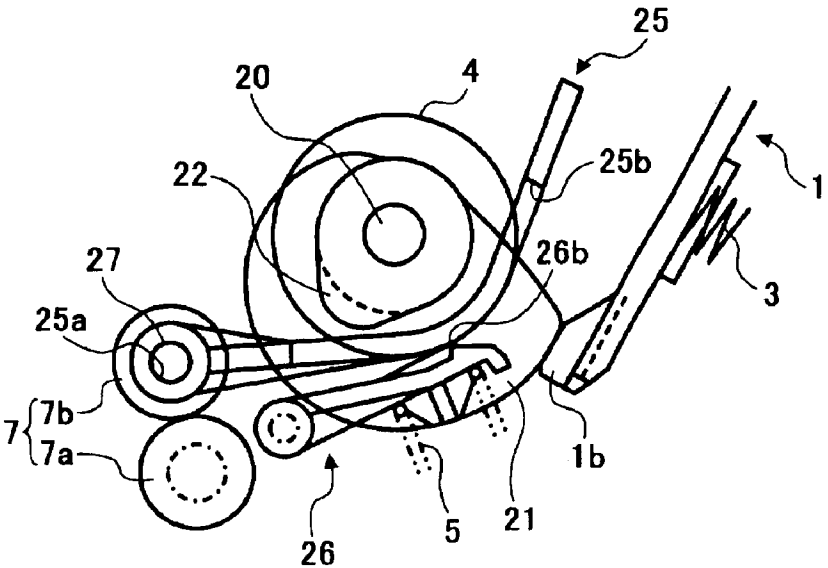
FIG. 60 is a cross sectional view illustrating the operation of the feeding apparatus provided with the taper member pressing plate of FIG. 59.

FIGS. 53 thorough 58 are prepared to illustrate the operation steps of the structure disclosed herein, and FIG. 58 in particular shows a sheet feed standby step.

In the first place, the base plate 1 and taper member 26 are removed from the feeding roller 4 by means of the first and second cams 21, 22 against a pressing force from coiled springs 3, 5, respectively.

When the sheet feeding is initiated and the feeding roller 4 rotates clockwise in the drawing, the first and second cams 21, 22 also start rotating in coincident to the rotation of the feeding roller 4, whereby the upper dead point of the second cam 22 is removed from the taper member 26, as shown in FIG. 53, and the taper member 26, in turn, brought into contact with the feeding roller 4.

Figure 55:
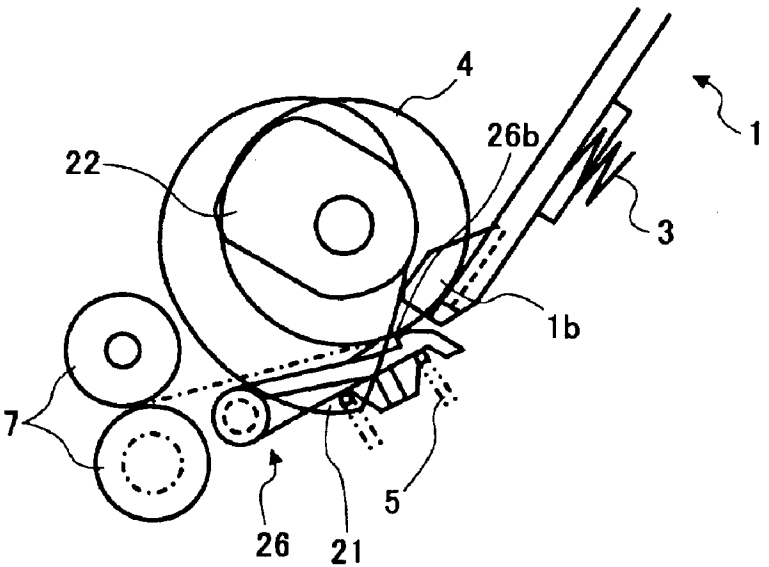
FIG. 55 is still another cross sectional view illustrating the operation, in which the uppermost sheet material is forwarded to the feeding roller pair.
Figure 54:
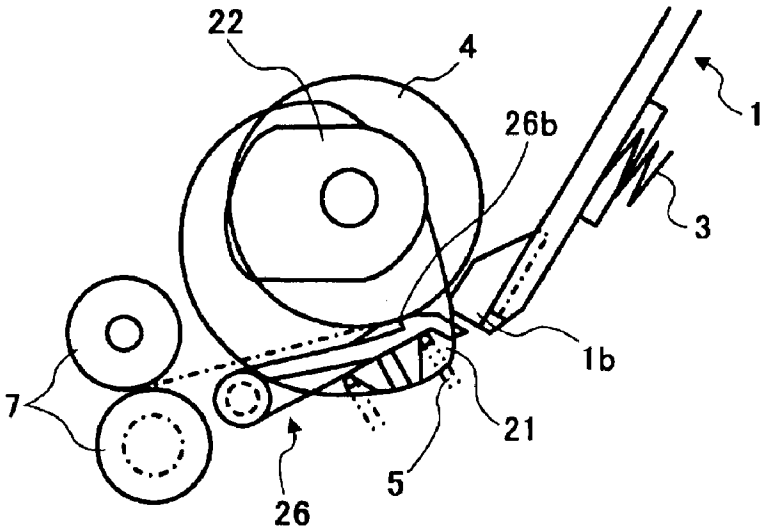
FIG. 54 is another cross sectional view illustrating the operation, in which the base plate swings toward the feeding roller 4.

Subsequently, as shown in FIGS. 54 and 55, the upper dead point of the first cam 21 is removed from the pressing rib 1*b* on the base plate 1, the base plate 1 swings toward the feeding roller 4, conveys the sheet material (not shown) loaded on the base plate 1 to the taper member 26, separates an uppermost sheet material from others, and then conveys the uppermost sheet material to the feeding roller pair 7.

Figure 57:
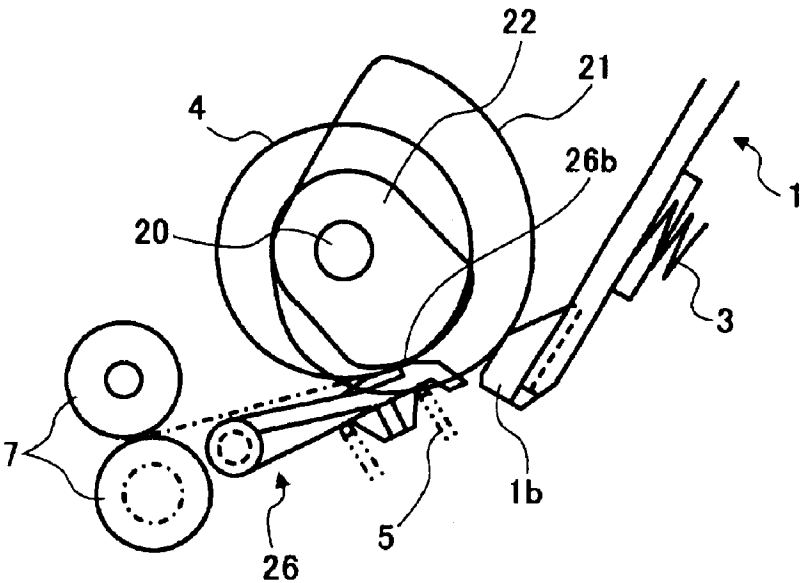
FIG. 57 is another cross sectional view illustrating the operation, in which the second cam comes into contact with the tapered member.
Figure 56:
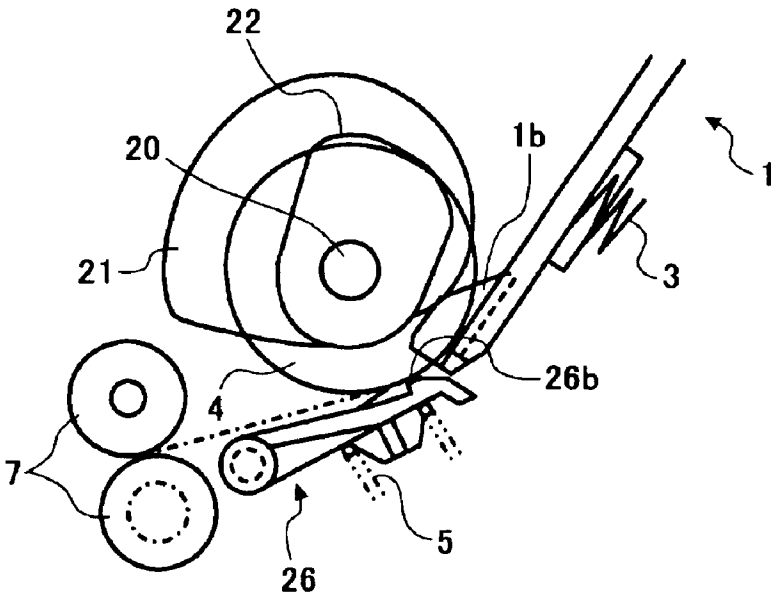
FIG. 56 is another cross sectional view illustrating the operation, in which the first cam again comes into contact with the pressing rib of base plate.

During the steps, the first cam 21 again comes into contact with the pressing rib 1*b* of base plate 1 as shown in FIG. 56 to swing the base plate 1 counterclockwise. Next, the second cam 22 comes into contact with the tapered member 26 to rotate clockwise, as shown in FIG. 57, and then the structure is brought back to the sheet feed standby mode.

As described above, by providing the ribs 26*g*, 26*g* detachably to the second cam 22 on the both sides of the taper member 26, and pressing down the member 26 by the single rotation of the feeding roller 4, the difficulty of possible wear-out of the contact face 26*b* caused by sheet friction can be reduced, since the end portion thereof is brought into contact with the feeding roller 4 by a pressing force from a spring coil 5, and the feeding roller 4 is brought to sheet feed standby state (i.e., sheet feeding state by means of the feeding roller pair).

In the above noted described fifteenth embodiment, however, there may gives rise to a case where a large number of sheet materials cannot be properly set under the feeding roller 4, if the leading edge of the sheet materials is irregular.

Figure 59:
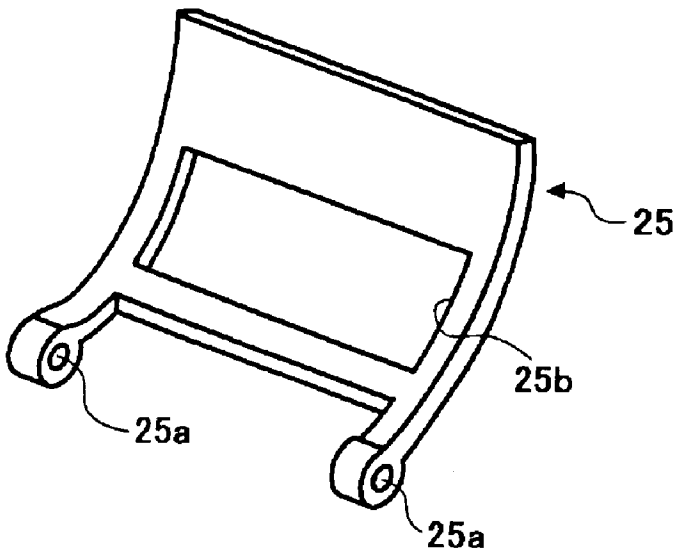
FIG. 59 is a perspective view illustrating a taper member pressing plate provided between the second cam and taper member according to the sixteenth embodiment disclosed herein.

FIG. 59 is a perspective view of the feeding apparatus which is formed according to the sixteenth embodiment disclosed herein to overcome the abovementioned difficulty caused by the irregularity, in which a taper member pressing plate 25 is provided between the second cam 22 and taper member 26.

In addition, a pair of bearing portions 25*a*, 25*a* situated on both right and left sides of the pressing plate 25 are axially supported by an axis 27 of opposing roller facing to the feeding roller pair 7, and an opening 25*b* formed in the middle of the longitudinal direction of the pressing plate 25 having an area large enough to cover the portion of contact between the feeding roller 4 and taper member 26, as shown in FIG. 59.

Other portions of the sheet feeding unit are formed in a similar manner to those mentioned earlier in the fifteenth embodiment.

Figure 65:
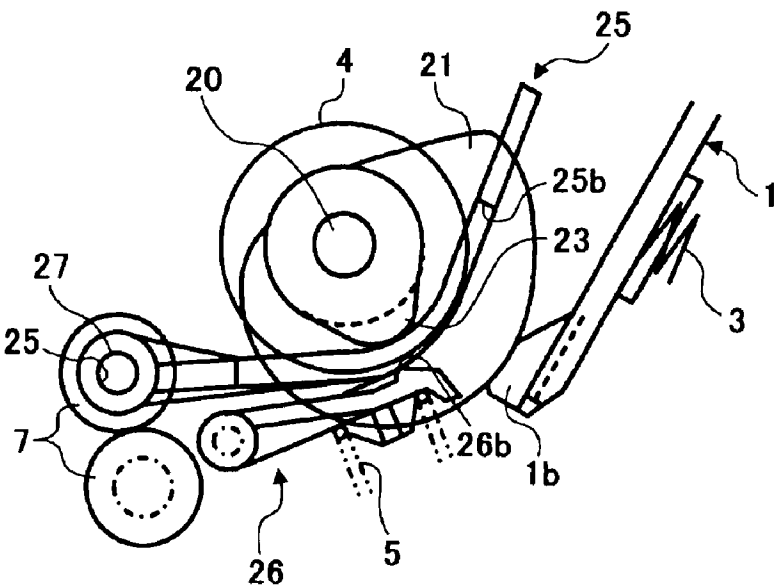
FIG. 65 is another cross sectional view illustrating the operation of the feeding apparatus of FIG. 60, in which the structure is brought back to the sheet feed standby mode.

With the thus formed construction according to the sixteenth embodiment, FIG. 65 is prepared to illustrate the sheet feed standby state, in which the first cam 21 presses the rib 1*b* formed on the base plate 1, the second cam 22 presses the rib 26*b* of the taper member 26 by way of the taper member pressing plate 25, and the base plate 1 and taper member 26 are each removed from the feeding roller 4.

In addition, the free end of the pressing member 25 is situated upstream of the feeding roller 4 having the width between the base plate 1 gradually widening toward the direction of sheet material insertion.

Utilizing the thus formed structure, a large number of sheet materials can be securely set under the feeding roller 4, even in case where the leading edge of the loaded sheet materials is irregular.

Figure 62:
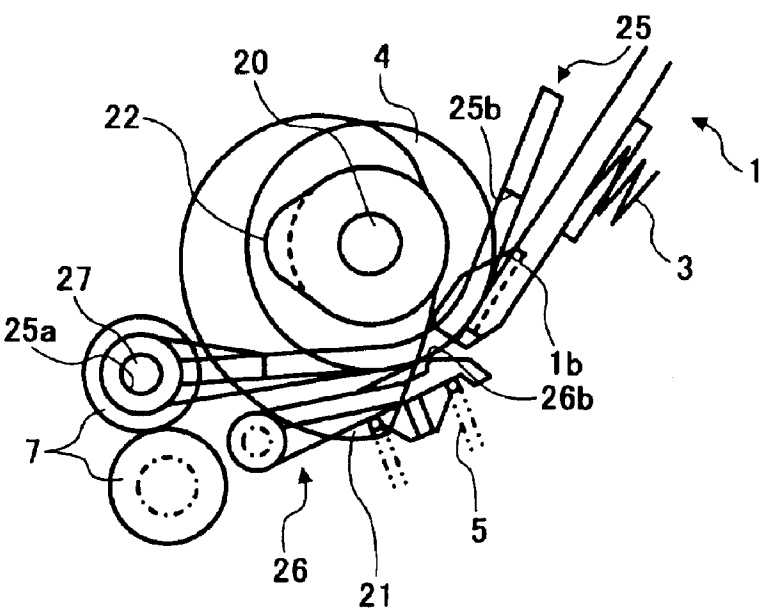
FIG. 62 is still another cross sectional view illustrating the operation of the feeding apparatus of FIG. 60, in which the base plate swings toward the feeding roller.

Leaving the state of sheet feed standby shown in FIG. 65, the feeding of sheet material is initiated. When the sheet feeding is initiated and the feeding roller 4 rotates clockwise in the drawing, the first and second cams 21, 22 also start rotating in coincident to the rotation of the feeding roller 4, whereby the upper dead point of the second cam 22 is removed from taper member pressing plate 25 as shown in FIG. 62, the base plate 1 swings toward the feeding roller 4, conveys the sheet material loaded on the base plate 1 to the taper member 26, separates an uppermost sheet material from others, and then conveys the uppermost sheet material to the feeding roller pair 7.

Figure 63:
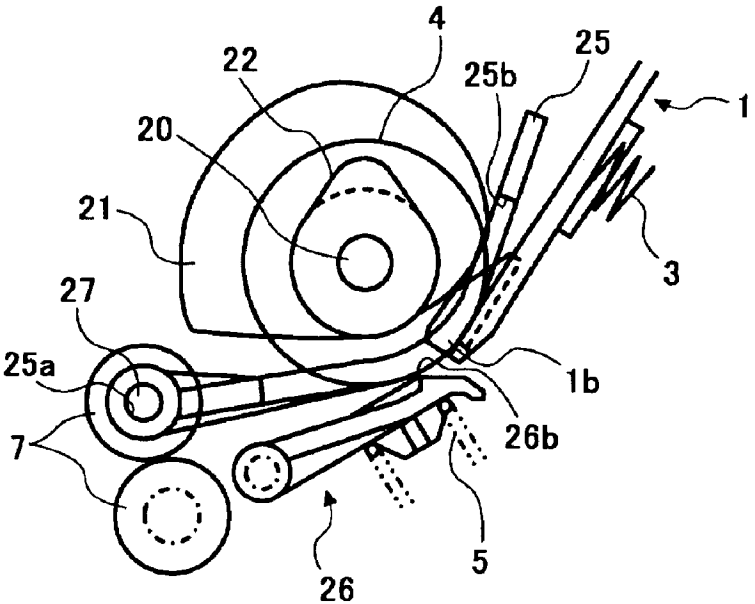
FIG. 63 is another cross sectional view illustrating the operation of the feeding apparatus of FIG. 60, in which; the first cam again comes into contact with the pressing rib of base plate.
Figure 64:
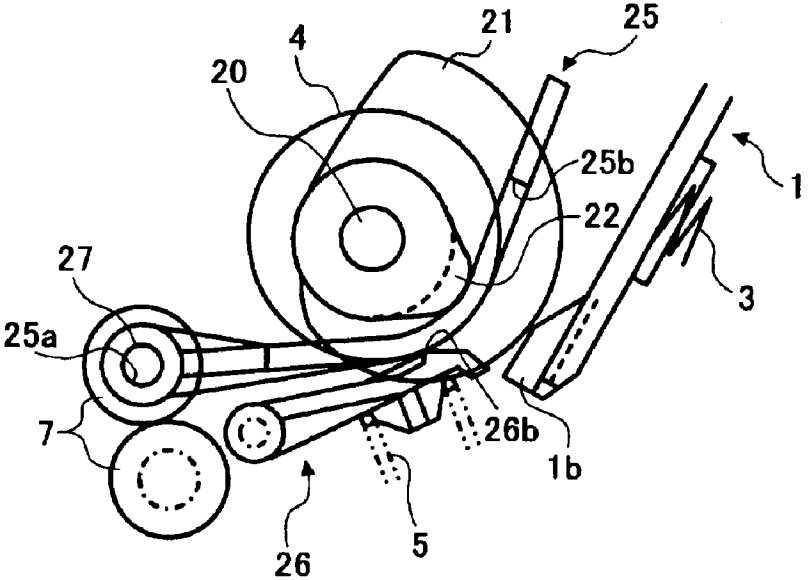
FIG. 64 is another cross sectional view illustrating the operation of the feeding apparatus of FIG. 60, in which the second cam comes into contact with the taper member pressing plate

After the first cam 21 again comes into contact with the pressing rib 1*b* of base plate 1 as shown in FIG. 63 to swing the base plate 1 counterclockwise, the second cam 22 comes into contact with the taper member pressing plate 25 to rotate clockwise as shown in FIG. 64, and then the structure is brought to the sheet feed standby mode as shown in FIG. 65.

As mentioned above, by providing the taper member pressing plate 25 between the taper member 26 and second cam 22 having an opening with an area large enough to cover the portion of contact between the feeding roller 4 and taper member 26, and by situating the end of the pressing member 25 upstream of the feeding roller 4 according to the sixteenth embodiment, a large number of sheet materials can securely be set under the feeding roller 4 after guided by the taper member pressing plate 25, even in case where the leading edge of the loaded sheet materials is irregular.

While feeding rollers have been utilized as the means for forwarding sheet material to separation complement in feeding apparatus has been described as one the embodiments 1 through 16, the means are not limited to the feeding rollers other means such as a feeding belt may suitably be used.

Figure 66:
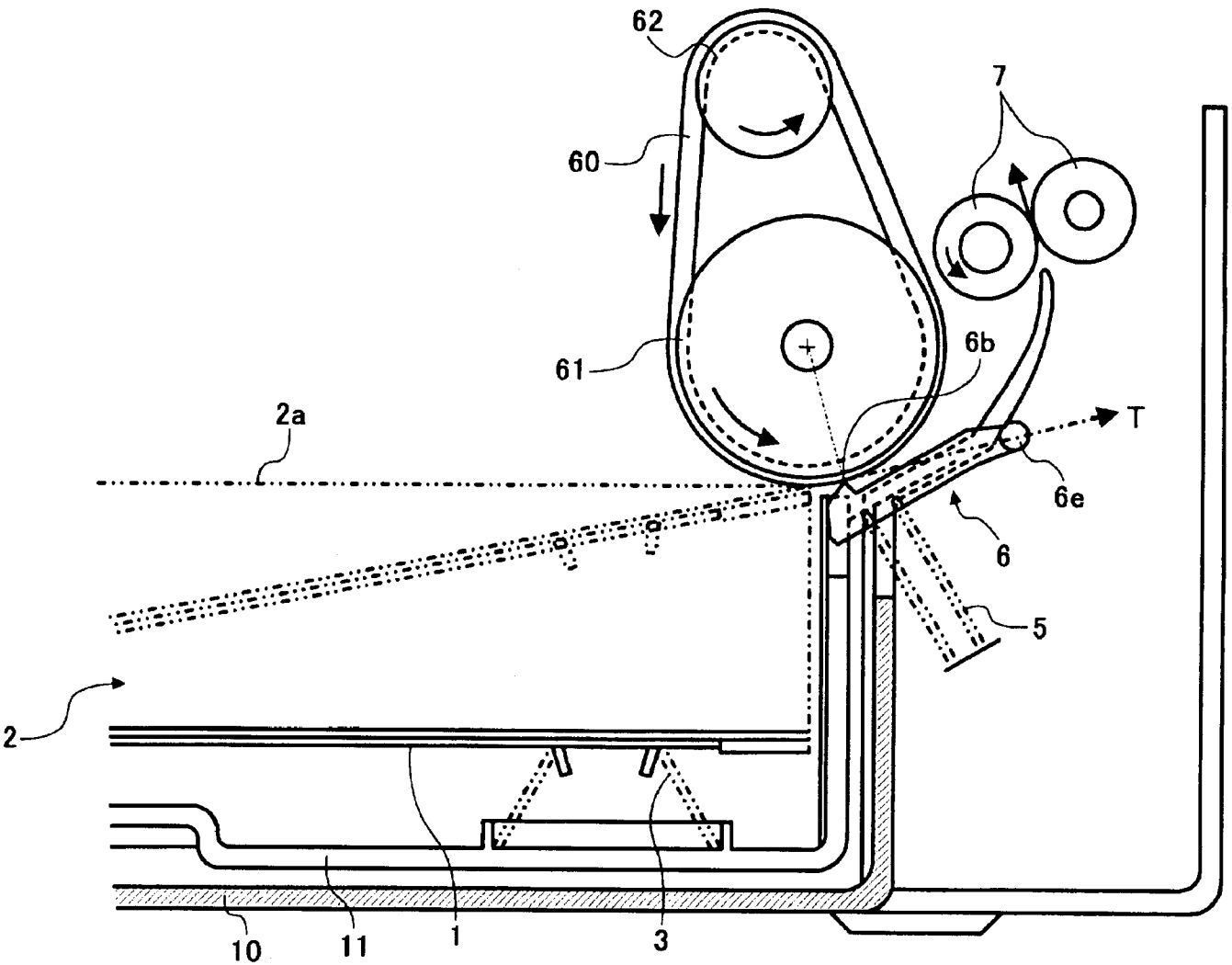
FIG. 66 is a cross sectional view illustrating the structure of the feeding unit provided with a feeding belt according to the seventeenth embodiment, in which a driving pulley is further included.

FIG. 66 is a longitudinal cross sectional view illustrating the structure incorporating such means according to the seventeenth embodiment disclosed herein, in which there included are a feeding pulley 61 rotatably provided to be situated at the same location as the feeding roller 4 the previous embodiment, a driving pulley 62 provided separately from the feeding pulley 61, and a feeding belt 60 provided wound circumferentially around the feeding pulley 61 and driving pulley 62.

The feeding belt 60 is positioned to be brought into contact with the leading edge of the uppermost sheet material 2*a* loaded on the base plate 1 and the contact face 6*b* of taper member 6*b*. Other portions of the structure are formed in a similar manner to those shown in FIGS. 1 and 22.

In the thus formed construction according to the seventeenth embodiment, when the driving pulley 62 rotates counterclockwise viewed as in the drawing, the feeding pulley 61 rotates also counterclockwise by way of feeding belt 60 and this rotation acts to forward the uppermost sheet material 2*a* in contact with the feeding belt in the direction of the tangent T of the contact face 6*b* of taper member 6 at the point of contact with the feeding belt 60, and then further forwarded to image forming unit (not shown) through the feeding roller pair 7.

Figure 67:
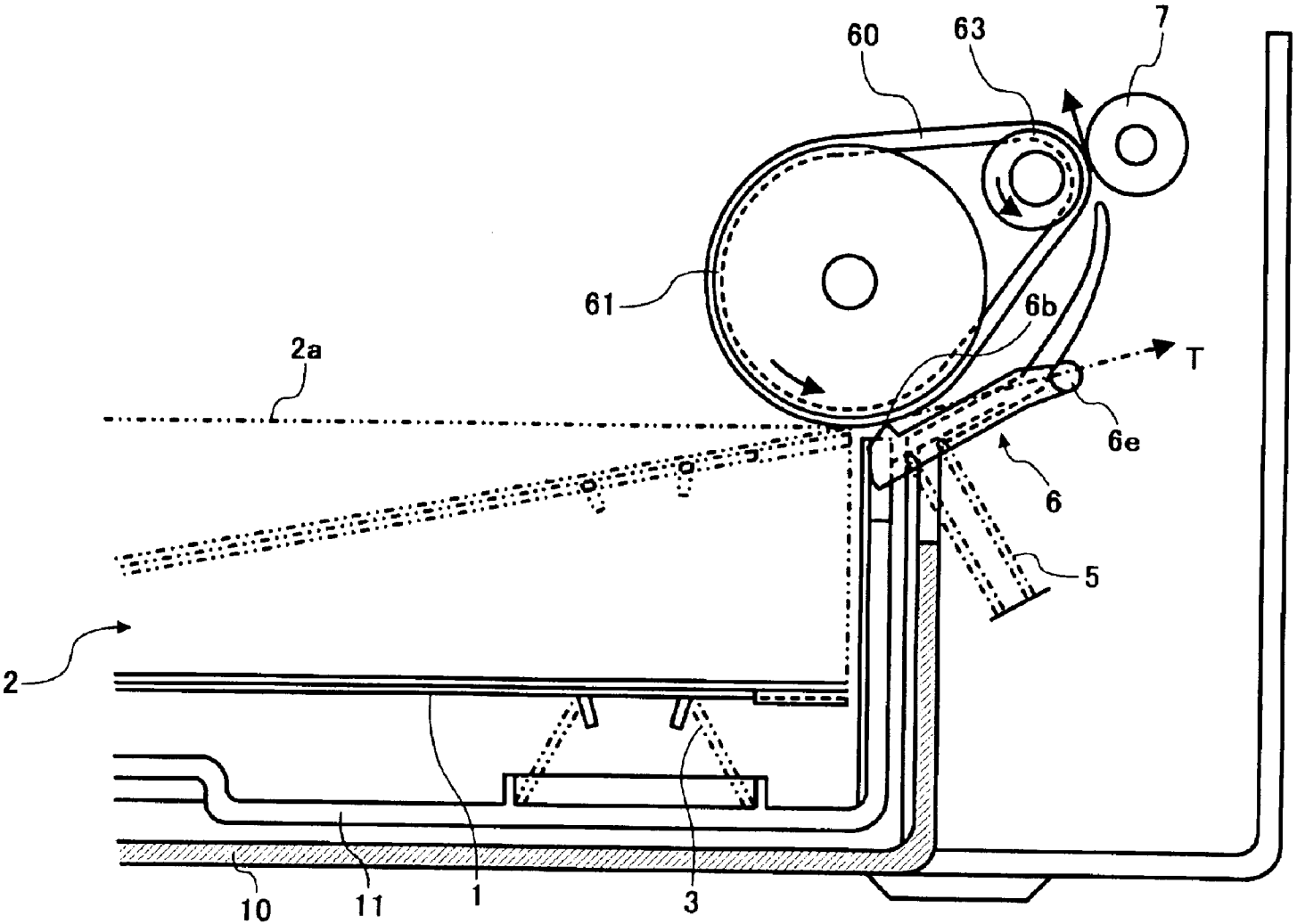
FIG. 67 is a cross sectional view illustrating the structure of the feeding unit provided with the feeding belt according to the eighteenth, in which a feeding pulley is further included in place of the driving pulley of FIG. 66.

FIG. 67 is a longitudinal cross sectional view prepared in a similar manner to FIG. 66, illustrating a further structure according to the eighteenth embodiment disclosed herein, in which a feeding pulley 63 is provided, in place of the driving pulley 62 shown in the seventeenth embodiment, on the driving side of feeding roller pair 7.

The feeding pulley 63 and feeding pulley 61 are wound circumferentially around by feeding belt 60 which is positioned to be brought into contact with the driven side of the feeding roller pair 7. Other portions of the structure are formed in a similar manner to those shown in FIG. 66 in reference to the previous embodiment.

In the thus formed construction according to the eighteenth embodiment, when the feeding pulley 63 rotates counterclockwise viewed as in the drawing, the feeding pulley 63 is rotated in the same direction by way of the feeding belt 60.

In the present structure, the speed of sheet material forwarded by feeding belt 60 at the contact position with taper member 6 is always kept the same as that of forwarding to image forming unit by means of the feeding belt 60 which is positioned to be brought into contact with the driven side of the feeding roller pair 7. As a result, the feeding of sheet materials can be carried out smoothly.

Figure 68:
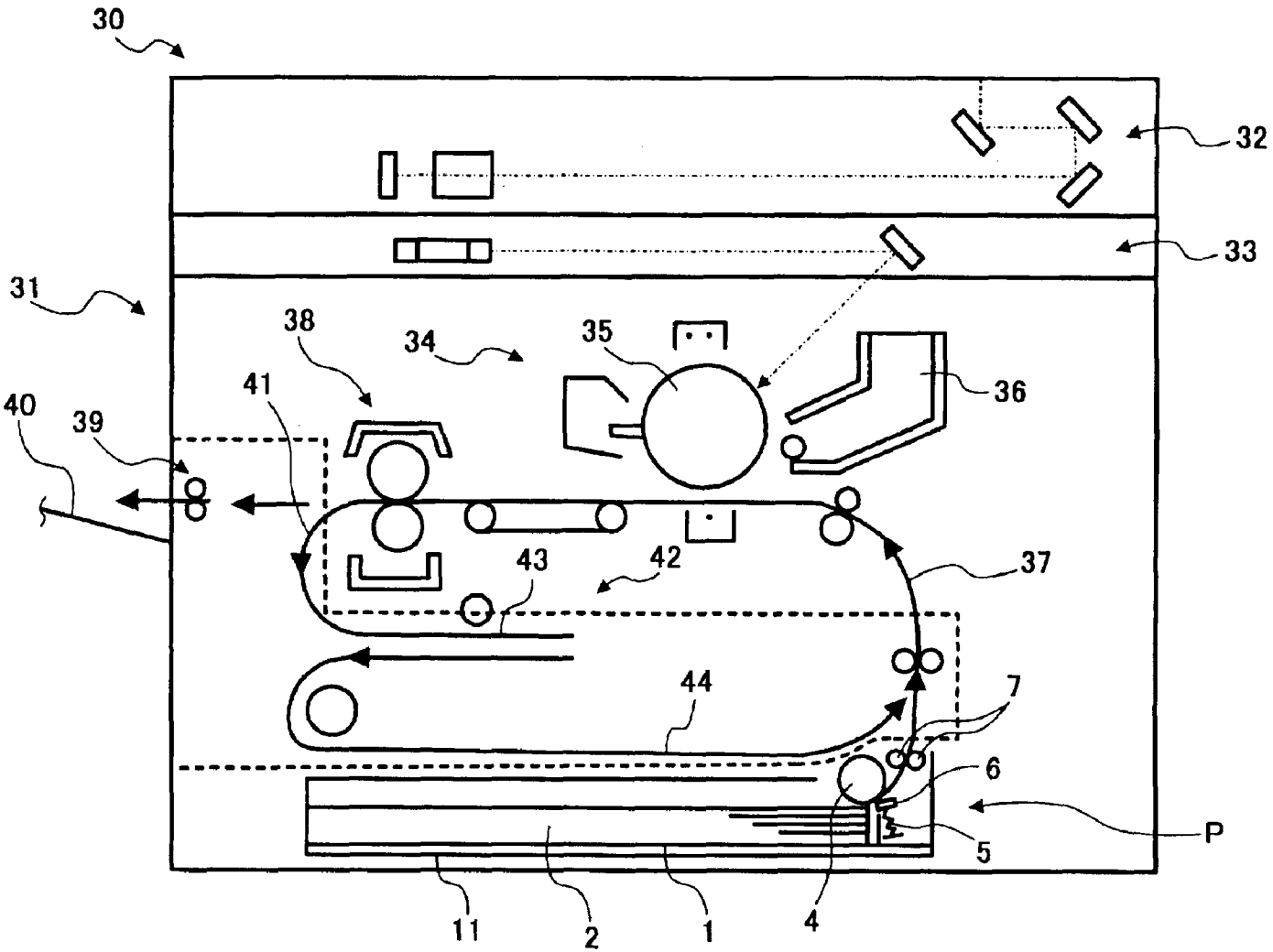
FIG. 68 is an overall cross sectional view illustrating a duplication machine as the image forming apparatus provided with sheet feeding unit disclosed herein.

FIG. 68 is an overall cross-sectional view illustrating a duplication machine as the image forming apparatus provided with sheet feeding unit disclosed herein above.

The duplication machine 30 is adapted to form electrostatic latent images on the surface of photoreceptor 35 provided in image bearing unit 34, based on image data recorded by an optical reading unit 32 by means of optical recording unit 33 such as beam illumination unit, and the latent images are rendered visible with toner particles by developing unit 36 in image forming unit 34.

A sheet feeding unit P is provided under the main chases 31 of the duplication machine, and sheet materials supported in stacked arrangement on the base plate 1 of sheet cassette 11 are separated and fed sequentially from the uppermost sheet.

The sheet material 2 is fed to image forming unit 34 by means of feeding roller pair byway of feeding path 37, and the visible images on the photoreceptor 35 are transferred onto the sheet material 2.

Following image transfer steps, the sheet material 2 is subsequently forwarded to fixing unit 38, subjected to fixing steps for the visible images to be fixed, and then output to an external sheet disposal tray 40.

In case of image formation on the both sides of sheet material, the sheet material is deflected by a disposal decision gate (not shown) from inversion transport path 41 to duplex transport path 42, stored once in a duplex tray 43, reversed its forwarding direction, forwarded again into image forming unit from the duplex transport path 42, image formed on the rear side thereof, and then output to the sheet disposal tray 40.

Although there is shown, for purposes of simplification, only one sheet feeding unit P in FIG. 68, a plurality of feeding units, some in different sizes if necessary, may also be provided.

In addition, the image forming apparatus incorporating sheet feeding unit disclosed herein is by no means limited to the duplication machine described above, but can suitably be utilized in various apparatuses such as, for example, facsimile and printer.

As another aspect to the sheet feeding apparatus incorporated into the image firming apparatus, the second example of the feeding apparatus will be described herein below with respect to several embodiments.

Figure 69:
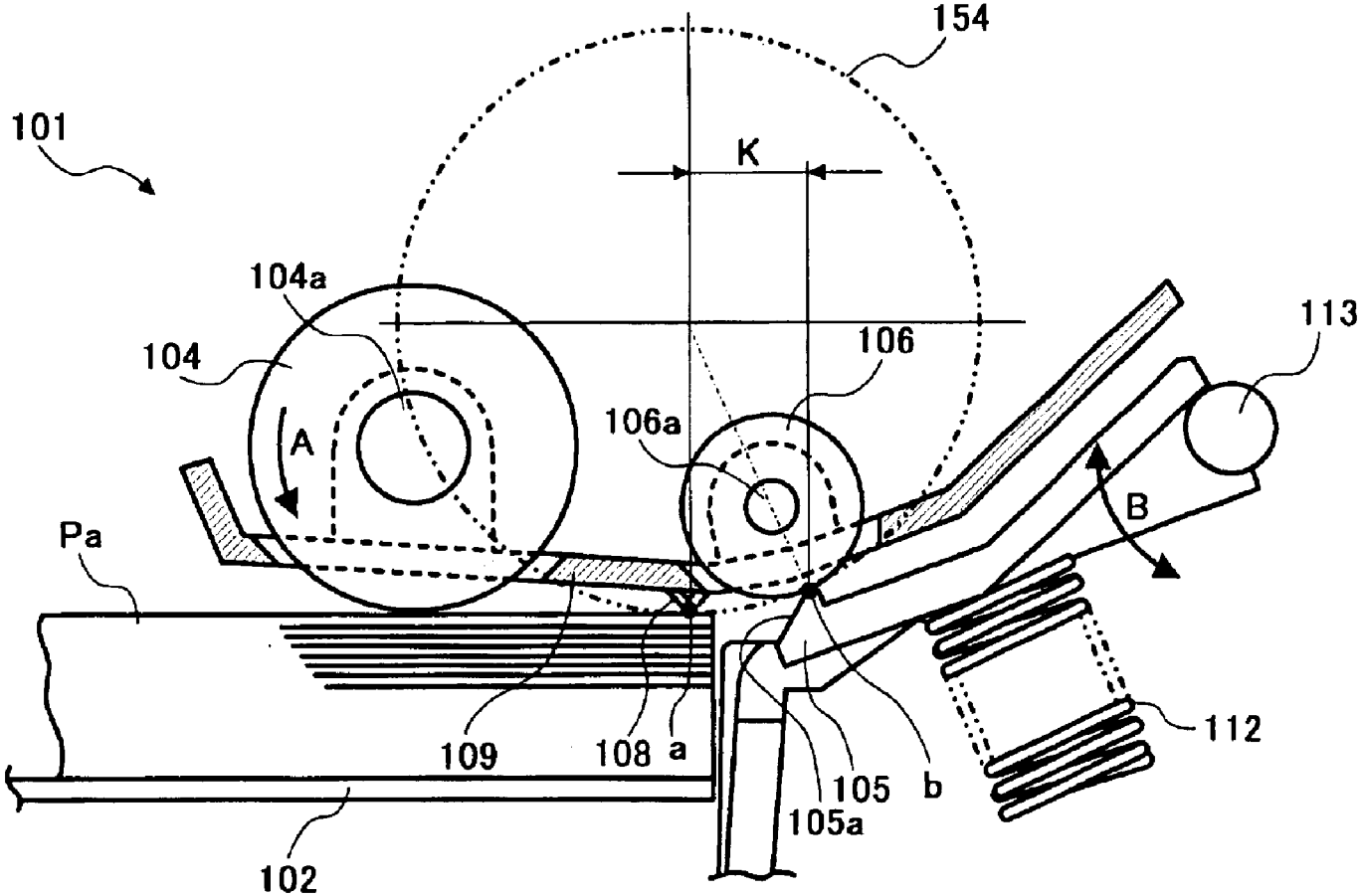
FIG. 69 is a cross-sectional view illustrating the construction of a sheet feeding apparatus according to another embodiment disclosed herein.
Figure 70:
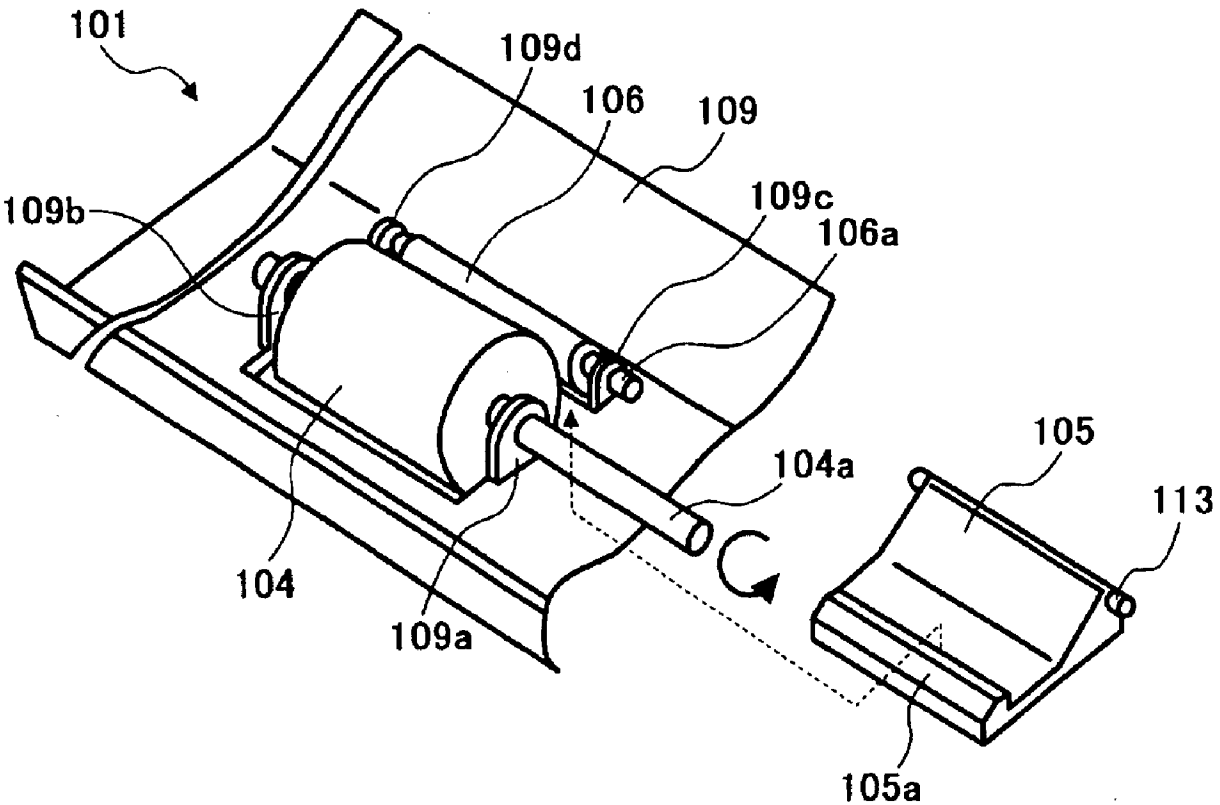
FIG. 70 is a compositional perspective view illustrating the major parts included in the sheet feeding apparatus of FIG. 69.

FIG. 69 is an overall view illustrating the construction of the feeding apparatus and FIG. 70 is a compositional perspective views thereof. In addition, FIG. 71 is a longitudinal cross sectional view illustrating the sheet feeding apparatus incorporating sheet feeding apparatus, which has a structure similar to FIG. 68 and like reference numerals designate identical or corresponding parts thereof.

Figure 71:
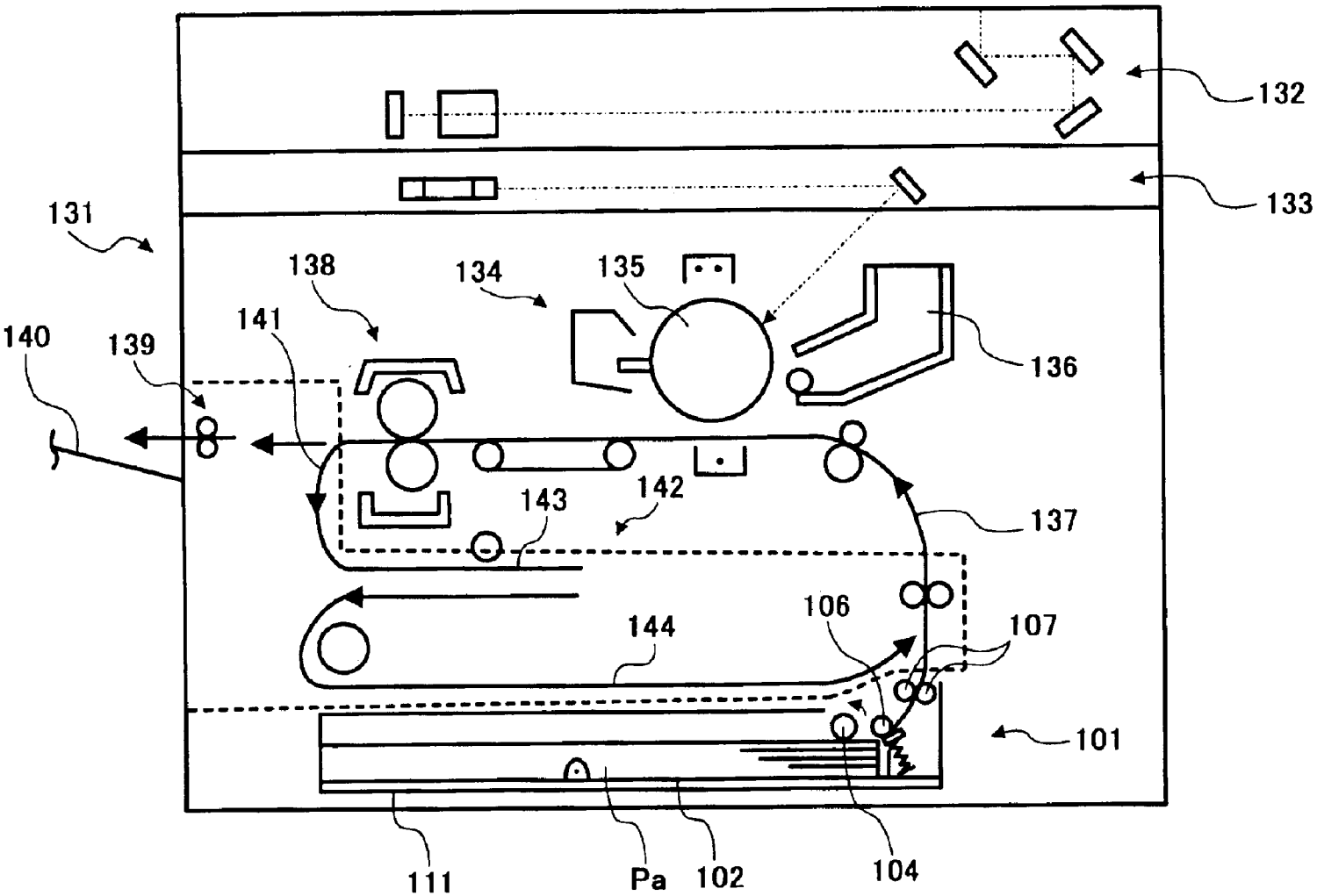
FIG. 71 is an overall cross-sectional view illustrating another duplication machine as the image forming apparatus provided with sheet feeding unit disclosed herein.

Referring to FIG. 71, a duplication machine as image forming apparatus in the present example is adapted to form electrostatic latent images on the surface of photoreceptor 135 provided in image bearing unit 134, based on image data recorded by an optical reading unit 132 by means of optical reading unit 133 such as beam illumination unit, and the latent images are rendered visible with toner particles by developing unit 136 in image forming unit 134.

A sheet feeding unit 101 is provided under the main chases 131 of the duplication machine, and sheet materials Pa are fed to image forming unit 134 by means of feeding roller pair 107 by way of feeding path 137, and the visible images (or toner images) on the photoreceptor 135 are transferred onto the sheet material Pa.

Following image transfer steps, the sheet material Pa is subsequently forwarded to fixing unit 138, subjected to fixing steps for the visible images to be fixed, and then output to an external sheet disposal tray 140.

In case of image formation on the both sides of sheet material, the sheet material is deflected by a disposal decision gate (not shown) from inversion transport path 141 to duplex transport path 142, stored once in a duplex tray 143, reversed its forwarding direction, forwarded again into image forming unit from the duplex transport path 142, image formed on the rear side thereof, and then output to the sheet disposal tray 140.

Although there is shown, for purposes of simplification, only one sheet feeding unit in FIG. 71, a plurality of feeding units, some in different sizes if necessary, may also be provided.

In addition, the image forming apparatus incorporating sheet feeding unit disclosed herein is by no means limited to the duplication machine described above, but can suitably be utilized in various apparatuses such as, for example, facsimile and printer.

Referring to FIG. 69, the sheet feeding apparatus 101 is provided with a base plate 102 as a sheet loading member pivotably supported around the left side edge (in the drawing) thereof, a feeding roller 104 provided as feeding means so as to be in contact with the leading edge (the right hand side edge in the drawing) of sheet materials Pa which are loaded on the base plate 102 and lifted by the swinging movements of the base plate 102, to subsequently forward to the direction 'A' designated by the arrow in the drawing, and a taper member 105 provided colliding with the leading edge of the sheet, whereby a plurality of sheet materials Pa are separated sheet by sheet with the taper member 105.

In addition, the sheet feeding apparatus 101 is provided with a separation roller 106 so as the circumference thereof to be in contact with the taper member 105, and a feeding guide member 109 which has a protrusion 108 situated between the separation roller 106 and feeding roller 104 to be brought in contact with the sheet material Pa fed by the feeding roller 104, and which pivotably supports the protrusion 108 together with separation roller 106 and feeding roller 104.

The taper member 105 is mounted also piovatably around a fulcrum 113 in the direction designated by the arrow 'B' in the drawing so as the bottom face thereof be pressed upward with a pressing force exerted by a separation coiled spring 112, to thereby for taper member 105 be brought into contact with the circumference of separation roller 106 by the pressing force from coiled spring 112.

On the feeding guide member 109, a pair of supports 109*a*, 109*b* is formed as shown in FIG. 70 by the cut-upright method, for example, for supporting both ends of the axial portion 104*a* of feeding roller 104 so as the axial portion 104*a* be pivotably supported. Also on the feeding guide member 109, a pair of supports 109*c*, 109*d* is formed by the cut-upright method, for example, for supporting both ends of the axial portion 106*a* of separation roller 106 so as the axial portion 104*a* be pivotably supported.

By the swinging movements of the base plate 102 counterclockwise as shown in FIG. 69 during sheet feeding steps, the leading edge of the sheet material loaded on the base plate 102 is brought into contact with the feeding roller 104.

When the feeding roller 104 is then rotated in the direction designated by the arrow 'A' in the drawing, the uppermost sheet material Pa is forwarded to the taper member 105, and in case of more than one sheet material Pa is fed into the portion between separation roller 106 and taper member 105, the plural sheet materials Pa are separated sheet by sheet to be subsequently forwarded further.

Figure 109:
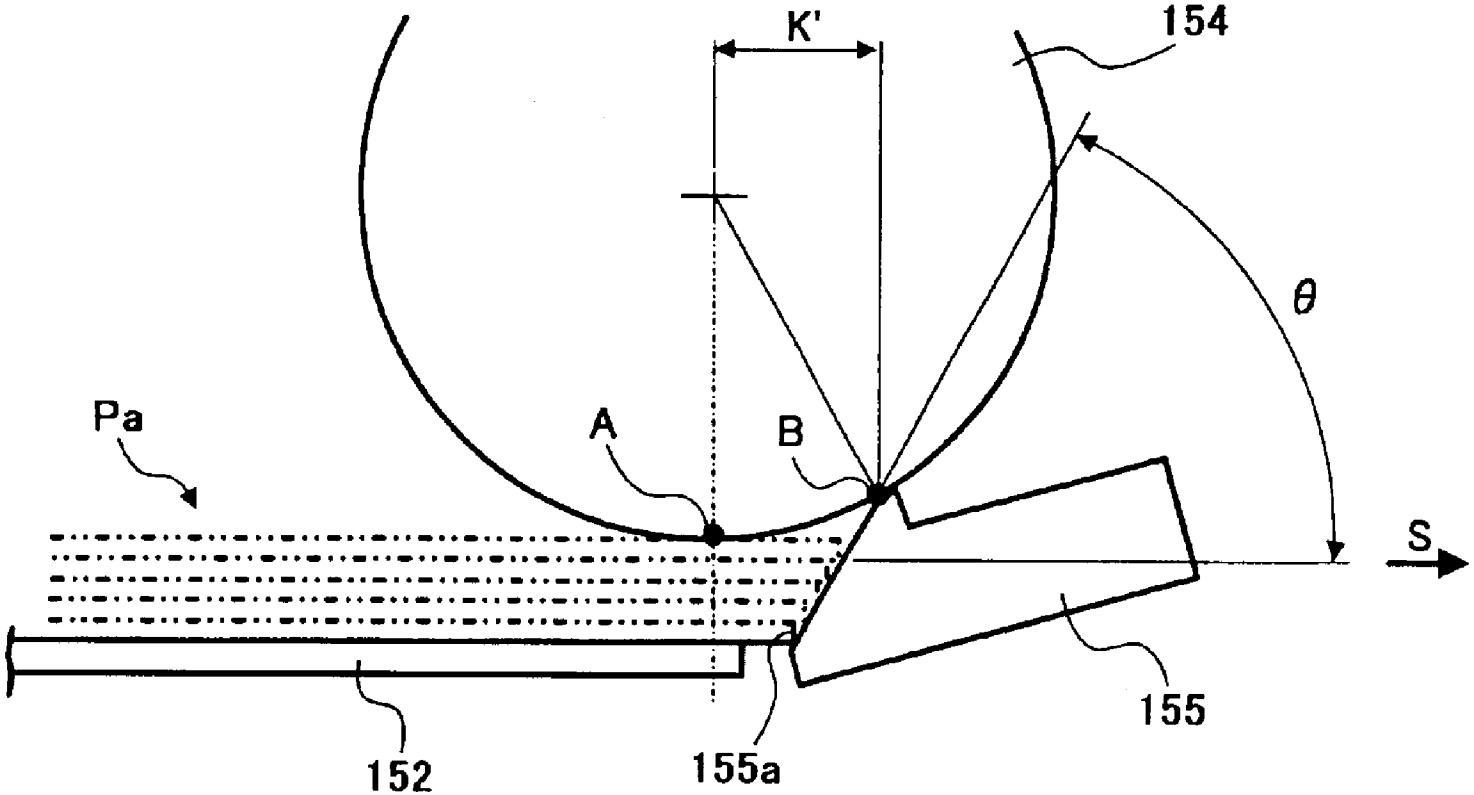
FIG. 109 is prepared to illustrate the distance K' in sheet forwarding direction between the point A of pressed contact for the uppermost sheet material loaded on the base plate to feeding roller and the point B of contact for the feeding roller.

To obtain satisfactory sheet separation results, on a variety of sheet materials different in thickness and/or size, with previous sheet feeding apparatuses which are adapted to separate sheet materials sheet by sheet by bringing the leading edge of the sheet material into contact with the tapered face of taper member, it has been described earlier (and also described later on in reference to FIG. 109) that the distance K' in sheet forwarding direction is preferably in the range from 2 to 6 mm between the point A of pressed contact for the uppermost sheet material loaded on the base plate to feeding roller 4, and the point B of contact for the feeding roller 4, and also the angle θ preferably ranges from 50° to 70° between the sheet forwarding direction S and the longitudinal direction of tapered face 155*a* in the taper member 155.

In order to achieve these conditions, however, the circumference of the feeding roller 104 has to be large enough to be in contact with both noted points A and B simultaneously, which results in a large diameter for the feeding roller 104 and a concomitant increase in size of the sheet feeding apparatus as a whole.

According to the sheet feeding apparatus 101 disclosed herein as the second example, in contrast, since the protrusion 108 is provided being situated between separation roller 106 and feeding roller 104 to be brought in contact with the sheet material, the same conditions can be satisfied by adjusting the distance K, between the protrusion 108 and the point b of separation contact (nip formation) of the separation roller 106 with taper member 105, to be equal to the distance K' (i.e., the distance between sheet feeding point 'a' to separation point 'b' shown in FIG. 69).

As a result, modulus values are seemingly equated to various sheet materials even for different kinds of sheet materials presently used, whereby excellent sheet separation characteristics can be obtained.

In addition, the feeding roller 104 can be provided spatially separated from separation roller 106 and the reduction in size for the feeding roller 104 can be achieved. Comparing with the diameter of previous feeding roller hypothetically shown with a double dotted circular line in FIG. 69, the effect of size reduction can be realized according to the degree of the noted comparison for the feeding roller and also for the feeding apparatus as a whole.

Furthermore, the protrusion 108 in the present embodiment is formed as one unit on the feeding guide member 109 which also pivotably supports both separation roller 106 and feeding roller 104.

As a result, both the spatial relation of protrusion 108 relative to feeding roller 104 and the accuracy of the distance between protrusion 108 and the separation point 'b' can be improved over the case where these units are formed individually, whereby the sheet feeding quality can be stabilized.

Figure 72:
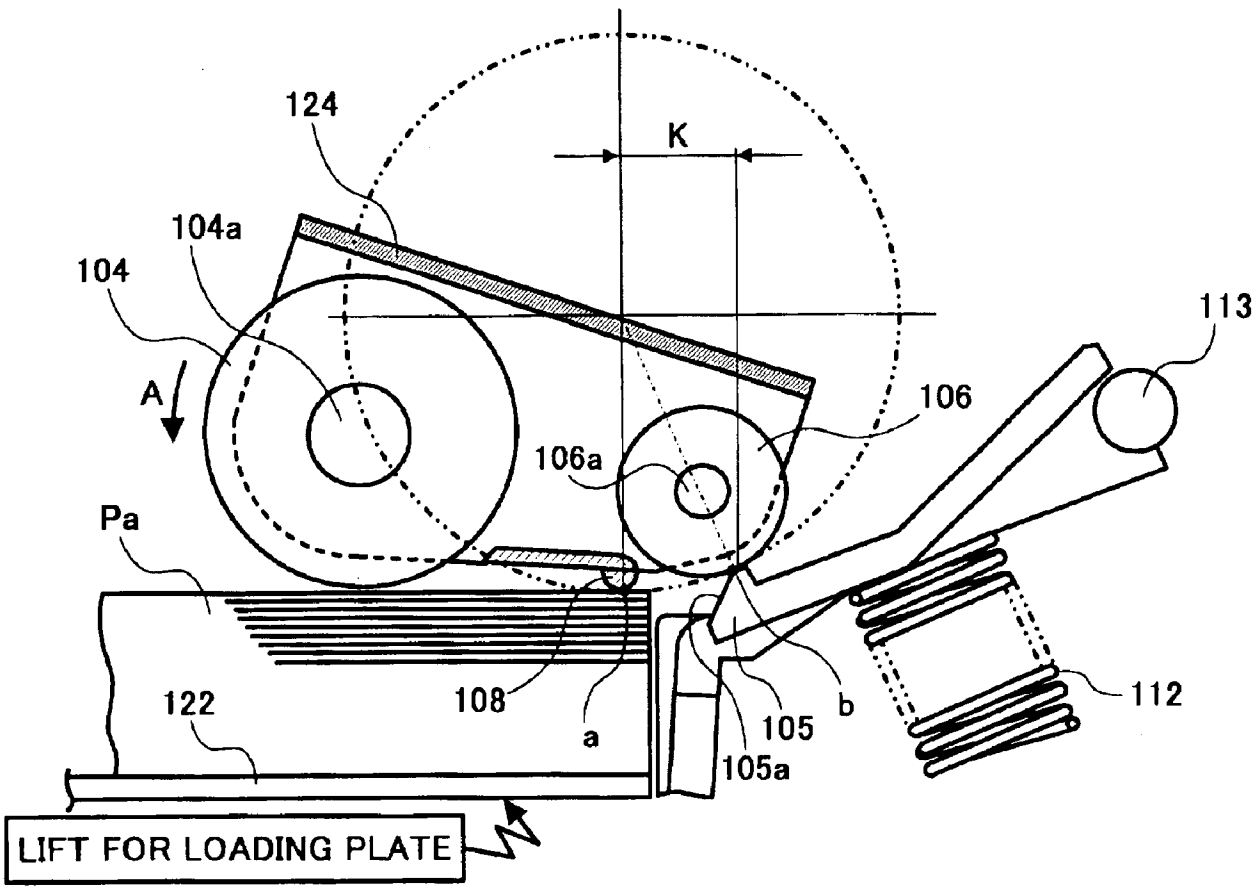
FIG. 72 is a cross-sectional view illustrating the construction of a sheet feeding apparatus according to another embodiment disclosed herein.
Figure 73:
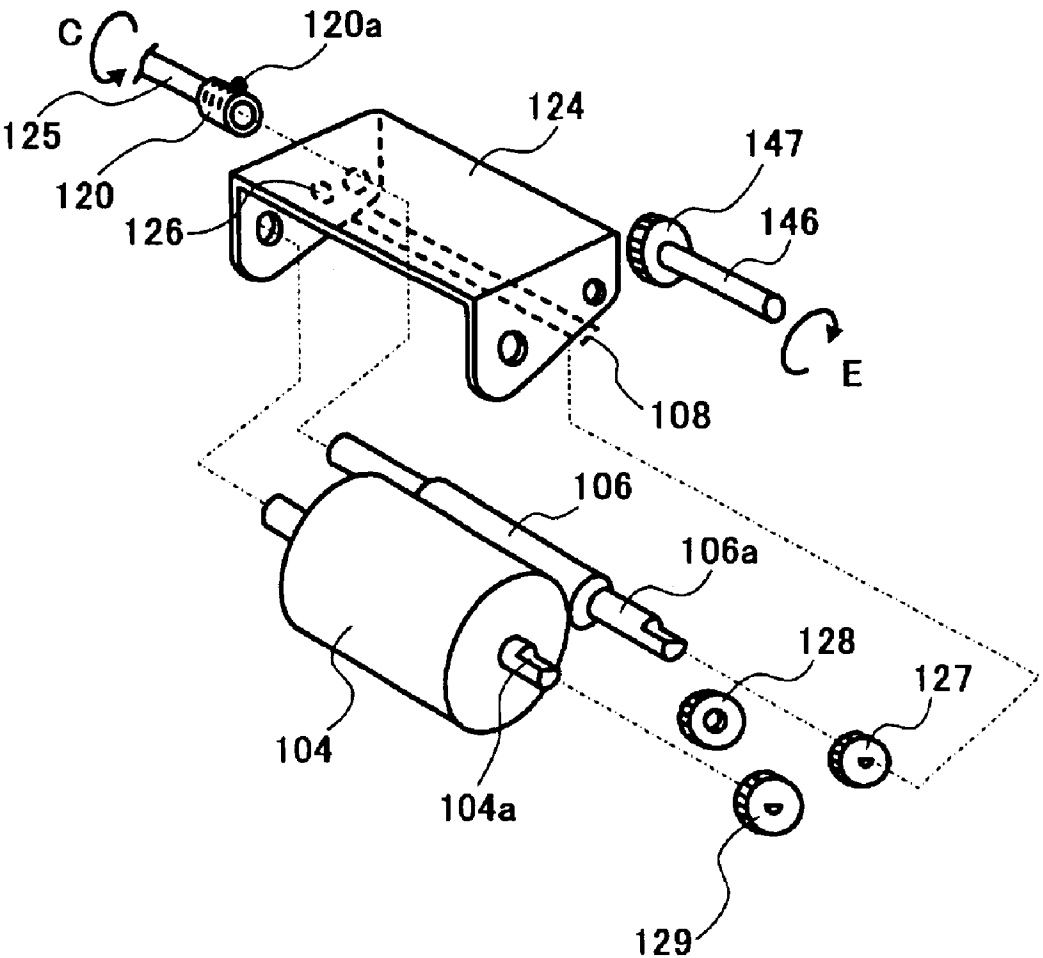
FIG. 73 is a compositional perspective view illustrating the major parts included in the sheet feeding apparatus of FIG. 72.

FIG. 72 is an overall view prepared in a similar manner to FIG. 69 illustrating the construction of the feeding apparatus adapted for loading a large number of sheets materials according to another embodiment disclosed herein, and FIG. 73 is a compositional perspective view thereof. Like reference numerals in FIG. 72 designate identical or corresponding parts shown in FIG. 69.

The sheet feeding apparatus 101 disclosed herein is provided with a sheet loading plate 122 capable of loading a large number of sheets materials, a loading plate elevation mechanism 123 as an elevation mechanism for lifting the sheet loading plate 122 retaining its horizontal orientation, a feeding roller 104 provided to be in pressed contact with, and then to forward further, the uppermost sheet material among the sheet materials loaded on sheet loading plate 122 and then elevated to the sheet feeding position as shown in FIG. 72 by means of elevation mechanism 123, and a taper member 105 provided with a tapered face 105*a*, in which the sheet materials forwarded by feeding roller is separated sheet by sheet for the leading edge of the sheet material 104 colliding with tapered face 105*a*.

In addition, the sheet feeding apparatus 101 is provided with a separation roller 106 rotatably provided so as the circumference thereof to be in contact with the taper member 105, and a support member 124 having a Π-shaped longitudinal cross section as shown in FIG. 73 to support the axial portion 106*a* as the rotation axis of separation roller 106.

In addition, the support member 124 is formed to rotatably support the axial portion 104*a* of feeding roller 104 and, at the same time, oscillatory supported around the axial portion 106*a* of separation roller 106.

Furthermore, a protrusion 108 is also provided being situated between separation roller 106 and feeding roller 104 to be brought in contact with the sheet material Pa forwarded by the feeding roller 104.

The noted loading plate elevation mechanism 123 is previously known, in which there included are two pulleys provided vertically being spatially separated and a belt wound circumferentially around the pulleys and fixed at one point thereof to the sheet loading plate 122, capable of hoisting the sheet loading plate 122 through forward or backward driving of the belt by a motor, for example.

At one end on left side in the drawing of axial portion 106*a* shown in FIG. 73, a torque limiter 120 is provided being attached to a driving axis 125 rotated by a driving source (not shown) in the direction-designated by the arrow C in the drawing. In addition, a fitting pawl 120*a* is provided on the torque limiter 120 to be engaged with a protrusion 126 formed on the one of side walls of the supporting member 124.

By rotating the driving axis 125 in the direction C designated by the arrow in the drawing, the protrusion 126 is pushed down by fitting pawl 120*a* of torque limiter 120, whereby the supporting member 124 is rotated counterclockwise as viewed in FIG. 5 around the axial portion 106*a* of separation roller 106.

Since the above rotation acts to push down the feeding roller 104 supported by the support member 124, the roller 104 comes into pressed contact with the uppermost sheet material among the sheet materials Pa loaded on sheet loading plate 122 elevated to the sheet feeding position as shown in FIG. 72 and presses further down the sheet material as shown in FIG. 72 by means of elevation mechanism 123.

When the downward pressing force increased to the extent large enough for the sheet feeding, the load placed onto the torque limiter 120 increases, thereby causing a slip at the engaging portion in torque limiter 120, whereby the pressure applied onto the sheet material from the feeding roller 104 can be adjusted to remain relatively constant.

At the other end of the axial portion 106*a* of separation roller 106 as shown in FIG. 73, a gear fitting portion is formed having a nearly D-shaped cross section to fix a separation roller gear 127. The separation roller gear 127 is then engaged with an idle gear 128 rotatably supported on the side wall of the support member 124 which is, in turn, engaged with the sheet feeding roller gear 129.

The sheet feeding roller gear 129 is fixed to the gear fitting portion formed at the other end of the axial portion 104*a* of feeding roller 104 having a nearly D-shaped cross section. In addition, a gear 147, which is fixed to the top portion of a roller driving axis 146 formed to be rotated by a driving source (not shown) in the direction designated by the arrow E in the drawing, is engaged with the separation roller gear 127.

Accordingly, by rotating the roller driving axis 146 in the arrow E direction, several rotations is followed in succession such as the rotation of the gear 147 in the same direction, separation roller gear 127 engaged with the gear 147, idle gear 128, and then sheet feeding roller gear 129. As a result, the feeding roller 104 is rotated in the direction of the arrow A as viewed in FIG. 72, to thereby sheet materials Pa be forwarded.

The thus forwarded sheet materials Pa are fed into the portion between separation roller 106 and taper member 105 to thereby be separated sheet by sheet and forwarded further to image forming unit (image printing unit).

Therefore, in the sheet feeding apparatus according to the embodiment disclosed herein as well, since the protrusion 108 is provided being situated between separation roller 106 and feeding roller 104 to be brought in contact with the sheet material, the same conditions as aforementioned can be satisfied by adjusting the distance K, between the protrusion 108 and the point b of separation contact (nip formation) of the separation roller 106 with taper member 105, to be equal to the distance K' (i.e., the distance between sheet feeding point 'a' to separation point 'b' shown in FIG. 69), whereby excellent sheet separation characteristics can be obtained.

Furthermore, the feeding roller 104 can be provided spatially separated from separation roller 106 and the reduction in size for the feeding roller 104 can be achieved.

As described earlier, several units are required for previously known sheet feeding apparatuses with the capability of loading a large number of sheets materials, such as a pressing mechanism for applying a pressurizing force by pressing a feeding roller (pickup roller) onto the uppermost sheet material among the sheet materials loaded on sheet loading plate which is elevated to, and retained for a certain period of time at, the sheet feeding position, and also a separation mechanism including a pressed pair of separation reverse rollers provided downstream of sheet feeding direction from the feeding roller 104 and another feeding roller.

In contrast, by providing the protrusion 108 downstream of sheet feeding direction in the sheet feeding apparatus disclosed herein, the sheet separation component can be formed by including only one separation roller 106 and one taper member 105 in contact therewith, without providing the roller pair in the sheet separation component.

In addition to the advantage affected by cost reduction from eliminating the use of the roller pair, therefore, primary objective such as excellent sheet separation characteristics can be achieved for the sheet feeding apparatus disclosed herein.

Furthermore, since the feeding roller 104 and separation roller 106 are provided one for each herein in place of the previous apparatus provided with two separation rollers on the both sides of the feeding roller 104, the reduction can be achieved in machine space as well as machine costs.

Although the sheet by sheet separation in the present embodiment has been described in reference to FIG. 73 on the case where the separation is carried out through forced rotation of the separation roller utilizing a transmission system consisting a plurality of gears, another construction may alternatively be utilized in which the separation roller gear 127 is rotatably provided with respect to the axial portion 106*a* of separation roller 106 so as to be rotated without constraint from the gears.

In addition, although the portion of separation roller 106 in contact with sheet material is generally formed of rubber, synthetic resinous materials may alternatively used instead. This method for forming the separation roller 106 of synthetic resinous materials may result in a further cost reduction in addition to the reduction from the above noted use of synthetic resinous materials for rubber. This is evident when the casting method is adapted for integral molding the driving parts (separation roller gears) together with the axial portion 106*a*.

Figure 74:
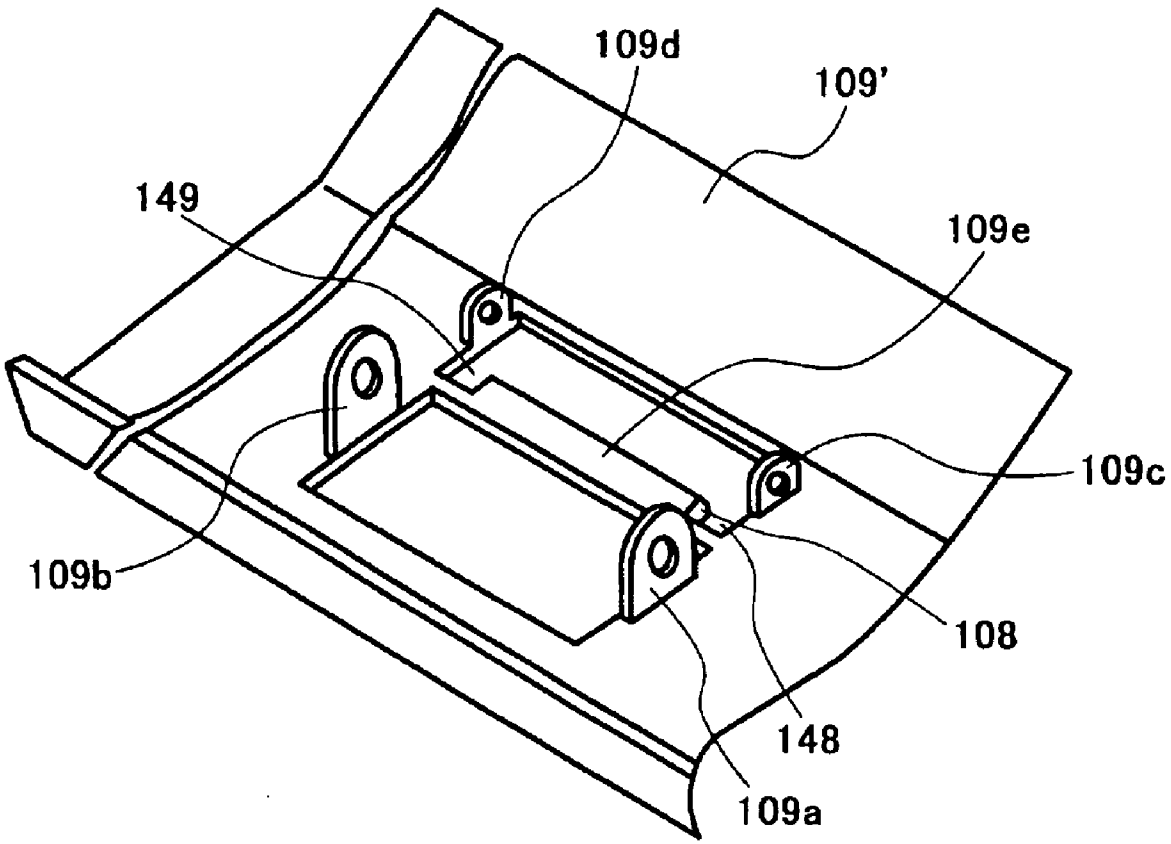
FIG. 74 is a perspective view illustrating a sheet feeding apparatus provided with a solid protrusion formed on a support member by way of elastic deformable portion according to another embodiment disclosed herein.

FIG. 74 is a perspective view illustrating a sheet feeding apparatus provided with a solid protrusion formed on a support member by way of elastic deformable portion. Like reference numerals in FIG. 74 designate identical or corresponding parts shown in FIG. 70.

Figure 75:
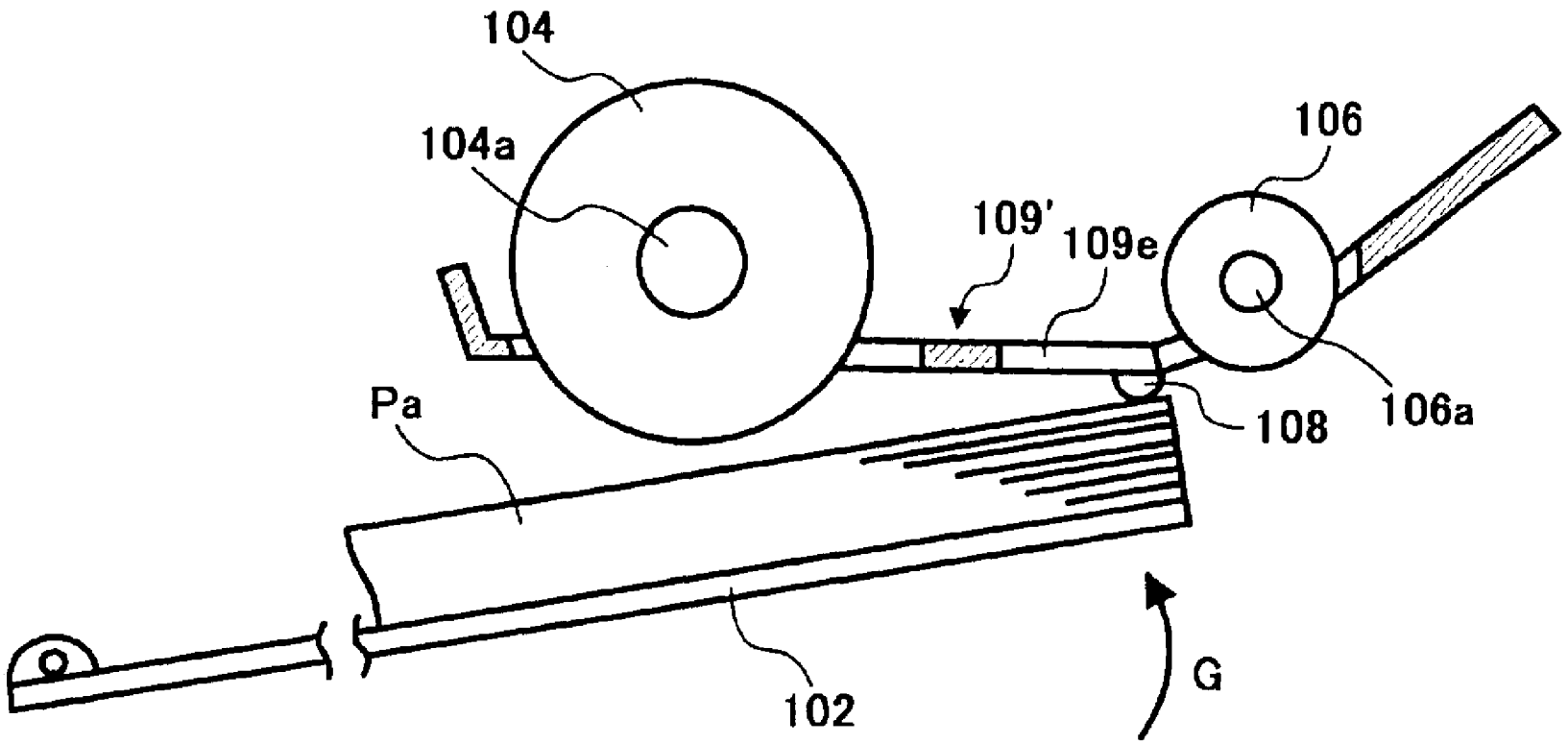
FIG. 75 is a cross-sectional view illustrating the operation of the sheet feeding apparatus of FIG. 74, in which the base plate is rotated.

In the present embodiment, there formed on the feeding guide member 109, which is pivotably supporting both feeding roller 104 and separation roller 106 (FIG. 75), are concave portions 148, 149 formed at the locations corresponding to both ends of the solid protrusion 108 and the elastic deformable portion 109*e*, and the solid protrusion portion 108 is herein mounted onto the feeding guide member 109 as a unit by way of elastic deformable portion 109*e*.

With the construction of the feeding guide member 109 with solid protrusion 108, an advantage is offered as follows. Namely, when the base plate 102 is rotated in the direction designated by the arrow G in the drawing, and when image formation is intended onto a reused sheet (i.e., the rear side of the sheet copied preciously), the edge of this sheet may be either wavy or curled since the sheet was once subjected to fixing steps in the course of previous image formation.

Figure 76:
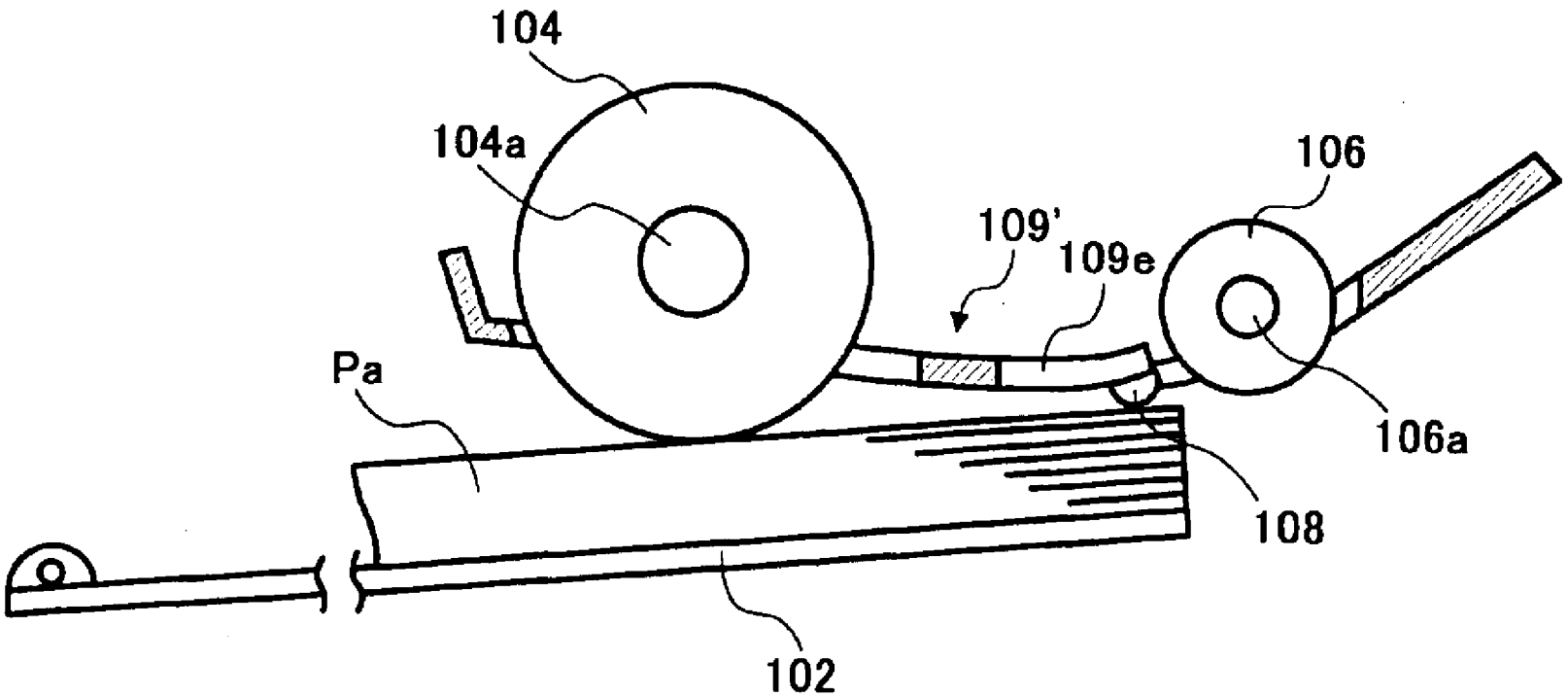
FIG. 76 is another cross-sectional view illustrating the operation of the sheet feeding apparatus of FIG. 74, in which the protrusion 108 is pushed upward.

The contact with the uppermost sheet material Pa loaded on the base plate 102 may be made first by the solid protrusion 108 rather than the feeding roller 104. In such a case, since the solid protrusion 108 is supported by the feeding guide member 109 by way of elastic deformable portion 109*e* which is able to be either twisted or bent, the protrusion 108 is pushed upward as shown in FIG. 76. The contact first by the feeding roller 104 with the uppermost sheet material Pa is therefore secured and a nip is formed between the feeding roller 104 and the sheet material Pa.

As a result, difficulties in sheet feeding such as non-feeding can be obviated. Incidentally, it may be added the noted contact with the uppermost sheet material Pa first by protrusion 108 may also be caused, for example, by fluctuation in size accuracy of parts manufactured.

In addition, the protrusion 108 may alternatively be formed itself of elastic materials in place of the noted solid martial, preferable having a low friction coefficient.

With such a formation, even when the base plate 102 is rotated and the contact with the uppermost sheet material Pa first by protrusion 108 results from the fluctuation in the size accuracy, the contact first by the feeding roller 104 with the uppermost sheet material Pa is again secured since the protrusion 108 can be deformed accordingly.

Furthermore, since the protrusion 108 is formed materials with low friction coefficient in this case, undue load against sheet feeding possibly caused by protrusion 108 onto sheet materiel can be prevented.

As long as the protrusion 108 is situated with respect to feeding roller 104 in such a spatial arrangement as to possibly cause the contact with the uppermost sheet material Pa by the tip of protrusion 108 prior to the feeding roller 104, undue load against sheet feeding may possibly be caused by protrusion 108 onto sheet materiel and also difficulties may result in sheet feeding such as non-feeding.

The ideal spatial arrangement for the tip of protrusion 108 is therefore determined after considering several steps such as for the feeding roller 104 first to be brought into contact with the sheet material prior to the tip of protrusion 108, for a sheet feeding nip portion to be formed between feeding roller 104 and the upper face of sheet material adequately press distorted in the vicinity of the circumference of feeding roller 104, and then for the tip of protrusion 108 to be brought into contact with the sheet material.

The spatial arrangement for the tip of protrusion 108 can be determined more preferably when durability and abrasion over time of the feeding roller 104 are taken into consideration for the arrangement.

Figure 77:
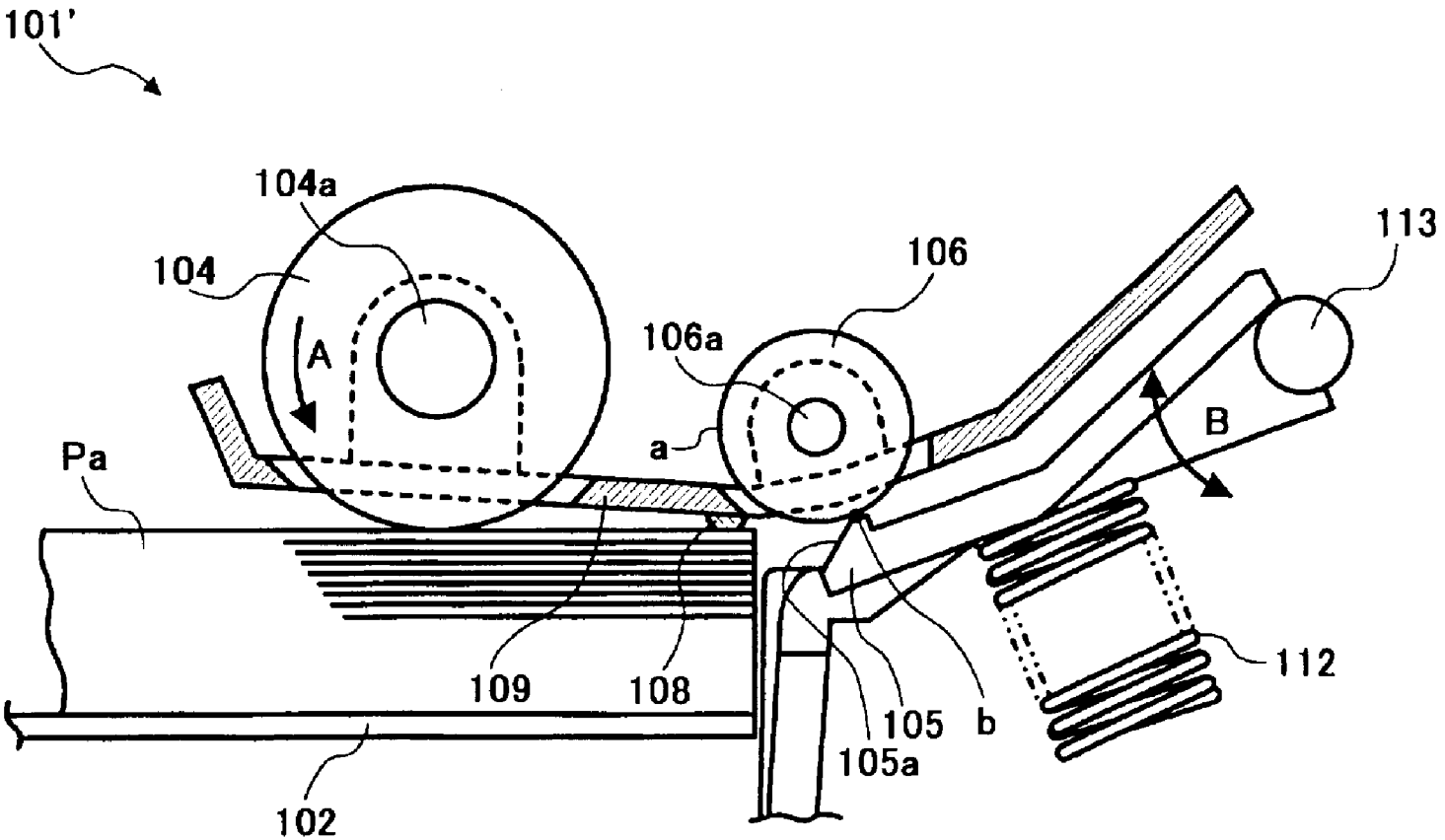
FIG. 77 is a cross sectional view illustrating the sheet feeding apparatus provided with the means for delaying the timing of driving the separation roller from that of feeding roller according to another embodiment disclosed herein.
Figure 78:
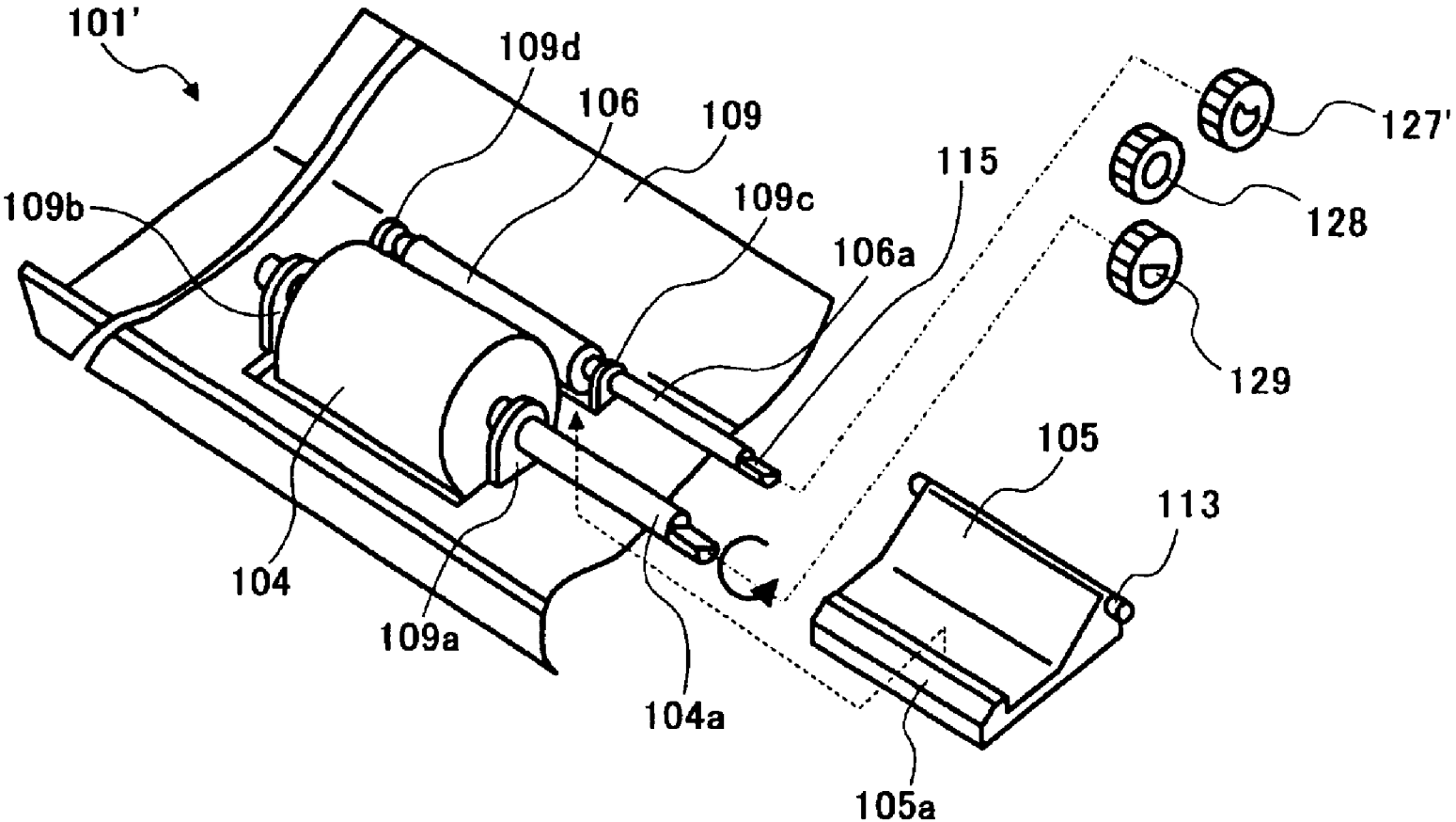
FIG. 78 is a compositional perspective view illustrating the major parts of the sheet feeding apparatus of FIG. 77.
Figure 79:
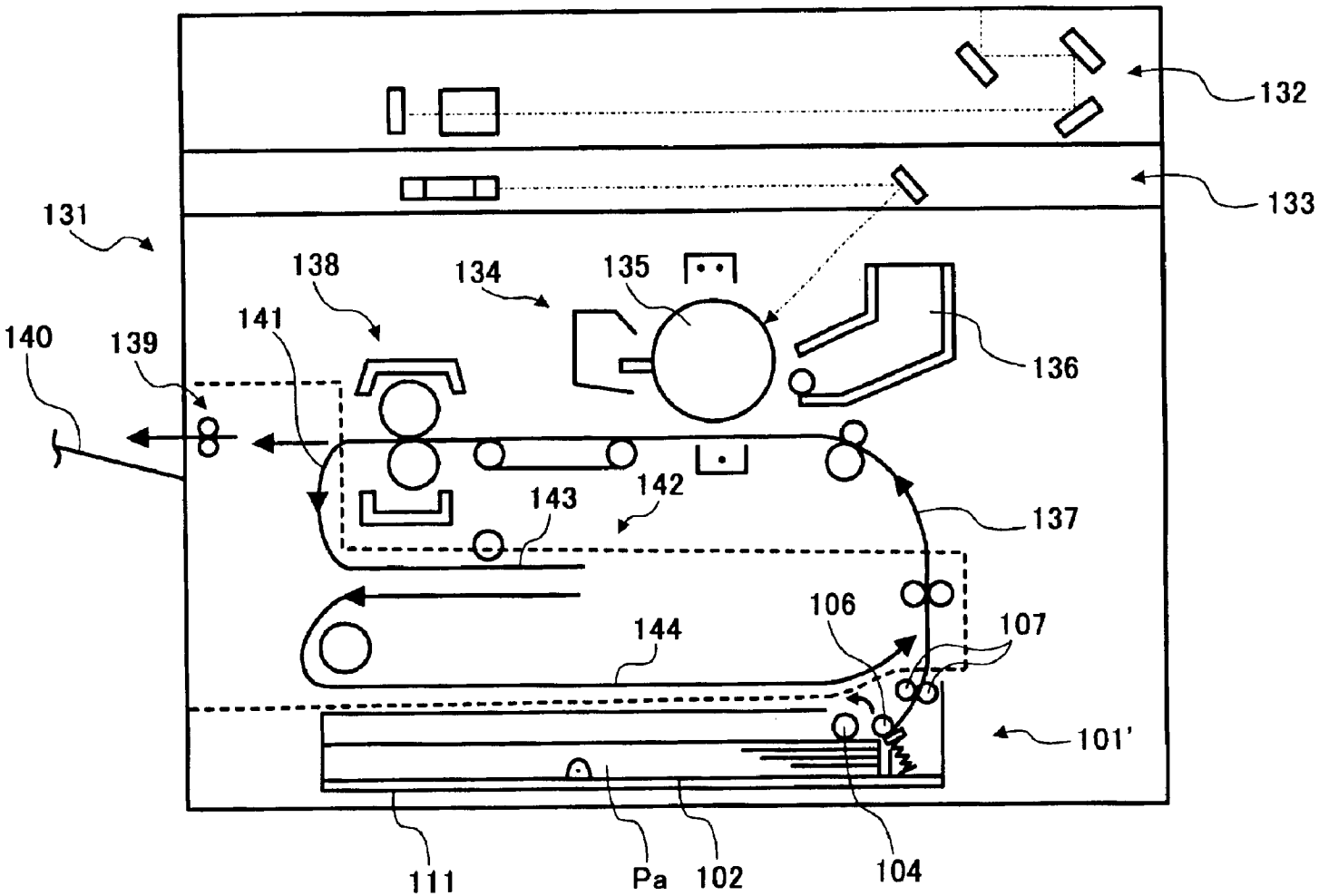
FIG. 79 is an overall cross sectional view illustrating the image forming apparatus provided with the means for delaying the timing of FIG. 77.

FIG. 77 is an overall view illustrating the sheet feeding apparatus provided with the means for delaying the timing of driving the separation roller 106 from that of feeding roller 104 according to another embodiment disclosed herein, FIG. 78 is a perspective view of thereof, and FIG. 79 is an overall view illustrating an image forming apparatus provided with the sheet feeding apparatus disclosed herein. Like reference numerals in FIGS. 77 though 79 designate identical or corresponding parts shown in FIGS. 69 through 71.

In addition, the image forming apparatus shown in FIG. 79 has a similar construction to that of FIG. 71 with the exception that a sheet feeding apparatus 101' is incorporated into the apparatus of FIG. 79. Detailed description is therefore abbreviated on the constriction and characteristics excepting the points relevant to the present embodiment.

Referring to FIG. 77, the sheet feeding apparatus 101' is formed in a similar manner to the apparatus 101 of FIG. 69.

The sheet feeding apparatus 101' is provided with a base plate 102 as a sheet loading member pivotably supported around the left side edge (in the drawing) thereof, a feeding roller 104 provided as feeding means so as to be in contact with the leading edge (the right hand side edge in the drawing) of sheet materials Pa which are loaded on the base plate 102 and lifted by the swinging movements of the base plate 102, to subsequently forward to the direction 'A' designated by the arrow in the drawing, and a taper member 105 provided colliding with the leading edge of the sheet, whereby a plurality of sheet materials Pa are separated sheet by sheet with the taper member 105.

In addition, the sheet feeding apparatus 101' is provided with a separation roller 106 so as the circumference thereof to be in contact with the taper member 105, and a feeding guide member 109 which has a protrusion 108 situated between the separation roller 106 and feeding roller 104 to be brought in contact with the sheet material Pa fed by the feeding roller 104, and which pivotably supports the protrusion 108 together with separation roller 106 and feeding roller 104.

The taper member 105 is mounted also piovatably around a fulcrum 113 in the direction designated by the arrow 'B' in the drawing so as the bottom face thereof be pressed upward with a pressing force exerted by a separation coiled spring 112, to thereby for taper member 105 be brought into contact with the circumference of separation roller 106 by the pressing force from coiled spring 112.

On the feeding guide member 109, a pair of supports 109*a*, 109*b* is formed as shown in FIG. 78 by the cut-upright method, for example, for supporting both ends of the axial portion 104*a* of feeding roller 104 so as the axial portion 104*a* be pivotably supported. Also on the feeding guide member 109, a pair of supports 109*c*, 109*d* is formed by the cut-upright method, for example, for supporting both ends of the axial portion 106*a* of separation roller 106 so as the axial portion 104*a* be pivotably supported.

By the swinging movements of the base plate 102 counterclockwise as shown in FIG. 69 during sheet feeding steps, the leading edge of the sheet material loaded on the base plate 102 is brought into contact with the feeding roller 104.

When the feeding roller 104 is then rotated in the direction designated by the arrow 'A' in the drawing, the uppermost sheet material Pa is forwarded to the taper member 105, and in case of more than one sheet material Pa is fed into the portion between separation roller 106 and taper member 105, the plural sheet materials Pa are separated sheet by sheet to be subsequently forwarded further.

The sheet feeding apparatus 101' disclosed herein is also provided with protrusion 108 between separation roller 106 and feeding roller 104, in a similar manner to the apparatus 101. With the thus formed protrusion 108, the same aforementioned conditions can be satisfied by adjusting the distance K, between the protrusion 108 and the point b of separation contact (nip formation) of the separation roller 106 with taper member 105, to be equal to the distance K' (i.e., the distance between sheet feeding point 'a' to separation point 'b' shown earlier).

As a result, modulus values are seemingly equated to various sheet materials even for different kinds of sheet materials presently used, whereby excellent sheet separation characteristics can be obtained.

Furthermore, the protrusion 108 in the present embodiment is formed as one unit on the feeding guide member 109 which also pivotably supports both separation roller 106 and feeding roller 104.

As a result, both the spatial relation of protrusion 108 relative to feeding roller 104 and the accuracy of the distance between protrusion 108 and the separation point 'b' can be improved over the case where these units are formed individually, whereby the sheet feeding quality can be stabilized.

In case where the sheet feeding is carried out as in the sheet feeding apparatus 101', in which a large number of sheets materials previously cut into a predetermined size are loaded in a multi-layered manner on the sheet loading plate 102 to be separated by means of the separation roller 106 and taper member 105, there may give rise to further difficulties such as the multiple feeding (i.e., feeding of two or more sheets) caused by a densely adhered leading edge portion of layered sheet materials, that is caused either by weld flash previously formed during sheet cutting process steps or by the attraction generated by electrostatic charging.

In order to obviated such difficulty, the sheet feeding apparatus 101' is provided with the means for delaying the timing of driving the separation roller 106 from that of feeding roller 104 according to another embodiment disclosed herein. By utilizing the thus formed apparatus, stable sheet feeding can be made even in case feeding of two or more of adhered sheets are simultaneously fed by the feeding roller 104.

Figure 80:
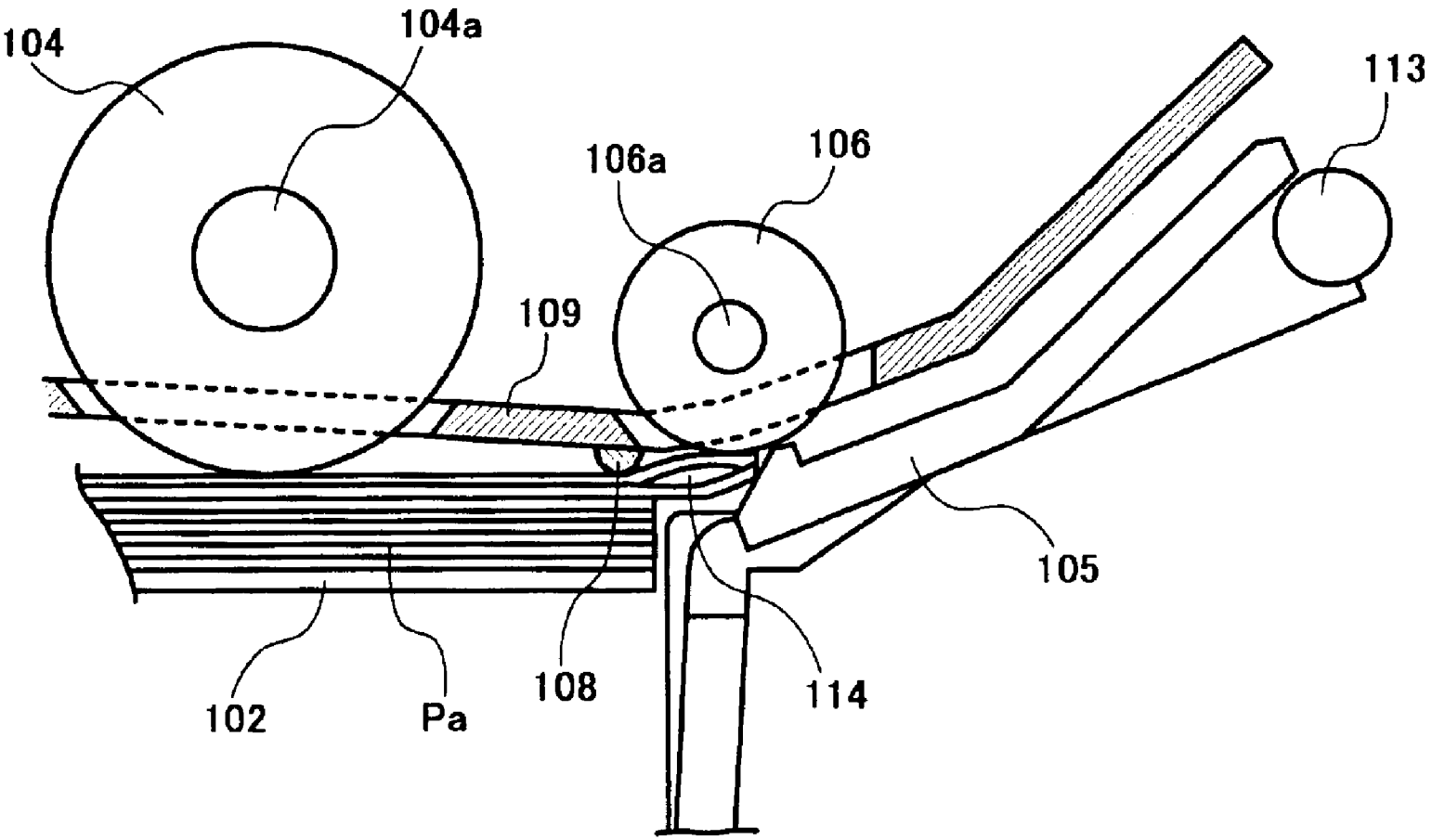
FIG. 80 is another cross sectional view illustrating the image forming apparatus provided with the means for delaying the timing of FIG. 77, in which a layer of air is formed between layered sheet materials.

Namely, in such as case, the forwarded sheet materials are blocked by the nip between separation roller 106 and taper member 105, which is non-operative because of the delayed timing, the leading edge portion of the sheet materials presently blocked by the nip portion are now bent as shown in FIG. 80 according to the delayed time length, and then layers of air 111 are formed between layered sheet materials. The strength of the noted adhesive force is therefore decreased, and sheet materials are securely separated sheet by sheet.

As a result, stable separation and feeding can be made of the sheet materials to thereby excellent sheet separation characteristics be achieved.

Figure 81:
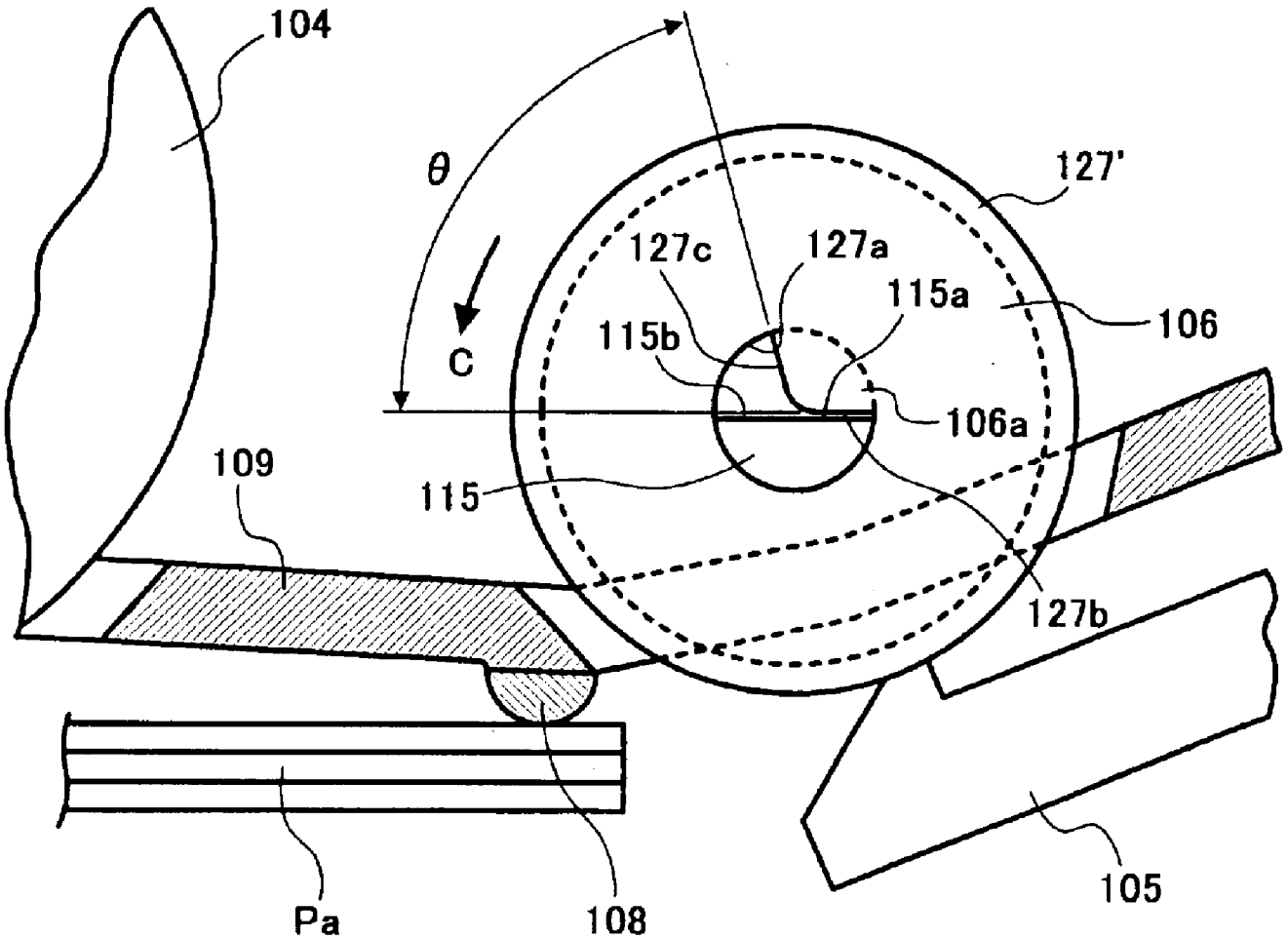
FIG. 81 is an enlarged cross sectional view illustrating the operation of the means for delaying the timing of FIG. 77, in which an axis fitting hole having nearly C-shape is formed approximately in the middle of the separation roller gear.
Figure 82:
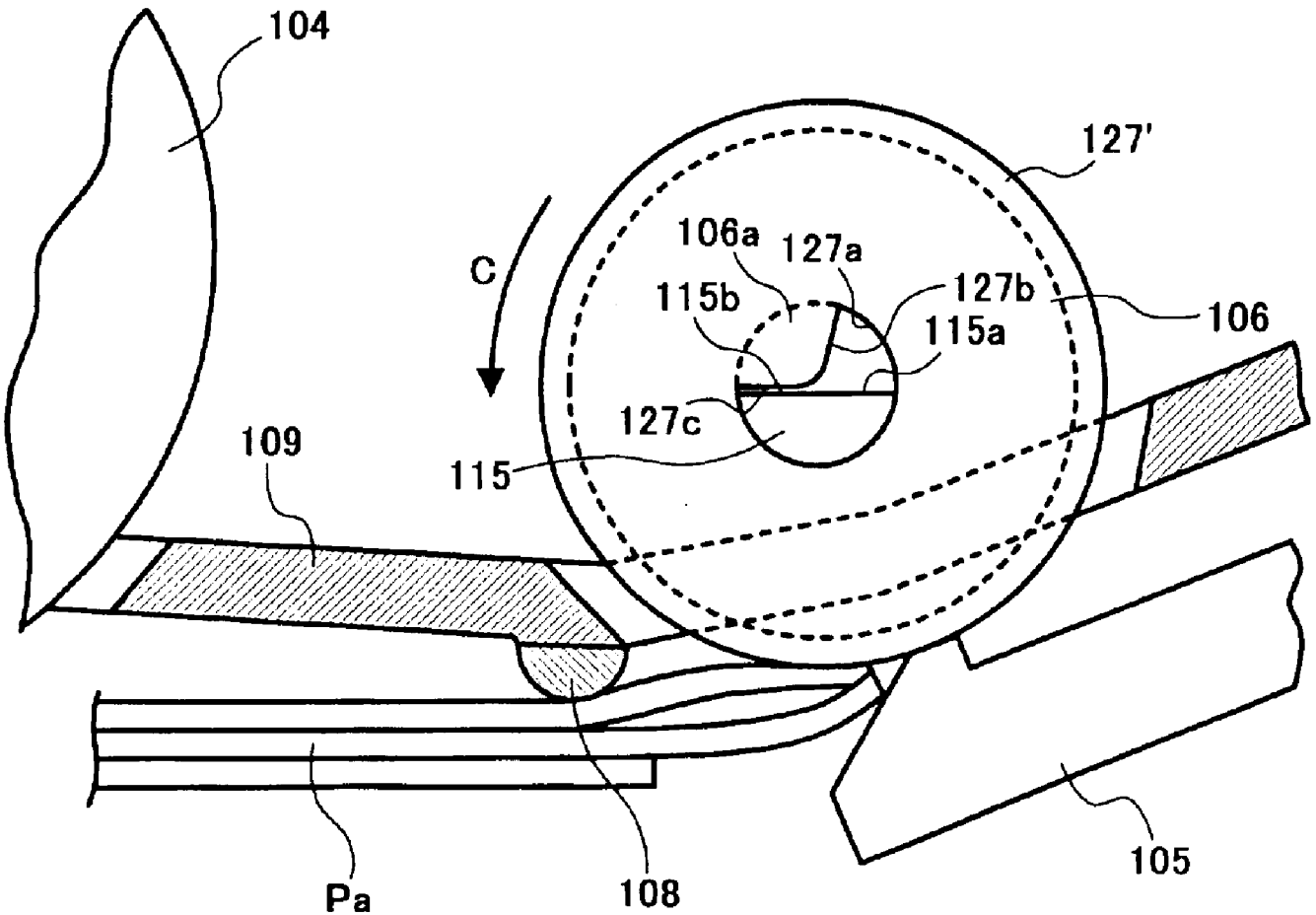
FIG. 82 is another enlarged cross sectional view illustrating the operation of the means for delaying the timing of FIG. 77, in which a gear fixing portion mounted at one end of axial portion of separation roller is engaged with the axis fitting hole by penetrating there into.

Referring to FIGS. 81 and 82, there will be described in the next place the means for delaying the timing of driving the separation roller from that of feeding roller.

At the other end of the axial portion 106*a* of separation roller 106 as shown in FIG. 78, a gear fitting portion 115 is formed having a nearly D-shaped cross section to fix a separation roller gear 127'. The separation roller gear 127' is then engaged with an idle gear 128 rotatably supported, which is, in turn, engaged with the sheet feeding roller gear 129.

In the middle of the separation roller gear 127' shown in FIGS. 81 and 82, there formed is an axis fitting hole 127*a* having nearly C-shape, and a gear fixing portion 115 mounted at one end of axial portion 106*a* of separation roller 106 is engaged with the axis fitting hole 127*a* by penetrating there into.

In addition, the axis fitting hole 127*a* is formed such that, when a first half of planar portion 115*a* of the gear fixing portion 115 is in contact with hole end face 127*c* as shown in FIG. 81, a gap having an angle θ is formed between a second half of planar portion 115*a* and hole end face 127*c*.

The above noted arrangement is at start position of sheet feeding for the means for delaying the timing. When the rotation of feeding roller 104 is initiated, the separation roller gear 127' starts rotating in the C direction in the drawing.

In the course of the rotation, however, since the gap of angle θ is formed between a second half of planar portion 115*a* and hole end face 127*c*, the separation roller 106 is not rotated up to the point where the angle becomes zero. That is, the timing of driving is delayed for the separation roller 106 with respect to that of feeding roller 104.

In addition, when a second half of planar portion 115*b* of the gear fixing portion 115 is in contact with hole end face 127*c* as shown in FIG. 82, the angle θ and accordingly the gap become zero, the rotation of axial portion 106*a* of separation roller 106 is initiated concomitant with the rotation of separation roller gear 127' in the C direction in the drawing.

Subsequently, the rotation of the feeding roller 104 is ceased at a predetermined timing after completing the sheet feeding by halting the rotation of the driving source. At the same time, the rotation of separation roller gear 127', which is rotated by the same driving source, is also halted.

The sheet material, for which the leading edge thereof has passed through the separation roller 106, is forwarded continuously by feeding roller pair 107 shown in FIG. 79. The separation roller 106 is therefore concomitantly rotated toward the C direction in FIG. 82 together with axial portion 106*a* as long as the separation roller 106 is in contact with the sheet material Pa.

Since the separation roller gear 127' is not rotated this time, the axial portion 106*a* is rotated up to the point where the planar portion 115*a* coincide with the hole end face 127*c*, and the noted gap having the angle θ is formed again between planar portion 115*a* and hole end face 127*c*, thereby returning to the start or feed ready status.

Therefore, utilizing the thus formed sheet feeding apparatus, the timing for driving the separation roller 106 can be delayed by the period of time corresponding to the angle θ shown in FIG. 81, even both feeding roller 104 and separation roller 106 are driven by a single driving source.

Figure 83:
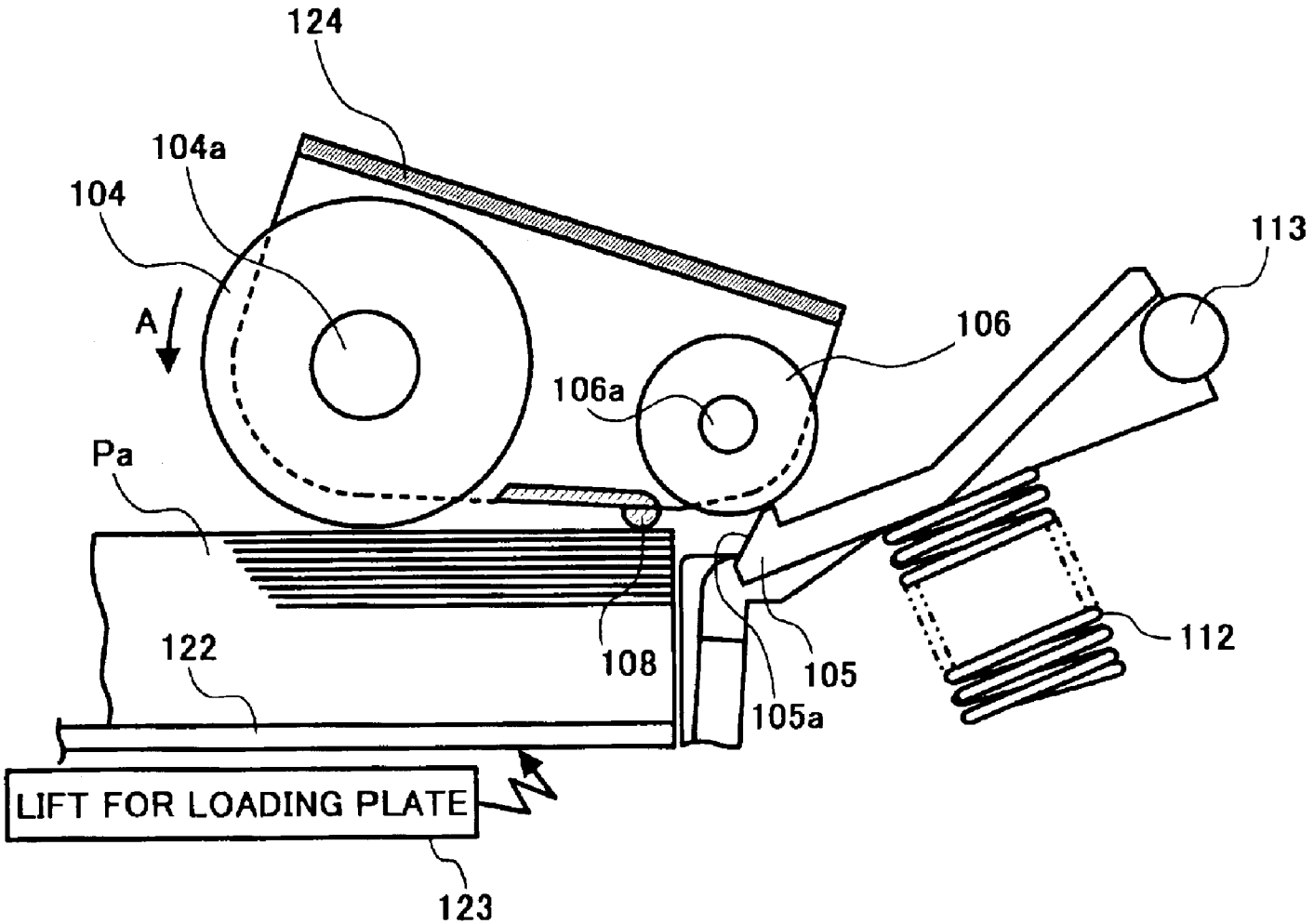
FIG. 83 is an overall cross-sectional view illustrating the feeding apparatus capable of loading a large number of sheets materials, being provided with the noted delay means according to another embodiment disclosed herein.
Figure 84:
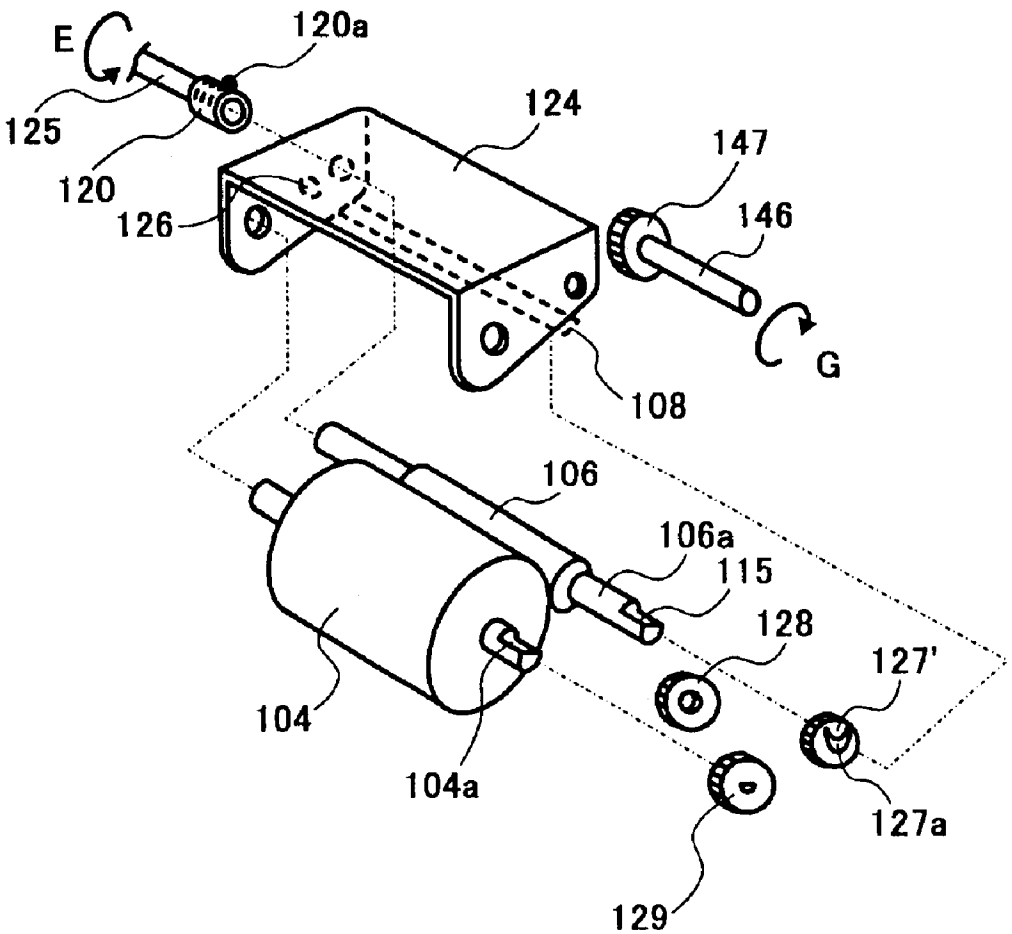
FIG. 84 is a compositional perspective view of the feeding apparatus of FIG. 83, in which the sheet feeding apparatus is provided with a separation roller so as the circumference thereof to be in contact with the taper member and a support member having a Π-shaped longitudinal cross section to support the axial portion as the rotation axis of separation roller.

FIG. 83 is an overall view prepared in a similar manner to FIG. 77 illustrating the feeding apparatus, which is capable of loading a large number of sheets materials, and which is provided with the noted delay means according to another embodiment disclosed herein, and FIG. 84 is a compositional perspective view thereof. Like reference numerals in FIGS. 83 and 84 designate identical or corresponding parts shown in FIGS. 72 and 73.

In a similar manner to the apparatus of FIG. 72, the sheet feeding apparatus disclosed herein is provided with a sheet loading plate 122 capable of loading a large number of sheet materials, a loading plate elevation mechanism 123 as an elevation mechanism for lifting the sheet loading plate 122 retaining its horizontal orientation, a feeding roller 104 provided to be in pressed contact with, and then to forward further, the uppermost sheet material among the sheet materials Pa loaded on sheet loading plate 122 and then elevated to the sheet feeding position as shown in FIG. 83 by means of elevation mechanism 123, and a taper member 105 provided with a tapered face 105*a*, in which the sheet materials forwarded by feeding roller is separated sheet by sheet for the leading edge of the sheet material 104 colliding with tapered face 105*a*.

In addition, the sheet feeding apparatus is provided with a separation roller 106 rotatably provided so as the circumference thereof to be in contact with the taper member 105, and a support member 124 having a Π-shaped longitudinal cross section as shown in FIG. 84 to support the axial portion 106*a* as the rotation axis of separation roller 106.

Also, the support member 124 is formed to rotatably support the axial portion 104*a* of feeding roller 104 and, at the same time, oscillatory supported around the axial portion 106*a* of separation roller 106.

Furthermore, a protrusion 108 is also provided in a similar manner to FIG. 73 being situated between separation roller 106 and feeding roller 104 to be brought in contact with the sheet material Pa forwarded by the feeding roller 104.

It is noted herein that the present feeding apparatus is different from that of FIG. 73 in regard to the delaying mechanism of FIG. 81 additionally provided, in which the timing for driving the separation roller 106 can be delayed by the period of time corresponding to the angle θ from that of feeding roller 104. This difference will be detailed herein below.

At the other end of the axial portion 106*a* of separation roller 106 as shown in FIG. 84, a gear fitting portion 115 is formed as shown in FIGS. 78, 81 and 82.

In the middle of the separation roller gear 127' shown in FIG. 78, there formed is an axis fitting hole 127*a* having nearly C-shape, a gear fixing portion 115 mounted at one end of axial portion 106*a* of separation roller 106 is engaged with the axis fitting hole 127*a* by penetrating thereinto, and the timing for driving the separation roller 106 can be delayed by the period of time corresponding to the angle θ from that of feeding roller 104, as shown in FIG. 81.

Incidentally, the separation roller gear 127' is then engaged with an idle gear 128 rotatably supported, which is, in turn, engaged with the sheet feeding roller gear 129.

The sheet feeding roller gear 129 is fixed to the gear fitting portion formed at the other end of the axial portion 104*a* of feeding roller 104 having a nearly D-shaped cross section. In addition, a gear 147, which is fixed to the top portion of a roller driving axis 146 formed to be rotated by a driving source (not shown) in the direction designated by the arrow G in the drawing, is engaged with the separation roller gear 127'.

Accordingly, by rotating the roller driving axis 146 in the arrow G direction, several rotations is followed in succession such as the rotation of the gear 147 in the same direction, separation roller gear 127 engaged with the gear 147, idle gear 128, and then sheet feeding roller gear 129. As a result, the feeding roller 104 is rotated in the direction of the arrow A as viewed in FIG. 72, to thereby sheet materials Pa be forwarded.

The thus forwarded sheet materials Pa are fed into the portion between separation roller 106 and taper member 105 to thereby be separated sheet by sheet and forwarded further to image forming unit (image printing unit).

The sheet feeding apparatus disclosed herein is also provided with the protrusion 108 between separation roller 106 and feeding roller 104 to be brought in contact with the sheet material, excellent sheet separation characteristics can be obtained.

Therefore, by providing the protrusion 108 downstream of sheet feeding direction in the sheet feeding apparatus disclosed herein capable of hoisting sheet loading plate 122 retaining its horizontal orientation and then feeding a large number of sheet materials, the sheet separation component can be formed by including only one separation roller 106 and one taper member 105 in contact therewith, without providing the roller pair in the sheet separation component.

As a result, in addition to the advantage affected by cost reduction from eliminating the use of the roller pair, primary objective such as excellent sheet separation characteristics can be achieved for the sheet feeding apparatus.

Figure 85:
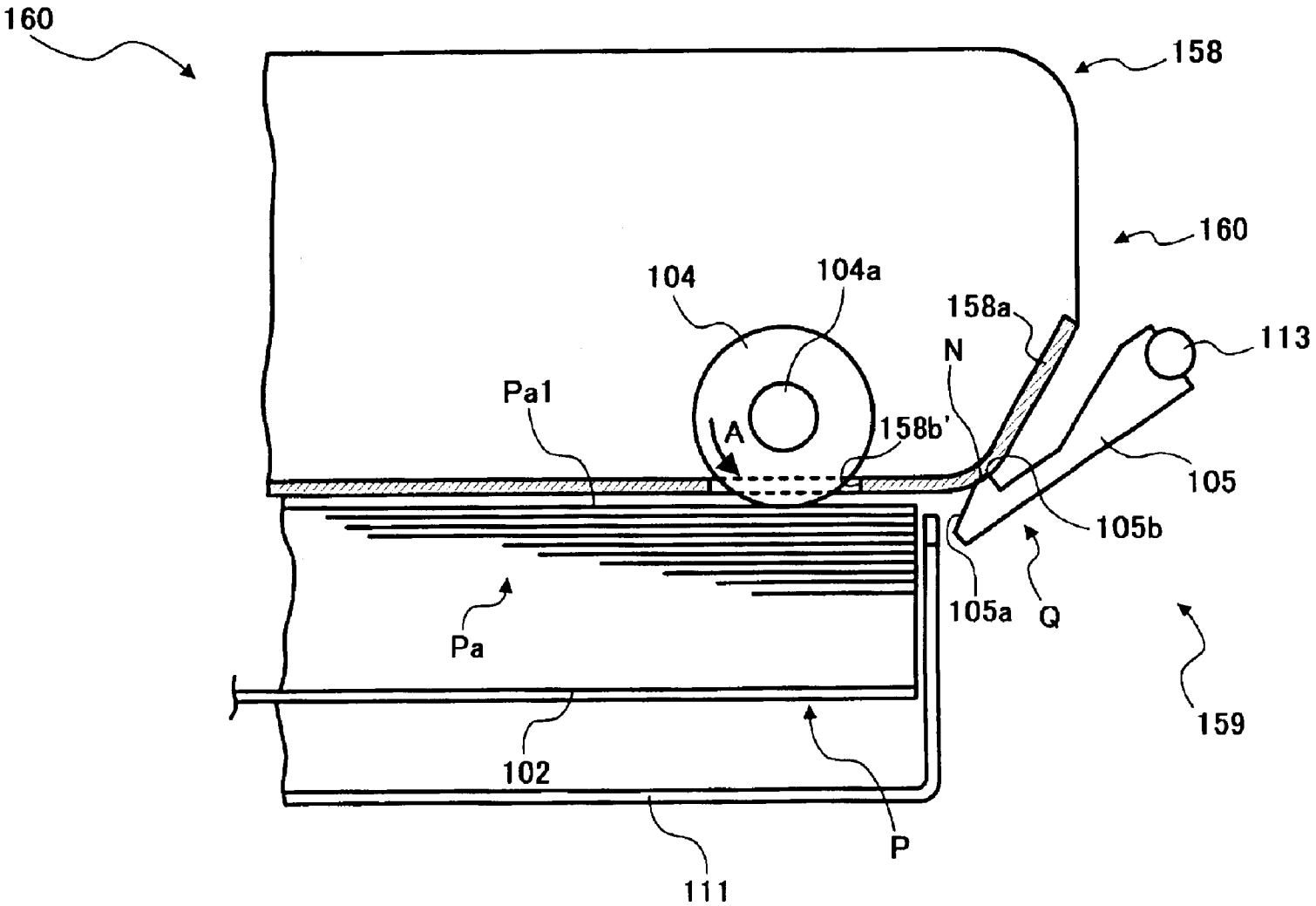
FIG. 85 is a cross sectional view illustrating the construction of the feeding apparatus provided with a feeding guide and a taper member pressure attached thereto according to another embodiment disclosed herein.
Figure 86:
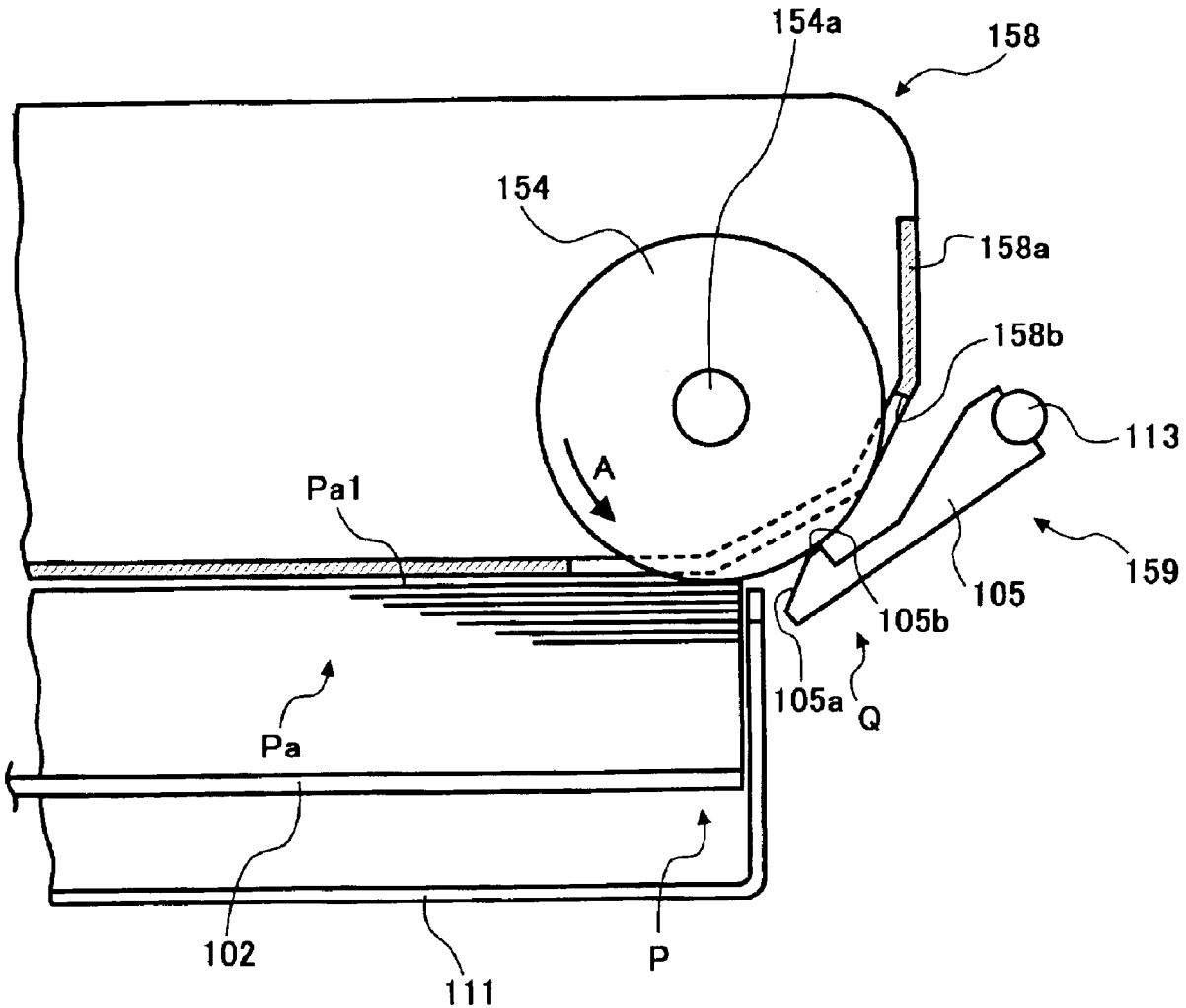
FIG. 86 is a similar cross sectional view illustrating conventionally known feeding apparatus provided with a feeding guide and a taper member pressure.

FIG. 85 is a cross sectional view illustrating the construction of the feeding apparatus provided with a feeding guide and a taper member pressure attached thereto according to another embodiment disclosed herein, and FIG. 86 is a similar cross sectional view of conventionally known feeding apparatus also provided with a feeding guide and a taper member pressure attached thereto. Like reference numerals are designated for identical or corresponding parts shown in FIGS. 85 and 86.

Referring to FIG. 86, the sheet feeding apparatus is formed including at least a base plate 102 (partially shown) mounted over a sheet feeding cassette 111, as a sheet loading unit, capable of loading a plurality of sheet materials Pa, in which one edge portion of the base plate 102 is pivotably supported by a supporting axis, and the other edge of which is free to be continually pressed upward with sheet feeding pressure P exerted by a coiled spring (not shown) attached to the cassette 11.

The sheet feeding cassette 111 is provided detachably to a sheet feeding chases 158 as a feeding guide unit, to which a feeding roller 154 is rotatably provided. In addition, a feeding guide 158*a* as a separation member is formed on the sheet feeding chases 158 as a unit, and the portion of the feeding roller 154 is protruded downward penetrating through a cutting portion 158*b*, to be pressed against the leading edge of the uppermost sheet material $Pa_1$.

In addition, the base portion of the taper member 105 is oscillatory supported around an axial fulcrum 113 attached to a chases 159, as another chases aside from the sheet feeding chases 158, and the taper member 105 is pressed clockwise as viewed in FIG. 86 with a separation pressure Q exerted by a coiled spring or torsion spring.

At the end of the taper member 105, a tapered face 105*a* is formed, and a contact face 105*b* neighboring thereto is brought into contact with the circumference of a forwarding roller 154.

When the forwarding roller 154 is then rotated in the direction designated by the arrow A in the drawing, both uppermost sheet material $Pa_1$ in contact with forwarding roller 154 and plural sheet materials Pa in contact therewith through friction are forwarded toward right in the drawing, and then collides with the tapered face 105*a* of taper member 105.

By adjusting in this moment the angle between the sheet forwarding direction and the tapered face 105*a* to be within a predetermined range, the combination of the forwarding roller 154 and contact face 105*b* can properly serve to forward the uppermost sheet material $Pa_1$ toward the image forming unit, without the undue non-feeding.

With such construction as described above, however, the circumference of the forwarding roller 154 has to be large enough to be in contact with both sheet material Pa and taper member 105, simultaneously, which results in a large diameter for the forwarding roller 154 and difficulties in reducing the size of the sheet feeding apparatus as a whole.

Accordingly, referring now to FIG. 85, the sheet feeding apparatus 160 is formed according to another embodiment disclosed herein, including at least a base plate 102 as a sheet loading unit capable of loading a plurality of sheet materials Pa, one edge portion at left hand side (not shown) of which is pivotably supported, and the other edge of which is free to be continually pressed upward with a feeding pressure P exerted between a sheet feeding cassette 111, a sheet feeding chases 158 detachably mounting the sheet feeding cassette 111, and a feeding roller 104 rotatably attached to sheet feeding chases 158 through the axial portion 104*a* of the roller 104, to whereby the sheet feeding chases 158 serves as a support for the feeding roller 104.

The sheet feeding chases 158 is formed as a unit, together with feeding guide 158*a* situated under the chases 158, and the portion of the feeding roller 104 is protruded downward penetrating through a cutting portion 158*b'* formed on the feeding guide 158*a*, to be pressed against the uppermost sheet material $Pa_1$.

In addition, the taper member 105 having tapered face 105*a* and contact face 105*b* is oscillatory supported around an axial fulcrum 113 attached to a chases 159, as another chases aside from the sheet feeding chases 158, and the contact face 105*b* of taper member 105 is pressed with a separation pressure Q against the lower face of feeding guide 158*a*.

The angle θ between the sheet forwarding direction and the longitudinal direction of tapered face 105*a* of the taper member 155 is adjusted during the noted steps to be within a predetermined range (from 50° to 70°), thereby resulting a considerably small width of the contact face 105*b*.

For the thus constructed sheet feeding apparatus 160, when the feeding roller 104 is rotated from the status shown in FIG. 85 toward the direction designated by the arrow A, both uppermost sheet material $Pa_1$ in contact with forwarding roller 154 and plural sheet materials Pa in contact therewith through friction are forwarded toward right in the drawing, and then collides with the tapered face 105*a* of taper member 105.

Accordingly, a force component in the direction for the longitudinal face of the tapered face 105*a* is generated from the total force exerted at the face 105*a* and the uppermost sheet material $Pa_1$ is forwarded slantingly upward by the force component. Subsequently, the uppermost sheet material $Pa_1$ is forwarded along the tapered face 105*a* and then reaches the nip forming portion N.

At this moment, the force component, which is parallel to the separation pressure Q, of the force exerted at the tapered face 105*a* from the uppermost sheet material $Pa_1$ has to be considered. If this force component is adjusted to be larger than the separation pressure Q, the uppermost sheet material $Pa_1$ can climb over the nip forming portion N, and then surely forwarded to the image forming unit (not shown).

For the next sheet material 2*b* situated immediately under the uppermost sheet material 2*a*, another force component, which is directed slantingly upward along the surface of tapered face 105*a*, is generated from friction between the sheet material one more sheet down.

Since the friction coefficient between sheet materials is generally as large as about 50% of that between the sheet material and feeding guide 158*a*, a force large enough to climb over the tapered face 6*a* is not generated in the present case, and the sheet material 2*b* is halted by the taper member 6, to thereby be separated from the uppermost sheet material 2*a*. As a result, the multiple feeding is obviated.

According to the present embodiment, since the taper member 105 has not necessarily be in contact with the feeding roller 104, the reduction in size of the feeding roller 104 and the improvement in durability of the feeding roller 104 and tapered member 105 becomes feasible, whereby operation characteristics for these units can be retained for a long term.

In addition, the feeding guide 158*a* in contact with the taper member 105 is formed as a unit together with the sheet feeding chases 158 which is axially supporting the feeding roller 104.

As a result, the accuracy of spatial arrangement of the sheet materiel in contact with feeding roller 104 relative to taper member 105 can be improved over the case where these units are formed individually, whereby the angle of entry into the separation unit for the sheet material is stabilized and sheet separation characteristics can be stabilized for a long period.

Figure 87:
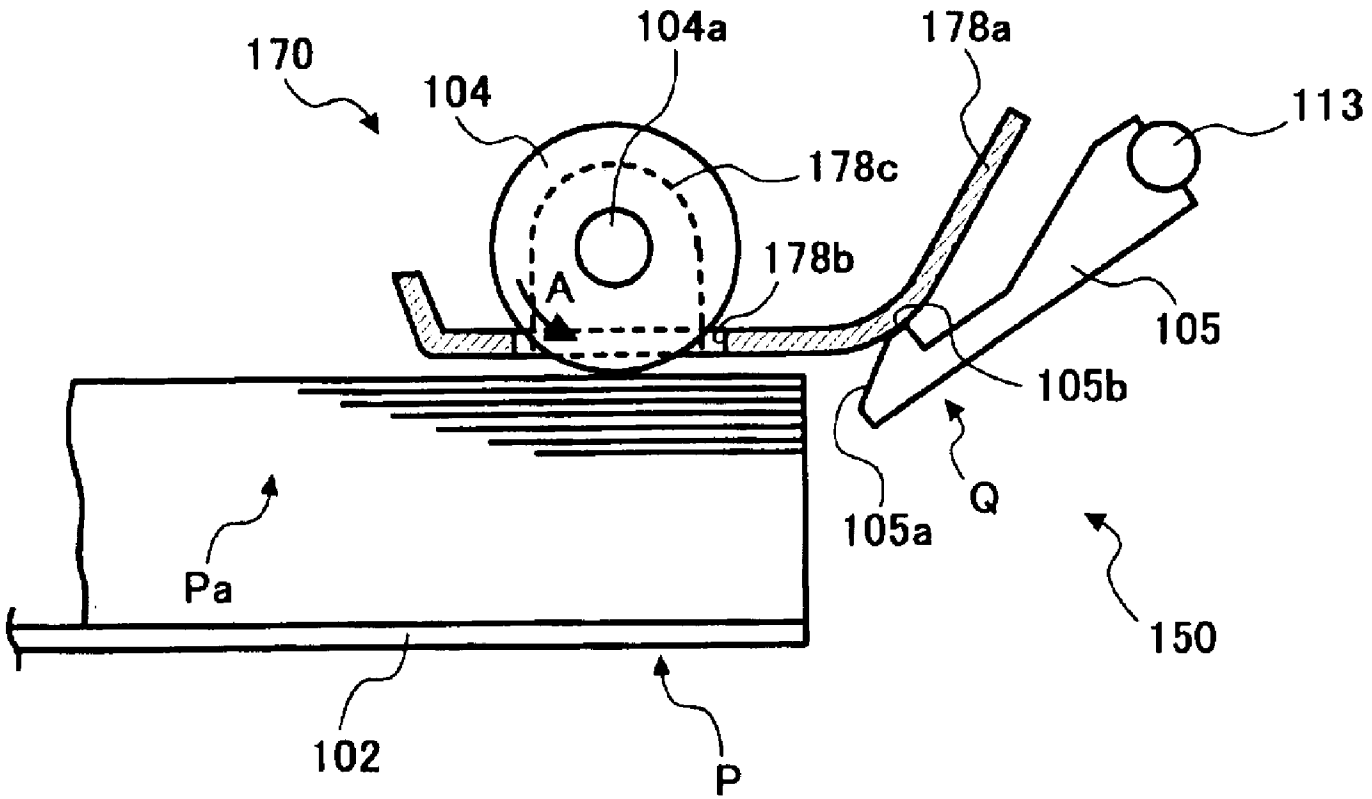
FIG. 87 is a cross sectional view illustrating a sheet feeding apparatus provided with a feeding guide formed of metal according to another embodiment disclosed herein.
Figure 88:
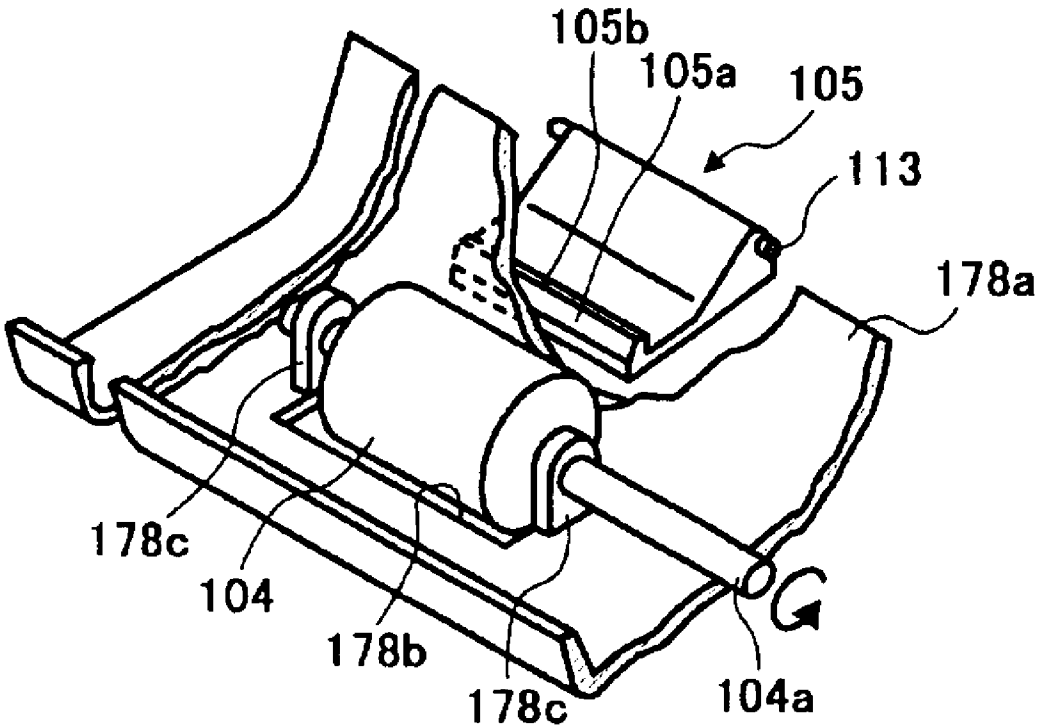
FIG. 88 is a perspective view illustrating the spatial relation among feeding guide, feeding roller and taper member of FIG. 87.

FIG. 87 is a cross sectional view illustrating a sheet feeding apparatus provided with a feeding guide formed of metal, and FIG. 88 is a perspective view showing the spatial relation among feeding guide, feeding roller and taper member. Like reference numerals in FIGS. 87 and 88 designate identical or corresponding parts shown in FIG. 85.

In the sheet feeding apparatus 170 according to another embodiment disclosed herein, a feeding guide 178*a* is formed of pressed metal in place of synthetic resinous materials conventionally used.

In addition, there formed on the feeding guide 178*a* are cutting portion 178*b* protruded through by the feeding roller 104, and a pair of supports 178*c*, 178*c*, formed of the noted cut metal, for supporting the both ends of axial portion of the feeding roller 104 so as to serve as a support member for the roller 104.

With the feeding guide 178*a* thus formed of metal, difficulties of worn-out parts and concomitant change over period of time in the angle of the tapered face 105*a* of taper member 105 can be alleviated, where by durability can be improved and separation characteristics are stabilized for long periods.

Figure 89:
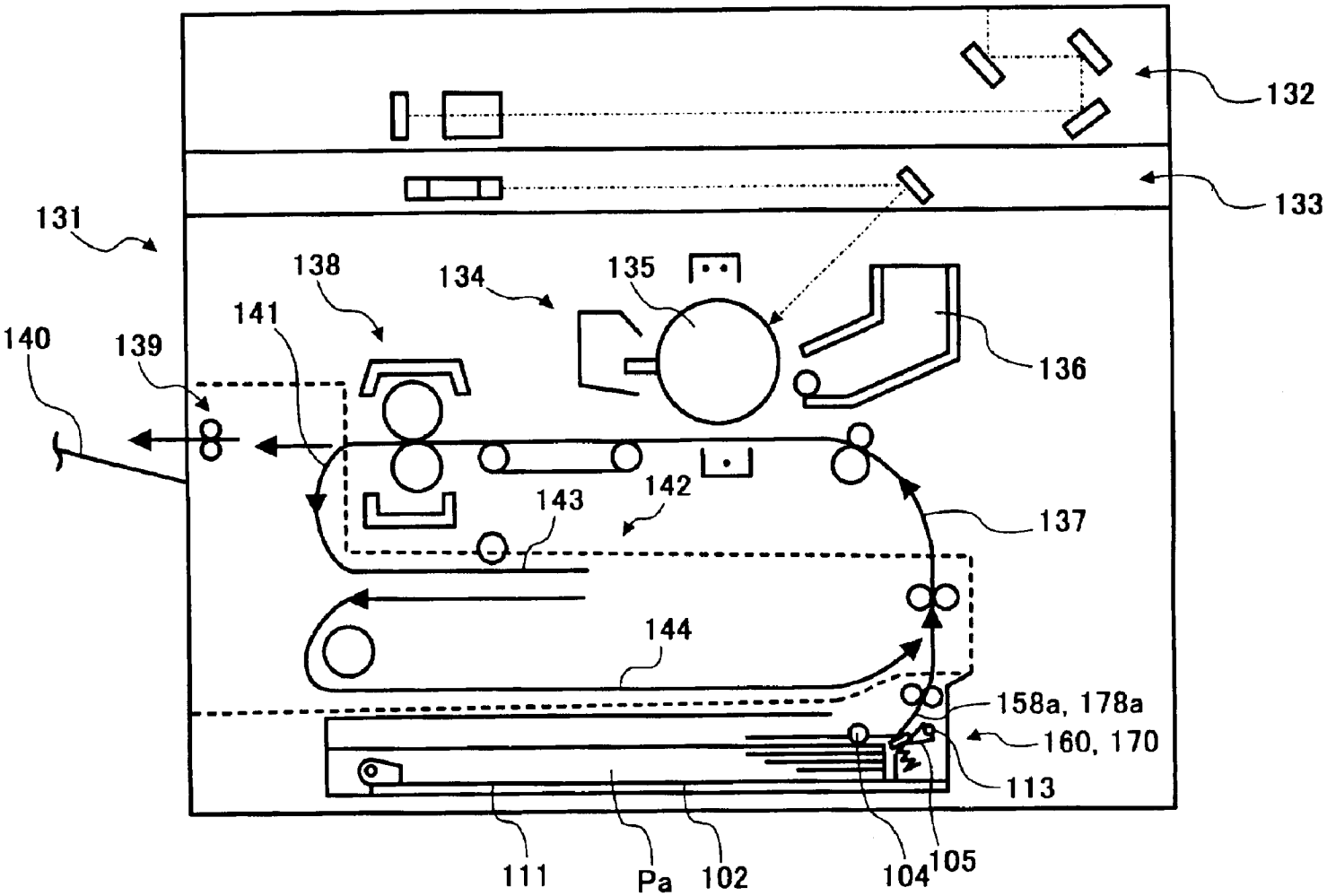
FIG. 89 is an overall cross sectional view illustrating an image forming apparatus provided with sheet feeding apparatus of FIG. 87.

FIG. 89 is prepared to illustrate an overall structure of the image forming apparatus incorporating the sheet feeding apparatus unit disclosed herein, in which like reference numerals designate identical or corresponding parts shown in FIG. 71.

In forming the present image forming apparatus (or duplication machine), the sheet feeding apparatus 101 previously included in the image forming apparatus of FIG. 71 is replaced by either the feeding apparatus 160 of FIG. 85 or the apparatus 170 of FIG. 87. Since other portions included in the structure are formed in a similar manner to those shown in FIG. 71, the details thereof are herein abbreviated.

Figure 90:
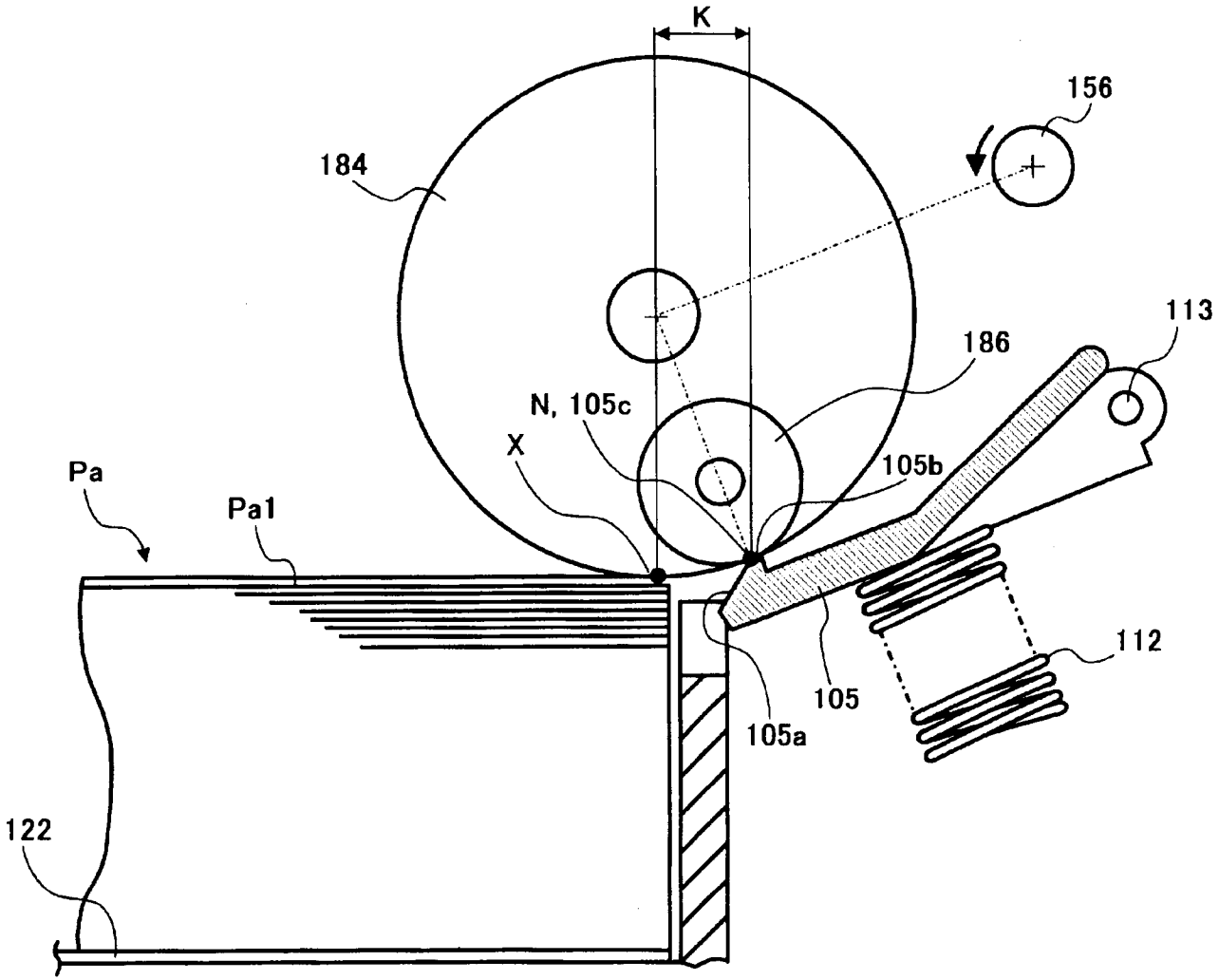
FIG. 90 is a cross sectional view illustrating the sheet feeding apparatus adapted to carry out the sheet feeding method according to another embodiment disclosed herein.
Figure 91:
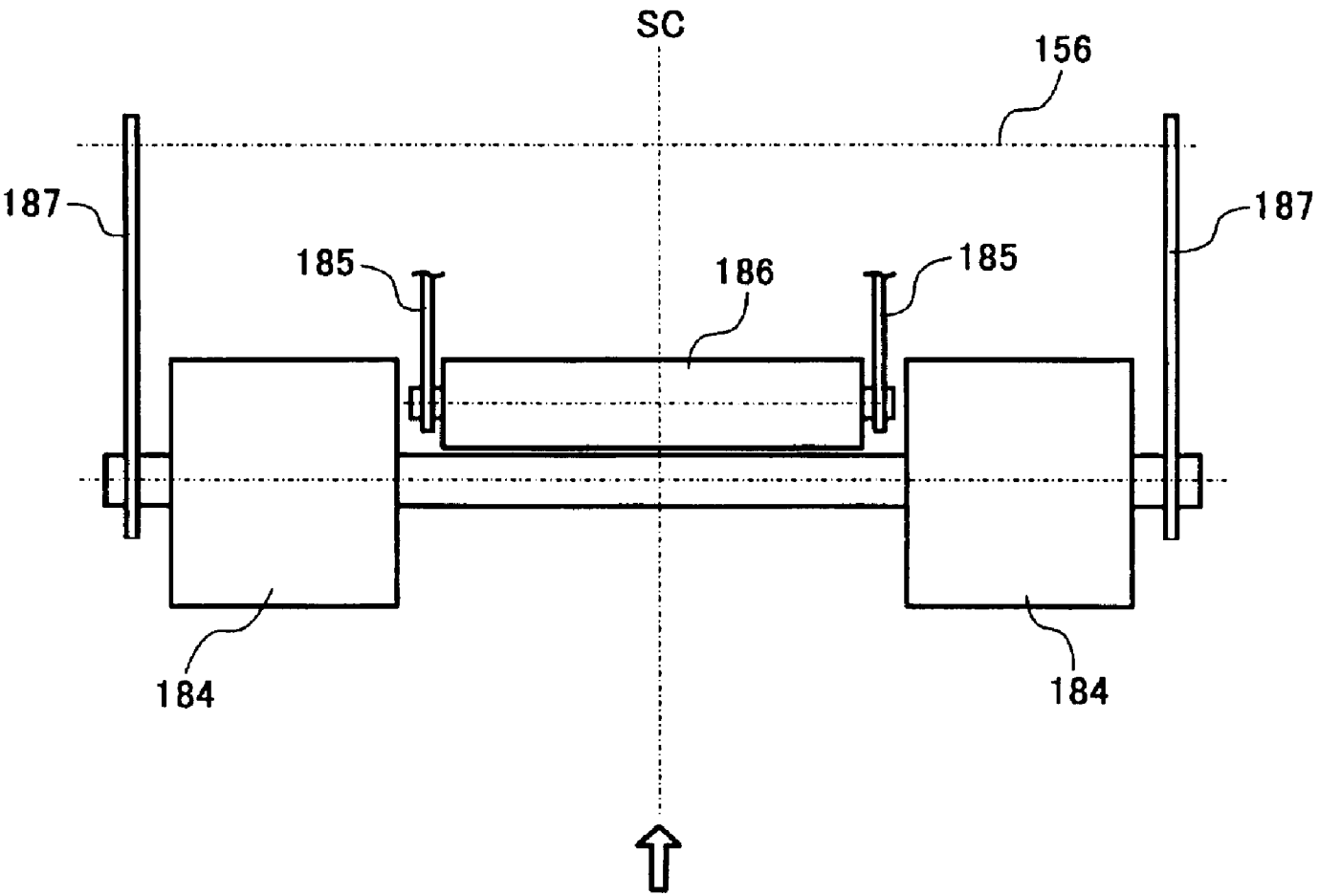
FIG. 91 is a plan view illustrating the construction of the major parts of the sheet feeding apparatus of FIG. 90.
Figure 92:
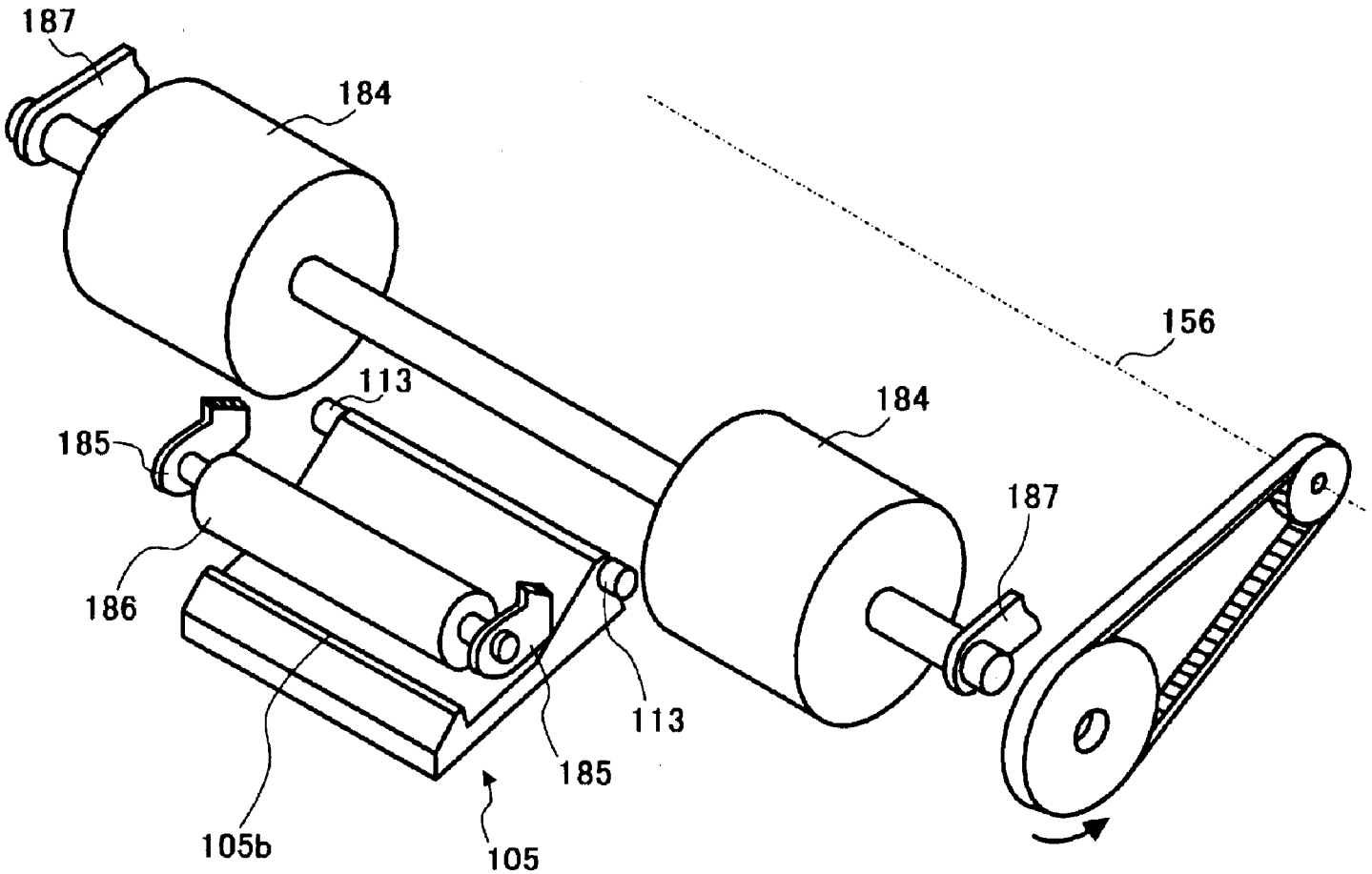
FIG. 92 is a compositional perspective view illustrating the structure of FIG. 91.

FIG. 90 is a longitudinal cross sectional view illustrating the sheet feeding apparatus adapted to carry out the sheet feeding method according to another embodiment disclosed herein, FIGS. 91 and 92 are plan and compositional perspective views, respectively, illustrating major portions thereof.

As shown in FIGS. 90 through 92 in reference to the present embodiment, the sheet feeding apparatus is provided with the feeding roller 184 as feeding means so as to be in contact with the leading edge of an uppermost sheet material $Pa_1$ among a plurality of sheet materials Pa loaded on the base plate 122 and then to forward to the separation component, and the taper member 105 provided being in contact with feeding roller 184 at a nip portion thereof and having a tapered face 105*a* which collides with the leading edge of the sheet.

In addition, the separation roller 186 is further provided in the separation component so as the outer circumference thereof to be brought into contact with the taper member 105.

Referring to FIG. 90, the separation roller 186 as another roller different from the feeding roller 184 is situated downstream from the contact point X at the nip forming location N in contact with the tailing edge 105*c* of taper member 105.

As shown in FIG. 91, the separation roller 186 is then supported by a pair of fixed bearings 185, 185 each attached to main chases (not shown) so as to be placed in the middle of the width of sheet feeding, which is perpendicular to sheet feeding direction (i.e., the same direction as the aforementioned sheet forwarding direction toward the right in FIG. 90) to be symmetric with respect to the center line SC of the feeding width.

In addition, the taper member 105 is supported oscillatory around an axis 6*e* as shown in FIG. 91, and the contact face 105*b* thereof is brought into contact with the separation roller 186, whereby the separation component is formed in the present embodiment.

Furthermore, a pair of feeding rollers 184, 184 is provided on both sides of the separation roller 186 to be supported by an axis 156 which is further supported oscillatory by a pair of movable bearing 187, 187. The separation roller 186 is then operated to transfer counterclockwise rotation of the separation roller 186 generated from a drive motor (not shown) thorough a belt to the feeding rollers 184, 184, and to exert feeding pressure from their own weight to the sheet material Pa which is then forwarded to the separation component.

Incidentally, the pair of feeding rollers 184, 184 are also arranged to be symmetric with respect to the center line SC of the feeding width, as shown in FIG. 91.

When a large number of sheet materials Pa are elevated to a predetermined feeding position by sheet loading member (not shown), the sheet materials Pa are pressed by the pair of the feeding rollers 184, 184 from their own weight, and the plurality of sheet materials Pa are forwarded to the separation component provided with taper member 105 by feeding rollers 184, 184.

In case when two or more sheet materials Pa are forwarded, they are separated sheet by sheet with the separation roller 186 to be subsequently forwarded to the image forming unit.

Referring to FIGS. 93 through 96 in the drawings, the spatial relation among the units in the apparatus and forces exerted thereto will be detailed herein below.

Figure 93:
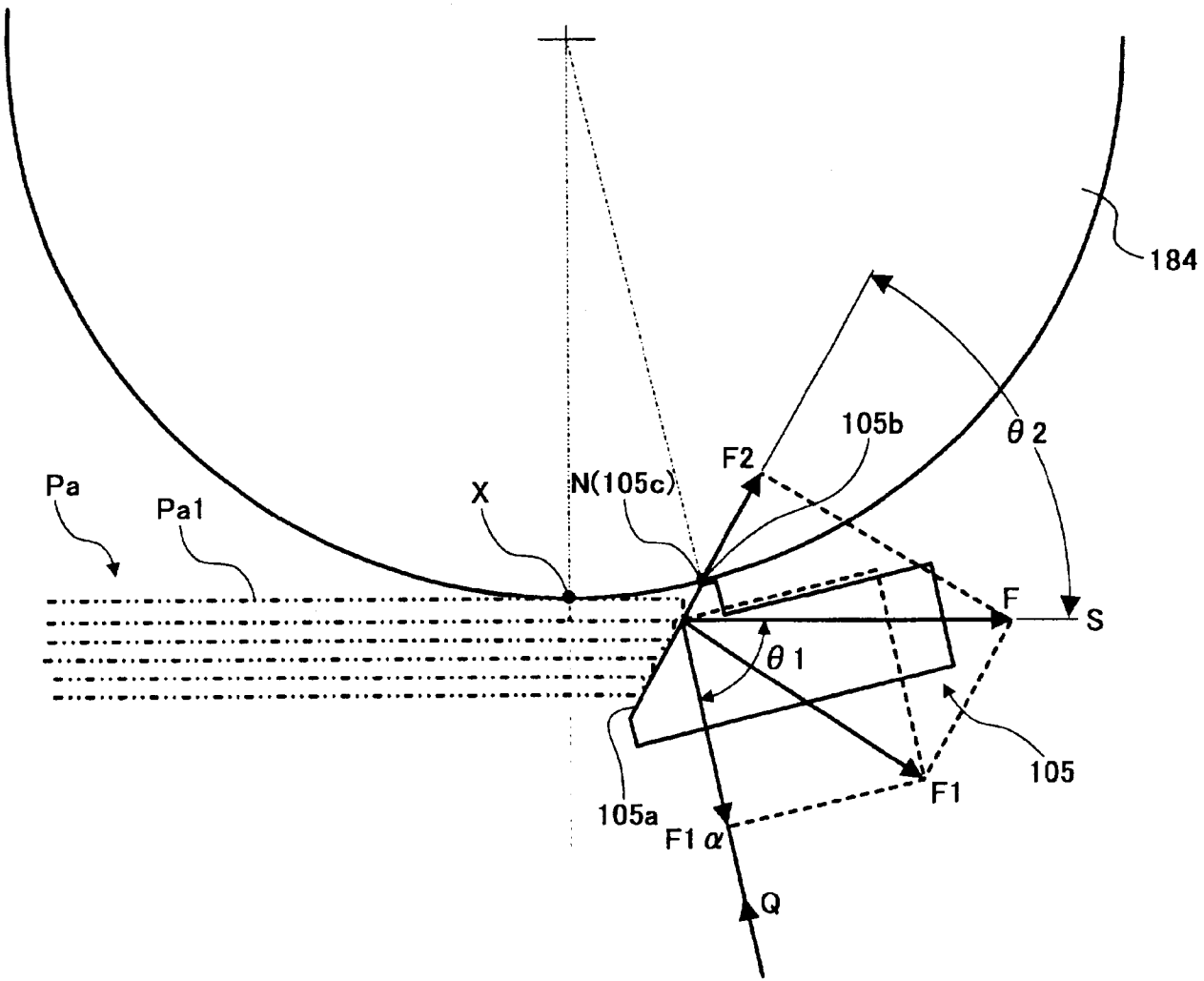
FIG. 93 is prepared to illustrate the force exerted onto the uppermost sheet material, in which a force F is applied to the tapered face through the leading edge of the sheet material as a resultant force for forwarding a plurality of sheet materials by means of the feeding roller.

FIG. 93 is prepared to illustrate the force exerted onto the uppermost sheet material $Pa_1$, in which a force F is applied to the tapered face 105*a* of taper member 105 through the leading edge of the sheet material $Pa_1$ as a resultant force for forwarding a plurality of sheet materials Pa by means of the feeding roller 184.

Since the tapered face 105*a* is mounted to make a predetermined angle $\theta_2$ between the direction S for forwarding the uppermost sheet material $Pa_1$, as mentioned earlier, first and second force components, $F_1$ and $F_2$, are generated in the direction perpendicular and parallel to the tapered face 105*a*, respectively. In addition, a separation pressure, Q, exerted to press the taper member 105 against feeding roller 184 is adjusted to make another predetermined angle $\theta_1$ with the direction S for forwarding the sheet materials $Pa_1$.

By adjusting the separation pressure Q smaller than $F1_\alpha$, the component of the above noted component $F_1$ parallel to the pressure Q, the uppermost sheet material $Pa_1$ can climb over the tapered face 105*a* of taper member 105*a* to be fed to the forwarding direction S.

Figure 96:
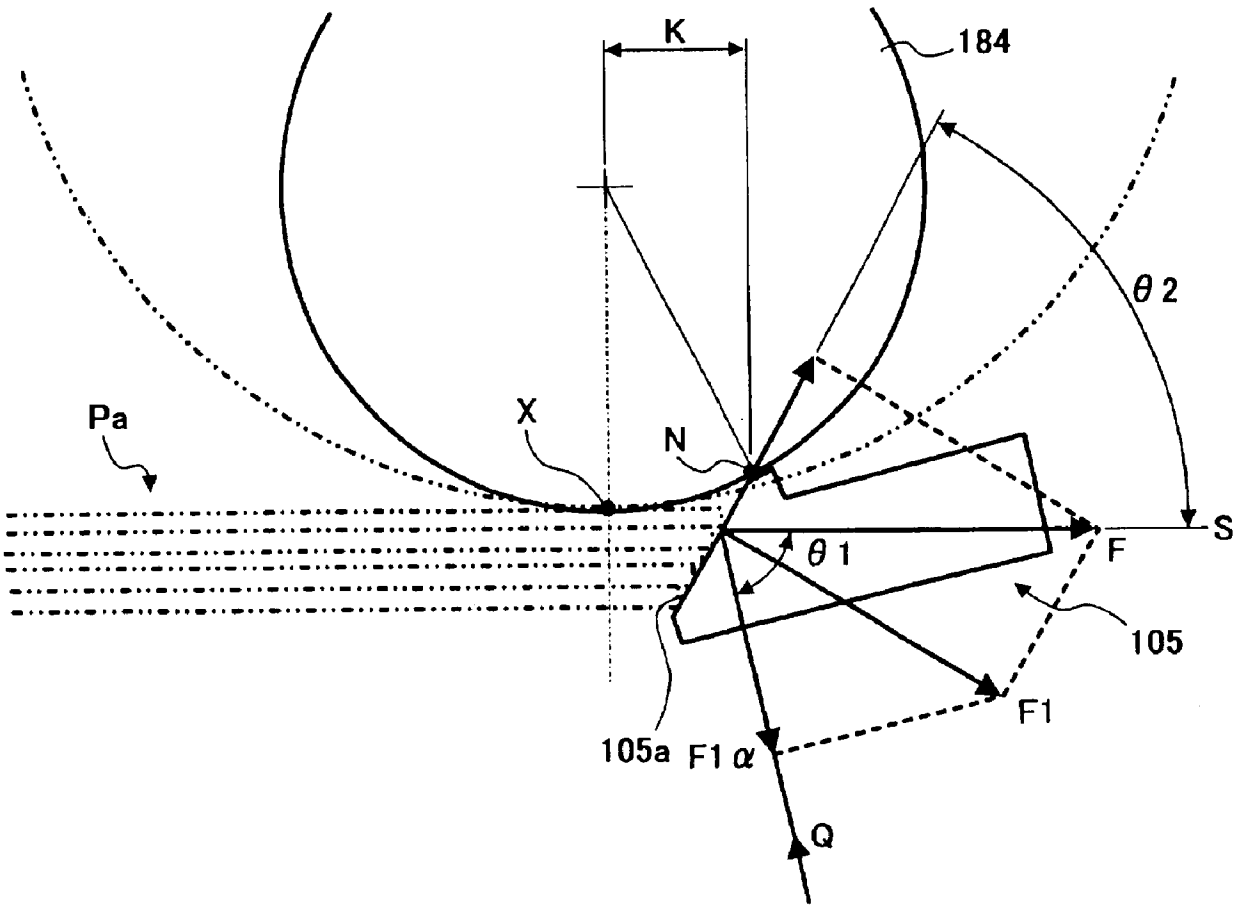
FIG. 96 is prepared to illustrate the distance K in sheet forwarding direction between the point X of pressed contact for the uppermost sheet material loaded on the base plate to feeding roller and the point N of contact for the feeding roller 4 with the tailing edge.

It may be added, as shown in FIGS. 90 and 96, that the distance K is defined as the distance along the sheet forwarding direction between the point X of pressed contact for the uppermost sheet material $Pa_1$ with feeding roller 184 and the location N of nip formation, i.e., the point of contact for the feeding roller 184 with the taper member 105.

Figure 94:
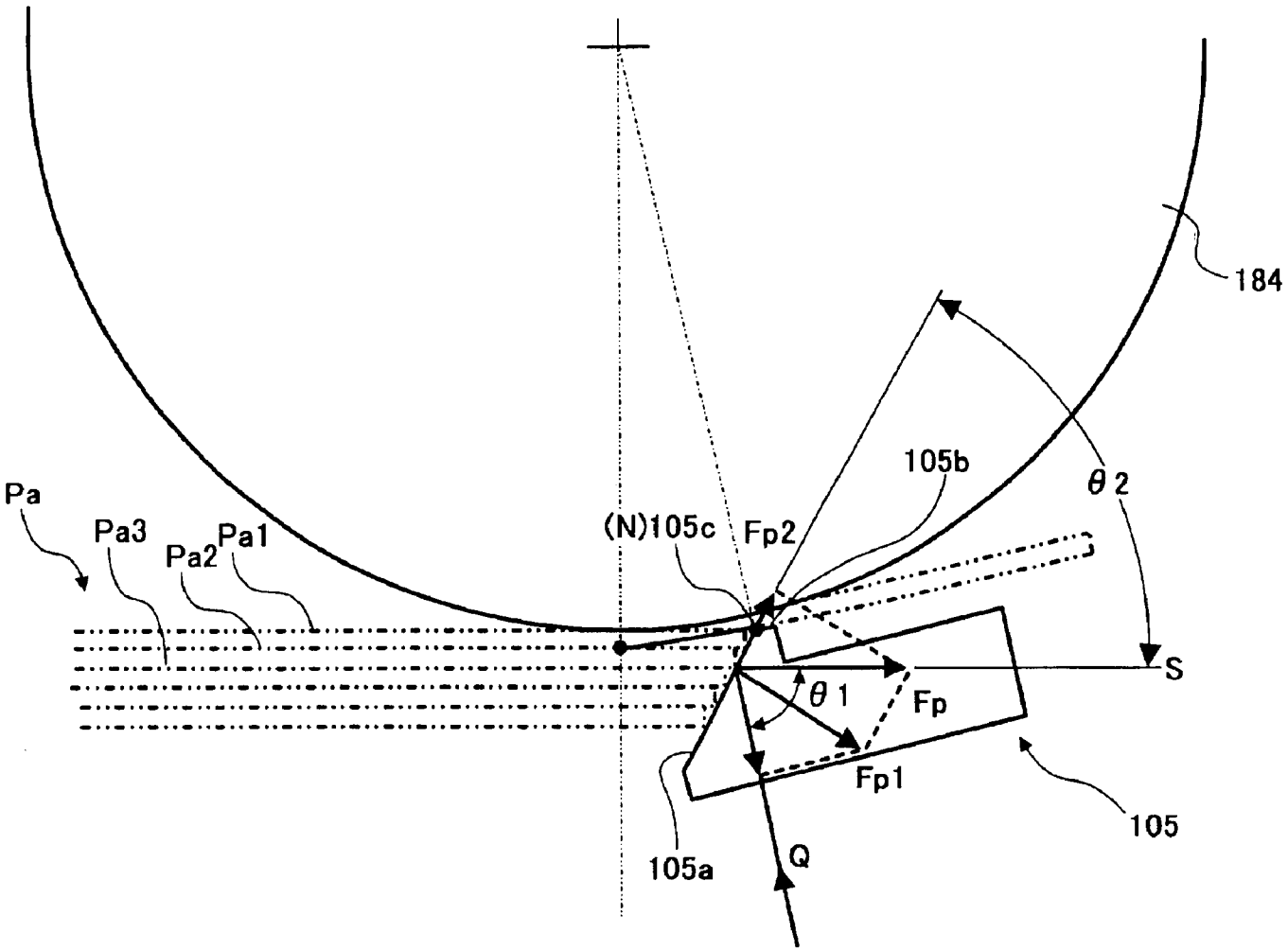
FIG. 94 is prepared to illustrate the force exerted onto the next sheet material situated immediately under the uppermost sheet material with the uppermost sheet material being at the nipped situation.

FIG. 94 is prepared to illustrate the force exerted onto the next sheet material $Pa_2$ situated immediately under the uppermost sheet material $Pa_1$, in which a force $F_P$ is generated through friction between the second next sheet material $Pa_3$ situated immediately under the sheet material $Pa_2$, to thereby generating further force components, $F_{P1}$ and $F_{P2}$, in the direction perpendicular and parallel to the tapered face 105*a*, respectively.

Since the friction coefficient between sheet materials is generally as large as about 50% of that between the sheet material and feeding roller 184, and the magnitude of the force $F_P$ is therefore about 50% of the force F of FIG. 93. As a result, a force associated with the frictional force $F_P$ having a magnitude large enough to climb over the tapered face 6*a* is not generated in the present case, and the sheet material $Pa_2$ is halted by the taper member 105, to thereby be separated from the uppermost sheet material $Pa_1$.

Even in the case of worn-out contact face 105*b*, in which the face 105*b* is worn-out to be a face 105*b'* having a narrower contact region with the feeding roller 184 of taper member 105 as shown in FIG. 94, the above mentioned conditions for the separation are retained since the taper member 105 is displaced in the direction of separation pressure Q from the compressed spring (FIG. 90) and the predetermined angle $\theta_1$ (FIG. 94) previously set with the tapered face 105*a* remains unchanged.

Furthermore, by reducing the region of contact face 6*b* in contact with the feeding roller 184 of taper member 105 from those previously known, the nip width for the uppermost sheet material $Pa_1$ is reduced to a present nip width C1 from previous width D1, and the distance of carrying the next sheet material around the feeding roller 184 immediately after the discharge of the uppermost sheet material $Pa_1$ is also decreased.

As a result, a forwarding force generated in proportion to the above distance is decreased, and the multiple feeding of sheet materials Pa can suitably be obviated.

In the following description, the method and apparatus will be examined theoretically according to the present disclosure in reference to FIG. 97.

In the apparatus descried earlier in FIGS. 90 through 96, sheet materials Pa are loaded horizontally. In this horizontal configuration, the point of application for the feeding pressure P is located at the lowermost point of the feeding roller

184. The point of application, X, is now taken as the origin, and the point of contact between the feeding roller 184 and tapered face 105*a* of taper member 105 is denoted by N.

There included herein are following notations:

r: Radius of feeding roller

P: Feeding pressure P

Q: Separation pressure Q $\theta_1$: The angle between applied separation pressure Q and the direction for forwarding sheet materials (in degree)

$\theta_2$: The angle between tapered face of taper member and the direction for forwarding sheet materials (in degree)

$\theta_{P2}$: The angle between the tangent to nip portion and the direction for forwarding sheet materials (in degree)

N: Nip forming portion $\mu_1$: Coefficient of friction between feeding roller and sheet material $\mu_2$: Coefficient of friction between tapered face of taper member and the leading edge of sheet material $\mu_{P12}$: Coefficient of friction between first and second sheet materials $\Delta\mu_P$: The difference in coefficients of friction between sheet materials According to the notations, the following relations are derived.

$$\theta_{P2}=\theta_{P1}+\theta_2-90 \quad (101).$$

With the aforementioned point of application X as the origin, the coordinate $(N_x,N_y)$ for the nip portion N is obtained as $$N_x=r\cdot\cos(-\theta_1) \quad (102.1)$$

$$N_y=r+r\cdot\sin(-\theta_1) \quad (102.2),$$

in which N (3.871, 0.475) is obtained for the parameters r=16, $\theta_1$=76°, and $\theta_2$=60°, for example.

In addition, several inequalities will be derived next with regard to the forces exerted on sheet materials Pa. There will be described on two cases, one for the leading edge of a sheet material 2 being right before entering to the nip portion, and the other right on entering into the nip forming portion N in reference to FIGS. 98, and 99A and 99B, respectively.

Figure 98:
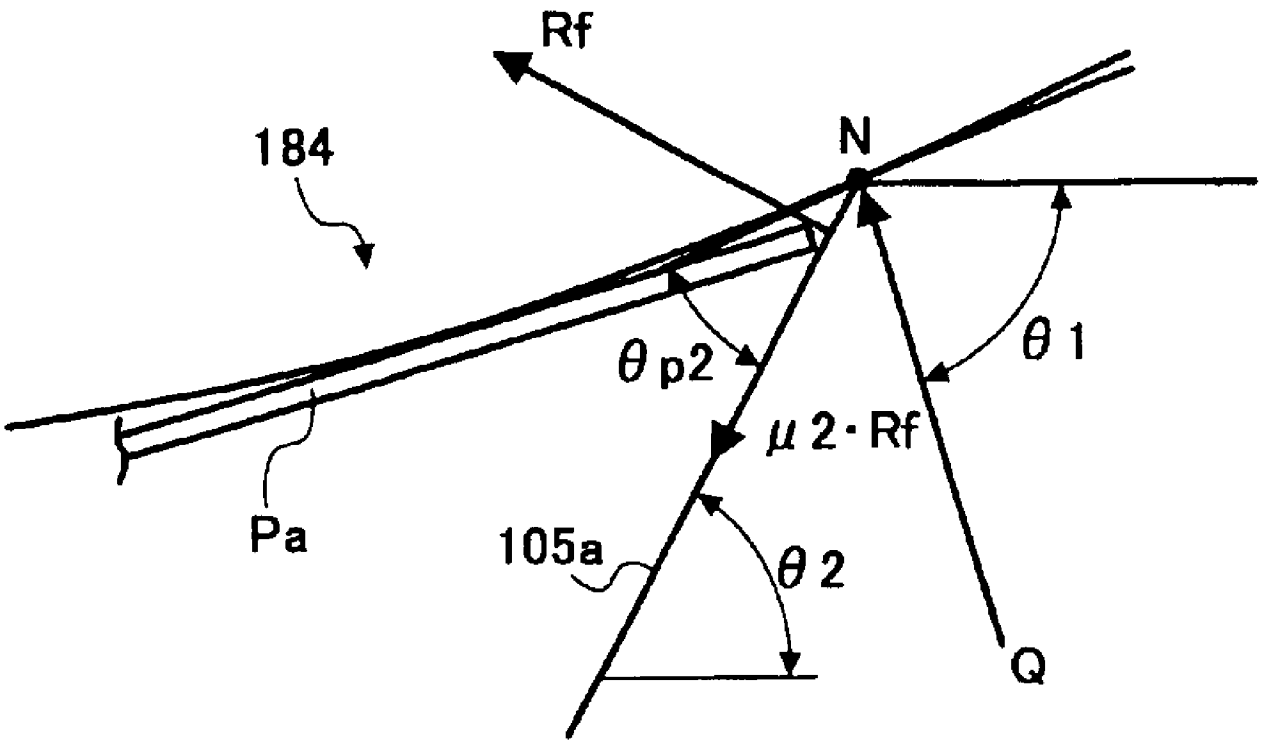
FIG. 98 is prepared to illustrate the case for the leading edge of a sheet material being right before entering to the nip portion.

Referring now to FIG. 98 illustrating the first case of right before entering to the nip portion, the leading edge of a sheet material Pa is exerted by a vertical drag $R_f$ through the tapered face 105*a* of taper member 105. For the leading edge of a sheet material Pa to arrive at the nip portion N, the material Pa has to be subjected to deflection in bending, and the magnitude of the force exerted onto the leading edge varies depending on the kind of sheet material, such as a larger force for a thick sheet, for example.

By making an assumption that the direction of sheet material Pa is in parallel to the tangent to the outer circle of feeding roller 184 at the nip portion N, and that the only location on the roller 4 for the leading edge of a sheet material Pa being in contact with is the point at which the feeding pressure P is exerted.

Since the conveying force for the uppermost sheet material $Pa_1$ is obtained as $(\mu_1-\mu_{P12})\cdot P$, and multiple feeding force onto the sheet material is $\Delta\mu_P\cdot P$, the condition for obviating non-feeding (NF) is expressed by the inequality $$(\mu_1-\mu_{P12})\cdot P>R_f\cdot A$$

$$\therefore P>R_f\cdot A/(\mu_1-\Delta\mu_{P12}) \quad (103),$$

while the condition for obviating multiple feeding (MF) is expressed by $$\Delta\mu_P\cdot P<R_f\cdot A$$

$$\therefore P<R_f\cdot A/\Delta\mu_P \quad (104)$$

$$A=\sin\theta_{P2}+\mu_2\cdot\cos\theta_{P2} \quad (105)$$

Therefore, the sheet feeding apparatus capable of obviating the non-feeding and multiple feeding can be formed by satisfying the relations (104) and (105).

Figure 99A:
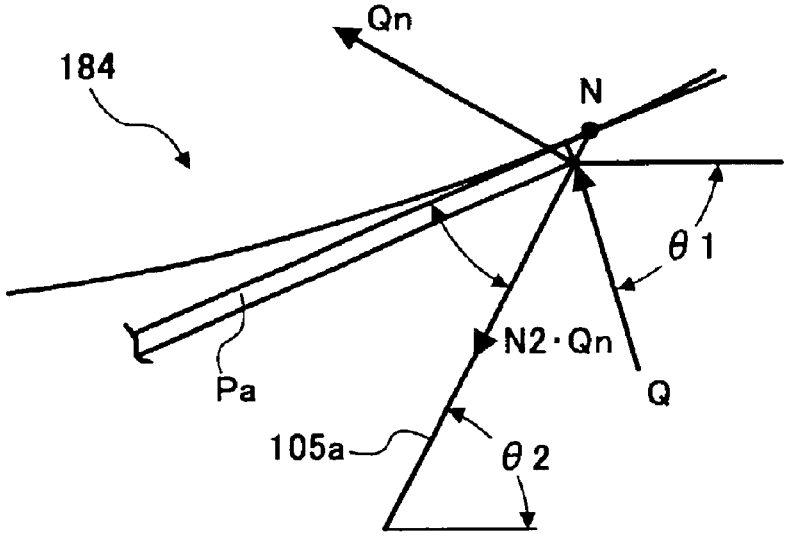
FIGS. 99A and 99B are prepared to illustrate the forces exerted onto the leading edge of a sheet material on entering to the nip portion.
Figure 99B:
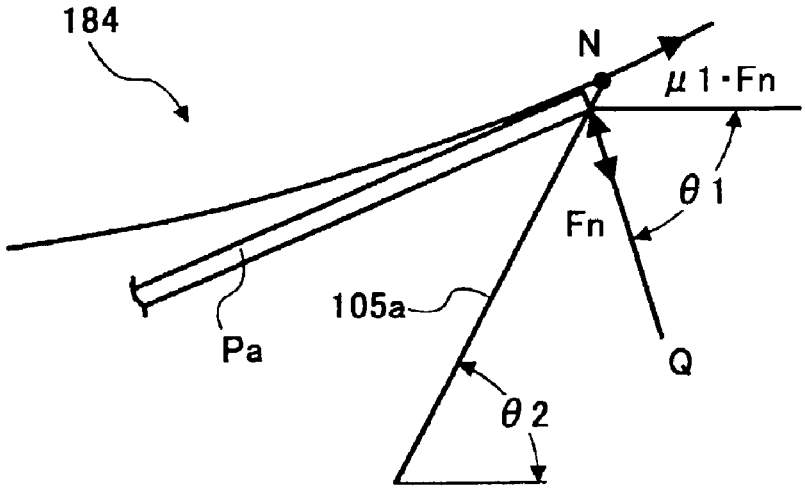

Referring to FIGS. 99A and 99B, the second case for the leading edge of a sheet material Pa being right on entering into the nip portion will be described, in which the leading edge of a sheet material Pa is exerted by a vertical drag $Q_n$ and its frictional force $\mu_n\cdot Q_n$ through the tapered face 105*a* of taper member 105.

On the other hand, the leading edge is also exerted by a force generated by nipping, such as another vertical drag $F_n$ and its frictional force $\mu_1\cdot Q_n$ in the forwarding direction.

The separation pressure Q is therefore obtained as $$F_n+R_f B=Q \quad (106)$$

$$R_f B=Q \quad (107)$$

$$B=\cos\theta_{P2}-\mu_2\cdot\sin\theta_{P2} \quad (108).$$

The conditions for obviating non-feeding in the longitudinal direction are obtained from (106) and (107), as $$(\mu_1-\mu_{P12})\cdot P+\mu_1\cdot F_n>Q_n\cdot A\ \therefore \quad (109)$$

$$P>\{(A/B)-\mu_1\}Q/(\mu_1-\mu_{P12})+\mu_1\cdot R_f\cdot B/(\mu_1-\mu_{P12}).$$

In addition, as the condition for obviating the multiple feeding is obtained as $$\Delta\mu_P\cdot P+\mu_{P12}\cdot F_n<Q_n\cdot A.$$

This is further deduced by inserting the relations (106) and (107), $$P<\{(A/B)-\mu_{P12}\}Q/\Delta\mu_P+\mu_{P12}\cdot R_f\cdot B/\Delta\mu_P. \quad (110)$$

Summarizing the coefficients included in the relations (109) and (110), there obtained are the relation for obviating the non-feeding as $$P>C\cdot Q+D \quad (111),$$

and the relation for obviating the multiple feeding as $$P<C\cdot Q+H \quad (112)$$

$$C=\{(A/B)-\mu_1\}/(\mu_1-\mu_{P12}) \quad (113)$$

$$D=\mu_1\cdot R_f B/(\mu_1-\mu_{P12}) \quad (114)$$

$$G=\{(A/B)-\mu_{P12}\}/\Delta\mu_P \quad (115)$$

$$H=\mu_{P12}\cdot R_f B/\Delta\mu_P \quad (116).$$

The force exerted to the leading edge of sheet material is considered in the next place. The leading edge is exerted by a force caused the bending of the leading edge through the tapered face 105*a* of taper member 105, and a component perpendicular to the tapered face is found to be equal to the above-mentioned perpendicular drag Rf.

Figure 100:
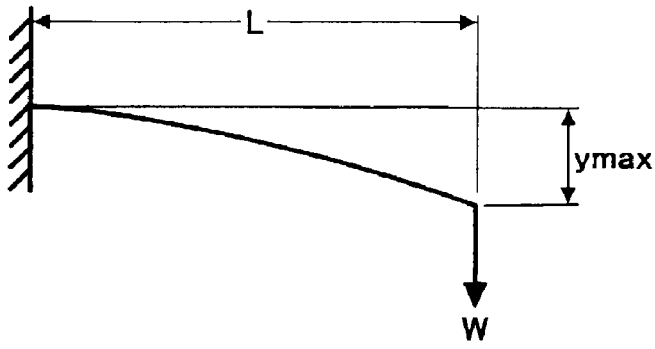
FIG. 100 is a view illustrating the component perpendicular to the tapered face which is equal to the vertical drag Rf.

This value may be calculated simply by assuming a concentrated weight placed on the tip of a beam of length L with the other end thereof is fixed as shown in FIG. 100. The amount of the bending $y_{max}$ at the tip of a beam is obtained as $$y_{max}=W\cdot L^3/3\cdot E\cdot I \quad (117)$$

$$I=b\cdot t^3/12 \quad (118)$$

where

I: Secondary section moment

E: Young's modulus b: Beam width t: Beam thickness.

Figure 97:
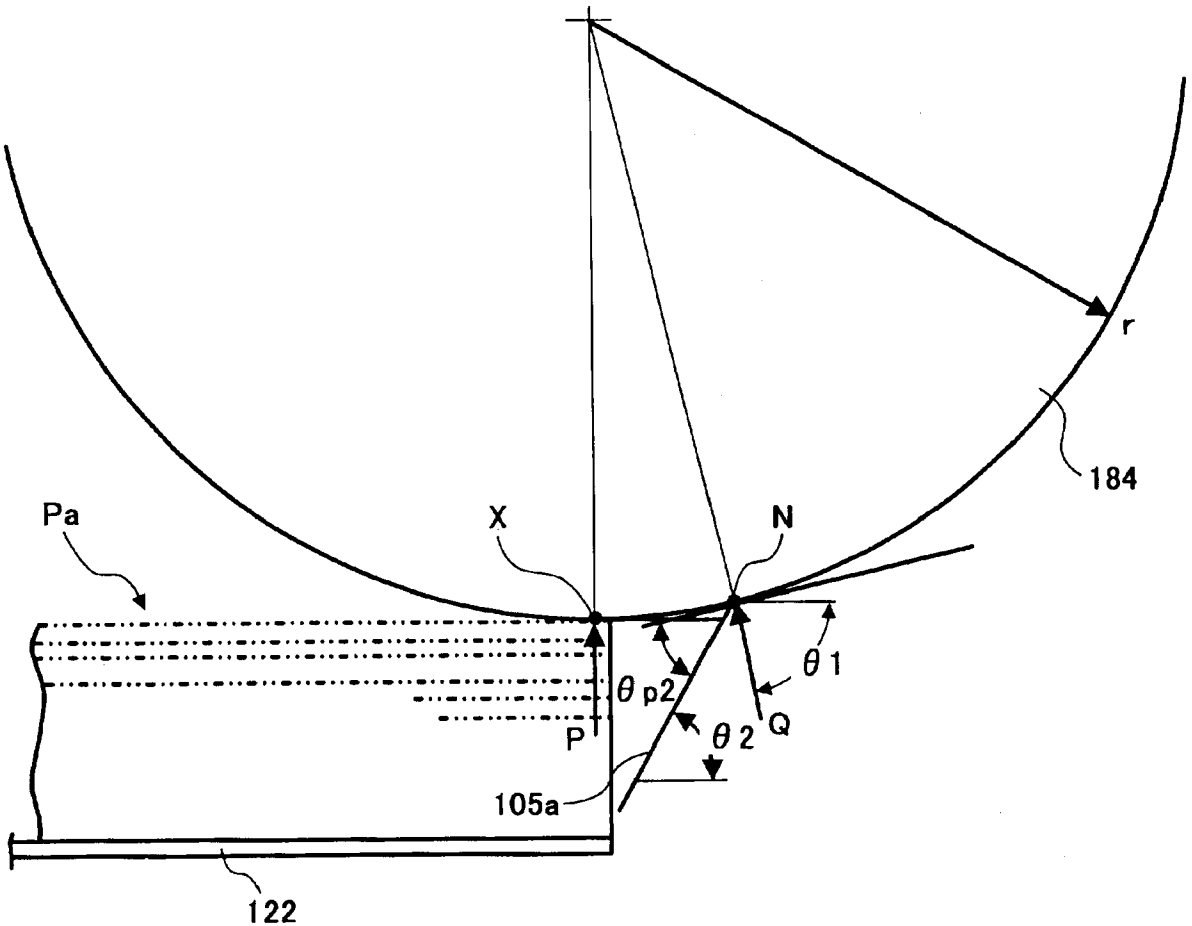
FIG. 97 is an expanded view of the contact points prepared to illustrate the details of the configuration of the sheet materials and the forces operated thereto.

The perpendicular drag Rf can be calculated by further assuming that the beam is fixed at the origin X, to which the feeding pressure P is exerted as shown in FIG. 97, and that the sheet material is bent up to the point N. The result from the calculation shows $$W=3\cdot E\cdot I\cdot N_y/L^3=R_f\cdot B$$

$$\therefore R_f=3\cdot E\cdot I\cdot N_y/B\cdot L^3 \quad (119)$$

$$L=\sqrt{(N_x^2+N_y^2)} \quad (120).$$

Also, the results on the perpendicular drag Rf obtained by the calculation using the relation (119) are shown in Table 1 for several sheet materials with different thickness, such as thick sheet A, thick sheet B, thin sheet A and thin sheet B. For the calculation, the width of sheet material is assumed to be 50 mm as equal as the width of feeding roller, and the values used for t and E are after experimental measurements.

TABLE 1

| Sheet | T [μm] | E [N/m²] | b [mm] | EI [N/m²] | W [N] | $R_f$ [N] |
|---|---|---|---|---|---|---|
| Thick A | 120.0 | 7.09E+09 | 50 | 5.10E−5 | 1.227 | 2.091 (*2.175) |
| Thick B | 89.0 | 6.26E+09 | 50 | 5.10E−5 | 0.442 | 0.731 |
| Thin A | 72.5 | 3.60E+09 | 50 | 5.10E−5 | 0.155 | 0.257 |
| Thin B | 62.6 | 3.37E+09 | 50 | 5.10E−5 | 0.083 | 0.137 |

*Experimentally obtained for the sheet placed at (3.803 mm, 0.358 mm)

The comparison will now be made after substituting actual values into the values in the above relations, between the sheet separation method disclosed herein and the previous method using a separation pad. It may be noted three levels were used for the difference $\Delta\mu_P$ in friction coefficients between sheets considering the use of back paper. An example of the substituted values for each variable is shown in Table 2.

TABLE 2

| Notation | Values substituted presently |
|---|---|
| r | 16 [mm] |
| $\theta_1$ | 76 [deg] |
| $\Theta_2$ | 60 [deg] |
| $\mu_1$ | 1.3 (Relatively small value is set considering degradation) |
| $M_2$ | 0.15 |
| $\mu_{P12}$ | 0.6 (Sheet commonly used) |
| $\Delta\mu_P$ | 0.06, 0.1, 0.2 |
| $R_f$ | Thick A: 210 [gf], Thin B: 15 [gf] |
| $\mu_{FP2}$ | 0.8 (Friction coefficient of the sheet against friction pad) |

Figure 101:
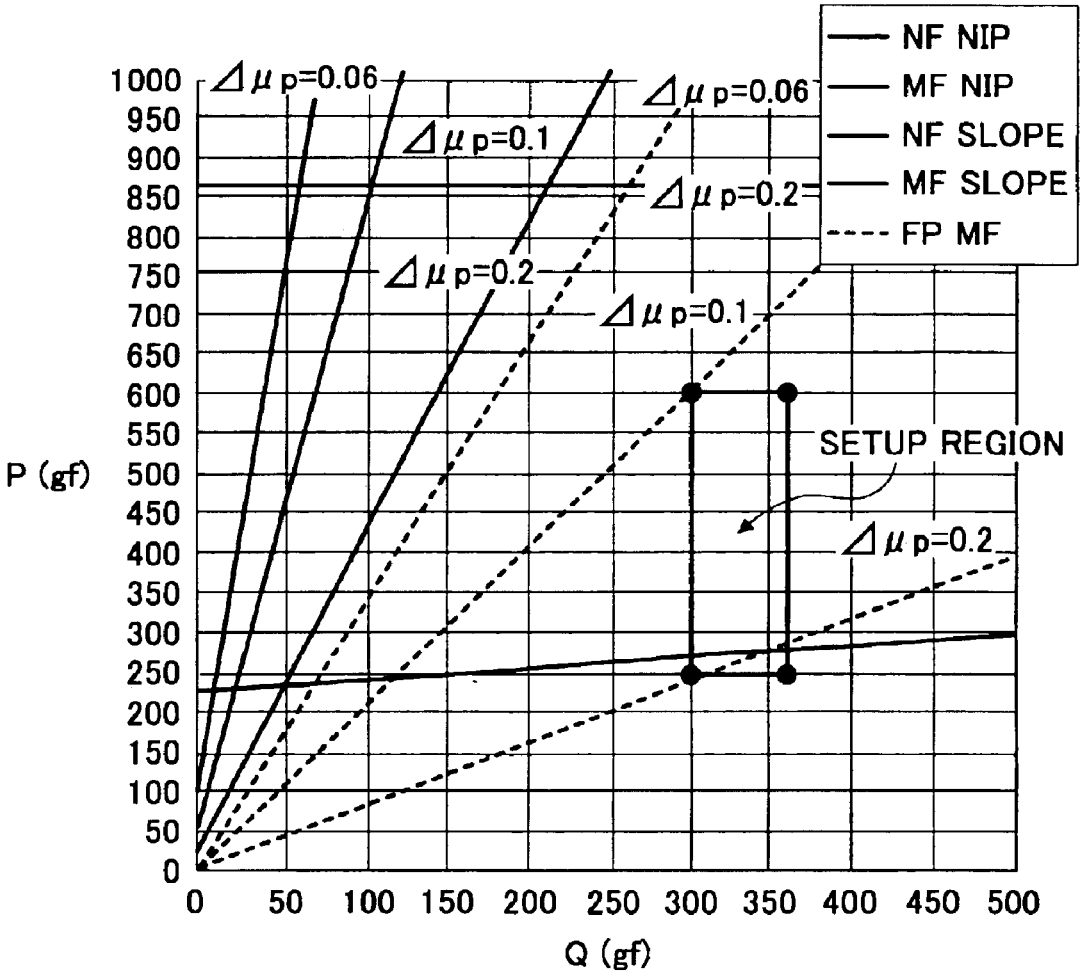
FIG. 101 is a diagrammatic drawing representing the feeding pressure P, vertically, versus the separation pressure Q, horizontally, for the sheet separation method according to the present embodiment disclosed herein.

FIG. 101 is a diagrammatic drawing representing the -feeding pressure P, vertically, versus the separation pressure Q, horizontally, for the sheet separation method disclosed herein, in which several boundary lines obtained from the above relations are shown such as NF slope according to the relation (103), (which is abbreviated herein as 'NF slope: relation (103)'), MF slope: relation (104), NF nip: relation (111), and MF nip: relation (112). In addition, three lines are shown each corresponding to three levels of the $\Delta\mu_P$ values.

For also the FP separation method using the separation pad, three MF boundary lines are shown corresponding to three levels of the $\Delta\mu_P$ values. Additionally shown are the ranges in which the parameters, P and Q, are suitably set during the practical use of the sheet feeding apparatus disclosed herein.

It may be added further the separation and feeding pressures can be measured using several means such as, for example, a spring balance and pressure sensing device. In the case of measurement, it is preferable to take the weight of sheet material into consideration for the measurements.

As seen from the results shown in FIG. 112, since the range for multiple feeding in the FP separation method is considerably narrowed at $\Delta\mu_P$=0.2, the proper feeding cannot be achieved with the conventional P-Q setup.

In contrast, a relatively large margin against the MF region still exists even at $\Delta\mu_P$=0.2 in the sheet separation method disclosed herein.

An MF boundary line is expressed by the following formula (121) in the FP separation method.

$$P<(\mu_{FP}-\mu_{P12})Q/\Delta\mu_P \quad (121)$$

On the other hand, inclination of the MF boundary line in the sheet material separation method disclosed herein is obtained from (115) as $$\{(A/B)-\mu_{P12}\}/\Delta\mu_P$$

which indicates the value (A/B) corresponds to FP friction coefficient $\mu_{FP}$ in the present method. In addition, this is the coefficient for determining the component of the force exerted at the leading edge of the sheet material, and the following relation is found from (105) and (108) for the present setting of the variables, indicating the equivalence in that the $\mu_{FP}$ value is seemingly 1.4.

$$A/B=1.4 \quad (122).$$

This is considered to be one of the factors from which the degree of multistory margin with the sheet material separation method disclosed herein is far larger than the FP separation method.

In this case, the ratio of inclination of the MF boundary between the present method and the FP separation method is obtained as $$\{(A/B)-\mu_{P12}\}/(\mu_{FP}-\mu_{P12})-4.1 \quad (123).$$

The degree of MF margin of the present disclosure is therefore approximately 4 times larger than the FP separation method.

Figure 102:
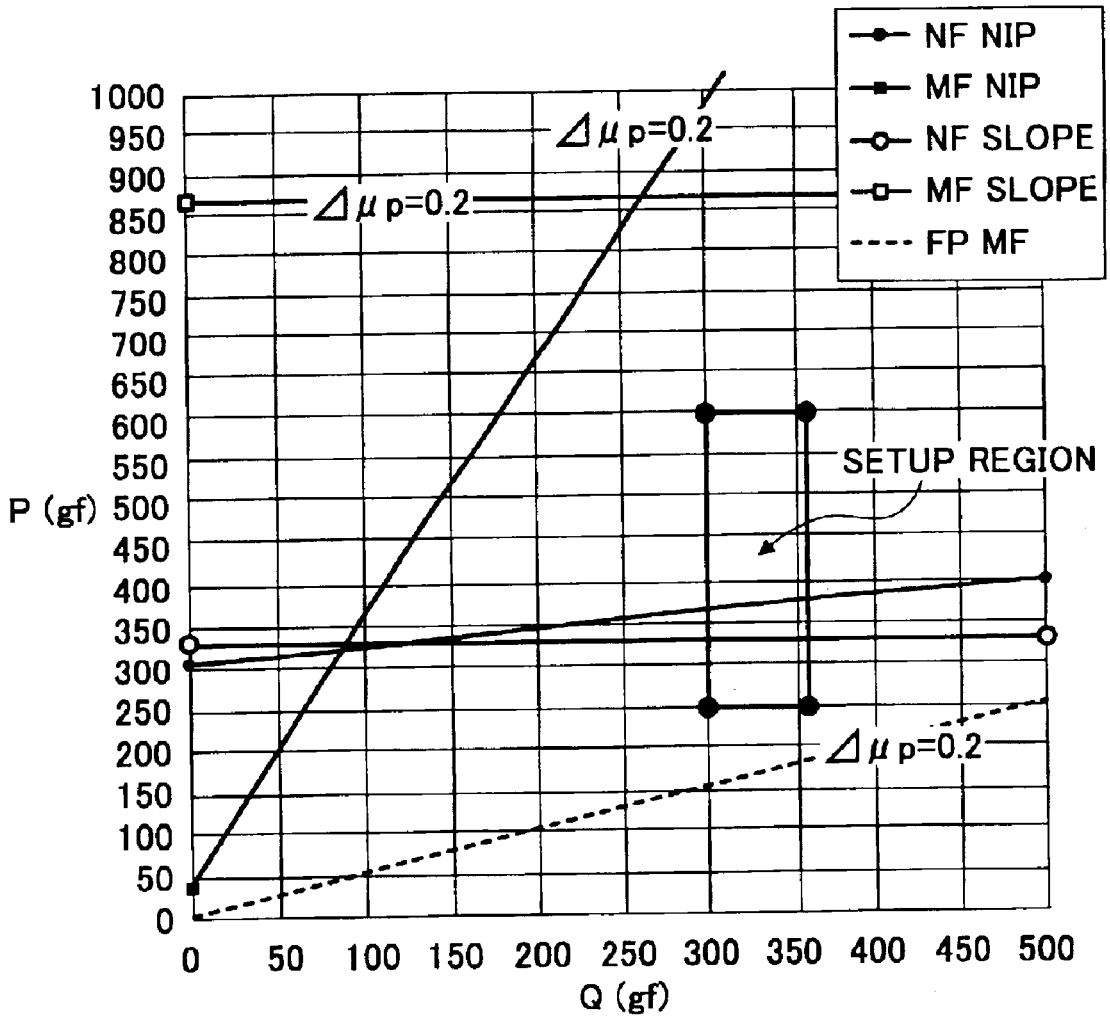
FIG. 102 is another diagrammatic drawing representing the feeding pressure P versus pressure Q relation in the case the friction coefficient $\mu_{P12}$ between the first and second sheet material being expected to be relatively large.

Furthermore, in order to confirm the degree of MF margin in the case of the lug paper (bond paper) and the recycled paper, in which the friction coefficient $\mu_{P12}$ between the first and second sheet material is expected to be relatively large, another P-Q diagram is shown in FIG. 102 in the case of $\mu_{P12}$=0.77 and $\Delta\mu_P$=0.2.

From the results shown in FIG. 102, it is indicated that even back papers with high friction coefficients can also be separated by the present sheet material separation method when a high enough feeding pressure P is applied.

Figure 103:
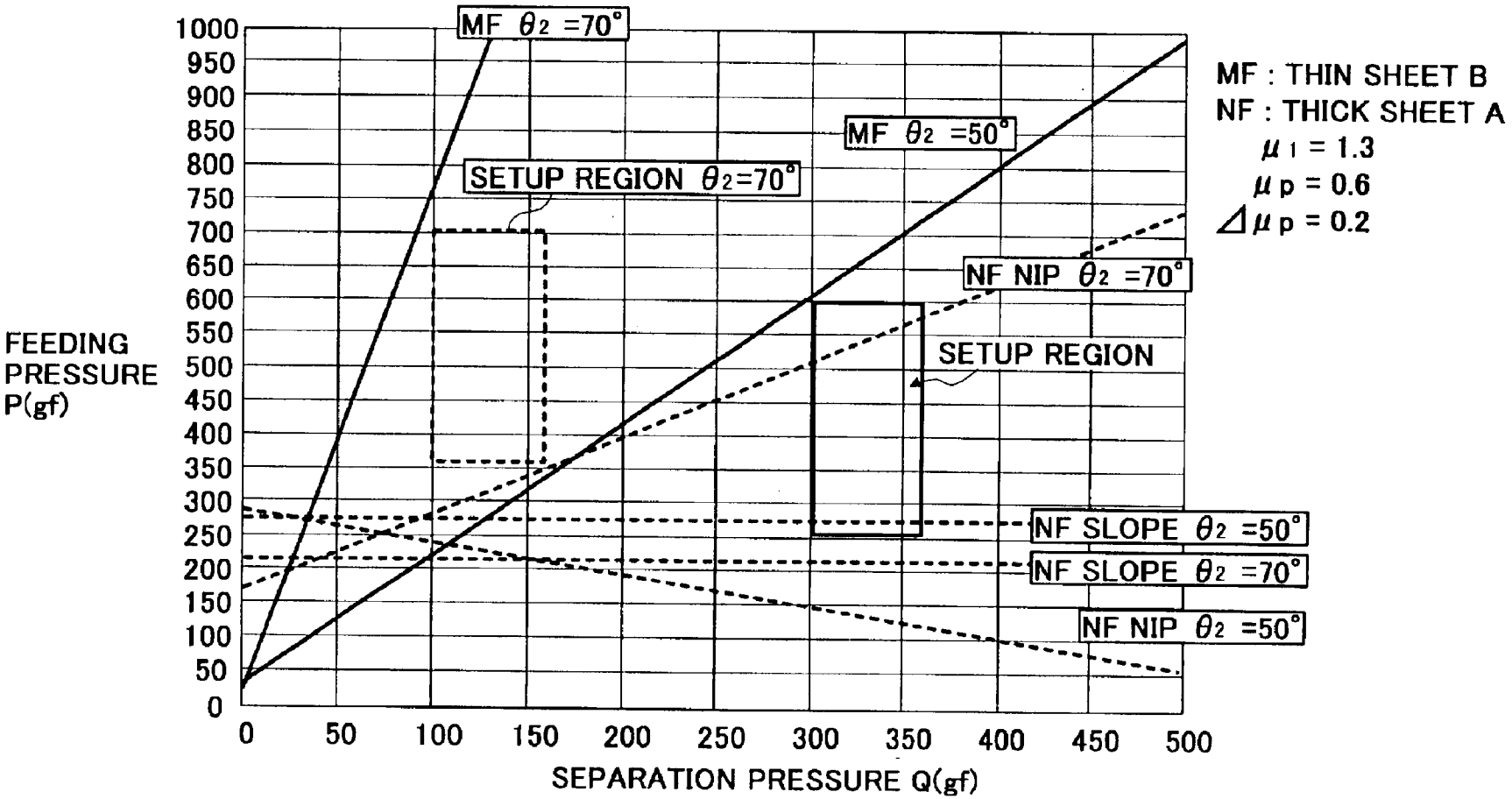
FIG. 103 is another diagrammatic drawing representing P versus Q relation obtained from experiments, when the angel between the tapered face of taper member and the direction for forwarding the sheet material is varied ranging from 50° to 70°.

In the next place, FIG. 103 is another diagrammatic drawing prepared in a similar manner to FIG. 101, representing MF and NF regions with respect to the feeding pressure P, vertically, versus the separation pressure Q, horizontally, based on the experimental results obtained, when the angel ($\theta_2$) between the tapered face 105*a* of taper member 105 and the direction for forwarding the sheet material is varied ranging from 50° to 70°.

As seen clearly from FIG. 103, with the parameter setting indicated by the square drawn with solid lines in the drawing sheet separation becomes feasible up to the difference in coefficient $\Delta\mu_P$=0.2.

Although the NF region becomes severe to be materialized when the above-mentioned angle $\theta_2$ is set as 70°, an appropriate setup becomes possible by bringing the ratio, separation pressure/feeding pressure, to be within the region indicated by the square drawn with solid lines in the drawing.

Figure 104:
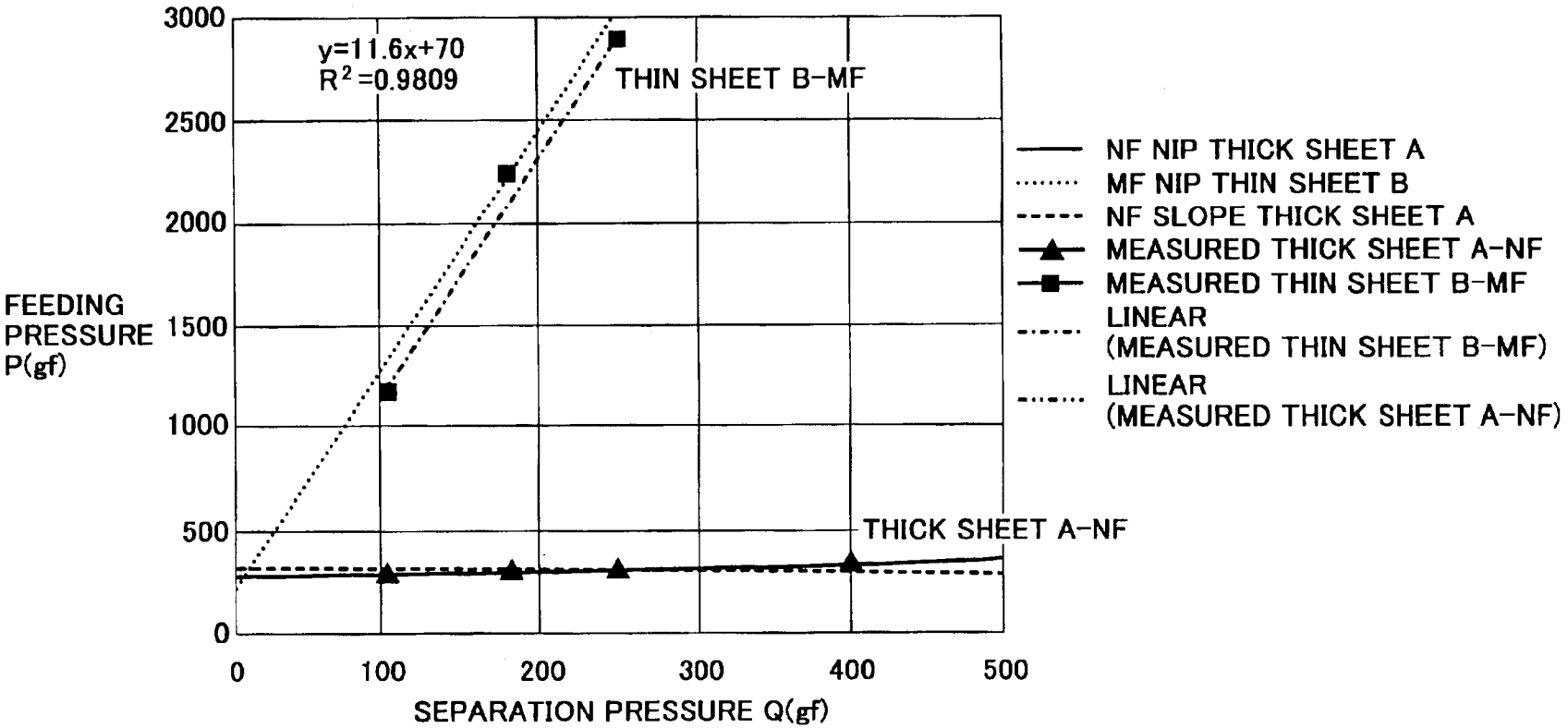
FIG. 104 is a diagram prepared to illustrate the comparison of the NF region for thick sheet, which is calculated using aforementioned relations, with that obtained through the actual measurement.

Also shown in FIG. 104 is a diagram which compares the NF region for thick sheet A, which is calculated using aforementioned relations, with that obtained through the actual measurement. It is confirmed that the NF region for the thick sheet A is approximated by the values, $\mu_1$=1.3 and $\mu_P$=0.67, while the MF region for thin sheet B is approximated by $\mu_2'$=1.3, $\mu_P$=0.54 and $\Delta\mu_P$=0.048.

It may be noted other substituted values and the vertical drag Rf from the tapered face for the thick A sheet and thin B sheet are the same as those aforementioned in Tables 1 and 2. Therefore, it has been confirmed that the values obtained through actual measurements can be approximated by the calculations which are carried out by substituting several friction coefficient data obtained from separate measurements, whereby the validity of respective aforementioned relations has been proved.

According to the noted embodiment, even in the sheet feeding unit which is provided with the sheet loading member 22 capable of loading a large number of sheet material, and of being elevated retaining its horizontal state, the taper member can be used as one having relative simple construction and excellent separation characteristics by only providing additionally the separation roller 86 (of the type of either rotated, or non-rotated or fixed) disclosed herein in place of rather complicated previous structure consisting of forwarding roller in combination with separation reverse roller. In addition to the excellent separation characteristics, the number of parts to be used in the present structure can be reduced.

It may be added further, in place of rubber used for forming separation roller 186, synthetic resinous materials conventionally used may alternatively be utilized such as, for example, polyacetal POM, having excellent properties such as high crash proof, heat resistance, chemical proof, and weathering resistance.

Even such materials as mentioned above are used, the relation between the aforementioned two forces remain unchanged, in which these forces is the feeding force, which is exerted by the feeding roller 184, 184 for the uppermost sheet material $Pa_1$ to climb over the taper member 105, and the other is generated by the friction between the uppermost sheet material $Pa_1$ and the next sheet material $Pa_2$.

In addition, the distance K in the sheet forwarding direction between the points, X and N, of pressed contact with feeding roller 184, is set to be the same as mentioned earlier. As result, sheet separation characteristics are retained and parts cost can be reduced for the separation roller as well.

Figure 105:
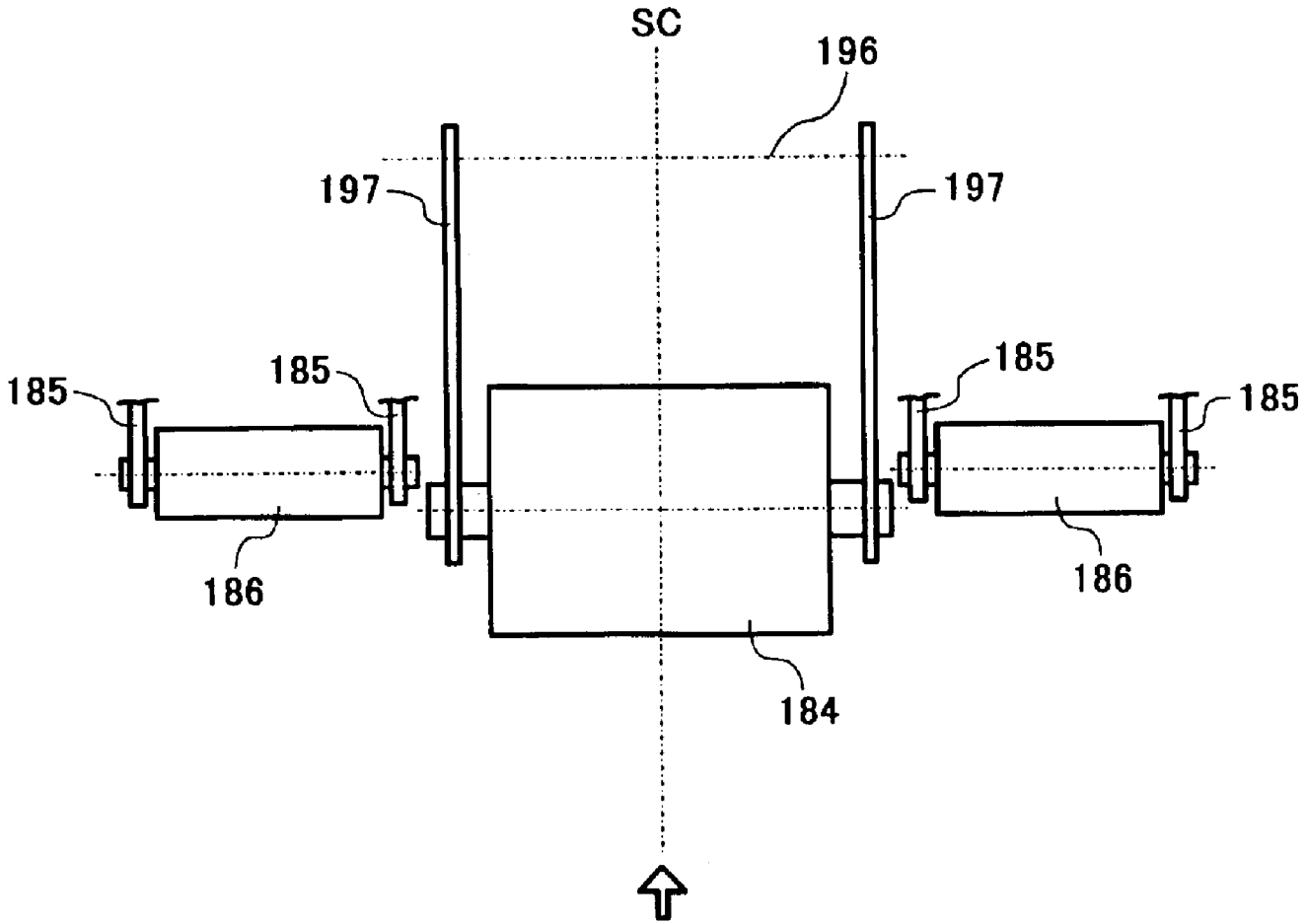
FIG. 105 is a plan view illustrating the feeding apparatus according to another embodiment provided with a feeding roller in the middle of the width of sheet feeding and a pair of taper members provided on the both sides of the feeding roller.
Figure 106:
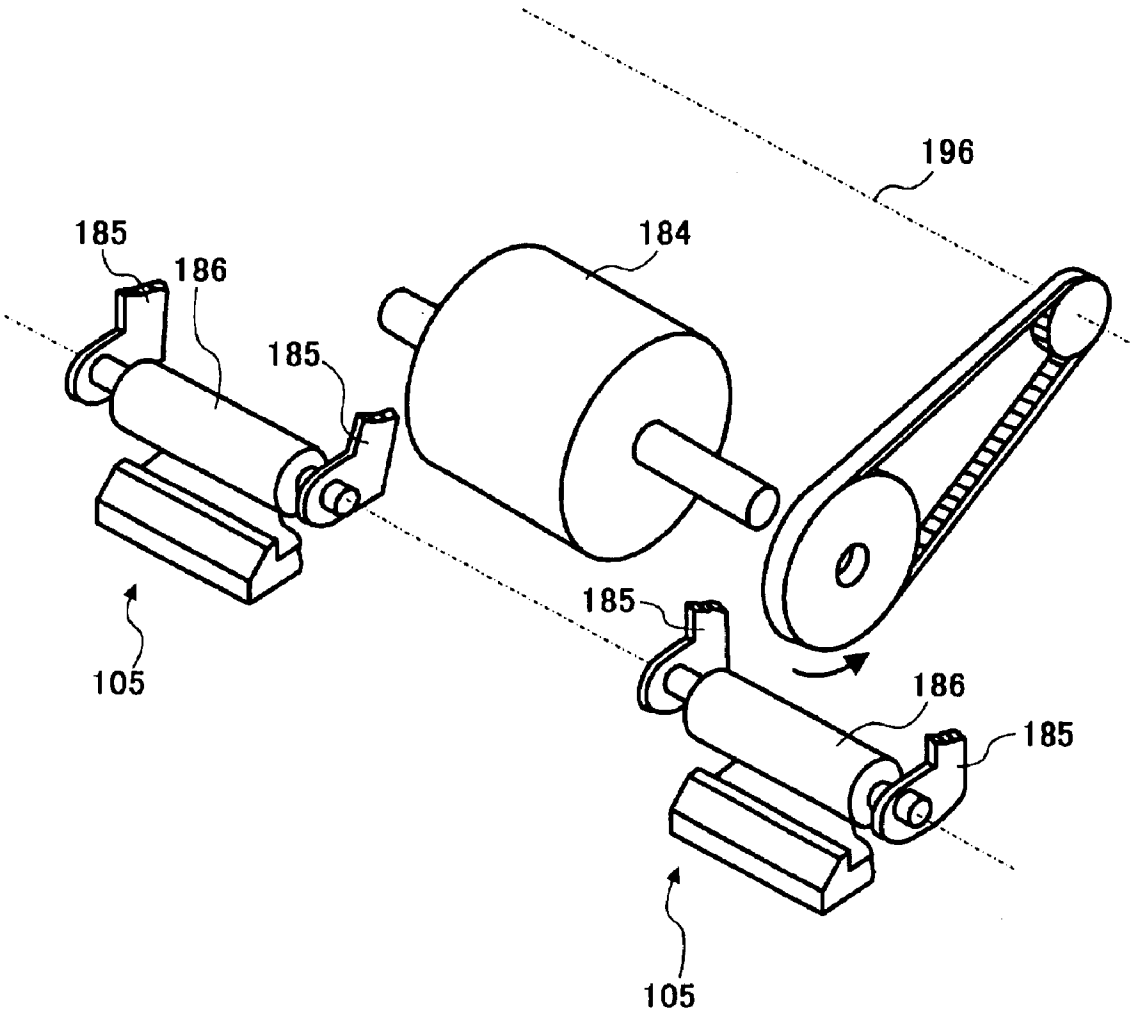
FIG. 106 is a compositional perspective view of the feeding apparatus of FIG. 105.

FIG. 105 is a plan view illustrating the feeding apparatus according to another embodiment provided with a feeding roller in the middle of the width of sheet feeding and a pair of taper members provided on the both sides of the feeding roller, and FIG. 106 is a compositional perspective view thereof.

Referring to FIG. 105, the feeding apparatus is provided with a feeding roller 184 supported by a pair of fixed bearings 197, 197 so as to be placed in the middle of the width of sheet feeding, a pair of taper members 105, 105 are provided on the both sides of the feeding roller 184, and a pair of separation rollers 186, 186 each corresponding to the taper members 105, 105 are supported oscillatory by fixed bearings 185, 185. The feeding roller 184 and separation rollers 186, 186 formed on both sides thereof are aligned to be symmetric with respect to the center line SC of the feeding width. Other portions and the operation characteristics are similar to those described earlier with reference to FIGS. 90 through 92.

In addition, synthetic resinous materials conventionally used may be utilized for forming separation roller 186 in place of rubber. Although two of each of the taper member and separation roller are provided in the present embodiment, overall machine cost can be reduced still, since the part formed of rubber is feeding roller 184 only, when the separation roller 186 is formed of synthetic resinous materials.

Figure 107:
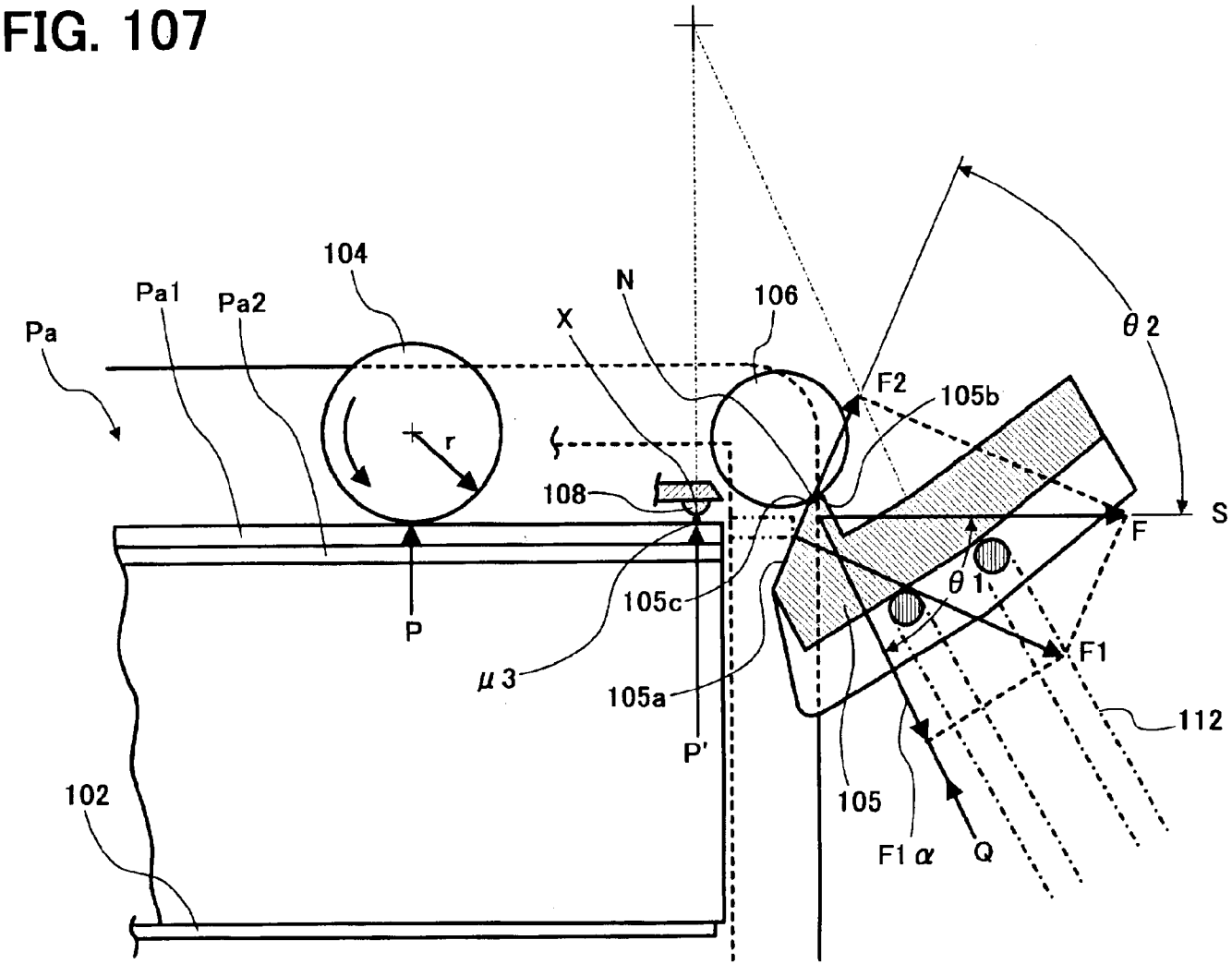
FIG. 107 is a cross sectional view of the feeding apparatus for illustrating the sheet feeding method according to another embodiment disclosed herein, in which the tapered face of taper member is mounted to make a predetermined angle between the direction for forwarding the uppermost sheet material.

FIG. 107 is a cross sectional view of the feeding apparatus prepared for illustrating the sheet feeding method according to another embodiment disclosed herein. Like reference numerals in FIG. 107 designate identical or corresponding parts shown in FIG. 69.

For implementing the present feeding method, the sheet feeding apparatus 101 shown earlier in FIG. 65 is utilized, for example.

In the sheet feeding apparatus 101 of FIG. 107, the tapered face 105*a* of taper member 105 is mounted to make a predetermined angle $\theta_2$ to the direction for forwarding the uppermost sheet material $Pa_1$ among plural sheet materials Pa loaded on the base plate 102 as the sheet loading member by means of feeding roller 104.

In addition, the contact face 105*b*, which is brought into contact with the separation roller 106 serving as a separation member for the taper member 105, is formed as a protrusion with its longitudinal side aligned in the axial direction of the feeding roller 104, having a considerably narrow width.

Furthermore, the distance along the sheet forwarding direction is made as small as possible between the points X and N, where the former X is the point at which the uppermost sheet material $Pa_1$ loaded on the base plate 102 is brought into pressed contact with the protrusion 108 formed between the feeding roller 104 and separation roller 106, and the latter N is the point of nip formation i.e., the point of contact for the separation roller 106 with the tailing edge 105*c* of taper member 105.

The rotation in the direction designated by the arrow shown in the drawing for the thus prepared feeding roller 104 is initiated upon receiving a feeding start instruction signal from a control unit (not shown) and continues until the forwarding the uppermost sheet material $Pa_1$ is completed.

When the protrusion 108 is provided between the feeding roller 104 and separation roller 106 as described above, this portion 108 is subjected to a frictional force dictated by friction coefficient $\mu_3$ between the sheet material as well as the control pressure P'.

When the distance between both contact points, X and N, is decreased, this is advantageous for decreasing the difference in flexural modulus for various kinds of sheet materials, even in case where the distance between feeding roller and separation roller is increased and where various sheet materials different in friction coefficient are used. The scatter of the components of force generated on the tapered face 105*a* of taper member 105 is therefore decreased.

As a result, the separation of sheet materials becomes feasible not only for those having relatively large modulus values such as thick paper sheets, post cards and sealed letters, but also thin paper sheets with small modulus values as well, to thereby be able to handle various kinds of sheet materials.

In the next place, the spatial relation among the units in the sheet feeding apparatus shown in FIG. 107 and forces exerted thereto will be detailed herein below. Description on the units similar or identical to those shown in FIGS. 90 through 104 is herein simplified or abbreviated where appropriate.

FIG. 107 is prepared to illustrate the force exerted onto the uppermost sheet material $Pa_1$, in which a force F is applied to the tapered face 105*a* of taper member 105 through the leading edge of the sheet material $Pa_1$ as a resultant force for forwarding a plurality of sheet materials Pa by means of the feeding roller 184.

Since the tapered face 105*a* is mounted to make a predetermined angle $\theta_2$ between the direction S for forwarding the uppermost sheet material $Pa_1$, as mentioned earlier, first and second force components, $F_1$ and $F_2$, are generated in the direction perpendicular and parallel to the tapered face 105*a*, respectively.

In addition, a separation pressure, Q, exerted by separation coiled spring 112 to press the taper member 105 against feeding roller 184 is adjusted to make another predetermined angle $\theta_1$ between the direction S for forwarding the sheet materials $Pa_1$.

By adjusting the separation pressure Q smaller than $F1_\alpha$, the component of the above noted component $F_1$ parallel to the pressure Q, the uppermost sheet material $Pa_1$ can climb over the tapered face 105*a* of taper member 105*a* to be fed to the forwarding direction S.

The force exerted onto the next sheet material $Pa_2$ situated immediately under the uppermost sheet material $Pa_1$ can be treated in a similar manner in principle to earlier description with reference to FIG. 94, with the exception that the separation roller 106, in place of feeding roller 184, is brought into contact with the taper member 105 in the present case.

Since the friction coefficient between sheet materials is generally as large as about 50% of that between the sheet material and separation roller 106 in this case, a force associated with the frictional force $F_P$ having a magnitude large enough to climb over the tapered face 6*a* is not generated. Only the sheet material $Pa_2$ is therefore separated from the uppermost sheet material $Pa_1$, and advanced along the forwarding direction S.

Figure 95:
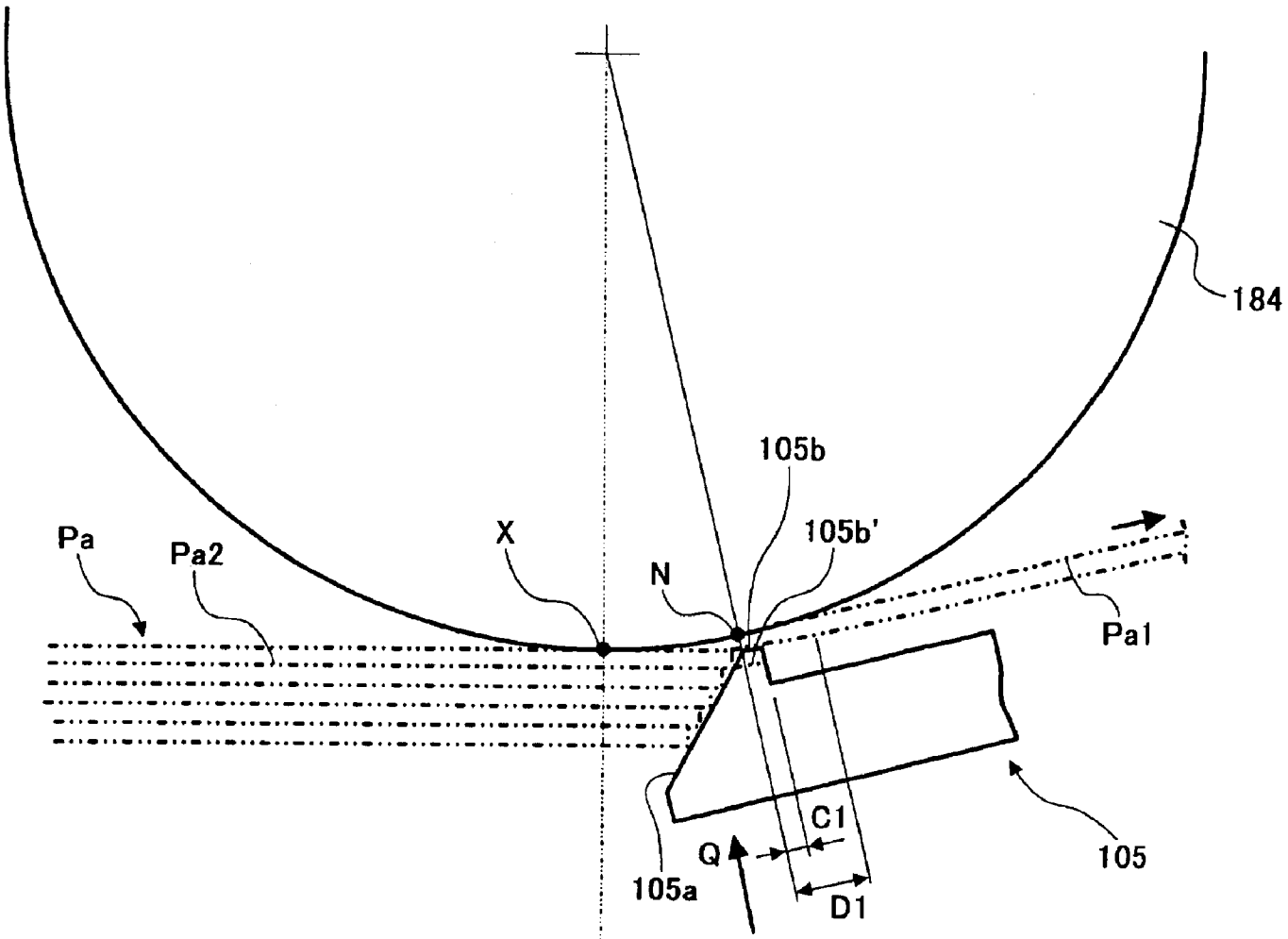
FIG. 95 is prepared to illustrate the configuration of the sheet materials upon leaving of the uppermost sheet material from the nip portion.

Also in the case of worn-out contact face 105*b*, the force can be treated in a similar manner to the earlier description with reference to FIG. 95, with the only exception that the separation roller 106 is included in place of feeding roller 184. Since this causes only a horizontal displacement of the taper member 105 toward the separation pressure Q from the separation coiled spring 112, the predetermined angle $\theta_2$ remains unchanged.

Furthermore, by reducing the region of contact face 105*b* in contact with the separation roller 106, the nip width for the uppermost sheet material $Pa_1$ is reduced to a present nip width C1 from previous width D1. As a result, a forwarding force generated in proportion to the above distance is decreased, and the multiple feeding of sheet materials $Pa_1$ can suitably be obviated in this case, as well.

In the sheet feeding apparatus, sheet materials Pa are loaded horizontally, in a similar manner to the case descried earlier in FIG. 97. In this horizontal configuration in reference to FIG. 107, the point of application for the feeding pressure P is located at the lowermost point of the feeding roller 104.

The point of pressure application X, i.e., the point of contact of the protrusion 108 formed between feeding roller 104 and separation roller 106 with the uppermost sheet material $Pa_1$ loaded on base plate 102, is now taken as the origin. In addition, the point of contact between the tailing edge of tapered face 105*c* and separation roller 106 becomes the nip forming portion N.

There included herein are following notations:

r: Radius of feeding roller

P: Feeding pressure

P': Feeding pressure at protrusion

Q: separation pressure $\theta_1$: The angle between applied separation pressure Q and the direction for forwarding sheet materials (in degree)

$\theta_2$: The angle between tapered face of taper member and the direction for forwarding sheet materials (in degree)

$\theta_{P2}$: The angle between the tangent to nip portion and the direction for forwarding sheet materials (in degree)

N: Nip forming portion $\mu_1$: Coefficient of friction between feeding roller and sheet material $\mu_2$: Coefficient of friction between tapered face of taper member and the leading edge of sheet material $\mu_3$: Coefficient of friction between protrusion and sheet material $\mu_{P12}$: Coefficient of friction between first and second sheet materials $\Delta\mu_P$: The difference in coefficients of friction between sheet materials According to the notations, the following parameters are obtained in a similar manner to that earlier described such as $\theta_{P2}$ as obtained by (101), and the coordinate $(N_x,N_y)$ for the nip portion N as obtained by (102.1) and (102.2), and N (3.871, 0.475) is obtained for the parameters r=16, $\mu_1$=76°, and $\theta_2$=60°, for example.

In addition, several inequalities will be derived next with regard to the forces exerted on sheet materials Pa. There will be described on two cases, one for the leading edge of a sheet material Pa being right before entering to the nip portion, and the other right on entering into the nip forming portion N in reference to FIGS. 98, and 99A and 99B, respectively.

Referring now to FIG. 98 illustrating the first case of right before entering to the nip forming portion, the leading edge of a sheet material Pa is exerted by a vertical drag $R_f$ through the tapered face 105*a* of taper member 105. For the leading edge of a sheet material Pa to arrive at the nip portion N, the material Pa has to be subjected to deflection in bending, and the magnitude of the force exerted onto the leading edge varies depending on the kind of sheet material, such as a larger force for a thick sheet, for example.

By making an assumption that the direction of sheet material Pa is in parallel to the tangent to the outer circle of feeding roller at the nip forming portion N, and that the only location on the feeding roller for the leading edge of a sheet material Pa being in contact with is the point at which the feeding pressure P is exerted.

Since the conveying force for the uppermost sheet material $Pa_1$ is obtained as $(\mu_1-\mu_{P12})\cdot P$, and multiple feeding force onto the sheet material is $\Delta\mu_P\cdot P$, the condition for obviating non-feeding (NF) is expressed by the inequality $$(\mu_1-\mu_{PI2})\cdot P-\mu_3P'>R_f\cdot A\ \therefore\ P>R_f\cdot A/(\mu_1-\Delta\mu_{PI2})+\mu_3P'/(\mu_1-\mu_{PI2}), \quad (124)$$

while the condition for obviating multiple feeding (MF) is expressed by $$\Delta\mu_p\cdot P-\mu_3P'<R_f\cdot A\ \therefore\ P<R_f\cdot A/\Delta\mu_P+\mu_3P'/(u_1-\mu_{PI2}), \quad (125)$$

where $A=\sin\theta_{P2}+\mu_2\cdot\cos\theta_{P2}$, as obtained earlier.

Therefore, the sheet feeding apparatus capable of obviating the non-feeding and multiple feeding can be formed by satisfying the relations (124) and (125).

Referring to FIGS. 99A and 99B, the second case for the leading edge of a sheet material Pa being right on entering into the nip forming portion will be described, in which the leading edge of a sheet material Pa is exerted by a vertical drag $Q_n$ and its frictional force $\mu_2\cdot Q_n$ through the tapered face of taper member.

The following parameters are also obtained in a similar manner to that earlier described such as Q as obtained by (106), and other relations (107) and (108).

The conditions for obviating non-feeding in the longitudinal direction are obtained from (106) and (107), as $$(u_1-\mu_{PI2})\cdot P-\mu_3P'+\mu_1\cdot F_n>Q_n\cdot A\ \therefore\ P>\{(A/B)-\mu_1\}Q/(\mu_1-\mu_{PI2})+\mu_1\cdot R_f\cdot B/(\mu_1-\mu_{PI2})+\mu_3P'/(\mu_1-\mu_{PI2}). \quad (126)$$

In addition, as the condition for obviating the multiple feeding is obtained as $$\Delta\mu_P\cdot P-\mu_3P'+\mu_{P12}\cdot F_n<Q_n\cdot A.$$

By substituting (106) and (107), $$P<\{(A/B)-\mu_{PI2}\}Q/\Delta\mu_P+\mu_{PI2}\cdot R_f\cdot B/\Delta\mu_P+\mu_3P'/(\mu_1-\mu_{PI2}). \quad (127)$$

Summarizing the coefficients included in the relations (126) and (127), there obtained are the relation for obviating the non-feeding as $$P>C\cdot Q+D+E \quad (128),$$

and the relation for obviating the multiple feeding as $$P<C\cdot Q+H+E \quad (129)$$

$$C=\{(A/B)-\mu_1\}/(\mu_1-\mu_{P12}) \quad (113)$$

$$D=\mu_1\cdot R_f\cdot B/(\mu_1-\mu_{P12}) \quad (114)$$

$$G=\{(A/B)-\mu_{P12}\}/\Delta\mu_P \quad (115)$$

$$H=\mu_{P12}\cdot R_f\cdot B/\Delta\mu_P \quad (116)$$

$$E=-\mu_3P'.$$

The force exerted to the leading edge of sheet material is considered in the next place. The leading edge is exerted by a force caused the bending of the leading edge through the tapered face 105*a* of taper member 105, and a component perpendicular to the tapered face is found to be equal to the above-mentioned perpendicular drag Rf.

This value may be calculated simply by assuming a concentrated weight placed on the tip of a beam of length L with the other end thereof is fixed as shown in FIG. 100. The amount of the bending $y_{max}$ at the tip of a beam is obtained by the noted relation (117), and accordingly the perpendicular drag Rf is by the relation (119).

Also, the results on the perpendicular drag Rf obtained by the calculation using the relation (119) are shown in the earlier noted Table 1 for several sheet materials with different thickness, such as thick sheet A, thick sheet B, thin sheet A and thin sheet B. For the calculation, the width of sheet material is assumed to be 50 mm as equal as the width of feeding roller, and the values used for t and E are after experimental measurements.

The comparison will now be made after substituting actual values into the values in the above relations, between the sheet separation method disclosed herein and the previous method using a separation pad. It may be noted three levels were used for the difference $\Delta\mu_P$ in friction coefficients between sheets considering the use of back paper. An example of the substituted values for each variable is shown in the earlier noted Table 2.

In the next place, several boundary lines are obtained from the above relations such as NF slope according to the relation (103), MF slope: relation (104), NF nip: relation (111), and MF nip: relation (112), whereby a diagrammatic drawing in a similar manner as shown in the earlier noted FIG. 101 is obtained representing the feeding pressure P, vertically, versus the separation pressure Q, horizontally, for the sheet separation method disclosed herein.

In addition, three lines are shown each corresponding to three levels of the $\Delta\mu_P$ values. For also the FP separation method using the separation pad, three MF boundary lines are shown in FIG. 101 corresponding to three levels of the $\Delta\mu_P$ values. Additionally shown are the ranges in which the parameters, P and Q, are suitably set during the practical use of the sheet feeding apparatus disclosed herein.

It may be added further the separation and feeding pressures can be measured using several means such as, for example, a spring balance and pressure sensing device. In the case of measurement, it is preferable to take the weight of sheet material into consideration for the measurements.

As seen from the results shown in FIG. 101, since the range for multiple feeding in the FP separation method is considerably narrowed at $\Delta\mu_P=0.2$, the proper feeding cannot be achieved with the conventional P-Q setup. In contrast, a relatively large margin against the MF region still exists even at $\Delta\mu_P=0.2$ in the sheet separation method disclosed herein.

An MF boundary line is expressed by the following formula (121) in the FP separation method. The inclination of the MF boundary line in the present sheet method is given by $$\{(A/B)-\mu_{P12}\}/\Delta\mu_P,$$

which indicates the value (A/B) corresponds to FP friction coefficient $\mu_{FP}$ in this method. In addition, this is the coefficient for determining the component of the force exerted at the leading edge of the sheet material, and the following relation is found from (105) and (108) for the present setting of the variables shown in Table 2, the equivalence in that the $\mu_{FP}$ value is seemingly 1.4.

This is considered to be one of the factors from which the degree of multistory margin with the sheet material separation method disclosed herein is far larger than the FP separation method.

In this case, the ratio of inclination of the MF boundary between the present method and the FP separation method is obtained as the relation (123) obtained earlier.

The degree of MF margin of the present disclosure is therefore approximately 4 times larger than the FP separation method.

Furthermore, as described in reference to P-Q diagram shown in FIG. 102 in the case of $\mu_{P12}$=0.77 and $\Delta\mu_P$=0.2, for lug paper (bond paper) and the recycled paper, for which the friction coefficient $\mu_{P12}$ between the first and second sheet material is expected to be relatively large, it is indicated that even back papers with high friction coefficients can also be separated by the present sheet material separation method when a high enough feeding pressure P (P') is applied.

Also in the sheet feeding apparatus of FIG. 107, the diagrammatic drawing as shown FIG. 103 is obtained representing MF and NF regions with respect to the feeding pressure P, vertically, versus the separation pressure Q, horizontally, based on the experimental results obtained, when the angel ($\theta_2$) between the tapered face 105*a* of taper member 105 and the direction for forwarding the sheet material is varied ranging from 50° to 70°.

As seen clearly from FIG. 103, with the parameter setting indicated by the square drawn with solid lines in the drawing sheet separation becomes feasible up to the difference in coefficient $\Delta\mu_P$=0.2.

Although the NF region becomes severe to be materialized when the above-mentioned angle $\theta_2$ is set as 70°, an appropriate setup becomes possible by bringing the ratio, separation pressure/feeding pressure, to be within the region indicated by the square drawn with solid lines in FIG. 103.

Also shown in FIG. 104 is a diagram which compares the NF region for thick sheet A, which is calculated using aforementioned relations, with that obtained through the actual measurement. It is confirmed that the NF region for the thick sheet A is approximated by the values, $\mu_1$=1.3 and $\mu_P$=0.67, while the MF region for thin sheet B is approximated by $\mu_2'$=0.15, $\mu_P$=0.54 and $\Delta\mu_P$=0.048.

It may be noted other substituted values and the vertical drag Rf from the tapered face for the thick A sheet and thin B sheet are the same as those aforementioned in Tables 1 and 2. Therefore, it has been confirmed that the values obtained through actual measurements can be approximated by the calculations which are carried out by substituting several friction coefficient data obtained form separate measurements, whereby the validity of respective aforementioned relations has been proved.

According to the noted embodiment, even in the sheet feeding unit of FIG. 107, the taper member can be used as one having relative simple construction and excellent separation characteristics by only providing additionally the separation roller 106 disclosed herein in place of rather complicated previous structure consisting of forwarding roller in combination with separation reverse roller. In addition to the excellent separation characteristics, the number of parts to be used in the present structure can be reduced.

Figure 108:
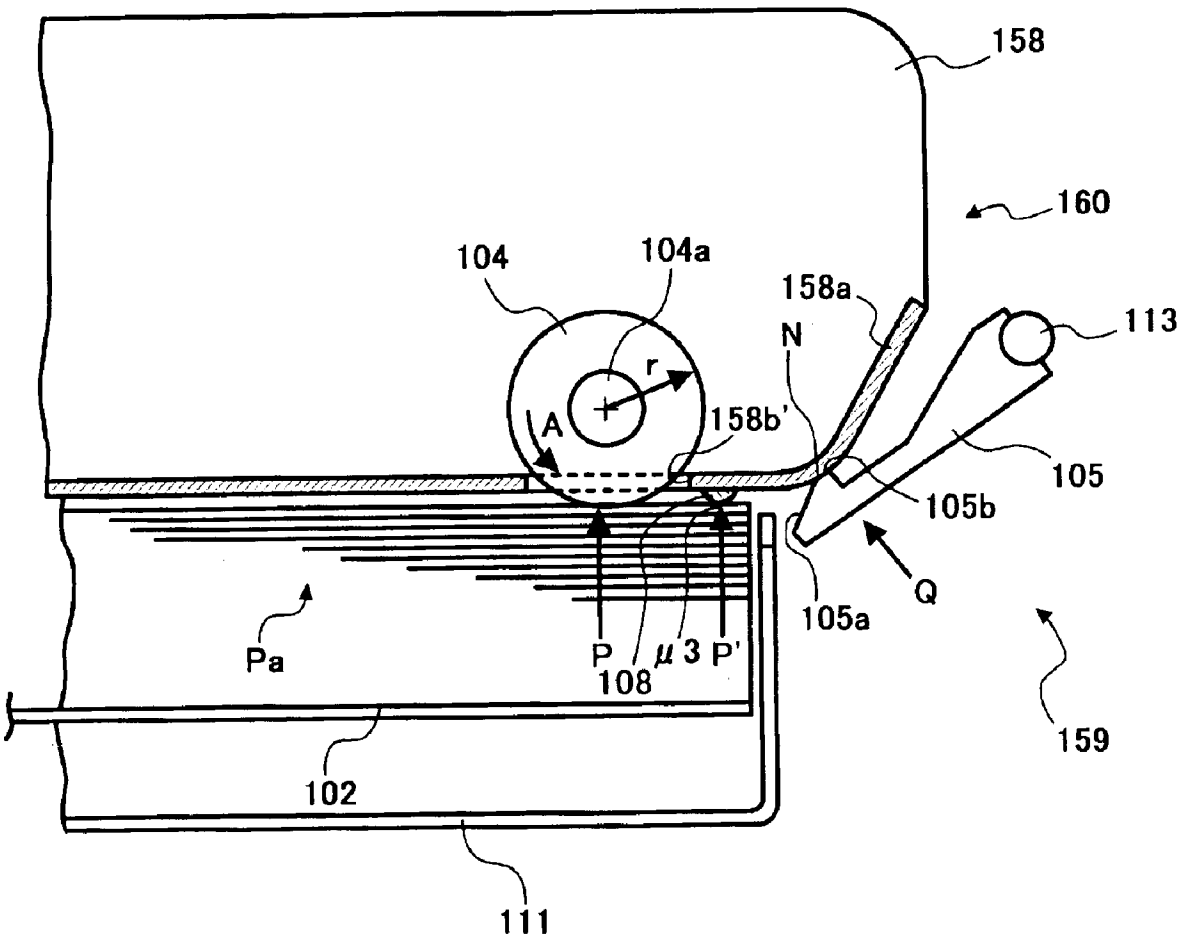
FIG. 108 is a cross sectional view prepared for illustrating the sheet feeding method utilizing the feeding apparatus provided with a feeding guide and a taper member pressure attached thereto according to another embodiment disclosed herein.

FIG. 108 is a cross sectional view prepared for illustrating the sheet feeding method utilizing the feeding apparatus provided with a feeding guide and a taper member pressure attached thereto according to another embodiment disclosed herein. Like reference numerals in FIG. 108 are designated for identical or corresponding parts shown in FIG. 85.

The sheet feeding method utilizes the sheet feeding apparatus shown in FIG. 108, for example, in which there provided are the taper member 105 oscillatory supported around an axial fulcrum 113 and the tapered face 105*b* thereof, a part of which is pressed at the nip forming portion N against the lower portion of curved feeding guide 158*a* serving as the separation member.

In addition, being situated between the nip forming portion N and feeding roller 104, the protrusion 108 is formed on feeding guide 158*a* of sheet feeding chases 158 to be brought in contact with the sheet material Pa fed by the feeding roller 104 at the pressing portion X.

The feeding apparatus utilized for implementing the sheet feeding method according to the present embodiment has a similar construction to FIG. 107, with the only exception that the curved portion of feeding guide 158*a* is used in place of the separation roller 106. The operation characteristics are therefore quite similar to those with the apparatus of FIG. 107.

Accordingly, the non-feeding and multiple feeding during the implementation of the present sheet feeding method can be obviated by satisfying the above noted relations (124), (125) and (105) under the following notations.

r: Radius of feeding roller

P: Feeding pressure

P': Feeding pressure at protrusion

Q: separation pressure Q $\theta_1$: The angle between applied separation pressure Q and the direction for forwarding sheet materials (in degree)

$\theta_2$: The angle between tapered face of taper member and the direction for forwarding sheet materials (in degree)

$\theta_{P2}$: The angle between the tangent to nip portion and the direction for forwarding sheet materials (in degree)

N: Nip forming portion $\mu_1$: Coefficient of friction between feeding roller and sheet material $\mu_2$: Coefficient of friction between tapered face of taper member and the leading edge of sheet material $\mu_3$: Coefficient of friction between tapered face and sheet material $\mu_{P12}$: Coefficient of friction between first and second sheet materials $\Delta\mu_P$: The difference in coefficients of friction between sheet materials According to the method for feeding sheet material disclosed above, this method is implemented using the feeding apparatus provided with the protrusion 108 which is situated between the taper member 105 and feeding roller 104 such that the tip portion of taper member 105 is in contact with the feeding guide 158*a* and that the protrusion 108 is brought in contact with the sheet material Pa fed by the feeding roller 104.

The conditions suitable for feeding can be satisfied by adjusting the distance between the protrusion 108 and the point of nip formation at which the taper member 105 is in contact with the feeding guide 158*a* so that modulus values are equated for various kinds of sheet materials even for a variety of sheet materials different in size and/or thickness. As a result, sheet materials can be securely separated sheet by sheet.

In addition, the limitation to the outer diameter is lifted for the feeding roller and the reduction in size for the feeding roller 104 can be achieved. Accordingly, non-feeding or multiple feeding can now be alleviated for the various kinds of sheet materials despite of the compactness in size of the sheet feeding apparatus.

It may be added the image forming apparatus incorporating the sheet feeding apparatus disclosed herein has a similar construction to that of FIG. 71 with the exception that the sheet feeding apparatus shown in FIG. 108 is incorporated in place of the previous feeding apparatus 101 of FIG. 71. Detailed description and drawings related to the image forming apparatus is therefore abbreviated herein.

The apparatuses and process steps set forth in the present description may therefore be implemented using suitable host computers and terminals incorporating appropriate processors programmed according to the teachings disclosed herein, as will be appreciated to those skilled in the relevant arts.

Therefore, the present disclosure also includes a computer-based product which may be hosted on a storage medium and include instructions which can be used to program a processor to perform a process in accordance with the present disclosure. The storage medium can include, but is not limited to, any type of disk including floppy disks, optical disks, CD-ROMS, magneto-optical disks, ROMs, RAMs, EPROMs, EEPROMS, flash memory, magnetic or optical cards, or any type of media suitable for storing electronic instructions.

It is apparent from the above description including the examples, the methods and apparatuses disclosed herein for feeding sheet materials have several advantages over similar methods previously known.

Since the conditions suitable for feeding can be satisfied by adjusting the distance between the protruded portion and nip formation, and by equating modulus values to various sheet materials even for a variety of sheet materials different in size and thickness, considerably high sheet separation qualities are obtained with the present methods and apparatuses by obviating undue non-feeding or multiple feeding even for the sheet materials having large frictional coefficients in-between, and undue noises during the feeding can be alleviated, as described earlier.

Therefore, various kinds of sheet materials different in size or thickness can be forwarded sheet by sheet securely to image forming unit without non-feeding or multiple feeding, and satisfactory image formation can be achieved for various kinds of paper sheets regardless of the variation of sheet materials by means of the present image forming apparatuses.

Obviously, additional modifications and variations of the present invention are possible in light of the above teachings. It is therefore to be understood that within the scope of the appended claims, the invention may be practiced otherwise than as specifically described herein.

This document claims priority and contains subject matter related to Japanese Patent Applications No. 2002-32985, 56456, 92405, 130314, 229200, 326074 and 336234, filed with the Japanese Patent Office on Feb. 8, 2002, Mar. 1, 2002, Mar. 28, 2002, May 2, 2002, Aug. 6, 2002, Nov. 8, 2002, and Nov. 20, 2002, respectively, the entire contents of which are hereby incorporated by reference.

What is claimed is:

1. A method for feeding a sheet material for a sheet feeding apparatus, comprising the steps of:

providing a feeding means for forwarding a sheet material to a separation unit, said feeding means being in contact with a sheet material loaded on a sheet loading member;

providing a taper member provided thereon with a tapered face, said taper member being brought into pressed contact with said feeding means at a nip forming portion, and said tapered face colliding with a leading edge of said sheet material;

providing further on said taper member with a contact face of a protruded portion, said contact face being aligned parallel to a tangent of sheet feeding direction to be brought into contact with said feeding means;

forwarding said sheet material to said separation unit; and separating said sheet material by means of said tapered face of taper member under following conditions adapted to said sheet material feeding;

$$P>R_f A/(\mu_1-\mu_{P12})$$

$$P<R_f A/\Delta\mu_P$$

$$A=\sin\theta_{P2}+\mu_2\cdot\cos\theta_{P2},$$

where

P: feeding pressure, $R_f$: a vertical drag caused by sheet material bending exerted onto leading edge of said sheet material through said taper face of taper member, $\mu_1$: coefficient of friction between said feeding means and said sheet material, $\mu_2$: coefficient of friction between said tapered face of taper member and said leading edge of said sheet material, $\mu_{P12}$: coefficient of friction between first and second sheet materials, $\Delta\mu_P$: a difference in coefficients of friction between said sheet materials, and $\theta_{P2}$: an angle between a tangent to said nip forming portion and said sheet forwarding direction.

2. The method according to claim 1, wherein:

an angle is adjusted to be in the range from 50° to 70° between the longitudinal direction of said tapered face of taper member and a leading edge of said sheet material colliding with said tapered face.

3. A method for feeding a sheet material for a sheet feeding apparatus, comprising the steps of:

providing a feeding means for forwarding a sheet material to a separation unit, said feeding means being in contact with a sheet material loaded on a sheet loading member;

providing a taper member provided thereon with a tapered face, said taper member being brought into pressed contact with said feeding means at a nip forming portion, and said tapered face colliding with a leading edge of said sheet material;

providing further on said taper member with a contact face of a protruded portion, said contact face being aligned parallel to a tangent of sheet feeding direction to be brought into contact with said feeding means;

forwarding said sheet material to said separation unit; and separating said sheet material by means of said nip forming portion under following conditions adapted to said sheet material feeding;

$$P>\{(A/B)-\mu_1\}Q/(\mu_1-\mu_{P12})+\mu_1\cdot R_f\cdot B/(\mu_1-\mu_{P12})P<\{(A/B)-\mu_{P12}\}Q/\Delta\mu_P+\mu_{P12}\cdot R_f\cdot B/\Delta\mu_P$$

$$A=\sin\theta_{P2}+\mu_2\cdot\cos\theta_{P2}$$

$$B=\cos\theta_{P2}-\mu_2\cdot\sin\theta_{P2},$$

where

P: feeding pressure,

Q: separation pressure, $R_f$: a vertical drag caused by sheet material bending exerted onto leading edge of said sheet material through said taper face of taper member, $\mu_1$: coefficient of friction between said feeding means and said sheet material, $\mu_2$: coefficient of friction between said tapered face of taper member and said leading edge of said sheet material, $\mu_{P12}$: coefficient of friction between first and second sheet materials, $\Delta\mu_P$: a difference in coefficients of friction between said sheet materials, and $\theta_{P2}$: an angle between a tangent to said nip forming portion and said sheet forwarding direction.

4. The method according to claim 3, wherein:

an angle is adjusted to be in the range from 50° to 70° between the longitudinal direction of said tapered face of taper member and a leading edge of said sheet material colliding with said tapered face.

5. A method for feeding a sheet material for a sheet feeding apparatus, comprising the steps of:

providing a feeding means for forwarding a sheet material to a separation unit, said feeding means being in contact with a sheet material loaded on a sheet loading member;

providing a taper member provided thereon with a tapered face, said taper member being brought into pressed contact with said feeding means at a nip forming portion, and said tapered face colliding with a leading edge of said sheet material;

providing further on said taper member with a contact face of a protruded portion, said contact face being aligned parallel to a tangent of sheet feeding direction to be brought into contact with said feeding means;

forwarding said sheet material to said separation unit; and separating said sheet material by means of said tapered face of taper member and said nip forming portion under following conditions adapted to said sheet material feeding;

$$P>R_f A/(\mu_1-\mu_{P12})$$

$$P<R_f A/\Delta\mu_P$$

$$P>\{(A/B)-\mu_1\}Q/(\mu_1-\mu_{P12})+\mu_1\cdot R_f\cdot B/(\mu_1-\mu_{P12})P<\{(A/B)-\mu_{P12}\}Q/\Delta\mu_P+\mu_{P12}\cdot R_f\cdot B/\Delta\mu_P$$

$$A=\sin\theta_{P2}+\mu_2\cdot\cos\theta_{P2}$$

$$B=\cos\theta_{P2}-\mu_2\cdot\sin\theta_{P2},$$

where

P: feeding pressure,

Q: separation pressure, $R_f$: a vertical drag caused by sheet material bending exerted onto leading edge of said sheet material through said taper face of taper member, $\mu_1$: coefficient of friction between said feeding means and said sheet material, $\mu_2$: coefficient of friction between said tapered face of taper member and said leading edge of said sheet material, $\mu_{P12}$: coefficient of friction between first and second sheet materials, $\Delta\mu_P$: a difference in coefficients of friction between said sheet materials, and $\theta_{P2}$: an angle between a tangent to said nip forming portion and said sheet forwarding direction.

6. The method according to claim 5, wherein:

an angle is adjusted to be in the range from 50° to 70° between the longitudinal direction of said tapered face of taper member and a leading edge of said sheet material colliding with said tapered face.

7. A sheet feeding apparatus, comprising:

a feeding means provided for forwarding a sheet material to a separation unit, said feeding means being in contact with a sheet material loaded on a sheet loading member; and a taper member provided thereon with a tapered face, said taper member being brought into pressed contact with said feeding means at a nip forming portion, and said tapered face colliding with a leading edge of said sheet material, wherein:

said taper member is further provided thereon with a contact face of a protruded portion, said contact face being aligned parallel to a tangent of sheet feeding direction to be brought into contact with said feeding means, and wherein:

said sheet material is forwarded to said separation unit and separated by means of said tapered face of taper member under following conditions adapted to said sheet material feeding;

$$P>R_f A/(\mu_1-\mu_{P12})$$

$$P<R_f A/\Delta\mu_P$$

$$A=\sin\theta_{P2}+\mu_2\cdot\cos\theta_{P2},$$

where

P: feeding pressure, $R_f$: a vertical drag caused by sheet material bending exerted onto leading edge of said sheet material through said taper face of taper member, $\mu_1$: coefficient of friction between said feeding means and said sheet material, $\mu_2$: coefficient of friction between said tapered face of taper member and said leading edge of said sheet material, $\mu_{P12}$: coefficient of friction between first and second sheet materials, $\Delta\mu_P$: a difference in coefficients of friction between said sheet materials, and $\theta_{P2}$: an angle between a tangent to said nip forming portion and said sheet forwarding direction.

8. The sheet feeding apparatus according to claim 7, wherein:

an angle is adjusted to be in the range from 50° to 70° between the longitudinal direction of said tapered face of taper member and a leading edge of said sheet material colliding with said tapered face.

9. A sheet feeding apparatus, comprising:

a feeding means provided for forwarding a sheet material to a separation unit, said feeding means being in contact with a sheet material loaded on a sheet loading member; and a taper member provided thereon with a tapered face, said taper member being brought into pressed contact with said feeding means at a nip forming portion, and said tapered face colliding with a leading edge of said sheet material, wherein:

said taper member is further provided thereon with a contact face of a protruded portion, said contact face being aligned parallel to a tangent of sheet feeding direction to be brought into contact with said feeding means, and wherein:

said sheet material is forwarded to said separation unit and separated by means of said nip forming portion under following conditions adapted to said sheet material feeding;

$$P > \{(A/B) - \mu_1\}Q/(\mu_1 - \mu_{P12}) + \mu_1 \cdot R_f \cdot B/(\mu_1 - \mu_{P12})P < \{(A/B) - \mu_{P12}\}Q/\Delta\mu_P + \mu_{P12} \cdot R_f \cdot B/\Delta\mu_P$$

$$A = \sin\theta_{P2} + \mu_2 \cdot \cos\theta_{P2}$$

$$B = \cos\theta_{P2} - \mu_2 \cdot \sin\theta_{P2},$$

where

P: feeding pressure,

Q: separation pressure, $R_f$: a vertical drag caused by sheet material bending exerted onto leading edge of said sheet material through said taper face of taper member, $\mu_1$: coefficient of friction between said feeding means and said sheet material, $\mu_2$: coefficient of friction between said tapered face of taper member and said leading edge of said sheet material, $\mu_{P12}$: coefficient of friction between first and second sheet materials, $\Delta\mu_P$: a difference in coefficients of friction between said sheet materials, and $\theta_{P2}$: an angle between a tangent to said nip forming portion and said sheet forwarding direction.

10. The sheet feeding apparatus according to claim 9, wherein:

an angle is adjusted to be in the range from 50° to 70° between the longitudinal direction of said tapered face of taper member and a leading edge of said sheet material colliding with said tapered face.

11. A sheet feeding apparatus, comprising:

a feeding means provided for forwarding a sheet material to a separation unit, said feeding means being in contact with a sheet material loaded on a sheet loading member; and a taper member provided thereon with a tapered face, said taper member being brought into pressed contact with said feeding means at a nip forming portion, and said tapered face colliding with a leading edge of said sheet material, wherein:

said taper member is further provided thereon with a contact face of a protruded portion, said contact face being aligned parallel to a tangent of sheet feeding direction to be brought into contact with said feeding means, and wherein:

said sheet material is forwarded to said separation unit means and separated by means of said tapered face of taper member and said nip forming portion under following conditions adapted to said sheet material feeding;

$$P > R_f A/(\mu_1 - \mu_{P12})$$

$$P < R_f A/\Delta\mu_P$$

$$P > \{(A/B) - \mu_1\}Q/(\mu_1 - \mu_{P12}) + \mu_1 \cdot R_f \cdot B/(\mu_1 - \mu_{P12})P < \{(A/B) - \mu_{P12}\}Q/\Delta\mu_P + \mu_{P12} \cdot R_f \cdot B/\Delta\mu_P$$

$$A = \sin\theta_{P2} + \mu_2 \cdot \cos\theta_{P2}$$

$$B = \cos\theta_{P2} - \mu_2 \cdot \sin\theta_{P2},$$

where

P: feeding pressure,

Q: separation pressure, $R_f$: a vertical drag caused by sheet material bending exerted onto leading edge of said sheet material through said taper face of taper member, $\mu_1$: coefficient of friction between said feeding means and said sheet material, $\mu_2$: coefficient of friction between said tapered face of taper member and said leading edge of said sheet material, $\mu_{P12}$: coefficient of friction between first and second sheet materials, $\Delta\mu_P$: a difference in coefficients of friction between said sheet materials, and $\theta_{P2}$: an angle between a tangent to said nip forming portion and said sheet forwarding direction.

12. The sheet feeding apparatus according to claim 11, wherein:

an angle is adjusted to be in the range from 50° to 70° between the longitudinal direction of said tapered face of taper member and a leading edge of said sheet material colliding with said tapered face.

13. An image forming apparatus, comprising:

said sheet feeding apparatus recited in anyone of claims 7 through 12.

14. A method for feeding a sheet material for a sheet feeding apparatus, comprising the steps of:

providing a feeding means for forwarding a sheet material to a separation unit, said feeding means being in contact with a sheet material loaded on a sheet loading member;

providing a separation member in said separation unit;

providing a taper member to be brought into pressed contact with said feeding means at a nip forming portion, said taper member being provided thereon with a tapered face colliding with a leading edge of said sheet material;

providing a protrusion between said taper member and said feeding means, said protrusion being brought into contact with said sheet material forwarded by said feeding means;

forwarding said sheet material to said separation unit; and separating said sheet material by means of said tapered face of taper member under following conditions adapted to said sheet material feeding, $$P>R_f A/(\mu_1-\mu_{P12})+\mu_3 P'/(\mu_1-\mu_{P12})$$

$$P<R_f A/\Delta\mu_P+\mu_3 P'/(\mu_1-\mu_{P12})$$

$$A=\sin\theta_{P2}+\mu_2\cdot\cos\theta_{P2},$$

where

P: feeding pressure,

P': feeding pressure at said protrusion, $R_f$: a vertical drag caused by sheet material bending exerted onto leading edge of said sheet material through said taper face of taper member, $\mu_1$: coefficient of friction between said feeding means and said sheet material, $\mu_2$: coefficient of friction between said tapered face of taper member and said leading edge of said sheet material, $\mu_3$: coefficient of friction between said protrusion and said sheet material $\mu_{P12}$: coefficient of friction between first and second sheet materials, $\Delta\mu_P$: a difference in coefficients of friction between said sheet materials, and $\theta_{P2}$: an angle between a tangent to said nip forming portion and said tapered face of taper member.

15. The method according to claim 14, wherein:

an angle is adjusted to be in the range from 50° to 70° between the longitudinal direction of said tapered face of taper member and a leading edge of said sheet material colliding with said tapered face.

16. A method for feeding a sheet material for a sheet feeding apparatus, comprising the steps of:

providing a feeding means for forwarding a sheet material to a separation unit, said feeding means being in contact with a sheet material loaded on a sheet loading member;

providing a separation member in said separation unit;

providing a taper member to be brought into pressed contact with said feeding means at a nip forming portion, said taper member being provided thereon with a tapered face colliding with a leading edge of said sheet material;

providing a protrusion between said taper member and said feeding means, said protrusion being brought into contact with said sheet material forwarded by said feeding means;

forwarding said sheet material to said separation unit; and separating said sheet material by means of said nip forming portion under following conditions adapted to said sheet material feeding, $$P>\{(A/B)-\mu_1\}Q/(\mu_1-\mu_{P12})+\mu_1\cdot R_f\cdot B/(\mu_1-\mu_{P12})+\mu_3 P'/(\mu_1-\mu_{P12})$$

$$P<\{(A/B)-\mu_{P12}\}Q/\Delta\mu_P+\mu_{P12}\cdot R_f\cdot B/\Delta\mu_P+\mu_3 P'/(\mu_1-\mu_{P12})$$

$$A=\sin\theta_{P2}+\mu_2\cdot\cos\theta_{P2}$$

$$B=\cos\theta_{P2}-\mu_2\cdot\sin\theta_{P2},$$

where

P: feeding pressure,

P': feeding pressure at said protrusion

Q: separation pressure, , $R_f$: a vertical drag caused by sheet material bending exerted onto leading edge of said sheet material through said taper face of taper member, $\mu_1$: coefficient of friction between said feeding means and said sheet material, $\mu_2$: coefficient of friction between said tapered face of taper member and said leading edge of said sheet material, $\mu_3$: coefficient of friction between said protrusion and said sheet material, $\mu_{P12}$: coefficient of friction between first and second sheet materials, $\Delta\mu_P$: a difference in coefficients of friction between said sheet materials, and $\theta_{P2}$: an angle between a tangent to said nip forming portion and said tapered face of taper member.

17. The method according to claim 16, wherein:

an angle is adjusted to be in the range from 50° to 70° between the longitudinal direction of said tapered face of taper member and a leading edge of said sheet material colliding with said tapered face.

18. A method for feeding a sheet material for a sheet feeding apparatus, comprising the steps of:

providing a feeding means for forwarding a sheet material to a separation unit, said feeding means being in contact with a sheet material loaded on a sheet loading member;

providing a separation member in said separation unit;

providing a taper member to be brought into pressed contact with said feeding means at a nip forming portion, said taper member being provided thereon with a tapered face colliding with a leading edge of said sheet material;

providing a protrusion between said taper member and said feeding means, said protrusion being brought into contact with said sheet material forwarded by said feeding means;

forwarding said sheet material to said separation unit; and separating said sheet material by means of by means of said tapered face of taper member and said nip forming portion under following conditions adapted to said sheet material feeding, $$P>R_f A/(\mu_1-\mu_{P12})+\mu_3 P'/(\mu_1-\mu_{P12})$$

$$P<R_f A/\Delta\mu_P+\mu_3 P'/(\mu_1-\mu_{P12})$$

$$P>\{(A/B)-\mu_1\}Q/(\mu_1-\mu_{P12})+\mu_1\cdot R_f\cdot B/(\mu_1-\mu_{P12})+\mu_3 P'/(\mu_1-\mu_{P12})$$

$$P<\{(A/B)-\mu_{P12}\}Q/\Delta\mu_P+\mu_{P12}\cdot R_f\cdot B/\Delta\mu_P+\mu_3 P'/(\mu_1-\mu_{P12})$$

$$A=\sin\theta_{P2}+\mu_2\cdot\cos\theta_{P2}$$

$$B=\cos\theta_{P2}-\mu_2\cdot\sin\theta_{P2},$$

where

P: feeding pressure,

P': feeding pressure at said protrusion,

Q: separation pressure, $R_f$: a vertical drag caused by sheet material bending exerted onto leading edge of said sheet material through said taper face of taper member, $\mu_1$: coefficient of friction between said feeding means and said sheet material, $\mu_2$: coefficient of friction between said tapered face of taper member and said leading edge of said sheet material, $\mu_3$: coefficient of friction between said protrusion and said sheet material, $\mu_{P12}$: coefficient of friction between first and second sheet materials, $\Delta\mu_P$: a difference in coefficients of friction between said sheet materials, and $\theta_{P2}$: an angle between a tangent to said nip forming portion and said tapered face of taper member.

19. The method according to claim 18, wherein:

an angle is adjusted to be in the range from 50° to 70° between the longitudinal direction of said tapered face of taper member and a leading edge of said sheet material colliding with said tapered face.

20. A sheet feeding apparatus, comprising:

a feeding means provided for forwarding a sheet material to a separation unit, said feeding means being in contact with a sheet material loaded on a sheet loading member;

a separation member provided in said separation unit;

a taper member provided to be brought into pressed contact with said feeding means at a nip forming portion, said taper member being provided thereon with a tapered face colliding with a leading edge of said sheet material; and a protrusion provided between said taper member and said feeding means, said protrusion being brought into contact with said sheet material forwarded by said feeding means, wherein:

said sheet material is forwarded to said separation unit and separated by means of said tapered face of taper member under following conditions adapted to said sheet material feeding;

$$P>R_f A/(\mu_1-\mu_{P12})+\mu_3 P'/(\mu_1-\mu_{P12})$$

$$P<R_f A/\Delta\mu_P+\mu_3 P'/(\mu_1-\mu_{P12})$$

$$A=\sin\theta_{P2}+\mu_2\cdot\cos\theta_{P2},$$

where

P: feeding pressure,

P': feeding pressure at said protrusion, $R_f$: a vertical drag caused by sheet material bending exerted onto leading edge of said sheet material through said taper face of taper member, $\mu_1$: coefficient of friction between said feeding means and said sheet material, $\mu_2$: coefficient of friction between said tapered face of taper member and said leading edge of said sheet material, $\mu_3$: coefficient of friction between said protrusion and said sheet material, $\mu_{P12}$: coefficient of friction between first and second sheet materials, $\Delta\mu_P$: a difference in coefficients of friction between said sheet materials, and $\theta_{P2}$: an angle between a tangent to said nip forming portion and said tapered face of taper member.

21. The sheet feeding apparatus according to claim 20, wherein:

an angle is adjusted to be in the range from 50° to 70° between the longitudinal direction of said tapered face of taper member and a leading edge of said sheet material colliding with said tapered face.

22. A sheet feeding apparatus, comprising:

a feeding means provided for forwarding a sheet material to a separation unit, said feeding means being in contact with a sheet material loaded on a sheet loading member;

a separation member provided in said separation unit;

a taper member provided to be brought into pressed contact with said feeding means at a nip forming portion, said taper member being provided thereon with a tapered face colliding with a leading edge of said sheet material; and a protrusion provided between said taper member and said feeding means, said protrusion being brought into contact with said sheet material forwarded by said feeding means, wherein:

said sheet material is forwarded to said separation unit and separated by means of said nip forming portion under following conditions adapted to said sheet material feeding;

$$P > \{(A/B)-\mu_1\}Q/(\mu_1-\mu_{PI2}) + \mu_1\cdot R_f\cdot B/(\mu_1-\mu_{PI2}) + \mu_3 P'/(\mu_1-\mu_{PI2})$$

$$P < \{(A/B)-\mu_{PI2}\}Q/\Delta\mu_P + \mu_{PI2}\cdot R_f\cdot B/\Delta\mu_P + \mu_3 P'/(\mu_1-\mu_{PI2})$$

$$A=\sin\theta_{P2}+\mu_2\cdot\cos\theta_{P2}$$

$$B=\cos\theta_{P2}-\mu_2\cdot\sin\theta_{P2},$$

where

P: feeding pressure,

P': feeding pressure at said protrusion,

Q: separation pressure, $R_f$: a vertical drag caused by sheet material bending exerted onto leading edge of said sheet material through said taper face of taper member, $\mu_1$: coefficient of friction between said feeding means and said sheet material, $\mu_2$: coefficient of friction between said tapered face of taper member and said leading edge of said sheet material, $\mu_3$: coefficient of friction between said protrusion and said sheet material, $\mu_{P12}$: coefficient of friction between first and second sheet materials, $\Delta\mu_P$: a difference in coefficients of friction between said sheet materials, and $\theta_{P2}$: an angle between a tangent to said nip forming portion and said tapered face of taper member.

23. The sheet feeding apparatus according to claim 22, wherein:

an angle is adjusted to be in the range from 50° to 70° between the longitudinal direction of said tapered face of taper member and a leading edge of said sheet material colliding with said tapered face.

24. A sheet feeding apparatus, comprising:

a feeding means provided for forwarding a sheet material to a separation unit, said feeding means being in contact with a sheet material loaded on a sheet loading member;

a separation member provided in said separation unit;

a taper member provided to be brought into pressed contact with said feeding means at a nip forming portion, said taper member being provided thereon with a tapered face colliding with a leading edge of said sheet material; and a protrusion provided between said taper member and said feeding means, said protrusion being brought into contact with said sheet material forwarded by said feeding means, wherein:

said sheet material is forwarded to said separation unit and separated by means of said tapered face of taper member and said nip forming portion under following conditions adapted to said sheet material feeding;

$$P>R_f A/(\mu_1-\mu_{P12})+\mu_3 P'/(\mu_1-\mu_{P12})$$

$$P<R_f A/\Delta\mu_P+\mu_3 P'/(\mu_1-\mu_{P12})$$

$$P>\{(A/B)-\mu_1\}Q/(\mu_1-\mu_{P12})+\mu_1\cdot R_f\cdot B/(\mu_1-\mu_{P12})+\mu_3 P'/(\mu_1-\mu_{P12})$$

$$P<\{(A/B)-\mu_{P12}\}Q/\Delta\mu_P+\mu_{P12}\cdot R_f\cdot B/\Delta\mu_P+\mu_3 P'/(\mu_1-\mu_{P12})$$

$$A=\sin\theta_{P2}+\mu_2\cdot\cos\theta_{P2}$$

$$B=\cos\theta_{P2}-\mu_2\cdot\sin\theta_{P2},$$

where

P: feeding pressure,

P': feeding pressure at said protrusion,

Q: separation pressure, $R_f$: a vertical drag caused by sheet material bending exerted onto leading edge of said sheet material through said taper face of taper member, $\mu_1$: coefficient of friction between said feeding means and said sheet material, $\mu_2$: coefficient of friction between said tapered face of taper member and said leading edge of said sheet material, $\mu_3$: coefficient of friction between said protrusion and said sheet material $\mu_{P12}$: coefficient of friction between first and second sheet materials, $\Delta\mu_P$: a difference in coefficients of friction between said sheet materials, and $\theta_{P2}$: an angle between a tangent to said nip forming portion and said tapered face of taper member.

25. The sheet feeding apparatus according to claim 24, wherein:

an angle is adjusted to be in the range from 50° to 70° between the longitudinal direction of said tapered face of taper member and a leading edge of said sheet material colliding with said tapered face.

26. An image forming apparatus, comprising:

said sheet feeding apparatus recited in anyone of claims 20 through 25.

27. A sheet feeding apparatus, comprising:

a feeding means for forwarding a sheet material to a separation unit means, said feeding means being in contact with a sheet material loaded on a sheet loading means; and a taper member means provided thereon with a tapered face means, said taper member means being brought into pressed contact with said feeding means at a nip forming portion means, and said tapered face means colliding with a leading edge of said sheet material, wherein:

said taper member means is further provided thereon with a contact face means of a protruded portion means, said contact face means being aligned parallel to a tangent of sheet feeding direction to be brought into contact with said feeding means, and wherein:

said sheet material is forwarded to said separation unit means and separated by means of said tapered face means of taper member under following conditions adapted to said sheet material feeding;

$$P>R_f A/(\mu_1-\mu_{P12})$$

$$P<R_f A/\Delta\mu_P$$

$$A=\sin\theta_{P2}+\mu_2\cdot\cos\theta_{P2},$$

where

P: feeding pressure, $R_f$: a vertical drag caused by sheet material bending exerted onto leading edge of said sheet material through said taper face means of taper member means, $\mu_1$: coefficient of friction between said feeding means and said sheet material, $\mu_2$: coefficient of friction between said tapered face means of taper member and said leading edge of said sheet material, $\mu_{P12}$: coefficient of friction between first and second sheet materials, $\Delta\mu_P$: a difference in coefficients of friction between said sheet materials, and $\theta_{P2}$: an angle between a tangent to said nip forming portion means and said sheet forwarding direction.

28. The sheet feeding apparatus according to claim 27, wherein:

an angle is adjusted to be in the range from 50° to 70° between the longitudinal direction of said tapered face means of taper member and a leading edge of said sheet material colliding with said tapered face means.

29. A sheet feeding apparatus, comprising:

a feeding means provided for forwarding a sheet material to a separation unit means, said feeding means being in contact with a sheet material loaded on a sheet loading means; and a taper member provided thereon with a tapered face, said taper member being brought into pressed contact with said feeding means at a nip forming portion means, and said tapered face means colliding with a leading edge of said sheet material, wherein:

said taper member means is further provided thereon with a contact face means of a protruded portion, said contact face means being aligned parallel to a tangent of sheet feeding direction to be brought into contact with said feeding means, and wherein:

said sheet material is forwarded to said separation unit means and separated by means of said nip forming portion means under following conditions adapted to said sheet material feeding;

$$P > \{(A/B) - \mu_1\}Q/(\mu_1 - \mu_{P12}) + \mu_1 \cdot R_f \cdot B/(\mu_1 - \mu_{P12})$$

$$P < \{(A/B) - \mu_{P12}\}Q/\Delta\mu_P + \mu_{P12} \cdot R_f \cdot B/\Delta\mu_P$$

$$A = \sin\theta_{P2} + \mu_2 \cdot \cos\theta_{P2}$$

$$B = \cos\theta_{P2} - \mu_2 \cdot \sin\theta_{P2},$$

where

P: feeding pressure,

Q: separation pressure, $R_f$: a vertical drag caused by sheet material bending exerted onto leading edge of said sheet material through said taper face means of taper member, $\mu_1$: coefficient of friction between said feeding means and said sheet material, $\mu_2$: coefficient of friction between said tapered face of taper member means and said leading edge of said sheet material, $\mu_{P12}$: coefficient of friction between first and second sheet materials, $\Delta\mu_P$: a difference in coefficients of friction between said sheet materials, and $\theta_{P2}$: an angle between a tangent to said nip forming portion means and said sheet forwarding direction.

30. The sheet feeding apparatus according to claim 29, wherein:

an angle is adjusted to be in the range from 50° to 70° between the longitudinal direction of said tapered face means of taper member and a leading edge of said sheet material colliding with said tapered face means.

31. A sheet feeding apparatus, comprising:

a feeding means provided for forwarding a sheet material to a separation unit means, said feeding means being in contact with a sheet material loaded on a sheet loading means; and a taper member means provided thereon with a tapered face means, said taper member means being brought into pressed contact with said feeding means at a nip forming portion means, and said tapered face means colliding with a leading edge of said sheet material, wherein:

said taper member means is further provided thereon with a contact face means of a protruded portion means, said contact face means being aligned parallel to a tangent of sheet feeding direction to be brought into contact with said feeding means, and wherein:

said sheet material is forwarded to said separation unit means and separated by means of said tapered face means of taper member and said nip forming portion means under following conditions adapted to said sheet material feeding;

$$P > R_f A/(\mu_1 - \mu_{P12})$$

$$P < R_f A/\Delta\mu_P$$

$$P > \{(A/B) - \mu_1\}Q/(\mu_1 - \mu_{P12}) + \mu_1 \cdot R_f \cdot B/(\mu_1 - \mu_{P12})$$

$$P < \{(A/B) - \mu_{P12}\}Q/\Delta\mu_P + \mu_{P12} \cdot R_f \cdot B/\Delta\mu_P$$

$$A = \sin\theta_{P2} + \mu_2 \cdot \cos\theta_{P2}$$

$$B = \cos\theta_{P2} - \mu_2 \cdot \sin\theta_{P2},$$

where

P: feeding pressure,

Q: separation pressure, $R_f$: a vertical drag caused by sheet material bending exerted onto leading edge of said sheet material through said taper face means of taper member, $\mu_1$: coefficient of friction between said feeding means and said sheet material, $\mu_2$: coefficient of friction between said tapered face means of taper member and said leading edge of said sheet material, $\mu_{P12}$: coefficient of friction between first and second sheet materials, $\Delta\mu_P$: a difference in coefficients of friction between said sheet materials, and $\theta_{P2}$: an angle between a tangent to said nip forming portion means and said sheet forwarding direction.

32. The sheet feeding apparatus according to claim 31, wherein:

an angle is adjusted to be in the range from 50° to 70° between the longitudinal direction of said tapered face means of taper member and a leading edge of said sheet material colliding with said tapered face means.

33. A sheet feeding apparatus, comprising:

a feeding means for forwarding a sheet material to a separation unit means, said feeding means being in contact with a sheet material loaded on a sheet loading means;

a separation member means provided in said separation unit means;

a taper member means provided to be brought into pressed contact with said feeding means at a nip forming portion means, said taper member means being provided thereon with a tapered face means colliding with a leading edge of said sheet material; and a protrusion means provided between said taper member means and said feeding means, said protrusion means being brought into contact with said sheet material forwarded by said feeding means, wherein:

said sheet material is forwarded to said separation unit means and separated by means of said tapered face means of taper member under following conditions adapted to said sheet material feeding;

$$P > R_f A/(\mu_1 - \mu_{P12}) + \mu_3 P'/(\mu_1 - \mu_{P12})$$

$$P < R_f A/\Delta\mu_P + \mu_3 P'/(\mu_1 - \mu_{P12})$$

$$A = \sin\theta_{P2} + \mu_2 \cdot \cos\theta_{P2},$$

where

P: feeding pressure,

P': feeding pressure at said protrusion means, $R_f$: a vertical drag caused by sheet material bending exerted onto leading edge of said sheet material through said taper face means of taper member, $\mu_1$: coefficient of friction between said feeding means and said sheet material, $\mu_2$: coefficient of friction between said tapered face means of taper member and said leading edge of said sheet material, $\mu_3$: coefficient of friction between said protrusion means and said sheet material $\mu_{P12}$: coefficient of friction between first and second sheet materials, $\Delta\mu_P$: a difference in coefficients of friction between said sheet materials, and $\theta_{P2}$: an angle between a tangent to said nip forming portion and said tapered face means of taper member.

34. The sheet feeding apparatus according to claim 33, wherein:

an angle is adjusted to be in the range from 50° to 70° between the longitudinal direction of said tapered face means of taper member and a leading edge of said sheet material colliding with said tapered face means.

35. A sheet feeding apparatus, comprising:

a feeding means for forwarding a sheet material to a separation unit means, said feeding means being in contact with a sheet material loaded on a sheet loading means;

a separation member means provided in said separation unit means;

a taper member means provided to be brought into pressed contact with said feeding means at a nip forming portion means, said taper member being provided thereon with a tapered face means colliding with a leading edge of said sheet material; and a protrusion means provided between said taper member means and said feeding means, said protrusion means being brought into contact with said sheet material forwarded by said feeding means, wherein:

said sheet material is forwarded to said separation unit means and separated by means of said nip forming portion means under following conditions adapted to said sheet material feeding;

$$P > \{(A/B) - \mu_1\}Q/(\mu_1 - \mu_{P12}) + \mu_1 \cdot R_f \cdot B/(\mu_1 - \mu_{P12}) + \mu_3 P'/(\mu_1 - \mu_{P12})$$

$$P < \{(A/B) - \mu_{P12}\}Q/\Delta\mu_P + \mu_{P12} \cdot R_f \cdot B/\Delta\mu_P + \mu_3 P'/(\mu_1 - \mu_{P12})$$

$$A = \sin\theta_{P2} + \mu_2 \cdot \cos\theta_{P2}$$

$$B = \cos\theta_{P2} - \mu_2 \cdot \sin\theta_{P2},$$

where

P: feeding pressure,

P': feeding pressure at said protrusion means,

Q: separation pressure, $R_f$: a vertical drag caused by sheet material bending exerted onto leading edge of said sheet material through said taper face means of taper member, $\mu_1$: coefficient of friction between said feeding means and said sheet material, $\mu_2$: coefficient of friction between said tapered face of taper member means and said leading edge of said sheet material, $\mu_3$: coefficient of friction between said protrusion means and said sheet material, $\mu_{P12}$: coefficient of friction between first and second sheet materials, $\Delta\mu_P$: a difference in coefficients of friction between said sheet materials, and $\theta_{P2}$: an angle between a tangent to said nip forming portion means and said tapered face means of taper member.

36. The sheet feeding apparatus according to claim 35, wherein:

an angle is adjusted to be in the range from 50° to 70° between the longitudinal direction of said tapered face means of taper member and a leading edge of said sheet material colliding with said tapered face means.

37. A sheet feeding apparatus, comprising:

a feeding means for forwarding a sheet material to a separation unit means, said feeding means being in contact with a sheet material loaded on a sheet loading member means;

a separation member means provided in said separation unit means;

a taper member means provided to be brought into pressed contact with said feeding means at a nip forming portion means, said taper member means being provided thereon with a tapered face means colliding with a leading edge of said sheet material; and a protrusion means provided between said taper member means and said feeding means, said protrusion means being brought into contact with said sheet material forwarded by said feeding means, wherein:

said sheet material is forwarded to said separation unit and separated by means of said tapered face means of taper member and said nip forming portion means under following conditions adapted to said sheet material feeding;

$$P > R_f A/(\mu_1 - \mu_{P12}) + \mu_3 P'/(\mu_1 - \mu_{P12})$$

$$P < R_f A/\Delta\mu_P + \mu_3 P'/(\mu_1 - \mu_{P12})$$

$$P > \{(A/B) - \mu_1\}Q/(\mu_1 - \mu_{P12}) + \mu_1 \cdot R_f \cdot B/(\mu_1 - \mu_{P12}) + \mu_3 P'/(\mu_1 - \mu_{P12})$$

$$P < \{(A/B) - \mu_{P12}\}Q/\Delta\mu_P + \mu_{P12} \cdot R_f \cdot B/\Delta\mu_P + \mu_3 P'/(\mu_1 - \mu_{P12})$$

$$A = \sin\theta_{P2} + \mu_2 \cdot \cos\theta_{P2}$$

$$B = \cos\theta_{P2} - \mu_2 \cdot \sin\theta_{P2},$$

where

P: feeding pressure,

P': feeding pressure at said protrusion means,

Q: separation pressure, $R_f$: a vertical drag caused by sheet material bending exerted onto leading edge of said sheet material through said taper face means of taper member, $\mu_1$: coefficient of friction between said feeding means and said sheet material, $\mu_2$: coefficient of friction between said tapered face of taper member means and said leading edge of said sheet material, $\mu_3$: coefficient of friction between said protrusion means and said sheet material, $\mu_{P12}$: coefficient of friction between first and second sheet materials, $\Delta\mu_P$: a difference in coefficients of friction between said sheet materials, and $\theta_{P2}$: an angle between a tangent to said nip forming portion means and said tapered face means of taper member.

38. The sheet feeding apparatus according to claim 37, wherein:

an angle is adjusted to be in the range from 50° to 70° between the longitudinal direction of said tapered face means of taper member and a leading edge of said sheet material colliding with said tapered face means.

* * * * *